US010535222B2

(12) United States Patent
Takeda

(10) Patent No.: US 10,535,222 B2
(45) **Date of Patent: *Jan. 14, 2020**

(54) INFORMATION PROVIDING SYSTEM AND INFORMATION PROVIDING APPARATUS

(71) Applicant: Universal Entertainment Corporation, Koto-ku, Tokyo (JP)

(72) Inventor: Kengo Takeda, Tokyo (JP)

(73) Assignee: UNIVERSAL ENTERTAINMENT CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/447,351

(22) Filed: Mar. 2, 2017

(65) Prior Publication Data

US 2017/0256131 A1 Sep. 7, 2017

(30) Foreign Application Priority Data

Mar. 3, 2016 (JP) ..... 2016-040954

(51) Int. Cl.
*G07F 17/32* (2006.01)

(52) U.S. Cl.
CPC ..... *G07F 17/3239* (2013.01); *G07F 17/323* (2013.01); *G07F 17/3227* (2013.01)

(58) Field of Classification Search
CPC . G07F 17/323; G07F 17/3239; G07F 17/3227
See application file for complete search history.

(56) References Cited

U.S. PATENT DOCUMENTS

2002/0142827 A1* 10/2002 Aida ..... G07F 17/32 463/20
2014/0080597 A1* 3/2014 D'Amico ..... G07F 17/32 463/31
2017/0148264 A1* 5/2017 Pichette ..... G06Q 30/06

* cited by examiner

*Primary Examiner* — William H McCulloch, Jr.
*Assistant Examiner* — Yingchuan Zhang
(74) *Attorney, Agent, or Firm* — Potomac Law Group, PLLC; Kenneth Fagin

(57) ABSTRACT

[Object] To provide avoidance of a situation in which a player becomes addicted to a game.
[Solution] An information providing system includes: a storage device that stores game information with respect to each player; an announcement device operable to announce information; and an information processing device communicable with the announcement device. Upon determination that the game information associated with the player exceeds a predetermined threshold value, the information processing device transmits predetermined instruction information to the announcement device. The announcement device announces information for guiding the player not to play a game, based on the predetermined instruction information.

10 Claims, 75 Drawing Sheets

FIG.11

SYMBOL COMBINATION TABLE

| COMBINATION OF SYMBOLS | | | | | THE NUMBER OF PAYOUTS | WINNING COMBINATION |
|---|---|---|---|---|---|---|
| 1st VIDEO REEL | 2nd VIDEO REEL | 3rd VIDEO REEL | 4th VIDEO REEL | 5th VIDEO REEL | | |
| RED | RED | RED | RED | RED | 15 | RED |
| APPLE | APPLE | APPLE | APPLE | APPLE | 12 | APPLE |
| BLUE 7 | BLUE 7 | BLUE 7 | BLUE 7 | BLUE 7 | 10 | BLUE |
| BELL | BELL | BELL | BELL | BELL | 8 | BELL |
| CHERRY | CHERRY | CHERRY | CHERRY | CHERRY | 5 | CHERRY3 |
| STRAWBERRY | STRAWBERRY | STRAWBERRY | STRAWBERRY | STRAWBERRY | 5 | STRAWBERRY |
| PLUM | PLUM | PLUM | PLUM | PLUM | 4 | PLUM |
| ORANGE | ORANGE | ORANGE | ORANGE | ORANGE | 3 | ORANGE3 |
| CHERRY | CHERRY | CHERRY | (ANY) | (ANY) | 2 | CHERRY2 |
| ORANGE | ORANGE | ORANGE | (ANY) | (ANY) | 2 | ORANGE2 |
| CHERRY | (ANY) | (ANY) | (ANY) | (ANY) | 1 | CHERRY1 |
| ORANGE | (ANY) | (ANY) | (ANY) | (ANY) | 1 | ORANGE1 |

FIG.22

| INDEX NAME | DEFINITION OF CLASSIFICATION | REMARKS |
|---|---|---|
| PLAYER TYPE (MEMBER/NON-MEMBER) | MEMBER/NON-MEMBER | |
| PLAYER RANK | PLAYER RANK | |
| GENDER | GENDER | |
| NATIONALITY | NATIONALITY | |
| AGES | CLASSIFY BY EVERY 10 YEARS FROM BIRTHDAY (20's, 30's, etc.) | |
| MOST RECENT OPERATING DAY | LAST DAY OF WHICH DATA REMAINS | |
| MEMBER CATEGORY | ACTIVE MEMBER<br>INACTIVE MEMBER<br>GHOST MEMBER | ACTIVE MEMBER: MEMBER WHO VISITED MORE THAN ONCE WITHIN LAST 6 MONTHS<br>INACTIVE MEMBER: MEMBER WHO DID NOT VISIT WITHIN LAST 6 MONTHS<br>GHOST MEMBER: MEMBER WHO HAS NO PLAY HISTORY |
| GAME TYPE | EXCELLENT MEMBER<br>HIGH-BET MEMBER<br>HIGH-FREQUENCY-VISIT MEMBER<br>ESTRANGED MEMBER<br>NEW MEMBER | EXCELLENT MEMBER: AVERAGE BET PER VISIT IS 30,000 OR MORE AND FREQUENCY OF VISIT IS AT LEAST ONCE A MONTH<br>HIGH-BET MEMBER: AVERAGE BET PER VISIT IS 30,000 OR MORE<br>HIGH-FREQUENCY-VISIT MEMBER: FREQUENCY OF VISIT IS AT LEAST ONCE A MONTH<br>ESTRANGED MEMBER: AVERAGE BET PER VISIT IS LESS THAN 30,000 AND FREQUENCY OF VISIT IS LESS THAN ONCE A MONTH |
| MEMBER USER DEFINITION | VOLUNTARILY SET ON EDIT SCREEN | |
| PLAYER NAME | NAME OF PLAYER | |
| ... | . | ... |

FIG.23

| INDEX NAME | DEFINITION OF CLASSIFICATION | REMARKS |
|---|---|---|
| DENOMINATION | DENOMINATION | |
| THEME | THEME | |
| VENDOR | VENDOR | |
| LOCATION | LOCATION | |
| SET PAYOUT RATE (%) | SET PO | |
| MOST RECENT OPERATING DAY | LAST DAY OF WHICH DATA REMAINS | |
| GAME TYPE CLASS (GAME TYPE) | SLOT (NONE), TABLE (T−Ca−Bac、T−Ro−Ro, etc.) | |
| GAME TYPE CLASS (WITH OR WITHOUT LINK) | STAND ALONE(St), LINK(Li), MULTI(Mul) | |
| GAME TYPE CLASS (WITH OR WITHOUT PROGRESSIVE) | NON-PROGRESSIVE (NONE), PROGRESSIVE(Pro) | |
| GAME TYPE CLASS (DISPLAY MODE) | NON-VIDEO(Mc), VIDEO(Vi) | |
| GAME TYPE CLASS (THE NUMBER OF REELS) | 1 REEL(1R), 3 REEL(3R), 5 REEL(5R), etc. | |
| GAME TYPE CLASS (THE NUMBER OF LINES) | S, M, L | S:30 LINES OR LESS<br>M:31 LINES OR MORE AND 60 LINES OR LESS<br>L:61 LINES OR MORE |
| GAME TYPE CLASS (THE NUMBER OF BETS PER LINE) | S, M, L | S:10 BETS OR LESS<br>M:11 BETS OR MORE AND 24 BETS OR LESS<br>L:24 BETS OR MORE |
| GAME TYPE CLASS (BONUS FEATURE) | NON-LARGE WIN (NONE), LARGE WIN(LW) | |
| GAME TYPE CLASS (TABLE TYPE) | ROULETTE, CARD(BACCARAT), etc. | |
| GAME TYPE CLASS | SYNTHESIS | |
| ... | ... | ... |

FIG.24

| PLAYER ID CODE | PLAYER NAME | ICON DATA | ・・・ | PLAYER RANK |
|---|---|---|---|---|
| USR000010001 | ○○○○ | ..¥image0001.jpg | ・・・ | VIP |
| USR000010002 | △△△△ | ..¥image0002.jpg | ・・・ | MEMBER |
| USR000010003 | ▽▽▽▽ | ..¥image0003.jpg | ・・・ | MEMBER |
| USR000010004 | □□□□ | ..¥image0004.jpg | ・・・ | VISITOR |
| USR000010005 | × × × × | ..¥image0005.jpg | ・・・ | MEMBER |
| USR000010006 | ◎◎◎◎ | ..¥image0006.jpg | ・・・ | MEMBER |
| USR000010007 | ◇◇◇◇ | ..¥image0007.jpg | ・・・ | MEMBER |
| USR000010008 | ◿◿◿◿ | ..¥image0008.jpg | ・・・ | VIP |
| USR000010009 | ☆☆☆☆ | ..¥image0009.jpg | ・・・ | VISITOR |
| ・・・ | ・・・ | ・・・ | ・・・ | ・・・ |

FIG.25

| APPARATUS ID CODE | IP ADDRESS | APPARATUS IDENTIFIER | OBJECT DATA | COORDINATE DATA | APPARATUS STATUS |
|---|---|---|---|---|---|
| SM1000001 | 192.168.52.4 | GM-1 | obj0001 | (x1, y1) | ON LINE |
| SM1000002 | 192.168.52.8 | GM-2 | obj0002 | (x2, y2) | ON LINE |
| SM1000003 | 192.168.52.13 | GM-3 | obj0003 | (x3, y3) | ON LINE |
| SM1000004 | 192.168.52.22 | GM-4 | obj0004 | (x4, y4) | ON LINE |
| SM1000005 | 192.168.52.28 | GM-8 | obj0005 | (x5, y5) | ON LINE |
| SM1000006 | 192.168.52.29 | GM-10 | obj0006 | (x6, y6) | ON LINE |
| SM1000007 | 192.168.52.48 | GM-9 | obj0007 | (x7, y7) | ON LINE |
| KIO1000008 | 192.168.52.51 | KIOSK-1 | obj0008 | (x8, y8) | ON LINE |
| SIG1000009 | 192.168.52.09 | SIGNAGE-1 | obj0009 | (x9, y9) | ON LINE |
| SM1000010 | 192.168.52.10 | GM-5 | obj0010 | (x10, y10) | ON LINE |
| SM1000011 | 192.168.52.11 | GM-11 | obj0011 | (x11, y11) | OFF LINE |
| SM1000012 | 192.168.52.12 | GM-12 | obj0012 | (x12, y12) | JACKPOT |
| SM1000013 | 192.168.52.35 | GM-13 | obj0013 | (x13, y13) | HAND PAY |
| SM1000014 | 192.168.52.14 | GM-14 | obj0014 | (x14, y14) | MAINTENANCE |
| ... | ... | ... | ... | ... | ... |
| CAM1006006 | 192.168.52.16 | CAMERA-1 | obj0016 | (x16, y16) | ERROR |
| CAM1006007 | 192.168.52.17 | CAMERA-2 | obj0017 | (x17, y17) | ON LINE |
| ... | ... | ... | ... | ... | ... |

FIG.26

| PLAYER ID CODE | APPARATUS ID CODE | LOGIN TIME/DATE | LOGOUT TIME/DATE |
|---|---|---|---|
| USR000010001 | SM1000003 | 20160201 10:50 | 20160201 12:53 |
| USR000010002 | SM1000005 | 20160201 11:50 | 20160201 13:50 |
| USR000010003 | SM1000006 | 20160201 9:40 | 20160201 16:40 |
| ... | ... | ... | ... |
| USR000010005 | SM1000008 | 20160201 11:37 | 20160201 15:30 |
| USR000010007 | SM1000007 | 20160201 11:12 | 20160201 11:51 |
| USR000010008 | SM1000010 | 20160201 10:23 | 20160201 12:12 |
| ... | ... | ... | ... |

FIG.27A

| ID NO. (GAME HISTORY NO.) | PLAYER ID CODE | SESSION HISTORY NO. | THE NUMBER OF BETS | CONSUMPTION AMOUNT ($) (THE NUMBER OF BETS × DENOMINATION) | PAYOUT AMOUNT ($) (THE NUMBER OF PAYOUTS × DENOMINATION) | BENEFIT AMOUNT/LOSS AMOUNT ($) | PLAY START TIME/DATE | PLAY END TIME/DATE | PLAY INTERVAL (SEC) |
|---|---|---|---|---|---|---|---|---|---|
| ... | ... | ... | ... | ... | ... | ... | ... | ... | ... |
| 1000001 | USR000000001 | 120003 | 10 | 0.1 | 0 | −0.1 | 20160201 12:09:06 | 20160201 12:09:11 | — |
| 1000002 | USR000000001 | 120003 | 10 | 0.1 | 0 | −0.1 | 20160201 12:09:12 | 20160201 12:09:17 | 1 |
| 1000003 | USR000000001 | 120003 | 10 | 0.1 | 0 | −0.1 | 20160201 12:09:17 | 20160201 12:09:22 | 0 |
| 1000004 | USR000000001 | 120003 | 10 | 0.1 | 0 | −0.1 | 20160201 12:09:22 | 20160201 12:09:27 | 0 |
| 1000005 | USR000000001 | 120003 | 10 | 0.1 | 0.05 | −0.05 | 20160201 12:09:28 | 20160201 12:09:33 | 1 |
| 1000006 | USR000000001 | 120003 | 500 | 5 | 0 | −5 | 20160201 12:09:43 | 20160201 12:09:48 | 10 |
| 1000007 | USR000000001 | 120003 | 500 | 5 | 0 | −5 | 20160201 12:09:48 | 20160201 12:09:53 | 0 |
| 1000008 | USR000000001 | 120003 | 500 | 5 | 0 | −5 | 20160201 12:09:53 | 20160201 12:09:58 | 0 |
| ... | ... | ... | ... | ... | ... | ... | ... | ... | ... |

FIG.27B

| ID NO. (SESSION HISTORY NO.) | PLAYER ID CODE | APPARATUS ID CODE | TOTAL CONSUMPTION AMOUNT ($) | TOTAL PAYOUT AMOUNT ($) | TOTAL BENEFIT AMOUNT / TOTAL LOSS AMOUNT | SESSION START TIME/DATE | SESSION END TIME/DATE | TOTAL NUMBER OF PLAYS |
|---|---|---|---|---|---|---|---|---|
| ... | ... | ... | ... | ... | ... | ... | ... | ... |
| 120000 | USR000000001 | SM0000007 | 10 | 5 | −5 | 20160129 10:03:26 | 20160129 10:33:26 | 100 |
| 120001 | USR000000001 | SM0000023 | 40 | 25 | −15 | 20160130 10:43:22 | 20160130 11:46:44 | 400 |
| 120002 | USR000000001 | SM0000004 | 45 | 10 | −35 | 20160131 10:25:37 | 20160131 11:35:18 | 450 |
| 120003 | USR000000001 | SM0000006 | 15.5 | 0.05 | −15.45 | 20160201 12:05:06 | 20160201 12:10:15 | 8 |
| 120004 | USR000000001 | SM0000009 | 50 | 10 | −40 | 20160201 12:15:18 | 20160201 12:20:13 | 10 |
| 120005 | USR000000001 | SM0000023 | 100 | 20 | −80 | 20160201 12:31:13 | 20160201 12:37:13 | 10 |
| ... | ... | ... | ... | ... | ... | ... | ... | ... |

FIG.27C

| ID NO. (ACCUMULATION NO.) | PLAYER ID CODE | CUMULATIVE NUMBER OF PLAYS | CUMULATIVE NUMBER OF VISITS TO ARCADE | CUMULATIVE CONSUMPTION AMOUNT ($) | CUMULATIVE PAYOUT AMOUNT ($) | CUMULATIVE BENEFIT AMOUNT / CUMULATIVE LOSS AMOUNT | MAXIMUM LOSS AMOUNT | AVERAGE SESSION TIME | AVERAGE NUMBER OF BETS |
|---|---|---|---|---|---|---|---|---|---|
| ... | ... | ... | ... | ... | ... | ... | ... | ... | ... |
| 40000000 | USR000000001 | 978 | 3 | 260.5 | 70.5 | -190 | -80 | 00:29:51 | 21.5 |
| 40000004 | USR000032001 | 21231 | 21 | 458452.5 | 165552 | -292900.5 | 26000 | 03:12:45 | 350 |
| 40000005 | USR005421454 | 124 | 1 | 150 | 2000 | 1850 | 0 | 04:06:13 | 100 |
| ... | ... | ... | ... | ... | ... | ... | ... | ... | ... |

INFORMATION PROVIDING SYSTEM AND INFORMATION PROVIDING APPARATUS

CROSS-REFERENCE TO RELATED APPLICATION

This application claims the benefit of Japanese Patent Application No. 2016-040954, filed on Mar. 3, 2016, which application is incorporated herein by reference in its entirety.

FIELD OF THE INVENTION

The present invention relates to an information providing system and an information providing apparatus.

BACKGROUND OF THE INVENTION

A slot machine is conventionally known operable to stop and display a plurality of symbols after scrolling them, and award game media (e.g., coins) based on a combination of the symbols stopped.

A slot machine is also disclosed operable to allow a game player to realize an attractive payout rate by impressing the game player with a state becoming advantageous to the game player during progress of a game (see specification of United States Patent Application Publication No. 2012/0115571).

A player, who is addicted to a game, may sometimes invest a more amount than initially expected in playing the game, or spend a longer game time than initially expected in playing the game. In the short run, this benefits the game arcade, but in the long run, this may make the player run out shortly. This may possibly keep the game player away from the game, which may result in disadvantages to both the game arcade and the player.

The present invention was accomplished in view of the problems described above, and an object of the present invention is to provide avoidance of a situation in which a player becomes addicted to a game.

For example, the present invention is applicable not only to a game arcade as exemplified by a casino but also to a facility with a game arcade, such as a hotel, an airport, a station, a shopping mall, a fueling station capable of supplying a fuel such as gasoline, a restaurant, or a movie theater as well as a complex facility where a plurality of facilities are collected.

Objects of the present invention, problems to be solved by the present invention, and effects (benefits) of the present invention should be understood from the claims, and should not be wrongly interpreted from the following description.

BRIEF SUMMARY OF THE INVENTION

In a first aspect of the present invention, an information providing system includes:

a storage device that stores game information with respect to each player;

an announcement device operable to announce information; and an information processing device communicable with the announcement device, the information processing device operable to, upon determination that the game information associated with the player exceeds a predetermined threshold value, transmit predetermined instruction information to the announcement device, the announcement device operable to announce information for guiding the player not to play a game, based on the predetermined instruction information.

In this configuration, the information for guiding the player not to play the game is announced upon determination that the game information associated with the player, which is stored in the storage device, exceeds the predetermined threshold value.

Examples of the information for guiding the player not to play the game include an alert giving an implicit advice to stop the game (e.g., "Why don't you take a rest today?", "Why don't you watch a movie today?", or "How about going to a gym?" to the player; and "The customer using XX machine (machine ID) is under risk of addiction to game." or "Please give anti-addiction support to the customer seated at XX." to the hall staff).

For example, if it can be determined that the player is addicted to the game under the state where the predetermined threshold value is exceeded or it can be determined that the player tends to be addicted to the game under the state where the predetermined threshold value is exceeded, an alert is issued to the hall staff, the player who is likely to be addicted to the game, and the like.

In the above-described configuration, a player who is likely to be addicted to a game (a player-at-risk) is detected, and the information for guiding the player-at-risk not to play the game is announced to the player-at-risk, the hall staff, and the like, so that a situation in which the player-at-risk becomes addicted to the game can be avoided.

In the information providing system, the storage device stores game information of a player each time the player plays a game, and in response to the game information being stored in the storage device and upon determination that the game information associated with the player exceeds a predetermined threshold value, the information processing device transmits the predetermined instruction information to the announcement device.

In this configuration, the game information is stored each time a player plays a game, and upon determination that the game information associated with the player exceeds the predetermined threshold value, the information for guiding the player not to play the game is announced.

In this configuration, whether or not a player is likely to be addicted can be determined even in a case where there is no history of game information of the player (for example, in a case of a non-member).

In this configuration, therefore, the information for guiding the player-at-risk not to play the game is announced to the hall staff, the player (the player-at-risk) who is determined to be likely to be addicted to the game, and the like, even in a case where the player-at-risk is a non-member, so that a situation in which the player-at-risk becomes addicted to the game can be avoided.

The information providing system further includes a gaming machine enabling a game to be played, wherein the gaming machine transmits game start information to the information processing device at a time when the player starts a game, and in response to receiving the game start information from the gaming machine and upon determination that the game information associated with the player, which is stored in the storage device, exceeds the predetermined threshold value, the information processing device transmits the predetermined instruction information to the announcement device.

In this configuration, in response to reception of the game start information and upon determination that the game information associated with the player exceeds the predetermined threshold value, the information for guiding the player not to play the game is announced.

In this configuration, the information for guiding the player not to play the game is announced at a time when the game is started, that is, at a time when the player is calm before becoming addicted to the game on the gaming machine, so that a situation in which the player becomes addicted to the game can be avoided.

The information providing system further includes a gaming machine enabling a game to be played, wherein the storage device stores information by which whether or not the gaming machine is a speculative machine is identifiable, and upon determination that the game information associated with the player exceeds the predetermined threshold value and that the gaming machine is a speculative machine, the information processing device transmits the predetermined instruction information to the announcement device.

In this configuration, the information for guiding the player not to play the game is announced upon determination that the game information associated with the player exceeds the predetermined threshold value and that the gaming machine is a speculative machine.

In general, a player who is likely to be addicted to a game (a player-at-risk), having a greater waste amount, tends to play a game on a speculative gaming machine in an attempt to quickly catch up on the waste amount, which makes the player addicted to the game.

In the above-described configuration, if the player-at-risk tries to play a game on a speculative gaming machine, the information for guiding the player-at-risk not to play the game is announced, so that a situation in which the player-at-risk becomes addicted to the game on the speculative gaming machine can be avoided.

The information providing system further includes a gaming machine enabling a game to be played, wherein the storage device stores denomination setting information of the gaming machine, and upon determination that the game information associated with the player exceeds the predetermined threshold value and that the setting information exceeds a prescribed threshold value, the information processing device transmits the predetermined instruction information to the announcement device.

In this configuration, the information for guiding the player not to play the game is announced upon determination that the game information associated with the player exceeds the predetermined threshold value and that the denomination setting information exceeds the prescribed threshold value.

In general, a player who is likely to be addicted to a game (a player-at-risk), having a greater waste amount, tends to play a game on a gaming machine with a higher denomination setting in an attempt to quickly catch up on the waste amount, which makes the player addicted to the game.

In the above-described configuration, if a player-at-risk tries to play a game on a gaming machine with a higher denomination setting, the information for guiding the player-at-risk not to play the game is announced, so that a situation in which the player-at-risk becomes addicted to the game on the gaming machine with a higher denomination setting can be avoided.

In a second aspect of the present invention, an information providing apparatus includes:

a storage device that stores game information with respect to each player; and an information processing device communicable with an announcement device operable to announce information, the information processing device operable to, upon determination that the game information associated with the player, which is stored in the storage device, exceeds a predetermined threshold value, transmit predetermined instruction information to the announcement device such that information for guiding the player not to play a game is announced.

In this configuration, the information for guiding the player not to play the game is announced upon determination that the game information associated with the player, which is stored in the storage device, exceeds the predetermined threshold value.

Examples of the information for guiding the player not to play the game include an alert giving an implicit advice to stop the game (e.g., "Why don't you take a rest today?", "Why don't you watch a movie today?", or "How about going to a gym?" to the player; and "The customer using XX machine (machine ID) is under risk of addiction to game." or "please give anti-addiction support to the customer seated at XX." To the hall staff).

For example, if it can be determined that the player is addicted to the game under the state where the predetermined threshold value is exceeded or it can be determined that the player tends to be addicted to the game under the state where the predetermined threshold value is exceeded, an alert is issued to the hall staff, the player who is likely to be addicted to the game, and the like.

In the above-described configuration, a player who is likely to be addicted to a game (a player-at-risk) is detected, and the information for guiding the player-at-risk not to play the game is announced to the player-at-risk, the hall staff, and the like, so that a situation in which the player-at-risk becomes addicted to the game can be avoided.

The present invention provides avoidance of a situation in which a player becomes addicted to a game.

BRIEF DESCRIPTION OF THE DRAWINGS

The nature and mode of operation of the present invention will now be more fully described in the following detailed description of the invention taken with the accompanying drawing figures, in which:

FIG. 11 exemplifies a symbol combination table of the slot machine according to the embodiment of the present invention;

FIG. 22 exemplifies a player definition table according to the embodiment of the present invention;

FIG. 23 exemplifies a gaming machine definition table according to the embodiment of the present invention;

FIG. 24 exemplifies a player management table according to the embodiment of the present invention;

FIG. 25 exemplifies an address management table according to the embodiment of the present invention;

FIG. 26 exemplifies a login/logout management table according to the embodiment of the present invention;

FIG. 27A exemplifies a play history table according to the embodiment of the present invention;

FIG. 27B exemplifies a session history table according to the embodiment of the present invention;

FIG. 27C exemplifies an accumulation table according to the embodiment of the present invention;

DETAILED DESCRIPTION OF THE PREFERRED EMBODIMENT

It should be appreciated that, in the detailed description of the invention that follows, like reference numbers on different drawing views are intended to identify identical structural elements of the invention in the respective views.

[Outline of Information Providing System]

Figure 1:
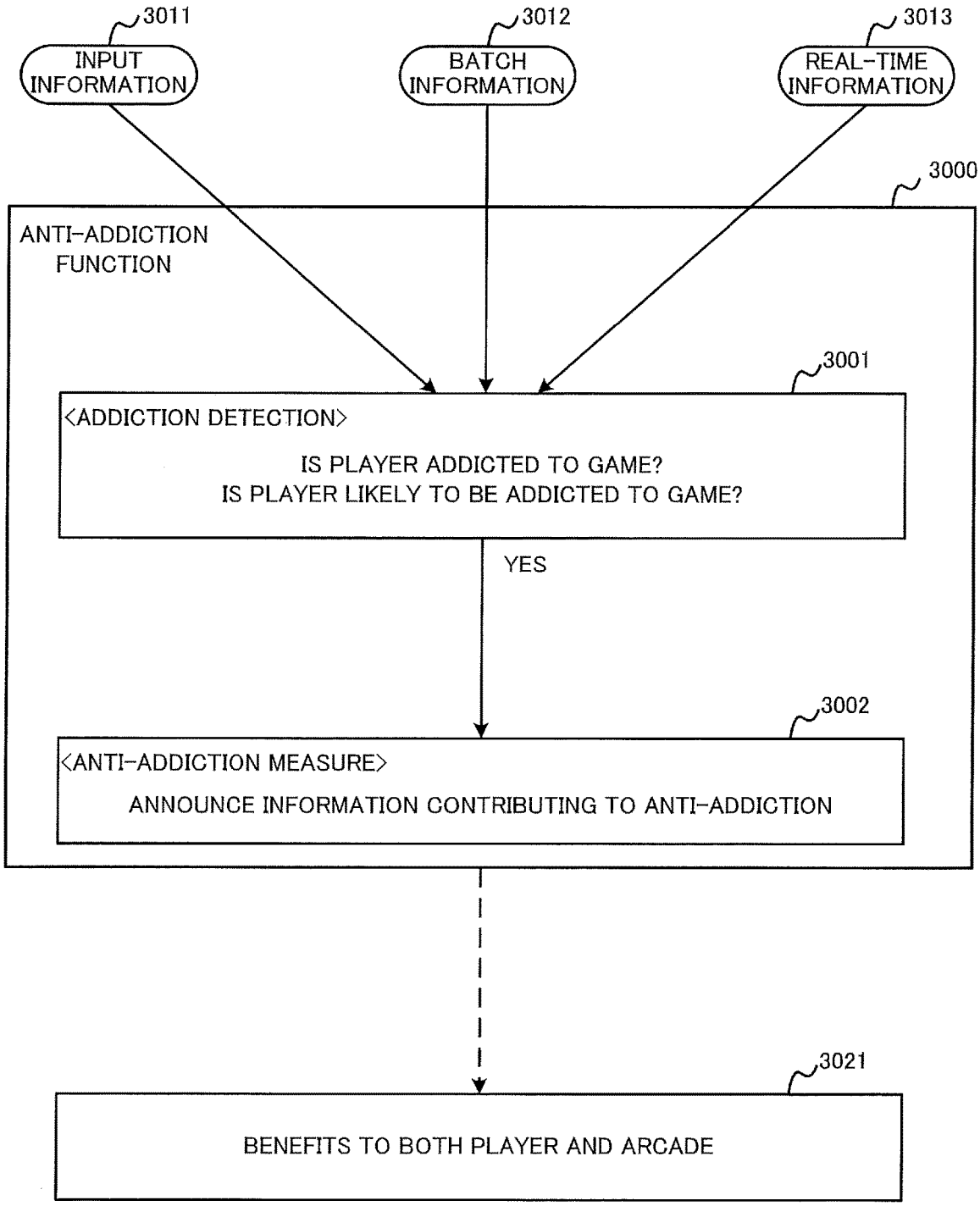
FIG. 1 shows outline of an information providing system according to the embodiment of the present invention.

Outline of an information providing system according to an embodiment is described with reference to a block diagram shown in FIG. 1 as an example.

The information providing system has an anti-addiction function 3000. The anti-addiction function 3000 enables both a player and an arcade to enjoy benefits.

To be more specific, the anti-addiction function 3000 includes an addiction detection 3001, an anti-addiction measure 3002, and the like.

In the addiction detection 3001, an abnormal value is detected based on input information 3011, batch information 3012, real-time information 3013, and the like. Based on a result of the detection, whether or not a player is addicted to a game, whether or not a player is likely to be addicted to a game, or the like, is determined, and thereby a player who is addicted to a game or who is likely to be addicted to a game (hereinafter referred to as an addicted player as appropriate), or the like, is detected.

The input information 3011 is input information (e.g., the amount consumable per day) that has been preliminarily set by a player himself/herself. The batch information 3012 is accumulated game information (e.g., game history data). The real-time information 3013 is game information (e.g., game operation data) that is obtained occasionally.

In the anti-addiction measure 3002, information contributing to anti-addiction is announced (for example, an alert is prompted).

As the announcement of the information contributing to anti-addiction, for example, information that encourages a player not to play a game or information that implicitly recommends stopping a game (for example, "Set amount is reached." or "Why don't you watch a movie today?") is provided to an addicted player. If the addicted player who recognizes the announcement stops the game, a situation in which the addicted player becomes addicted to the game can be avoided.

As the announcement of the information contributing to anti-addiction, for example, information for guiding a player not to play a game or information for guiding a player to stop a game (for example, "Please give anti-addiction support to the customer seated at XX." or "Please give guidance away from play.") is provided to an arcade staff. If the staff who recognizes the announcement guides the addicted player not to play the game (for example, guides the player to another facility in the arcade, such as a restaurant or a movie theater), a situation in which an addicted player becomes addicted to the game can be avoided.

The avoidance of addiction to a game provides a benefit of allowing a player to enjoy a game for a long time because occurrence of a situation in which a player runs out shortly and keeps away from a game (arcade) is reduced. The arcade side is also benefited in terms of use of another facility as well as long-term use of the game arcade.

First Embodiment

A first embodiment of the present invention is described with reference to the drawings.

Figure 2:
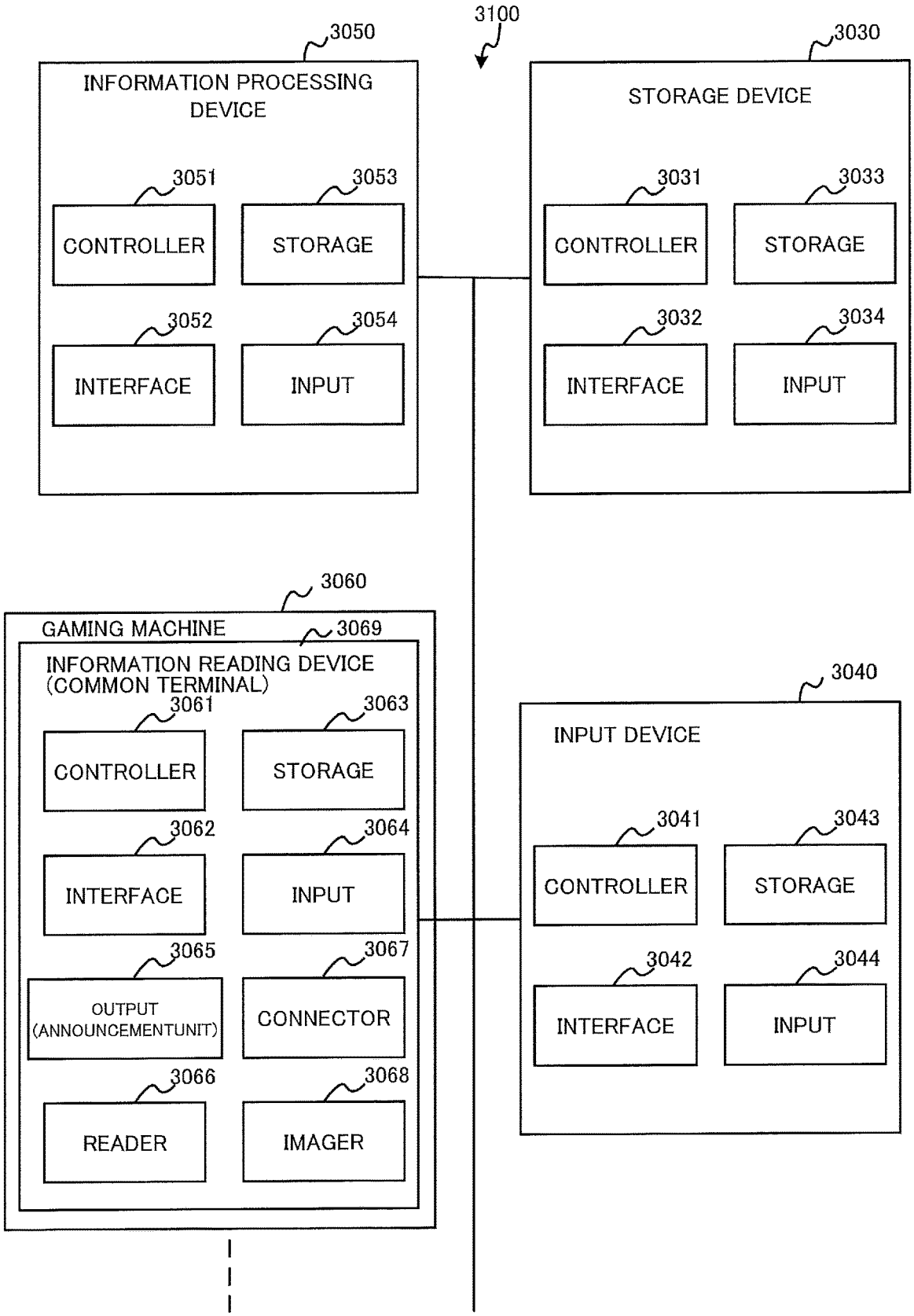
FIG. 2 shows a configuration of the information providing system according to the embodiment of the present invention.

FIG. 2 shows an exemplary system (information providing system 3100) operable to provide the information contributing to anti-addiction. The information providing system 3100 includes a storage device 3030, an input device 3040, an information processing device 3050, and a gaming machine 3060.

(Storage Device 3030)

The storage device 3030 includes a controller 3031, an interface 3032, a storage 3033, and an input 3034.

The controller 3031 is operable to control the interface 3032, the storage 3033, and the input 3034. The controller 3031 is operable to perform a process of, for example, storing information (e.g., game information) received via the interface 3032 into the storage 3033. A CPU (Central Processing Unit), an MCU (Micro-Controller), a motherboard, or the like, functions as the controller 3031.

The interface 3032 is communicable with an apparatus connected to a network. For example, a communication apparatus for wired communication or wireless communication (e.g., a communication module for a wired LAN, a wireless LAN, or mobile phone communication) functions as the interface 3032.

The storage 3033 is operable to store various information (e.g., programs and tables concerning a control of the information providing system 3100). A ROM (Read Only Memory), a RAM (Random Access Memory), a silicon disk, a hard disk, or the like, functions as the storage 3033.

For example, the CPU reads programs and table data stored in the ROM or the like and executes them on the RAM, to implement various functions of the storage device 3030.

The input 3034 is operable to input various information to the storage device 3030 based on a user operation. An input/output interface as exemplified by a USB terminal, a physical button, a physical keyboard, a mouse, a user interface provided on a liquid crystal touch panel, or the like, functions as the input 3034.

The storage device 3030 is, for example, a database server capable of storing various information. The storage device 3030 transmits data requested by each of the input device 3040, the information processing device 3050, and the gaming machine 3060; and receives a request from each of them, for storing, rewriting, or deleting data.

(Input Device 3040)

The input device 3040 includes a controller 3041, an interface 3042, a storage 3043, and an input 3044.

The controller 3041 is operable to control the interface 3042, the storage 3043, and the input 3044. The controller 3041 is operable to perform a process of, for example, transmitting information received via the input 3044 to the storage device 3030. Here, it may be possible to provide a display unit such as a display and provide a display controller separate from the controller 3041, the display controller operable to control, for example, displaying of images of the display unit.

A CPU (Central Processing Unit), an MCU (Micro-Controller), a motherboard, a GPU (Graphics Processing Unit), a video card (graphic board), or the like, functions as the controller 3041.

The interface 3042 is communicable with an apparatus connected to a network. For example, a communication apparatus for wired communication or wireless communication (e.g., a communication module for a wired LAN, a wireless LAN, or mobile phone communication) functions as the interface 3042.

The storage 3043 is operable to store various information (e.g., programs and tables concerning a control of the information providing system 3100). A ROM (Read Only Memory), a RAM (Random Access Memory), a silicon disk, a hard disk, or the like, functions as the storage 3043.

For example, the CPU reads programs and table data stored in the ROM or the like and executes them on the RAM, to implement various functions of the input device 3040.

The input 3044 is operable to input various information to the input device 3040 based on a user operation. An input/output interface as exemplified by a USB terminal, a physical button, a physical keyboard, a mouse, a user interface provided on a liquid crystal touch panel, or the like, functions as the input 3044. The input 3044 converts a human hand or finger movement into a certain digital signal (input information) via the mouse, the keyboard, the liquid crystal touch panel, or the like.

Examples of the input device 3040 include a kiosk terminal or a signage capable of receiving various information. The input device 3040 transmits input information (e.g., the amount consumable per day) received by the input 3044 to the storage device 3030 via the interface 3042. Upon receiving the input information, the storage device 3030 stores the input information in a predetermined storage area of the storage 3033.

(Information Processing Device 3050)

The information processing device 3050 includes a controller 3051, an interface 3052, a storage 3053, and an input 3054.

The controller 3051 is operable to control the interface 3052 and the storage 3053. The controller 3051 determines whether or not a predetermined condition is satisfied, and upon determination that it is satisfied, performs a process of, for example, making a control such that the information contributing to anti-addiction is announced by an announcement device (e.g., the gaming machine 3060). It may be possible to provide a display unit such as a display and provide a display controller separate from the controller 3051, the display controller operable to control, for example, displaying of images of the display unit.

A CPU (Central Processing Unit), an MCU (Micro-Controller), a motherboard, a GPU (Graphics Processing Unit), a video card (graphic board), or the like, functions as the controller 3051.

The interface 3052 is communicable with an apparatus connected to a network. For example, a communication apparatus for wired communication or wireless communication (e.g., a communication module for a wired LAN, a wireless LAN, or mobile phone communication) functions as the interface 3052.

The storage 3053 is operable to store various information (e.g., programs and tables concerning a control of the information providing system 3100). A ROM (Read Only Memory), a RAM (Random Access Memory), a silicon disk, a hard disk, or the like, functions as the storage 3053.

For example, the CPU reads programs and table data stored in the ROM or the like and executes them on the RAM, to implement various functions of the information processing device 3050.

The input 3054 is operable to input various information to the information processing device 3050 based on a user operation. An input/output interface as exemplified by a USB terminal, a physical button, a physical keyboard, a mouse, a user interface displayed on a liquid crystal touch panel, or the like, functions as the input 3054.

The storage device 3030 may be eliminated, and instead the information processing device 3050 may serve the function of the storage device 3030.

(Gaming Machine 3060)

The gaming machine 3060 includes an information reading device 3069.

The information reading device 3069 includes a controller 3061, an interface 3062, a storage 3063, an input 3064, an output 3065, a reader 3066, a connector 3067, and an imager 3068.

The controller 3061 is operable to control the other elements 3062 to 3068. A CPU, an MCU, a motherboard, a GPU, a video card (graphic board), or the like, functions as the controller 3061.

It may be possible to provide a display controller separate from the controller 3061, the display controller operable to control, for example, displaying of images of the output 3065 which is exemplified by a display.

The interface 3062 is communicable with an apparatus connected to a network. For example, a communication apparatus for wired communication or wireless communication (e.g., a communication module for a wired LAN, a wireless LAN, or mobile phone communication) functions as the interface 3062.

The storage 3063 is operable to store various information. A ROM, an RAM, a silicon disk, a hard disk, or the like, functions as the storage 3063.

The input 3064 is operable to input various information to the information reading device 3069 based on a user operation. An input/output interface as exemplified by a USB terminal, a physical button, a physical keyboard, a mouse, a user interface displayed on a liquid crystal touch panel, or the like, functions as the input 3064.

The output 3065 is operable to output various information (the information contributing to anti-addiction) received via the interface 3062. A display as exemplified by a liquid crystal display device, a light emitting member as exemplified by an LED (Light Emitting Diode), a speaker that outputs sound, voice, etc., a vibration generator as exemplified by a motor that generates vibrations, or the like, functions as the output 3065.

The reader 3066 is operable to read identification information by which a user can be identified, the identification information stored in a storage medium (e.g., an IC card). A contact type reader/writer, a contactless reader/writer, or the like, functions as the reader 3066.

The connector 3067 is communicable with the gaming machine. A communication apparatus for wired communication or wireless communication (e.g., a USB, an expansion slot, or a network terminal) functions as the connector 3067.

The imager 3068 is operable to capture video and images of a place where the information reading device 3069 is located. For example, a CCD image sensor functions as the imager 3068.

The input device 3040 may be eliminated, and instead the gaming machine 3060 may serve the functions of the input device 3040.

[Description of Outline of Game System]

Figure 3:
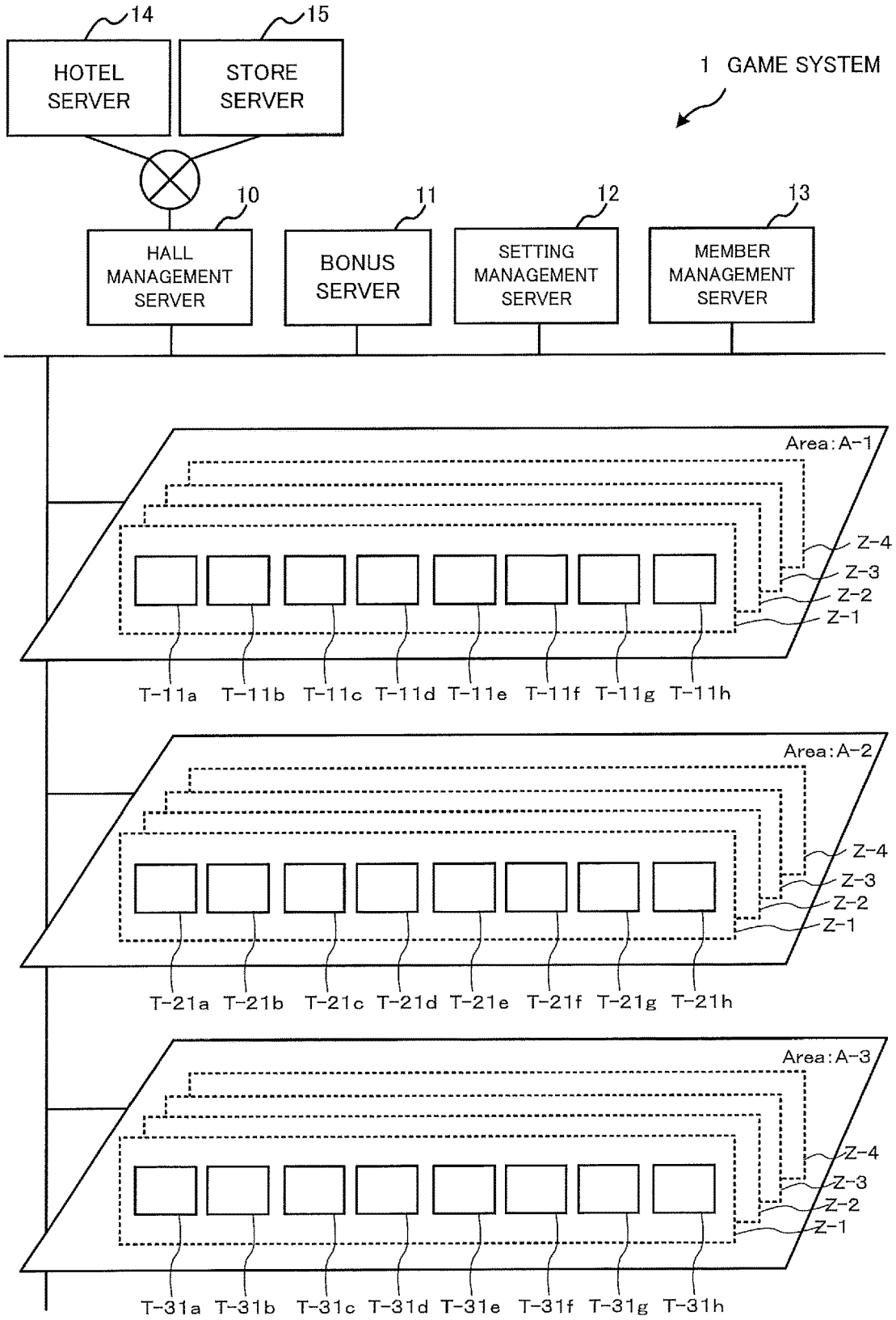
FIG. 3 schematically shows a game system according to the embodiment of the present invention.

Outline of a game system is described with reference to FIG. 3. FIG. 3 is an outline diagram schematically showing an overall configuration of a game system 1 according to a first embodiment.

The game system 1 includes a hall management server 10, a bonus server 11, a setting management server 12, a member management server 13, a hotel server 14, a store server 15, gaming machines, kiosk terminals, and signages.

The number of each of the devices may be arbitrary. For example, the number of each device may be one, or may be two or more. If, for example, the function of one device can be served by another device, the one device may not be provided.

The hall management server 10 aggregates and manages a money flow in a hall (game hall) to make a balance sheet or the like, and also manages the other servers. The hall management server 10 obtains game information from each gaming machine and accumulates the game information. The game information includes timing when the gaming machine has started a unit game, timing when the gaming machine has terminated the unit game, a lottery result in the unit game, and the like.

The hall management server 10 refers to the hotel server 14 for a vacant room, a free service, and the like, and stores vacant room information (information about an available room: the room size, the number of beds, the number of night stayed, the room rate, etc.), meal invitation information, and the like. The hall management server 10 also refers to the store server 15 for a vacant seat, an available coupon, the most immediate event, a limited-time sale, and the like, and stores vacant seat information, coupon information, event information, sale information, and the like.

The bonus server 11 controls a bonus lottery held in a bonus game, and an interlocking effect produced in association with the bonus lottery. The bonus server 11 also manages a cumulative value for awarding a bonus (for example, a credit accumulated for a progressive bonus).

The setting management server 12 stores and manages setting of a gaming machine for which a bonus lottery is to be held and setting of the interlocking effect. Although this embodiment illustrates a bonus game as an example, other types of games including a slot tournament are adoptable.

The member management server 13 is a server for storing and managing member's personal information, information about a member card (IC card), member's previous game results, and the like. The member card (IC card) is issued by, for example, a member card issuing terminal. At a time of membership registration, member's personal information that is inputted as well as an identification code of a member card is stored in the member management server 13. The member card issuing terminal may be provided with a camera so that the face of a player whose member card which is an IC card is being issued can be imaged at a time of issuance of the member card. The captured image is stored in the member management server 13 in association with the identification code.

As shown in FIG. 3, the gaming machines, the kiosk terminals, and the signages (the gaming machines and the like) are installed in a plurality of areas (for example, A-1 to A-3 shown in FIG. 3). Here, the area corresponds to, for example, one floor of the hall or an area on a floor. The areas A-1 to A-3 are shown in this example, which is merely illustrative.

The gaming machines and the like are installed in a zone within the area (for example, Z-1 to Z-4 shown in FIG. 3). Here, the zone corresponds to a certain space within the area. In this example, four zones (Z-1 to Z-4) are provided in the area, which is merely illustrative. Although eight machines are arranged in each zone of this example, this is merely illustrative and a various number of machines can be arranged therein.

The diagram schematically illustrates that the gaming machines and the like are connected to the hall management server 10, the bonus server 11, and the like, via LAN connection using Ethernet (registered trademark), though more detailed manner of the connection will be described later.

Each of the gaming machines and the like is assigned a unique identifier, and the hall management server 10 or the like uses the identifier to identify the source of data transmitted from each of the gaming machines and the like. The hall management server 10 or the like also uses the identifier to designate the destination of data when transmitting the data to the gaming machines and the like. Examples of the identifier include a network address such as an IP address, but an identifier different from the network address is also adoptable for managing each individual gaming machine.

The game system 1 may be built in a single hall (game hall) capable of offering various games, or may be built across a plurality of halls. In a case of being built in a single hall, the game system 1 may be built in each floor or each section of the hall. A communication line that connects the servers to the gaming machines and the like may be either wired or wireless, and a dedicated line, a circuit-switched line, or the like, is also adoptable therefor.

[Description of Outline of Gaming Machine]

Figure 4:
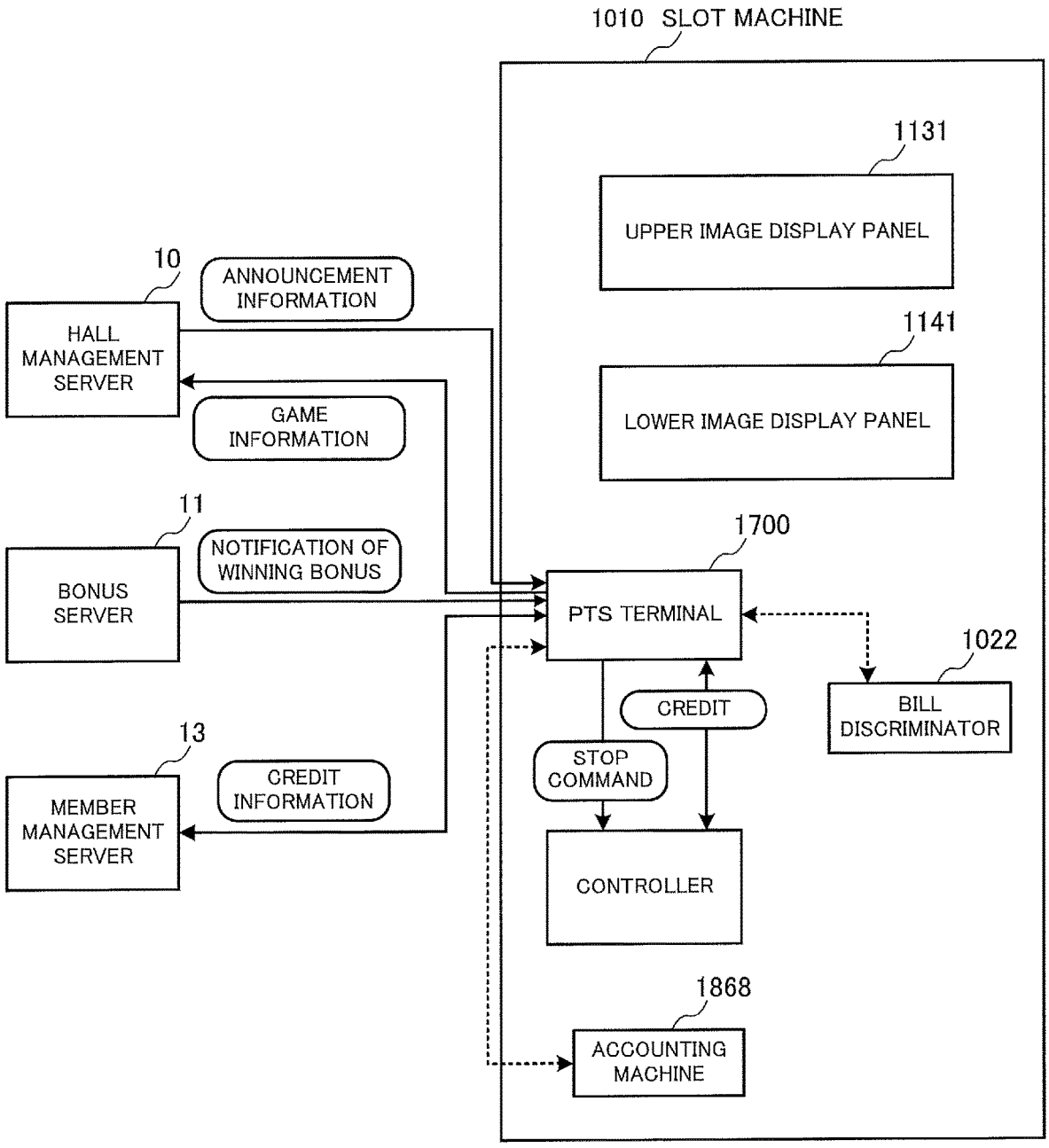
FIG. 4 schematically shows a slot machine according to the embodiment of the present invention.

A gaming machine according to the embodiment of the present invention is described with reference to FIG. 4. FIG. 4 shows a gaming machine integrated with a player tracking device. A configuration of a slot machine 1010 is conceptually shown. The player tracking device is a terminal for implementing a player tracking system. In the specification herein, this device will be hereinafter referred to as a PTS terminal. Although a slot machine will be illustrated as the gaming machine in the following description, the present invention is applicable not only to the slot machine but also to gaming machines for playing various games.

As shown in FIG. 4, the slot machine 1010 includes a PTS terminal 1700, and also includes an accounting machine 1868. The PTS terminal 1700 connects the slot machine 1010 to the hall management server 10, the bonus server 11, and the like, via a network. In this embodiment, one slot machine 1010 is provided with one PTS terminal 1700 that is arranged in a part of a housing of the slot machine 1010.

In this embodiment, the PTS terminal 1700 is connected to a bill discriminator 1022 via a communication line (or the slot machine 1010).

The PTS terminal 1700 transmits and receives data to and from a controller (a controller 1100 of the slot machine 1010 which will be described later) based on a predetermined protocol, and communicates data with the hall management server 10, the bonus server 11, and the like, that are connected via the network. For example, information about a credit necessary for starting a play, and a stop command to stop a unit game at a time of the interlocking effect, are transmitted from the PTS terminal 1700 to the controller; and information about a credit that is a playing outcome, a notification of starting a unit game, a notification of ending a unit game, and the like, are transmitted from the controller to the PTS terminal 1700.

For example, a notification of acceptance or removal of a member card, a notification of starting a unit game, a notification of ending a unit game, game information such as a lottery result, BET information, and the number of payouts, etc., are transmitted from the PTS terminal 1700 to the hall management server 10. Announcement information for announcing the information contributing to anti-addiction is transmitted from the hall management server 10 to the PTS terminal 1700. Upon receiving the announcement information, the PTS terminal 1700 announces the information contributing to anti-addiction, which will be detailed later.

The bonus server 11 transmits a notification of winning a bonus to the PTS terminal 1700 (of a predetermined slot machine 1010). The PTS terminal 1700 and the member management server 13 exchange information about a member's credit, for example.

A game flow for a member is outlined as follows. First, membership registration is made at the member card issuing terminal, and a member card (IC card) is issued at this time. Then, a player inserts the member card into the PTS terminal 1700 of the slot machine 1010, and inserts cash. Upon insertion of a bill, the bill discriminator 1022 identifies the denomination and amount, and transmits a result of the identification, which means denomination data and amount data, to the PTS terminal 1700. The PTS terminal 1700 obtains a play credit based on the denomination data and the amount data, and transmits the obtained credit to the controller.

The controller executes a game based on the credit transmitted from the PTS terminal 1700. A credit according to a playing outcome is transmitted from the controller to the PTS terminal 1700. The PTS terminal 1700 calculates a payout based on the playing outcome, to determine the amount to be paid out to the player. The PTS terminal 1700 writes the determined amount into the member card without any change, and discharges the member card. In addition, a predetermined point is given to the member card in accordance with the playing, or the like.

In a case where the member player plays a next game, the PTS terminal 1700 reads the member card inserted therein, to read the amount stored in the member card. The read amount is converted into a credit, which is then transmitted to the controller. In the same manner as mentioned above, a credit according to a playing outcome is transmitted from the controller to the PTS terminal 1700, and the PTS terminal 1700 calculates a payout based on the playing outcome, to determine the amount to be paid out to the player. The amount obtained as a result of the play is added to the amount stored in the inserted member card, which is thereby updated.

Furthermore, the PTS terminal 1700 transmits the updated amount and the identification code (or a player identification code) read from the member card to the member management server 13. The member management server 13 adds the amount transmitted from the PTS terminal 1700 to the amount owned by a member specified by the identification code, and stores a result of the addition. Constant management of the amount owned by the member is achieved by this process.

Thereafter, when needed, the member player can settle the account based on the amount stored in the member card in a cashier counter, for example. In a case of the slot machine 1010 including the accounting machine 1868 as illustrated above, settlement of the account can be made in the slot machine 1010 by using the member card.

A game flow for a non-member is outlined as follows. First, a player inserts cash into the PTS terminal 1700 of the slot machine 1010. Upon insertion of a bill, the bill discriminator 1022 identifies the denomination and amount, and transmits a result of the identification, which means denomination data and amount data, to the PTS terminal 1700. The PTS terminal 1700 obtains a play credit based on the denomination data and the amount data, and transmits the obtained credit to the controller.

The controller executes a game based on the credit transmitted from the PTS terminal 1700. The credit according to the playing outcome is transmitted from the controller to the PTS terminal 1700. The PTS terminal 1700 calculates the payout based on the playing outcome, to determine the amount to be paid out to the player. The PTS terminal 1700 writes the determined amount into a new IC card stocked in the slot machine 1010, and discharges the IC card. This is the first time the non-member obtains the IC card.

Thereafter, when needed, the non-member player can settle the account based on the amount stored in the IC card in a cashier counter, for example. In a case of the slot machine 1010 including the accounting machine 1868 as illustrated above, settlement of the account can be made in the slot machine 1010 by using the IC card.

[Description of Functional Flow Diagram]

Figure 5:
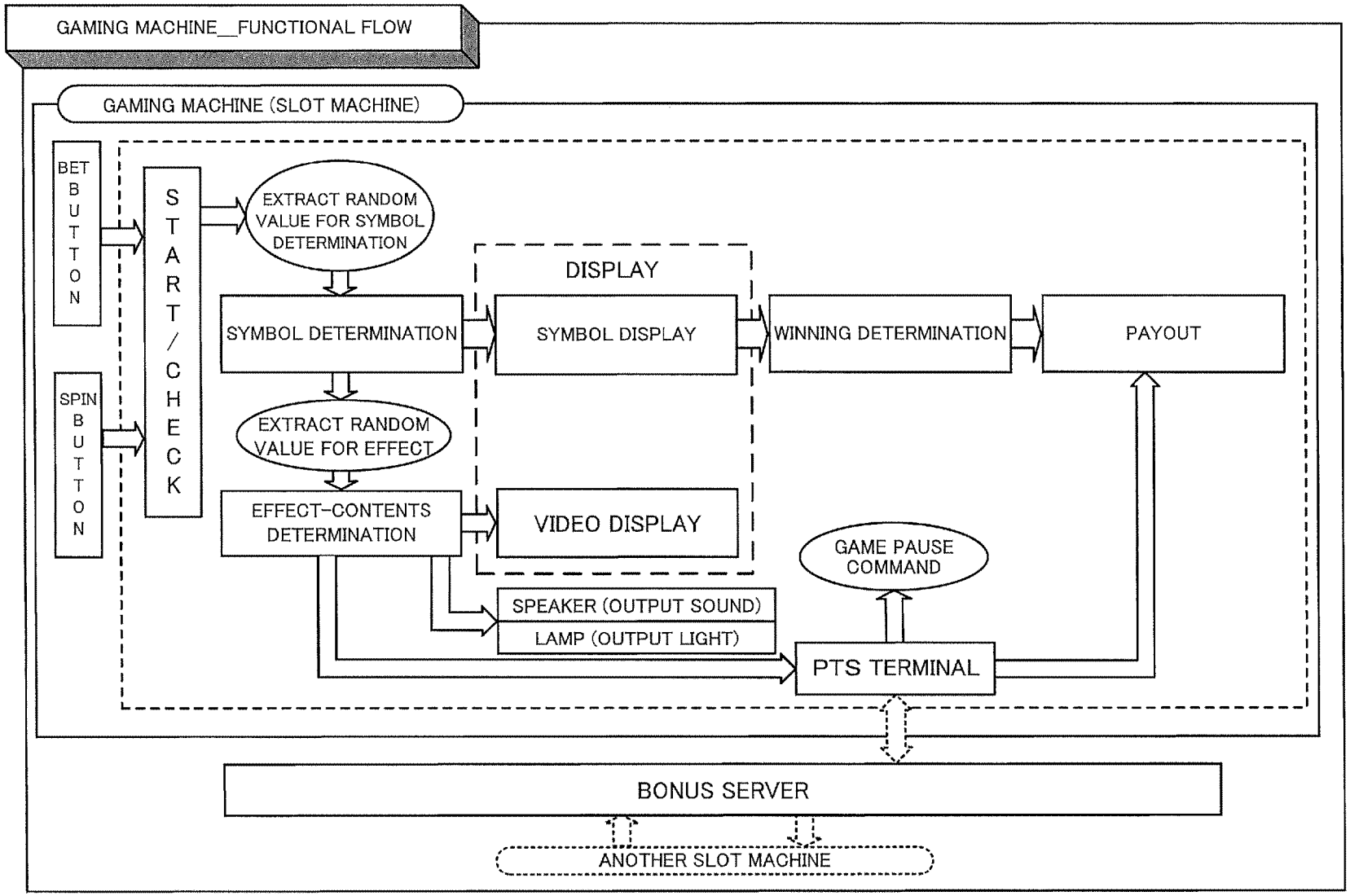
FIG. 5 shows basic functions of the slot machine according to the embodiment of the present invention.

Basic functions of the slot machine according to the embodiment of the present invention are described with reference to FIG. 5. As shown in FIG. 5, the slot machine 1010 is connected to an external control device (for example, the bonus server 11) so as to allow data communication therewith. The external control device is connected to a plurality of other slot machines 1010 installed in the hall so as to allow data communication therewith.

<Start-Check>

First, the slot machine 1010 checks whether or not a BET button is pressed by a player, and subsequently checks whether or not a spin button is pressed by the player.

<Symbol Determination>

Next, if the spin button is pressed by the player, the slot machine 1010 extracts random values for symbol determination, and determines symbols to be displayed to the player when symbol arrays stop scrolling, for each of a plurality of video reels displayed on a display.

<Symbol Display>

Next, the slot machine 1010 starts scrolling the symbol array of each video reel, and then stops scrolling so that the determined symbols are displayed to the player.

<Winning Determination>

After scrolling of the symbol array of each video reel is stopped, the slot machine 1010 determines whether or not a combination of symbols displayed to the player is a combination related to winning.

<Payout>

Then, if the combination of symbols displayed to the player is a combination related to winning, the slot machine 1010 offers benefits according to the type of the symbol combination to the player. For example, if a combination of symbols related to a payout is displayed, the slot machine 1010 pays out a payout to the player, the payout corresponding to the combination of symbols.

In response to the slot machine 1010 starting a unit game by a player pressing the spin button or terminating a unit game, the bonus server 11 holds a lottery for a bonus game. If any of the slot machines 1010 wins the lottery for the bonus game, the slot machine 1010 stops a unit game and then the PTS terminal 1700 produces the interlocking effect. Here, the unit game represents a series of operations from start of receiving a BET to a state in which an award can be established A payout is given from the bonus server 11 to the slot machine 1010 having won the bonus game via the PTS terminal 1700. For example, the bonus server 11 accumulates a part of a credit consumed by the player on the slot machine 1010 as a credit for a progressive bonus, and upon the slot machine 1010 wining the bonus game, pays out a part of the progressive bonus to the winning slot machine 1010.

<Determination of Effects>

The slot machine 1010 produces effects by displaying images to the display, outputting light from lamps, and outputting sounds from speakers. The slot machine 1010 extracts a random value for effect and determines contents of the effects based on the symbols and the like determined by lottery.

At the lottery for the bonus game, the interlocking effect is produced in a plurality of gaming machines through display devices, light-emitting units, and speakers of the PTS terminals 1700.

[Overall Configuration of Slot Machine]

Figure 6:
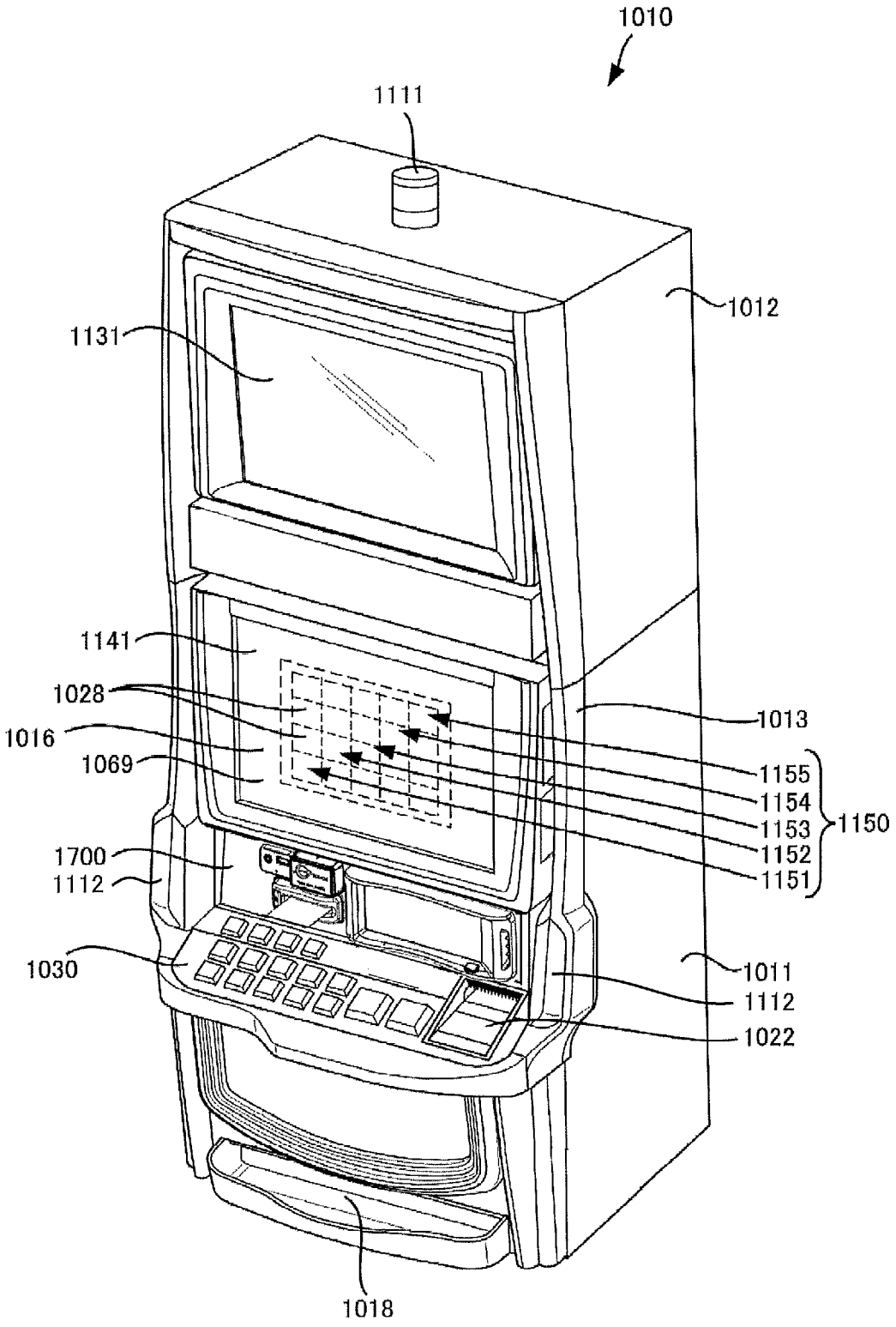
FIG. 6 is a perspective view showing an overall structure of the slot machine according to the embodiment of the present invention.

Next, an overall structure of the slot machine 1010 is described with reference to FIG. 6.

A member card (IC card), a bill, or electronic value information equivalent thereto is used as a game medium for the slot machine 1010. Particularly in this embodiment, credit-related data such as cash data stored in an IC card 1500 is adopted.

The slot machine 1010 includes a cabinet 1011, a top box 1012 provided on the upper side of the cabinet 1011, and a main door 1013 provided on a front face of the cabinet 1011.

The main door 1013 includes a symbol display device 1016 which is referred to as a lower image display panel 1141. The symbol display device 1016 is formed of a transparent liquid crystal panel. A screen displayed on the symbol display device 1016 has a display window 1150 in a central region thereof. The display window 1150 is made up of 20 display blocks 1028 that form five columns and four rows. The four display blocks 1028 included in each column, which constitute each of pseudo reels 1151 to 1155, rotate in accordance with a player's operation. In each of the pseudo reels 1151 to 1155, the four display blocks 1028 move downward with the entire speed thereof varying, so that symbols 1501 displayed in the display blocks 1028 are vertically rotated and then stopped, thus performing rearrangement.

Here, the "rearrangement" represents a state where the symbols 1501 are arranged again after an arrangement of the symbols 1501 is dissolved. The "arrangement" represents a state where the symbols 1501 are visually recognizable by an external player. The slot machine 1010 runs a so-called slot game in which a payout corresponding to a winning combination is awarded in accordance with how the symbols 1501 are arranged as a result of stopping the rotation of the pseudo reels 1151 to 1155.

Although this embodiment illustrates a case where the slot machine 1010 is a so-called video slot machine, the slot machine 1010 of the present invention may adopt so-called mechanical reels as a substitute for all or part of the pseudo reels 1151 to 1155.

The symbol display device 1016 has a touch panel 1069 provided on a front face thereof, and the player is able to input various instructions by operating the touch panel 1069. The touch panel 1069 transmits an input signal to the main CPU 1071.

An upper image display panel 1131 is provided on a front face of the top box 1012. The upper image display panel 1131 includes a liquid crystal panel, and forms the display. The upper image display panel 1131 displays images related to effects and images showing introduction of game contents and explanation of game rules. Further, the top box 1012 is provided with a lamp 1111.

A number-of-credit indicator (not shown) is displayed in an upper part of the display window 1150, to display the current number of credits. Here, the "credit" is a virtual game medium on the game, which the player uses for making a BET. The number-of-credit indicator displays the total number of credits currently owned by the player.

A fractional cash indicator (not shown) is displayed below the number-of-credit indicator. The fractional cash indicator displays fractional cash. The "fractional cash" means cash that remains without being converted into the credit in the event that an insufficient amount of cash is inserted.

Upon insertion of the IC card 1500 into the PTS terminal 1700 which will be described later, the number of credits stored in the IC card is displayed by the number-of-credit indicator while a fractional cash stored in the IC card is displayed by the fractional cash indicator. These numerical values are stored in the member management server 13 in association with the identification code of the member card.

The IC card is a contactless IC card in which an IC (Integrated Circuit) is built for recording and calculating various data such as credit, by which near field wireless communication as exemplified by NFC (Near Field Communication) is enabled using RFID (Radio Frequency Identification) technology. The IC card 1500 enables the player to own credit-related data and carry the data from one to another of different slot machines. The player inserts the IC card 1500 into the PTS terminal 1700 of the slot machine 1010, and thereby can play a game such as a unit game on the slot machine 1010 by using the credit-related data (amount data) stored in the IC card 1500.

It may be acceptable that the player is able to use a machine installed in the hall to accumulate cash data of cash including coins, bills, and the like, in the IC card 1500.

The PTS terminal 1700 is installed in the cabinet 1011, at a position below the lower image display panel 1141. Speakers 1112 are arranged to the left and right of the PTS terminal 1700, respectively. The lamp 1111 is arranged on the top of the top box 1012. The slot machine 1010 produces effects for the unit game by displaying images on the upper image display panel 1131, outputting sounds from the speakers 1112, outputting light from the lamp 1111, and the like.

[Configuration of PTS Terminal]

Figure 7:
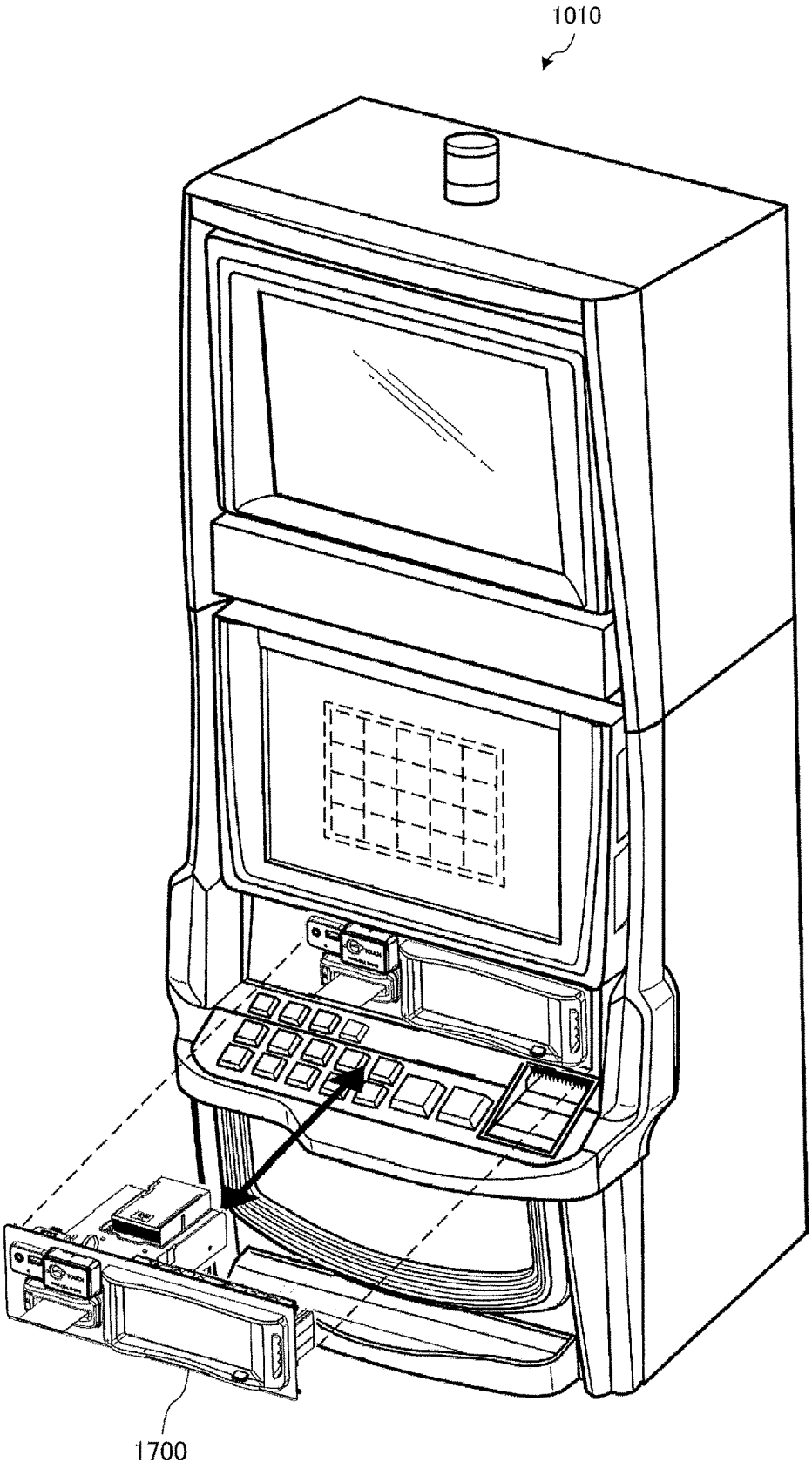
FIG. 7 shows a PTS terminal installed in the slot machine according to the embodiment of the present invention.

FIG. 7 shows the PTS terminal 1700 installed in the slot machine 1010. The PTS terminal 1700, which is operable to exchange data through a data interface that is common to gaming machines, is installable in various types of gaming machines from various manufacturers.

Figure 8:
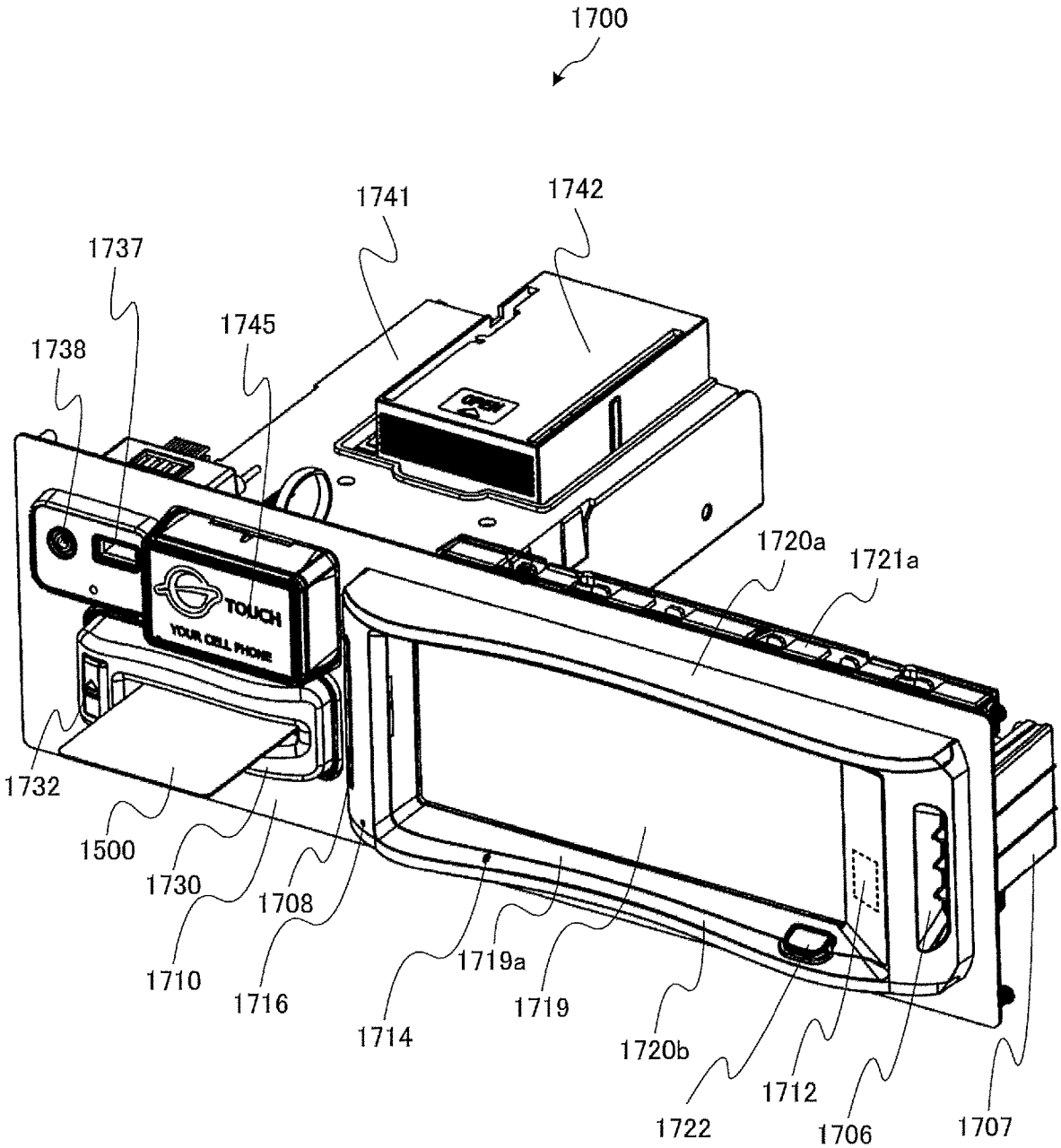
FIG. 8 shows, on an enlarged scale, the PTS terminal according to the embodiment of the present invention.

FIG. 8 shows the PTS terminal 1700 of FIG. 7 on an enlarged scale. As shown in FIG. 8, the PTS terminal 1700 includes a panel 1710. Parts arranged on a front face of the panel 1710 are visually recognizable by the player. Members arranged on a rear face of the panel 1710, which are housed within the slot machine 1010, are not visually recognizable by the player.

The panel 1710 has, in a right part of the front face thereof, an LCD 1719 with a touch panel function. For example, the LCD 1719 displays information about the member and information directed to the member, and has a screen size of 6.2 inches (about 15.7 cm). An LCD covering 1719*a* is provided around the LCD 1719. While the LCD 1719 is provided with the touch panel function in this example, the player may input instructions by using another input device such as a keyboard or a mouse.

A light-emitting plate 1720*a* for emitting light, which is connected to LEDs, is provided above the LCD 1719 and the LCD covering 1719*a*. For example, the light-emitting plate 1720*a* is made of polycarbonate, and connected to a plurality of (e.g., seven) full-color LEDs 1721*a* arranged on the rear side of the panel 1710 so that the light-emitting plate 1720*a* emits light in accordance with light emission of the full-color LEDs 1721*a*.

Likewise, a light-emitting plate 1720*b* for emitting light, which is connected to LEDs, is provided below the LCD 1719 and the LCD covering 1719*a*. For example, the light-emitting plate 1720*b* is made of polycarbonate, and connected to a plurality of (e.g., seven) full-color LEDs 1721*b* (not shown) arranged on the rear side of the panel 1710 so that the light-emitting plate 1720*b* emits light in accordance with light emission of the full-color LEDs 1721*b*.

The full-color LEDs 1721*a* (light-emitting plate 1720*a*) and the full-color LEDs 1721*b* (light-emitting plate 1720*b*) are able to emit light that contributes to anti-addiction.

An imaging window 1712 is provided to the right of the LCD 1719. A human body detection camera 1713 (see FIG. 10) arranged inside the LCD covering 1719*a* or on the rear side of the panel 1710 images the player or the like through the imaging window 1712. The imaging window 1712 may be made of, for example, a half mirror material given a shielding process such as smoking.

The LCD covering 1719*a* has a home button 1722 provided to the lower right of the LCD 1719. The home button 1722 is a button for shifting a screen displayed on the LCD 1719 into a predetermined superordinate screen.

The LCD covering 1719*a* has a speaker duct 1706 provided to the right of the LCD 1719. At a position corresponding thereto on the rear side of the panel 1710, a bass-reflex type speaker 1707 is provided. Likewise, a speaker duct 1708 is provided to the left of the LCD 1719, and at a position corresponding thereto on the rear side of the panel 1710, a bass-reflex type speaker 1709 (see FIG. 10) is provided. These speakers are speakers exclusive for the PTS terminal 1700, and provided separately from a slot machine game speaker provided in the slot machine 1010. These speakers are capable of producing interlocking effects, implementing voice conversations, outputting an announcement sound when the IC card 1500 is left inserted, and outputting sounds or voices that contribute to anti-addiction. Since the speakers are configured to allow stereophonic sound such that sounds outputted therefrom reach the front side (player side) through the above-mentioned speaker ducts 1706, 1708, it is possible to arrange the speakers on the rear side of the panel 1710, which results in achievement of space saving of the PTS terminal 1700 (panel face).

The LCD covering 1719*a* has a microphone opening 1714 and a microphone opening 1716 provided to the lower left of the LCD 1719. At positions corresponding thereto inside the LCD covering 1719*a*, microphones 1715 and 1717 (see FIG. 10) are provided, respectively.

A card slot 1730 through which the IC card 1500 can be inserted or removed is provided in a lower left part of the front face of the panel 1710. A full-color LED 1731 (see FIG. 10), which is provided in a card insertion portion of the card slot 1730, lights up in multiple colors to announce the number of IC cards 1500 stored in a card stacker 1742 which will be described later. An eject button 1732 is provided in the card slot 1730. A red LED 1733 (see FIG. 10) arranged near the eject button 1732 lights up to show the position of the eject button 1732 and a progress of ejection.

A card unit 1741 and the card stacker 1742 are provided on the rear side of the panel 1710 at a position corresponding to the card slot 1730. The card slot 1730 is configured as a part of the card unit 1741. The card stacker 1742 is capable of storing about 30 IC cards 1500. To pay back a credit to a new player who has played a unit game, the IC card 1500 stored in the card stacker 1742 is taken out and discharged through the card slot 1730.

At a time of payback of a credit, the IC card 1500 accepted through the card slot 1730 and held in the card unit 1741 is updated in its credit information by NFC or the like, and then the IC card 1500 is discharged through the card slot 1730. The IC card 1500 is fully received within the card unit 1741 while a player is playing a unit game.

In a conceivable configuration, the IC card 1500 may be kept in the card stacker 1742 if the human body detection camera or the like detects absence of the player while the IC card 1500 remains at a time of payback of the credit. This can avoid occurrence of a situation in which the IC card 1500 is left in the card unit 1741 for a long time even when, for example, a player who recognizes that the IC card 1500 holds only a small amount of credits leaves the machine with the IC card 1500 left therein or a player who simply forgets to take the IC card 1500 leaves the machine.

A USB terminal 1737 and an audio terminal 1738 are provided in an upper left part of the front face of the panel 1710. The USB terminal 1737 is configured such that a USB device connected thereto can be charged, for example. The audio terminal 1738 is, for example, of 4-terminal type, to which a headset can be inserted to enable the player to make a phone call by using headphones and a microphone. Alternatively, the audio terminal 1738 may be of 2-terminal or 3-terminal type which enables the player to hear voices by using headphones.

The front face of the panel 1710 has a touch unit 1745 provided to the left of the LCD 1719. The touch unit 1745 includes an RFID module that is able to function as a writer and a reader, the writer writing data to an IC device (e.g., a mobile phone or a smart phone having a communication function using a contactless IC card or NFC) including an IC chip by data communication, the reader reading data from the IC device by data communication. LEDs 1746 (not shown) are arranged at the four corners of the front face of the touch unit 1745. In addition to the touch unit 1745 or instead of the touch unit 1745, an information recording medium reading apparatus may be provided for reading information stored in an information recording medium as exemplified by a magnetic card. In such a configuration, a magnetic card instead of the IC card 1500 can be used as the member card.

As described above, the PTS terminal 1700 according to the embodiment of the present invention achieves space saving because various devices having a microphone function, a camera function, a speaker function, a display function, and the like, are integrated into a single unit. This does not cause an inconvenient situation in which, for example, speakers cannot be directed to the player while the LCD is directed to the player, which situation might be caused if the respective functions are provided as separate parts.

[Advantages of Providing Both Card Unit and Touch Unit]

The PTS terminal 1700 according to the embodiment of the present invention is configured such that, upon insertion of the IC card 1500 into the card slot 1730, the card unit 1741 reads the IC card 1500 and the entire IC card 1500 is accepted and held (inside the PTS terminal 1700). In addition to this, the touch unit 1745 is provided to allow data communication with another IC card, a mobile phone, or a smart phone.

The above-described configuration of the PTS terminal 1700 of the present invention makes it possible that, for example, in an event requiring any maintenance while a member player is playing on the gaming machine (at this time, the member card is held in the card unit 1741), a staff brings a maintenance IC card into touch with the touch unit 1745 to display a maintenance screen on the LCD 1719 of the PTS terminal 1700 or to transmit the contents or history of maintenance to the server, for accumulation.

For example, in a case of performing maintenance concurrently on a plurality of machines or sequentially on many machines, their touch units 1745 are sequentially touched with the maintenance card so that an operation for displaying the maintenance screen or registering the contents of maintenance can be performed quickly.

If the PTS terminal 1700 is configured such that the touch unit 1745 is the only access to the IC card or the like, the gaming machine cannot recognize exchange of players in a situation where a player who has initially played by touching the touch unit 1745 with the IC card 1500 leaves the gaming machine and then another player uses the gaming machine. To eliminate such inconvenience, the card unit 1741 configured to hold the IC card 1500 during the play is preferable. For example, if the player who has initially played by touching the touch unit 1745 with the IC card 1500 leaves the gaming machine and then another player plays on the same gaming machine by inserting a bill (without using any IC card), the credit-related data is stored in the IC card 1500 of the initial player at a time of payback.

[Circuit Configuration of Slot Machine]

Figure 9:
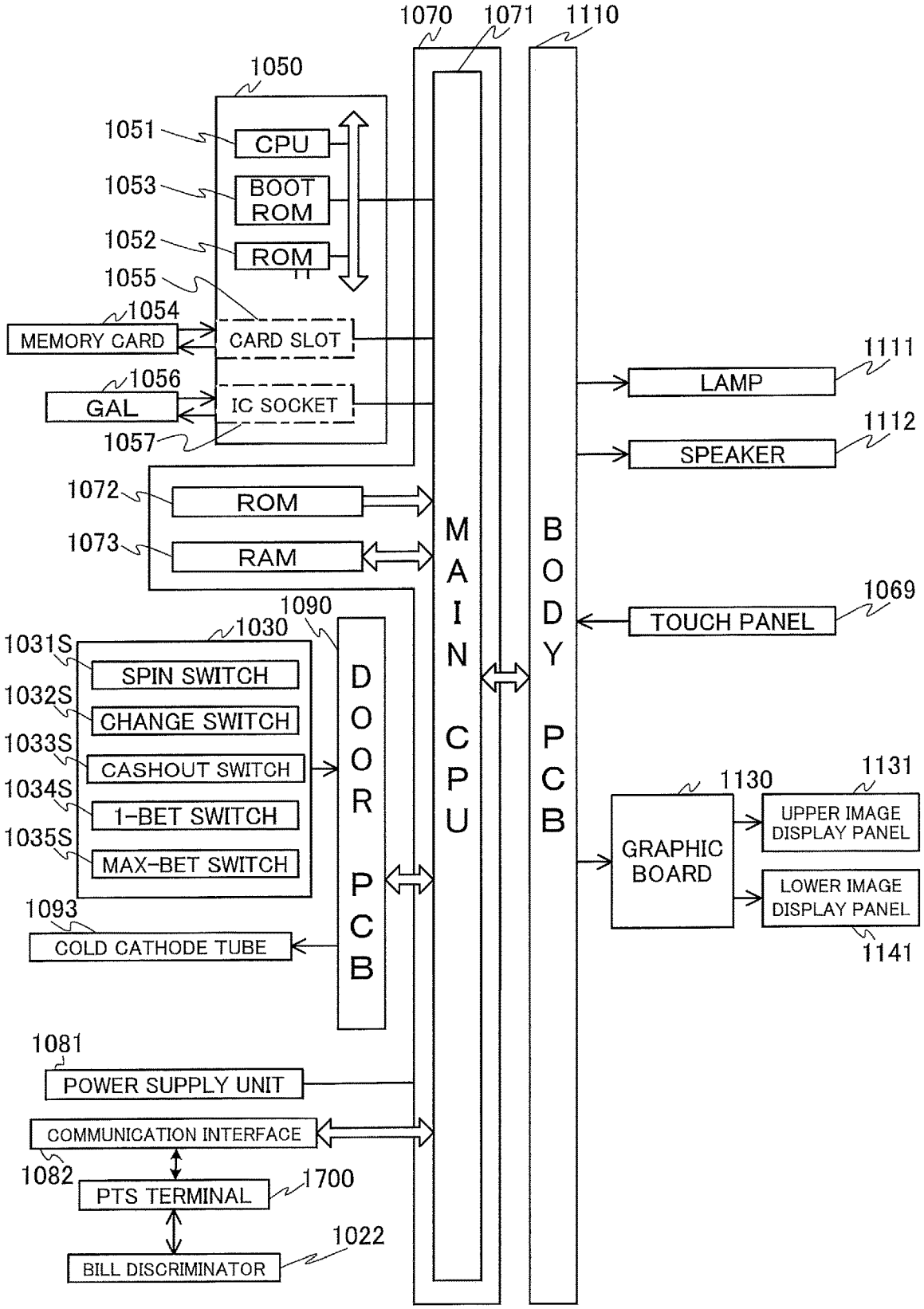
FIG. 9 shows a circuit configuration of the slot machine according to the embodiment of the present invention.

Next, a configuration of a circuit included in the slot machine 1010 is described with reference of FIG. 9.

A gaming board 1050 is provided with: a CPU 1051, a ROM 1052, and a boot ROM 1053, which are mutually connected by an internal bus; a card slot 1055 corresponding to a memory card 1054; and an IC socket 1057 corresponding to a GAL (Generic Array Logic) 1056.

The memory card 1054 includes a non-volatile memory, and stores a game program and a game system program. The game program includes a program related to game progression, and a program for producing effects (announcements) by images and sounds. Further, the aforementioned game program includes a symbol determination program. The symbol determination program is a program for determining symbols to be rearranged in the display blocks 1028.

Further, the card slot 1055 is configured so that the memory card 1054 can be inserted thereinto and removed therefrom, and is connected to a motherboard 1070 by an IDE bus. Accordingly, the type and contents of the game to be played on the slot machine 1010 can be changed by removing the memory card 1054 from the card slot 1055, writing another game program in the memory card 1054, and then inserting the memory card 1054 into the card slot 1055.

The GAL 1056 is a type of PLD (Programmable Logic Device) having a fixed OR array structure. The GAL 1056 is provided with a plurality of input ports and output ports, and predetermined input into the input port causes output of the corresponding data from the output port.

Further, the IC socket 1057 is configured so that the GAL 1056 can be inserted thereinto and removed therefrom, and is connected to the motherboard 1070 by a PCI bus. The contents of the game to be played on the slot machine 1010 can be changed by replacing the memory card 1054 with another memory card 1054 having another program written therein or by rewriting the program written on the memory card 1054 into another program.

The CPU 1051, the ROM 1052 and the boot ROM 1053 mutually connected by the internal bus are connected to the motherboard 1070 by a PCI bus. The PCI bus enables a signal transmission between the motherboard 1070 and the gaming board 1050, and power supply from the motherboard 1070 to the gaming board 1050.

The ROM 1052 stores an authentication program. The boot ROM 1053 stores a pre-authentication program, a program (boot code) to be used by the CPU 1051 for activating the pre-authentication program, and the like.

The authentication program is a program (tamper check program) for authenticating the game program and the game system program. The pre-authentication program is a program for authenticating the aforementioned authentication program. The authentication program and the pre-authentication program are written along a procedure (authentication procedure) for proving that the program to be the subject has not been tampered.

The motherboard 1070, which is configured with a general-purpose mother board commercially available (a printed circuit board on which basic parts of a personal computer are mounted), includes a main CPU 1071, a ROM (Read Only Memory) 1072, a RAM (Random Access Memory) 1073, and a communication interface 1082. The motherboard 1070 corresponds to the controller 1100 of this embodiment.

The ROM 1072 includes a memory device such as a flash memory, and stores a program such as BIOS (Basic Input/Output System) to be executed by the main CPU 1071, and permanent data. When the BIOS is executed by the main CPU 1071, processing for initializing predetermined peripheral devices is conducted; further, through the gaming board 1050, processing of loading the game program and the game system program stored in the memory card 1054 is started. In the present invention, the ROM 1072 may be either rewritable or non-rewritable.

The RAM 1073 stores data which are used in operation of the main CPU 1071 and programs such as the symbol determination program. For example, when the processing of loading the aforementioned game program, game system program or authentication program is conducted, the RAM 1073 can store the program. The RAM 1073 is provided with working areas used for operations in execution of these programs. Examples of the areas include: an area that stores a counter for managing the number of games, the number of BETs, the number of payouts, the number of credits and the like; and an area that stores symbols (code numbers) determined by a lottery.

The communication interface 1082 is for controlling transmission and reception of data to and from the PTS terminal 1700. Further, the motherboard 1070 is connected with a later-described door PCB (Printed Circuit Board) 1090 and a body PCB 1110 by respective USBs. The motherboard 1070 is also connected with a power supply unit 1081.

When power is supplied from the power supply unit 1081 to the motherboard 1070, the main CPU 1071 of the motherboard 1070 is activated, and then power is supplied to the gaming board 1050 through the PCI bus so as to activate the CPU 1051.

The door PCB 1090 and the body PCB 1110 are connected with input devices such as a switch and a sensor, and peripheral devices the operations of which are controlled by the main CPU 1071.

The door PCB 1090 is connected with the control panel 1030 and a cold cathode tube 1093.

The control panel 1030 is provided with a spin switch 1031S, a change switch 1032S, a cashout switch 1033S, al-BET switch 1034S, and a MAX-BET switch 1035S, which correspond to the above-mentioned buttons, respectively. Each of the switches detects the corresponding button being pressed by the player, and outputs a signal to the main CPU 1071.

The cold cathode tube 1093 functions as a backlight installed on the rear face side of the upper image display panel 1131 and the lower image display panel 1141, and lights up based on a control signal outputted from the main CPU 1071.

The body PCB 1110 is connected with the lamp 1111, the speakers 1112, the touch panel 1069, and a graphic board 1130. The bill discriminator 1022, though connected to the PTS terminal 1700 in this example, may be connected to the slot machine 1010.

The lamp 1111 lights up based on a control signal outputted from the main CPU 1071. The speakers 1112 output sounds such as BGM, based on a control signal outputted from the main CPU 1071.

The touch panel 1069 detects a place on the lower image display panel 1141 touched by the player's finger or the like, and outputs to the main CPU 1071 a signal corresponding to the detected place.

The bill discriminator 1022 identifies whether or not a bill is proper, and receives a genuine bill into the cabinet 1011. The bill received into the cabinet 1011 is converted into a credit, and this credit is added to the credit owned by the player.

The graphic board 1130 controls display of images conducted respectively by the upper image display panel 1131 and the lower image display panel 1141, based on a control signal outputted from the main CPU 1071. The graphic board 1130 is provided with a VDP (Video Display Processor) for generating image data, a video RAM for storing the image data generated by the VDP, and the like. It is to be noted that the image data used for generation of image data by the VDP is included in the game program that has been read from the memory card 1054 and stored into the RAM 1073.

The graphic board 1130 is provided with a VDP (Video Display Processor) for generating image data based on a control signal outputted from the main CPU 1071, a video RAM for temporarily storing the image data generated by the VDP. It is to be noted that the image data used for generation of image data by the VDP is included in the game program that has been read from the memory card 1054 and stored into the RAM 1073.

[Circuit Configuration of PTS Terminal]

Figure 10:
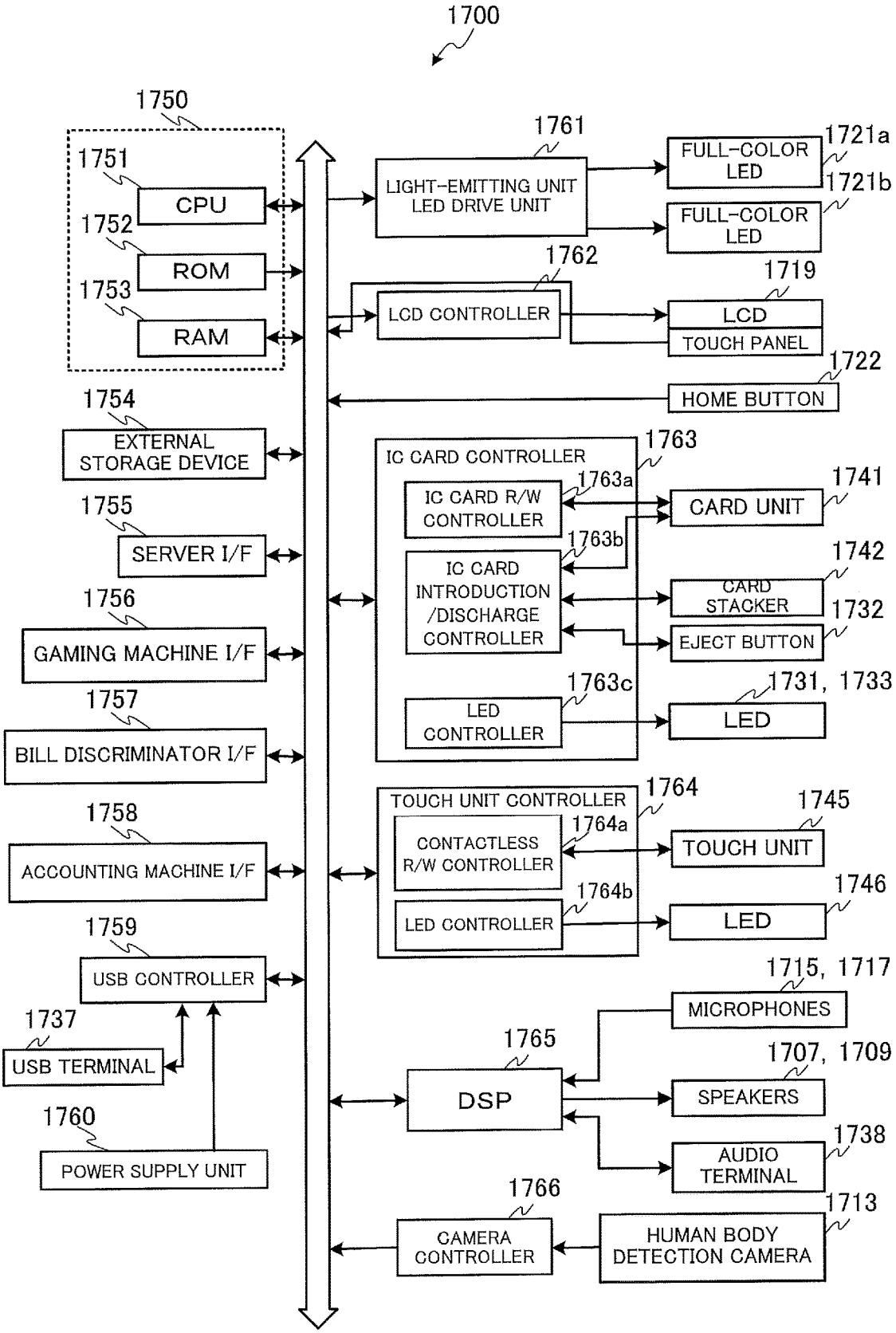
FIG. 10 shows a circuit configuration of the PTS terminal according to the embodiment of the present invention.

Next, a configuration of a circuit included in the PTS terminal 1700 is described with reference to FIG. 10.

A PTS controller 1750 that controls the PTS terminal 1700 includes a CPU 1751, a ROM 1752, and a RAM 1753.

The CPU 1751 controls operations of respective parts of the PTS terminal 1700, executes various programs stored in the ROM 1752, and performs calculation. For example, the CPU 1751 executes a credit update program, to update the credit-related data stored in the IC card 1500.

The ROM 1752 includes a memory device such as a flash memory, and stores permanent data to be executed by the CPU 1751. For example, the ROM 1752 can store the credit update program for rewriting the credit-related data stored in the IC card 1500, an interlocking effect control program to be executed in accordance with a request from the bonus server 11, and an announcement program to be executed in accordance with a request (e.g., announcement information) from the hall management server 10.

The RAM 1753 temporarily stores data necessary for executing the various programs stored in the ROM 1752.

An external storage device 1754, which is a storage device such as a hard disk device, stores programs to be executed by the CPU 1751 and data used for the programs to be executed by the CPU 1751.

A server I/F (interface) 1755 implements data communication between the PTS terminal 1700 and servers including the hall management server 10, the bonus server 11, and the like. A gaming machine I/F (interface) 1756 implements data communication between the PTS terminal 1700 and the controller 1100 of the slot machine 1010. For this data communication, a prescribed protocol can be used.

In addition, the PTS terminal 1700 is connected to the bill discriminator 1022 via a bill discriminator I/F (interface) 1757 and to the accounting machine 1868 via an accounting machine I/F (interface) 1758, so that the PTS terminal 1700 can transmit and receive data as need arises.

A USB controller 1759 determines whether or not to supply power from the power supply unit 1760 to the USB terminal 1737, and upon satisfaction of a predetermined condition, allows the USB terminal 1737 to be charged. If the predetermined condition is satisfied, the player is able to charge an electronic device by connecting the electronic device to the USB terminal 1737.

A light-emitting unit LED drive unit 1761 controls the full-color LEDs 1721*a* so as to light up them at predetermined timing and controls the full-color LEDs 1721*b* so as to light up them at predetermined timing in order that the light-emitting plate 1720*a* arranged above the LCD 1719 and the light-emitting plate 1720*b* arranged below the LCD 1719 can emit light, in accordance with an announcement request given from the hall management server 10, an interlocking effect start request given from the bonus server 11, or the like.

An LCD controller 1762 controls the LCD 1719 so as to display the information contributing to anti-addiction, the information about the member, the information directed to the member, and the like; and displays data read by the IC card 1500 or data inputted by the player. The LCD 1719 has a touch panel function, and in response to the player's operating the touch panel, transmits a predetermined signal to the CPU 1751.

The home button 1722, which is provided near the LCD 1719, is a button for shifting a screen displayed on the LCD 1719 into a predetermined superordinate screen. In response to the player's pressing the home button 1722, the player's operation is transmitted to the CPU 1751, and the CPU 1751 transmits a command to the LCD controller 1762, the command instructing the LCD controller 1762 to update the display of the LCD 1719 in accordance with the player's operation.

An IC card controller 1763 controls insertion and discharge of the IC card 1500, writing of credit data, and the like. The IC card controller 1763 includes an IC card R/W (reader/writer) controller 1763*a*, an IC card introduction/discharge controller 1763*b*, and an LED controller 1763*c*.

The IC card R/W controller 1763*a* controls the card unit 1741, to update the credit-related data stored in the IC card 1500. In a case of issuing a new IC card 1500, the IC card R/W controller 1763*a* stores credit-related data corresponding to the payback amount into the new IC card 1500. The card unit 1741 includes an antenna for reading or writing data from or to the IC card 1500 by NFC or the like.

The card unit 1741 has a function as an IC card reader for reading information stored in the IC card 1500 and a function as an IC card writer for writing information into the IC card 1500, but either one of the functions may be provided as appropriate.

The IC card introduction/discharge controller 1763*b* controls introduction and discharge of the IC card 1500. After the player inserts the IC card 1500 into the card slot 1730, the IC card introduction/discharge controller 1763*b* performs a control of keeping the IC card held in the card unit 1741 while the player is playing. The IC card introduction/discharge controller 1763*b* also performs a control of discharging the IC card 1500 after the credit-related data is written into the IC card 1500 at a time of payback. The IC card introduction/discharge controller 1763*b* also discharges the IC card 1500 in response to the eject button 1732 being pressed.

In a case of issuing a new IC card 1500, a new IC card 1500 is taken out from the card stacker 1742 and fed to the card unit 1741 so that credit-related data can be stored in the IC card 1500.

The LED controller 1763*c* performs a control of lighting up the LED (full-color LED 1731) provided near the card slot 1730 of the card unit 1741, and also performs a control of lighting up the LED (red LED 1733) provided near the eject button 1732.

The touch unit controller 1764 controls transmission and reception of data involved in touch operations using the IC card 1500, a mobile phone, a smart phone, or the like. The touch unit controller 1764 includes a contactless R/W (reader/writer) controller 1764*a* and an LED controller 1764*b*.

The contactless R/W controller 1764*a* determines whether or not the IC card 1500 or a mobile phone is within a predetermined distance from the touch unit 1745 (for example, a touch operation is made), and if it is within the predetermined distance, obtains a reading result or the like from the touch unit 1745. The touch unit 1745 includes an antenna for transmitting and receiving data to and from the IC card 1500 or the mobile phone by NFC or the like.

The touch unit 1745 has a function as an IC card reader for reading information stored in the IC card 1500 or the mobile phone and a function as a IC card writer for writing information into the IC card 1500 or the mobile phone, but either one of the functions may be provided as appropriate.

The LED controller 1764*b* controls the LEDs 1746 arranged at the four corners of the front face of the touch unit 1745, and lights up the LEDs 1746 at predetermined timing.

A DSP 1765 receives voice data obtained from the microphones 1715 and 1717, performs predetermined voice processing, and then transmits the resultant data to the CPU 1751. The DSP 1765 also transmits the received voice data to the speakers 1707 and 1709. The DSP 1765 also outputs a received voice to the headphones via the audio terminal having the headset connected thereto, and processes a voice received from the microphone to transmit the processed voice to the CPU 1751. It is to be noted that merely an outline configuration is illustrated herein with an A/D converter, a D/A converter, an amplifier, and the like, being omitted.

A camera controller 1766 obtains an image of the player or the like captured by the human body detection camera 1713, performs predetermined image processing as appropriate, and transmits the resultant data to the CPU 1751. The data is, for example, transmitted to the hall management server 10, the member management server 13, or the like, via a server I/F 1755.

The camera controller 1766 also transmits image information of an image captured by the human body detection camera 1713 to the hall management server 10 or the like in accordance with an instruction from the hall management server 10.

[Configuration of Symbol Combination Table]

Next, a symbol combination table is described with reference to FIG. 11.

The symbol combination table specifies combinations of drawn symbols relating to winning, and the number of payouts. In the slot machine 1010, the scrolling of symbol arrays of the pseudo reels 1151 to 1155 (first to fifth video reels) in the five columns is stopped, and winning is established when a combination of symbols displayed on a winning line matches one of the combinations of symbols specified by the symbol combination table. According to the winning combination, a benefit such as a payout of the credit is offered to the player. It is to be noted that winning is not established (i.e. the game is lost) when the combination of symbols displayed on the winning line does not match any of the combinations of symbols specified by the symbol combination table.

Basically, winning is established when all the symbols forming "RED", "APPLE", "BLUE 7", "BELL", "CHERRY", "STRAWBERRY", "PLUM", or "ORANGE" are displayed on the winning line by the pseudo reels 1151 to 1155 in the five columns. However, with respect to the symbols forming "CHERRY" or "ORANGE", winning is also established when one or three of the symbols is/are displayed on the winning line by the corresponding one or three pseudo reels.

For example, if all the symbols forming "BLUE 7" are displayed on the winning line by the pseudo reels 1151 to 1155 in the five columns, the winning combination is "BLUE" and it is determined that the number of payouts is "10". Based on the number of payouts thus determined, the credit is paid out. The payout of the credit is implemented by, for example, storing the credit obtained by addition into the IC card 1500 and then discharging the IC card 1500 through the card slot 1730.

[Contents of Programs Executed in Slot Machine]

Next, programs executed by the slot machine 1010 are described with reference to FIGS. 12 to 16. The slot machine 1010 transmits various game information to the hall management server 10 at any appropriate timing.

<Main Control Process>

Figure 12:
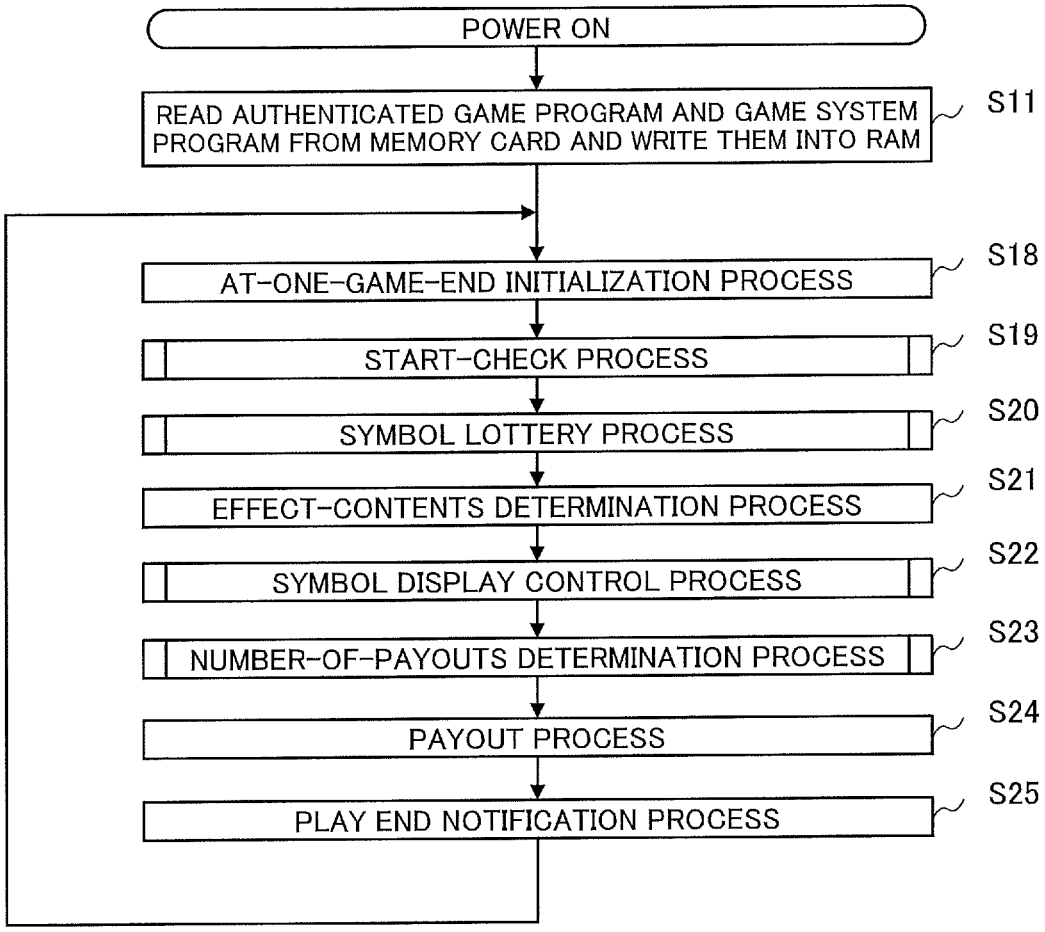
FIG. 12 is a flowchart illustrating steps of a main control process of the slot machine according to the embodiment of the present invention.

A main control process is described with reference to FIG. 12. First, when the slot machine 1010 is powered on, the main CPU 1071 reads the authenticated game program and game system program from the memory card 1054 through the gaming board 1050, and writes the programs into the RAM 1073 (step (hereinafter abbreviated as "S") 11).

Next, the main CPU 1071 conducts an at-one-game-end initialization process (S18). For example, data that becomes unnecessary after each game in the working areas of the RAM 1073, such as the number of BETs and the symbols determined by lottery, is cleared.

Then, the main CPU 1071 conducts a start-check process which will be described later (S19). In this process, inputs from the BET switch and the spin switch are checked, for example.

The main CPU 1071 then conducts a symbol lottery process which will be described later (S20). In this process, to-be stopped symbols are determined based on random values for symbol determination.

Then, the main CPU 1071 conducts an effect-contents determination process (S21). The main CPU 1071 extracts a random value for effect, and determines by lottery any of a plurality of effect contents that are preset. The effect content can be determined in accordance with the winning combination and the playing status on the slot machine 1010. In a possible configuration, for example, the probability of winning the lottery for each effect varies in accordance with the winning combination and the playing status on the slot machine 1010.

The main CPU 1071 then conducts a symbol display control process which will be described later (S22). In this process, scrolling of the pseudo reels 1151 to 1155 in the five columns (first to fifth video reels) is started, and each of the to-be stopped symbols determined in the symbol lottery processing of S20 is stopped at a predetermined position (e.g., in the display window 1150 of the lower image display panel 1141). That is, four symbols including the to-be stopped symbol are displayed in the display window 1150 with respect to each reel. For example, when the to-be stopped symbol is the symbol associated with the code number "10" and it is to be displayed in an upper region, the symbols associated with the code numbers "11", "12" and "13" are to be displayed in an upper central region, a lower central region and a lower region of the display window 1150, respectively.

Next, the main CPU 1071 conducts a number-of-payouts determination process which will be described later (S23). In this process, the number of payouts is determined based on the combination of symbols displayed on the winning line, and is stored into a number-of-payouts counter provided in the RAM 1073.

Then, the main CPU 1071 conducts a payout process (S24). The main CPU 1071 adds the value stored in the number-of-payouts counter to the value stored in a number-of-credits counter provided in the RAM 1073. If, for example, the player presses a cashout button at this time, the cashout switch 1033S detects the pressing and outputs a signal to the main CPU 1071, so that the number of credits stored in the IC card 1500 received in the card unit 1741 is updated with the value stored in the number-of-credits counter.

Then, the main CPU 1071 conducts a play end notification process (S25). In this process, the main CPU 1071 transmits to the PTS terminal 1700 data indicating the end of one play (data including play ending time/date data by which a time and date of ending the play can be identified) (together with, for example, the identification code of the IC card 1500, in a case where the IC card 1500, etc., is inserted so that the player can be identified). The PTS terminal 1700 transmits this data to the hall management server 10, and the hall management server 10 stores this data. In accordance with this data, the bonus server 11 holds a bonus game lottery. After the processing of S25 ends, the process returns to S18, to repeat the unit game.

<Start-Check Process>

Figure 13:
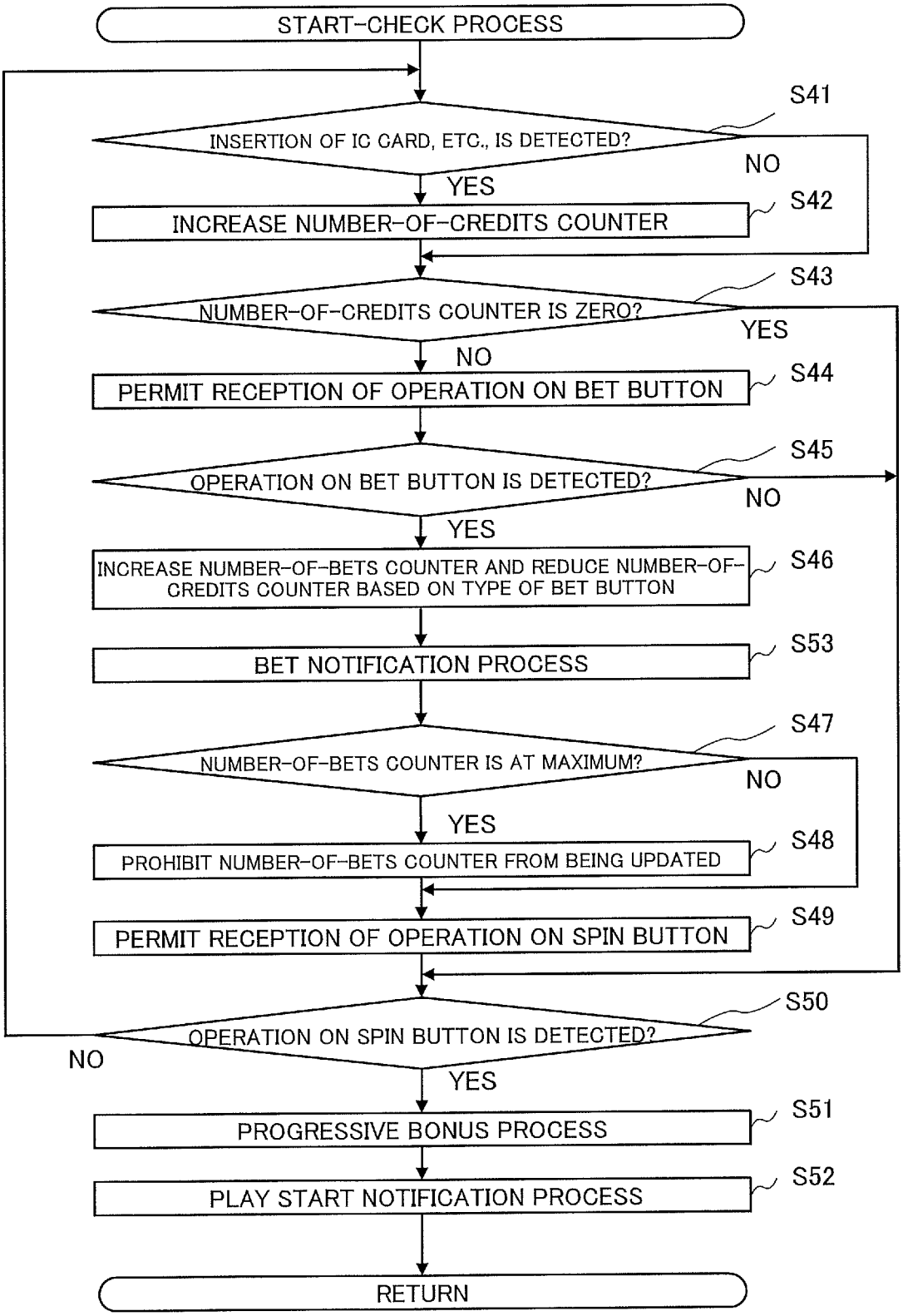
FIG. 13 is a flowchart illustrating steps of a coin-insertion/start-check process of the slot machine according to the embodiment of the present invention.

Next, a start-check process is described with reference to FIG. 13. First, the main CPU 1071 determines whether or not insertion of the IC card 1500, etc., has been detected (S41). Upon determination that the insertion of the IC card 1500, etc., has been detected, the main CPU 1071 makes an addition to the value stored in the number-of-credits counter (S42). In addition, the main CPU 1071 determines whether or not insertion of a bill has been detected by the bill discriminator 1022 as well as the insertion of the IC card 1500, etc., and upon determination that the insertion of a bill has been detected, the main CPU 1071 adds a value equivalent to the bill to the value stored in the number-of-credits counter.

After S42 or upon determining in S41 that insertion of the IC card 1500, etc., has not been detected, the main CPU 1071 determines whether or not the value stored in the number-of-credits counter is zero (S43). When the main CPU 1071 determines that the value stored in the number-of-credits counter is not zero, the main CPU 1071 permits an operation on the BET buttons to be received (S44).

Next, the main CPU 1071 determines whether or not an operation on any of the BET buttons is detected (S45). Upon determination that the BET switch has been detected pressing of the BET button by the game player, the main CPU 1071 makes an addition to the value stored in a number-of-BETs counter provided in the RAM 1073 and makes a subtraction from the value stored in the number-of-credits counter, based on the type of the BET button (S46).

Then, the main CPU 1071 conducts a BET notification process (S53). In this process, the main CPU 1071 transmits to the PTS terminal 1700 data (the number of BETs, the BET amount, or the like) indicating the amount to be bet on one play. The PTS terminal 1700 transmits this data to the hall management server 10, and the hall management server 10 stores this data (the storing may be either overwriting or adding). The BET notification process may not always have to be conducted after the processing of S46, and may be conducted at any appropriate timing after an operation on the BET button is detected.

Then, the main CPU 1071 determines whether or not the number-of-BETs counter is at its maximum (S47). Upon determination that the number-of-BETs counter is at its maximum, the main CPU 1071 prohibits the number-of-BETs counter from being updated (S48). After S48 or upon determining in S47 that the number-of-BETs counter is not at its maximum, the main CPU 1071 permits an operation on the spin button to be received (S49).

After S49, or upon determining in S45 that the operation on any of the BET buttons is not detected or in S43 that the value stored in the number-of-credits counter is zero; the main CPU 1071 determines whether or not an operation on the spin button is detected (S50). Upon determination that an operation on the spin button is not detected, the main CPU 1071 proceeds to the processing of S41.

Upon determination that an operation on the spin button is detected, the main CPU 1071 conducts a progressive bonus process. In this process, the credit that has been bet is partially paid to the bonus server 11 via the PTS terminal 1700, as a credit to be accumulated for a progressive bonus, for example (S51).

Then, the main CPU 1071 conducts a play start notification process (S52). In this process, the main CPU 1071 transmits to the PTS terminal 1700 a play start notification indicating the start of one play (data including play starting time/date data by which a time and date of starting the play can be identified) (together with, for example, the identification code of the IC card 1500, in a case where the IC card 1500, etc., is inserted so that the player can be identified). The PTS terminal 1700 transmits this data to the hall management server 10, and the hall management server 10 stores this data. In accordance with this data, the bonus server 11 holds a bonus game lottery. After the processing of S52 ends, the start-check process is terminated.

<Symbol Lottery Process>

Figure 14:
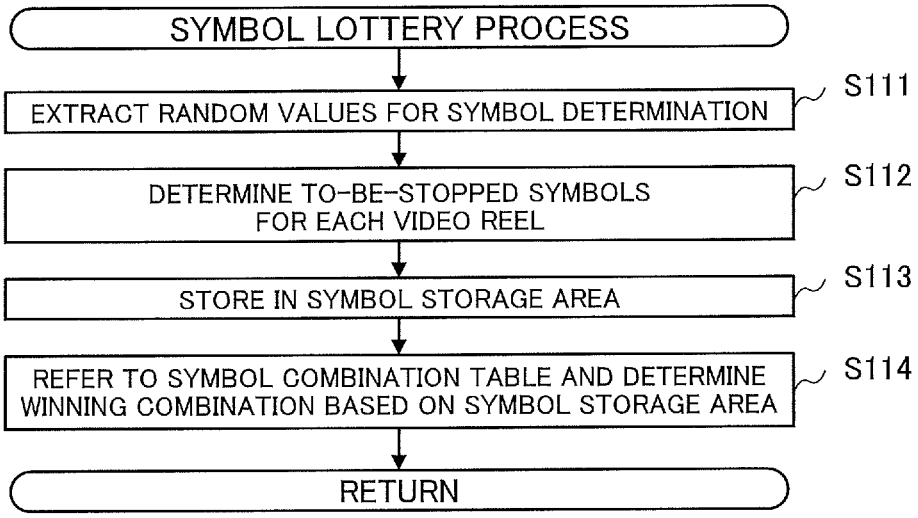
FIG. 14 is a flowchart illustrating steps of a symbol lottery process of the slot machine according to the embodiment of the present invention.

Next, a symbol lottery process is described with reference to FIG. 14. First, the main CPU 1071 extracts random values for symbol determination (S111). The main CPU 1071 then determines to-be stopped symbols for the pseudo reels 1151 to 1155 in the five columns (first to fifth video reels), by lottery (S112). The main CPU 1071 holds a lottery for each video reel, and determines any one of 22 symbols (code numbers from "00" to "21") as a to-be stopped symbol. At this time, each of the 22 symbols (code numbers from "00" to "21") is determined at an equal probability (i.e. 1/22).

The main CPU 1071 then stores the determined to-be stopped symbols for the respective video reels into a symbol storage area provided in the RAM 1073 (S113). Next, the main CPU 1071 references the symbol combination table (FIG. 11) and determines a winning combination based on the symbol storage area (S114). The main CPU 1071 determines whether or not the combination of symbols to be displayed on the winning line by the respective video reels matches any of the combinations of symbols specified by the symbol combination table, and determines the winning combination. Upon completion of this processing, the symbol lottery process ends.

<Symbol Display Control Process>

Figure 15:
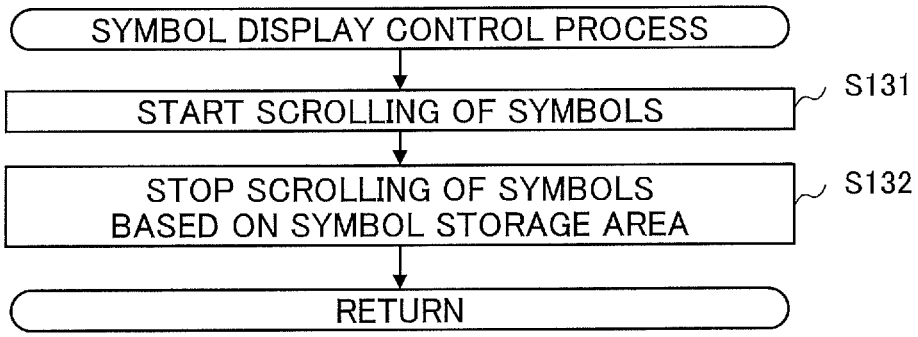
FIG. 15 is a flowchart illustrating steps of a symbol display control process of the slot machine according to the embodiment of the present invention.

Next, a symbol display control process is described with reference to FIG. 15. First, the main CPU 1071 starts scrolling of the symbol arrays of the respective video reels that are displayed in the display window 1150 of the lower image display panel 1141 (S131). The main CPU 1071 then stops the scrolling of the symbol arrays of the respective video reels, based on the aforementioned symbol storage area (S132). Upon completion of this processing, the symbol display control process ends.

The effect determined in the effect-contents determination process (FIG. 12) is produced in time with the timing when the scrolling of the symbol arrays is started and stopped in the symbol display control process or another timing. This effect can be produced by, for example, displaying a moving image or a still image on the upper image display panel 1131 of the slot machine 1010 and, in synchronization with this, outputting a voice from the speakers 1112 as well as lighting up the lamp 1111.

<Number-of-Payouts Determination Process>

Figure 16:
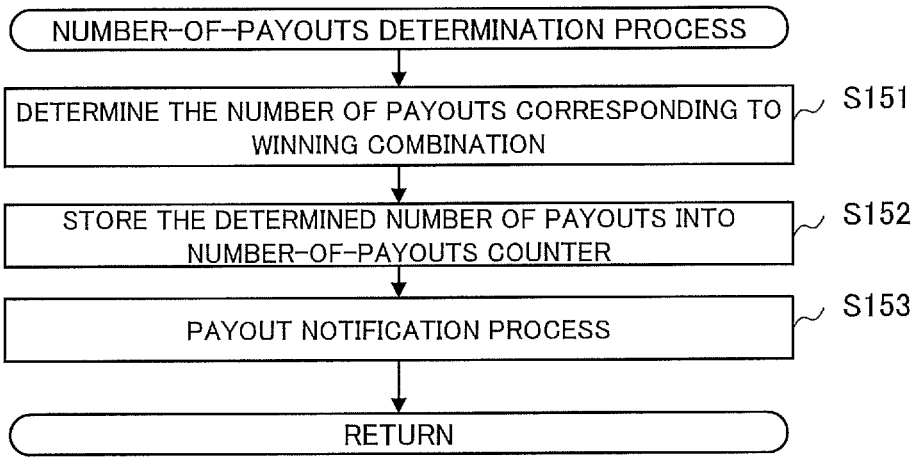
FIG. 16 is a flowchart illustrating steps of a number-of-payouts determination process of the slot machine according to the embodiment of the present invention.

Next, a number-of-payouts determination process is described with reference to FIG. 16. First, the main CPU 1071 determines the number of payouts corresponding to a combination of symbols (winning combination) stopped (S151). For example, in a case of the winning combination of "BELL", it is determined that the number of payouts is "8" (see FIG. 11). In a case of losing, it is determined that the number of payouts is "0".

Then, the main CPU 1071 stores the determined number of payouts into the number-of-payouts counter (S152).

Then, the main CPU 1071 conducts a payout notification process (S153). In the payout notification process, the main CPU 1071 transmits data (the number of payouts, the payout amount, etc.) indicating a benefit obtained in one play to the PTS terminal 1700. The PTS terminal 1700 transmits this data to the hall management server 10, and the hall management server 10 stores this data. Upon completion of this processing, the number-of-payouts determination process ends.

If the bonus game lottery held by the bonus server 11 is won, the interlocking effect is produced by the PTS terminals 1700 of the plurality of slot machines 1010 including the winning slot machine 1010, and concurrently the bonus server 11 pays out a bonus. This bonus is added to the number-of-payouts counter, for example.

[Configuration of Signage]

Figure 17:
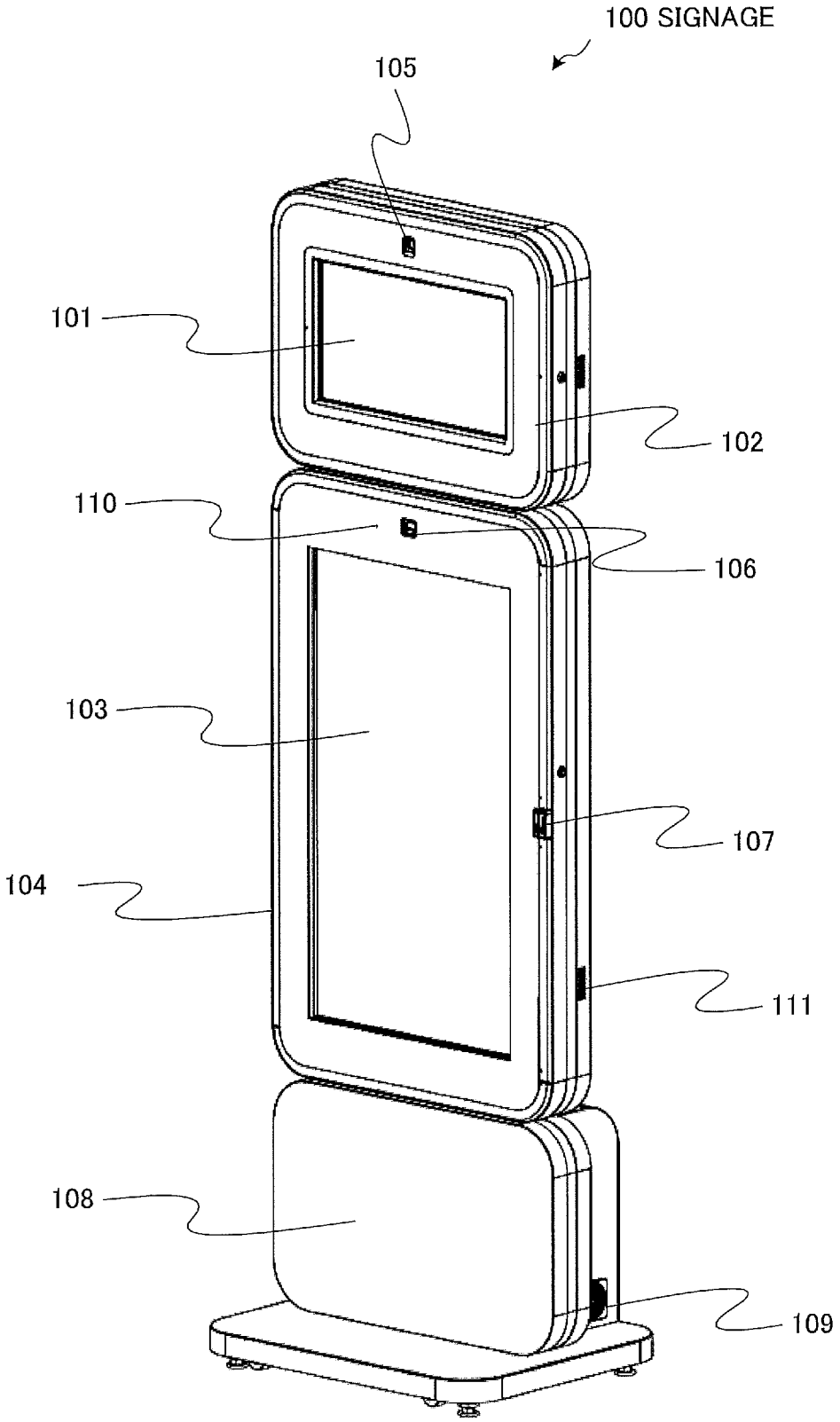
FIG. 17 shows an overall structure of a signage according to the embodiment of the present invention.

FIG. 17 shows a signage 100 adopted in the game system 1 according to the embodiment of the present invention. The signage 100 is an information display apparatus used mainly to display a store advertisement (including a billboard), a hall floor guide, and the like. The signage 100 is connectable to the server of the game system 1 (e.g., to the bonus server 11 or the member management server 13) via a network.

The signage 100 includes an LCD 101 and an LCD 103 with a touch panel function. The LCD 101 is a liquid crystal display device of 24 inches (about 60.96 cm), for example. The LCD 103 is a liquid crystal display device of 46 inches (about 116.84 cm), for example. As mentioned above, these LCDs display an allowance amount input screen which will be described later, advertisement information, guidance information, and the like. The touch panel function of the LCD 103 is implemented by, for example, a touch panel having an infrared scheme. While the LCD 103 is provided with the touch panel function in this example, another input device such as a keyboard or a mouse may also be used to input instructions.

Each of the LCD 101 and the LCD 103 is housed in a cabinet. Effect LEDs 102 and 104, which are for effect purposes, are provided in peripheral portions of front faces of the respective cabinets. The effect LEDs 102 and 104 are, for example, LED lights arranged on tapes.

The signage 100 further includes motion sensors 105 and 106 provided in the cabinets of the LCD 101 and the LCD 103, respectively. For example, the motion sensors 105 and 106 are cameras. Video images captured by the motion sensors 105 and 106 are used to analyze behaviors of a user using the signage 100 or a customer passing through a passage.

The signage 100 is also provided with a touch unit 107 including an RFID module capable of data communication with a mobile phone or a smart phone having a communication function using a contactless IC card or NFC. A member is able to login by placing a member card (IC card) associated with the member over the touch unit 107, so that the LCD 101 or the LCD 103 displays a member menu screen and information concerning the member. The information concerning the member is, for example, obtained from the member management server 13.

A hall staff is able to login by placing a staff IC card, so that the LCD 101 or the LCD 103 displays a staff menu screen, and the like.

Unlike the PTS terminal 1700, the signage 100 does not include any card unit capable of holding the IC card 1500. The signage 100 includes the touch unit 107 alone. The signage 100 is configured such that the information concerning the member, which has been displayed on the LCD 103 or the like by the user's touching with the IC card, is hidden upon elapse of a predetermined period so that logoff of the user is automatically made even though the user leaves the signage 100 without logging off.

The signage 100 further includes a microphone 133 for obtaining a voice, which is provided in the cabinet of the LCD 103. The cabinet of the LCD 103 has a microphone opening 110 at a position corresponding to the microphone. In FIG. 17, the microphone opening 110 is shown at a side of the motion sensor 106.

The signage 100 also includes speakers 134 and 135 for outputting a voice, which are provided in the cabinet of the LCD 103. The cabinet of the LCD 103 has speaker ducts at positions corresponding to the speakers, respectively. In FIG. 17, a speaker duct 111 corresponding to one of the speakers is shown.

In addition, the signage 100 includes a base unit 108 that supports the cabinets of the LCD 101 and the LCD 103, and a control unit 109 provided therein with a controller that controls the LCDs, the LEDs, and the like.

[Circuit Configuration of Signage]

Figure 18:
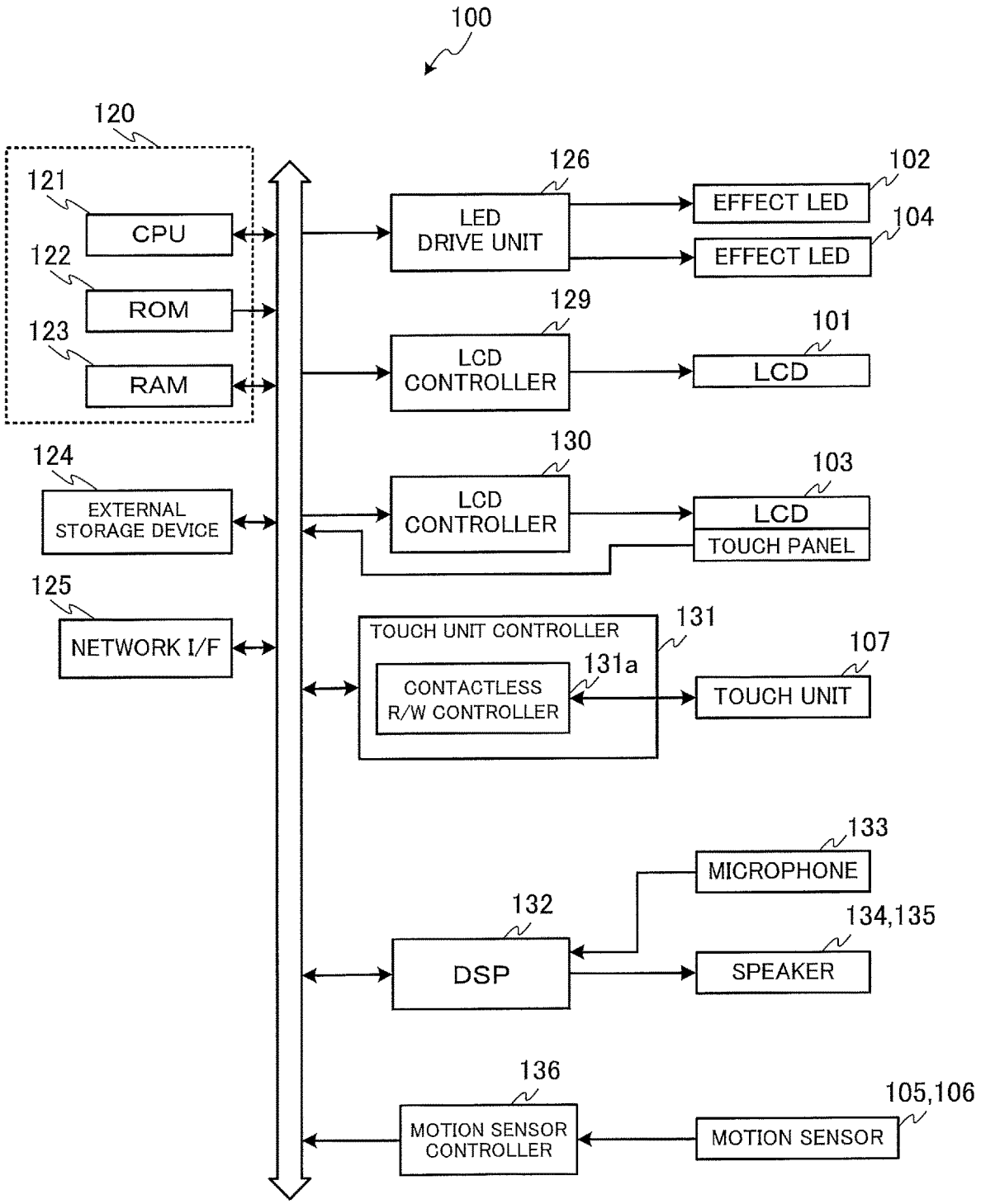
FIG. 18 shows a circuit configuration of the signage according to the embodiment of the present invention.

Next, a configuration of a circuit included in the signage 100 is described with reference to FIG. 18.

A signage controller 120 that controls the signage 100 includes a CPU 121, a ROM 122, and a RAM 123.

The CPU 121 controls operations of respective parts of the signage, executes various programs stored in the ROM 122, and performs calculation.

The ROM 122 includes a memory device such as a flash memory, and stores permanent data to be executed by the CPU 121. For example, the ROM 122 can store a program related to input of the allowance amount, an interlocking effect control program to be executed in accordance with a request from the bonus server 11, and the like.

The RAM 123 temporarily stores data necessary for executing the various programs stored in the ROM 122.

An external storage device 124, which is a storage device such as a hard disk device, stores programs to be executed by the CPU 121 and data used for the programs to be executed by the CPU 121.

A network I/F (interface) 125 implements data communication with the PTS terminal 1700 and servers including the hall management server 10, the bonus server 11, the member management server 13, and the like.

An LED drive unit 126 controls the effect LEDs 102 and 104 so as to light up them at predetermined timing in accordance with an interlocking effect start request given from the bonus server 11. The LED drive unit 126 may also be operable to make the effect LEDs 102 and 104 emit light in synchronization with displaying the advertisement information, displaying the guidance information, displaying the member information based on a member's operation, and the like.

An LCD controller 129 controls the LCD 101 so as to display the allowance amount input screen which will be described later, and information such as the advertisement information.

An LCD controller 130 controls the LCD 103 so as to display the allowance amount input screen which will be described later, and information such as the advertisement information. The LCD 103 has a touch panel function to transmit a user operation to the CPU 121.

A touch unit controller 131 controls transmission and reception of data involved in touch operations on the touch unit 107 with an IC card or a mobile phone. The touch unit controller 131 includes a contactless R/W (reader/writer) controller 131*a*.

A contactless R/W controller 131*a* determines whether or not a touch operation with an IC card or a mobile phone is made on the touch unit 107, and if a touch operation is made, obtains a reading result from the touch unit 107, for example. The touch unit 107 includes an antenna for transmitting and receiving data to and from the IC card or the mobile phone by NFC or the like.

Upon receiving an identification code of the member card (IC card) from the touch unit 107, the CPU 121 obtains member information associated with the identification code from the member management server 13, and displays the information on the LCD 101 or the LCD 103. The CPU 121 can also make the LCD 103 display an operation menu for the member, or make the LCD 101 or the LCD 103 display advertisement information appropriate for the member.

A DSP 132 receives voice data obtained from the microphone 133, performs predetermined processing thereon, and then transmits the resultant data to the CPU 121. The DSP 132 transmits the received voice data to the speakers 134 and 135, for outputting.

A motion sensor controller 136 receives an image of a user or the like from the motion sensors (e.g., cameras) 105 and 106, performs predetermined image processing thereon as appropriate, and transmits the resultant data to the CPU 121.

The motion sensor controller 136 is operable to receive image information from the motion sensors 105 and 106, and transmit the image information to the hall management server 10 in accordance with an acquisition request given from the hall management server 10.

[Configuration of Kiosk Terminal]

Figure 19:
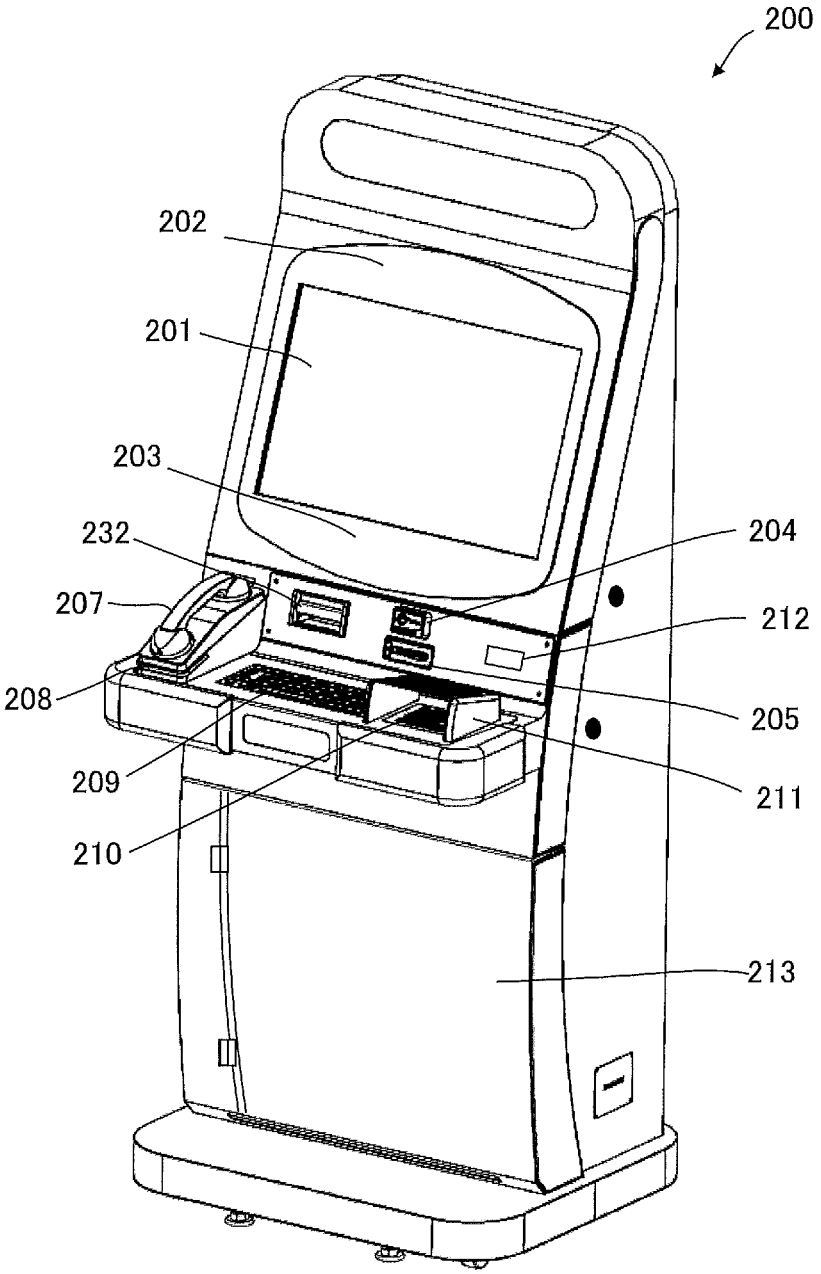
FIG. 19 shows an overall structure of a kiosk terminal according to the embodiment of the present invention.

FIG. 19 shows a kiosk terminal 200 adopted in the game system 1 according to the embodiment of the present invention. The kiosk terminal 200 is an information display apparatus used mainly to display information concerning the plays made in the hall, such as start of the bonus game in the bonus server 11, countdown to the start, today's winning ranking, machine popularity ranking, and the like. The kiosk terminal 200 is connectable to the server of the game system 1 (e.g., to the hall management server 10, the bonus server 11, or the member management server 13) via a network.

The kiosk terminal 200 includes an LCD 201 with a touch panel function. The LCD 201 is a liquid crystal display device of 24 inches (about 60.96 cm), for example. As mentioned above, this LCD displays the allowance amount input screen which will be described later, the information concerning the plays made in the hall, and the like. While the LCD 201 is provided with the touch panel function in this example, another input device such as a keyboard or a mouse may also be used to input instructions.

The kiosk terminal 200 includes motion sensors 202 and 203 provided above and below the LCD 201, respectively. For example, the motion sensors 202 and 203 are cameras. Video images captured by the motion sensors 202 and 203 are used to analyze behaviors of a user using the kiosk terminal 200 or a customer passing through a passage.

The kiosk terminal 200 is also provided with a touch unit 204 including an RFID module capable of data communication with a mobile phone or a smart phone having a communication function using a contactless IC card or NFC. A member is able to login by placing a member card (IC card) associated with the member over the touch unit 204, so that the LCD 201 displays a member menu screen and information concerning the member. The information concerning the member is, for example, obtained from the member management server 13. In addition to the touch unit 204 or instead of the touch unit 204, an information recording medium reading apparatus may be provided for reading information stored in an information recording medium as exemplified by a magnetic card. In such a configuration, a magnetic card instead of the IC card 1500 can be used as the member card.

A hall staff is able to login by placing a staff IC card, so that the LCD 201 displays a staff menu screen, and the like.

Figure 20:
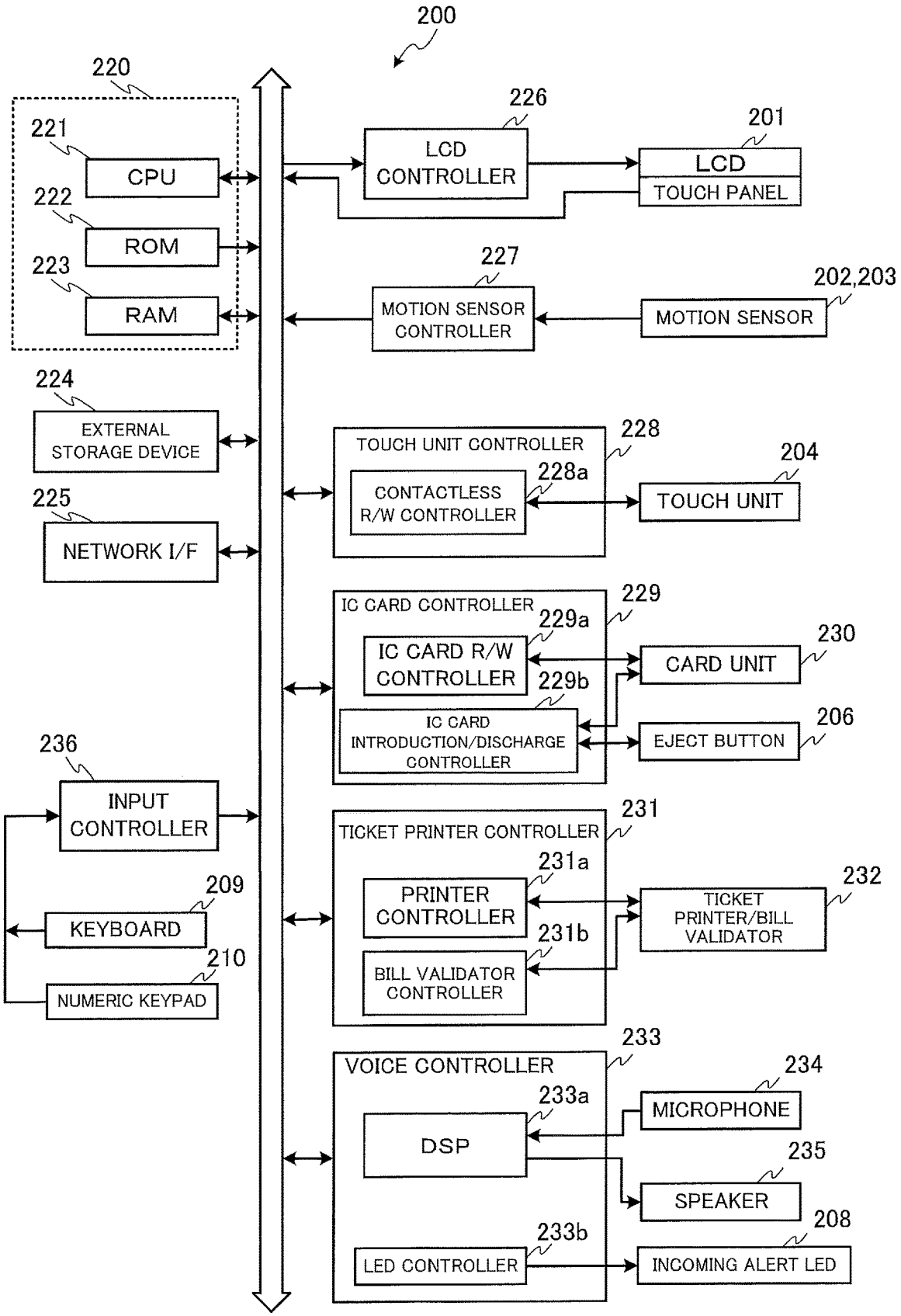
FIG. 20 shows a circuit configuration of the kiosk terminal according to the embodiment of the present invention.

The kiosk terminal 200 is also provided with a card slot 205 through which the IC card 1500 can be inserted or removed. The card slot 205 has an eject button 206 (FIG. 20). A card unit 230 is provided within a kiosk housing at a position corresponding to the card slot 205. The card slot 205 is configured as a part of the card unit 230.

Insertion of the member card into the card slot 205 allows the LCD 201 to display the member menu screen or the information concerning the member. The card unit 230 is operable to issue and collect limited cards and reward cards.

The kiosk terminal 200 includes a ticket printer 232. The ticket printer 232 is operable to issue and collect tickets and coupons, and may be provided with a function as a bill discriminator.

The kiosk terminal 200 includes a phone receiver 207 used for a VoIP conversation. A user using the kiosk terminal 200 is able to talk with a user using another kiosk terminal 200 or a player playing on a gaming machine via the phone receiver 207. A control is performed so as to make an incoming alert LED 208 emit light upon arrival of an incoming VoIP call.

The kiosk terminal 200 includes a keyboard 209 and a numeric keypad 210 that the user uses to input data (for setting the allowance amount, making membership registration, and making text chatting), and also includes LED plates 211 for privacy protection arranged at opposite sides of the numeric keypad 210.

The kiosk terminal 200 includes a QR code scanner 212 for reading a QR code (registered trademark), which is operable to read a QR code attached to a mail addressed to a mobile phone or the like.

In addition, the kiosk terminal 200 includes a storage 213 that stores therein a controller for controlling the LCD, the LED, and the like.

[Circuit Configuration of Kiosk Terminal]

Next, a configuration of a circuit included in the kiosk terminal 200 is described with reference to FIG. 20.

A kiosk terminal controller 220 that controls the kiosk terminal 200 includes a CPU 221, a ROM 222, and a RAM 223.

The CPU 221 controls operations of respective parts of the kiosk terminal, executes various programs stored in the ROM 222, and performs calculation.

The ROM 222 includes a memory device such as a flash memory, and stores permanent data to be executed by the CPU 221. For example, the ROM 222 can store a program related to input of the allowance amount, a VoIP conversation control program, and the like.

The RAM 223 temporarily stores data necessary for executing the various programs stored in the ROM 222.

An external storage device 224, which is a storage device such as a hard disk device, stores programs to be executed by the CPU 221 and data used for the programs to be executed by the CPU 221.

A network I/F (interface) 225 implements data communication with the PTS terminal 1700 and servers including the hall management server 10, the bonus server 11, the member management server 13, and the like.

The LCD controller 226 controls the LCD 201 so as to display the allowance amount input screen which will be described later, information including play information, and the like. The LCD 201 has a touch panel function to transmit a signal according to a user operation to the CPU 221.

A motion sensor controller 227 receives an image of a user or the like from the motion sensors (e.g., cameras) 202 and 203, performs predetermined image processing thereon as appropriate, and transmits the resultant data to the CPU 221.

The motion sensor controller 227 is operable to receive image information from the motion sensors 202 and 203, and transmit the image information to the hall management server 10 in accordance with an acquisition request given from the hall management server 10.

A touch unit controller 228 controls transmission and reception of data involved in touch operations on the touch unit 204 with an IC card or a mobile phone. The touch unit controller 228 includes a contactless R/W (reader/writer) controller 228*a*.

The contactless R/W controller 228*a* determines whether or not a touch operation with an IC card or a mobile phone is made on the touch unit 204, and if a touch operation is made, obtains a reading result from the touch unit 204, for example. The touch unit 204 includes an antenna for transmitting and receiving data to and from the IC card or the mobile phone by NFC or the like.

An IC card controller 229 controls insertion and discharge of the IC card 1500, reading of data, and the like. The IC card controller 229 includes an IC card R/W (reader/writer) controller 229*a* and an IC card introduction/discharge controller 229*b*.

The IC card R/W controller 229*a* controls the card unit 230 to read the identification code, etc., stored in the IC card 1500. The card unit 230 includes an antenna for writing data into the IC card 1500 by NFC or the like.

The IC card introduction/discharge controller 229*b* controls introduction and discharge of the IC card 1500. After the user inserts the IC card 1500 into the card slot 205, the IC card introduction/discharge controller 229*b* performs a control of keeping the IC card held in the card unit 230 until the user logs off. The IC card introduction/discharge controller 229*b* also discharges the IC card 1500 in response to the eject button 206 being pressed.

A ticket printer controller 231 controls a ticket-printer/bill-validator 232 to issue and collect tickets and coupons, identify bills, and the like. The ticket printer controller 231 includes a printer controller 231*a* and a bill validator controller 231*b*.

A voice controller 233 inputs and outputs voices by using a microphone 234 and a speaker 235 included in the phone receiver 207. The voice controller 233 includes a DSP 233*a* and an LED controller 233*b*. The DSP 233*a* controls a voice input from the microphone 234 and a voice output from the speaker 235 by performing predetermined voice signal processing. The LED controller 233*b* controls the incoming alert LED 208 so as to emit light based on an incoming signal concerning a VoIP conversation or the like.

An input controller 236 converts user's inputs on the keyboard 209 and the numeric keypad 210 into signals, and transmits the signals to the CPU 221.

[Circuit Configuration of Hall Management Server]

Next, a configuration of a circuit included in the hall management server 10 is described with reference to FIG. 21.

A hall management server controller 1400 that controls the hall management server 10 includes a CPU 1401, a ROM 1402, and a RAM 1403.

The CPU 1401 controls operations of respective parts of the hall management server 10, executes various programs stored in the ROM 1402, and performs calculation.

The ROM 1402 includes a memory device such as a flash memory, and stores permanent data to be executed by the CPU 1401. For example, the ROM 1402 can store a program related to the control of the information providing system, and the like.

The RAM 1403 temporarily stores data necessary for executing the various programs stored in the ROM 1402.

An external storage device 1404, which is a storage device such as a hard disk device, stores programs to be executed by the CPU 1401 and data (e.g., tables) used for the programs to be executed by the CPU 1401.

A graphic board 1405 controls an LCD 1408 to display various information.

An input controller 1406 converts inputs from a keyboard 1409 and a mouse 1410 into signals, and transmits the signals to the CPU 1401.

A network I/F (interface) 1407 implements data communication with servers including the member management server 13 and the like, the PTS terminal 1700, the signage 100, the kiosk terminal 200, and a monitoring camera.

[Various Tables]

FIG. 22 exemplifies a player definition table. Index information indicated by the player definition table is stored for each player in the hall management server 10 and the member management server 13. Alternatively, the player definition table may be stored in another server or the like.

More specifically, the member management server 13 registers (stores) information of the player type, the player rank, the gender, the nationality, the ages, the most recent operating day, the member category, the game type, the member user definition, the player name, and the like, and the hall management server 10 obtains necessary information at appropriate timing (in synchronization).

FIG. 23 exemplifies a gaming machine definition table. Index information indicated by the gaming machine definition table is stored for each gaming machine in the hall management server 10. Alternatively, the gaming machine definition table may be stored in another server or the like.

More specifically, the hall management server 10 stores information of the denomination, the theme, the vendor, the location, the set payout rate (%), the most recent operating day, the game type class (game type), the game type class (with or without link), the game type class (with or without progressive), the game type class (display mode), the game type class (the number of reels), the game type class (the number of lines), the game type class (the number of BETs per line), the game type class (bonus feature), the game type class (table type), the game type class, and the like.

FIG. 24 exemplifies a player management table. The player management table is stored in the member management server 13 and the hall management server 10, with synchronization ensured. A configuration may also be acceptable in which the player management table is provided in the member management server 13, the hall management server 10, or another server; and a server including no table obtains data as appropriate.

In the player management table, information including a player name indicating the name of a player, icon data indicating the face of the player, a player rank indicating the rank to which the player belongs, and the like, is stored in association with the player identification code by which the player can be identified.

The player management table is basically updated at a time of membership registration. The player rank is updated by the arcade side. For example, the player management table may be automatically update based on a visiting frequency, a behavior pattern, or the like, or may be updated by an administrator or the like.

FIG. 25 exemplifies an address management table. The address management table is stored in the hall management server 10. A configuration may also be acceptable in which the address management table is provided in the member management server 13, the hall management server 10, or another server; and a server including no table obtains data as appropriate.

In the address management table, an IP address indicating the address of an apparatus on the network, an apparatus identifier indicating the name of an apparatus, object data indicating a thumbnail sample of an apparatus, coordinate data indicating the position of an apparatus on a floor map, and apparatus status information indicating the status of an apparatus, are stored in association with the apparatus identification code by which the apparatus such as a gaming machine can be identified. The stored information is not limited thereto. For example, position data indicating the position of an apparatus on a floor can be adopted instead of the coordinate data.

The address management table is basically updated by the administrator at a time of installation of the apparatus, change of arrangement of the apparatus, removal of the apparatus, or the like. The apparatus status information is updated at appropriate timing based on apparatus status data that is transmitted from each apparatus. Basically, information about the apparatus identification code, the IP address, the apparatus identifier, the object data, and the coordinate data has been initially registered at a time of generation and update of a floor map (e.g., a template in which the apparatus is mapped on a floor layout).

FIG. 26 exemplifies a login/logout management table. The login/logout management table is stored in the hall management server 10. Alternatively, the login/logout management table may be stored in another server or the like.

In the login/logout management table, the apparatus identification code, login time and date, and logout time and date are stored in association with the player identification code.

In an example, the login/logout management table is updated at timing when the player logs in (timing when the IC card 1500 is inserted into the slot machine 1010, the kiosk terminal 200, or the like; or timing when the IC card is placed over the signage 100). In another example, the login/logout management table is updated at timing when the player logs out (timing when the IC card 1500 is removed from the slot machine 1010, the kiosk terminal 200, or the like; or timing when the IC card is placed over the signage 100).

FIG. 27A exemplifies a play history table. The play history table is stored in the hall management server 10. Alternatively, the play history table may be stored in another server or the like.

In the play history table, information including the player identification code indicating the player making plays, a session history number by which a series of plays (sessions) from login to logout can be identified, the number of BETs bet on a single play, the amount consumed in a single play (consumption amount), the amount paid out in a single play (payout amount), the amount indicating a benefit or loss in a single play (benefit amount/loss amount), a play start time/date indicating a time and date of starting a single play, a play end time/date indicating a time and date of ending a single play, a play interval indicating a time period from the end of a previous play to the start of the current play, is stored in association with an identification number (play history number).

The consumption amount is calculated by multiplying the denomination by the number of BETs. The payout amount is calculated by multiplying the denomination by the number of payouts. The benefit amount/loss amount is calculated by subtracting the consumption amount from the payout amount. The play interval is calculated by subtracting the previous play end time/date from the current play start time/date.

The play history table is basically updated at appropriate timing based on the game information that is transmitted from each gaming machine.

FIG. 27B exemplifies a session history table. The session history table is stored in the hall management server 10. Alternatively, the session history table may be stored in another server or the like.

In the session history table, information including the player identification code indicating the player making plays, the apparatus identification code indicating the gaming machine providing the plays, the amount consumed in a single session (total consumption amount), the amount paid out in a single session (total payout amount), the amount indicating a benefit or loss in a single session (total benefit amount/total loss amount), a session start time/date indicating a time and date of starting a single session (a time and date of login), a session end time/date indicating a time and date of ending a single session (a time and date of logout), and the total number of plays indicating the number of plays made in a single session, is stored in association with an identification number (session history number).

The total consumption amount is calculated by summing up the consumption amounts in the single session. The total payout amount is calculated by summing up the payout amounts in the single session. The total benefit amount/total loss amount is calculated by subtracting the total consumption amount from the total payout amount. The total number of plays is calculated by counting the plays made in the single session.

Basically, the session start time/date is a time and date when the IC card 1500 is inserted into the PTS terminal 1700, and the session end time/date is a time and date when the IC card 1500 is ejected from the PTS terminal 1700.

Here, a time and date when a bill or the like is inserted into the PTS terminal 1700 and a time and date when cash-out is made on the PTS terminal 1700 may be adopted as the session start time/date and the session end time/date, respectively, instead of or in addition to the insertion and ejection of the IC card 1500.

In another possible example, whether or not the player is seated may be determined based on facial authentication by the PTS terminal 1700, and a time and date when the player sits down and a time and date when the player stands up may be adopted as the session start time/date and the session end time/date, respectively.

The session history table is basically updated at appropriate timing based on the game information that is transmitted from each gaming machine.

FIG. 27C exemplifies an accumulation table. The accumulation table is stored in the hall management server 10. Alternatively, the accumulation table may be stored in another server or the like.

In the accumulation table, information including the player identification code indicating the player making plays, the cumulative number of plays indicating the number of plays played in the arcade, the cumulative number of visits indicating the number of visits to the arcade, the amount consumed in the arcade (the cumulative consumption amount), the amount paid out in the arcade (the cumulative payout amount), the amount indicating a benefit or loss in the arcade (the cumulative benefit amount/cumulative loss amount), the maximum loss amount indicating the maximum loss amount in a single play, a session time indicating the average time length of a single session, and the average number of BETs indicating the average of the numbers of BETs in a single play, is stored in association with an identification number (accumulation number).

The cumulative number of plays is calculated by counting the total number of plays made by a single player. The cumulative number of visits is calculated by counting the number of visits to the arcade. The cumulative consumption amount is calculated by summing up the total consumption amounts of a single player. The cumulative payout amount is calculated by summing up the total payout amounts of a single player. The cumulative benefit amount/cumulative loss amount is calculated by subtracting the cumulative consumption amount from the cumulative payout amount.

The accumulation table is basically updated at appropriate timing based on the game information that is transmitted from each gaming machine.

[Information Providing Service]

Figure 28A:
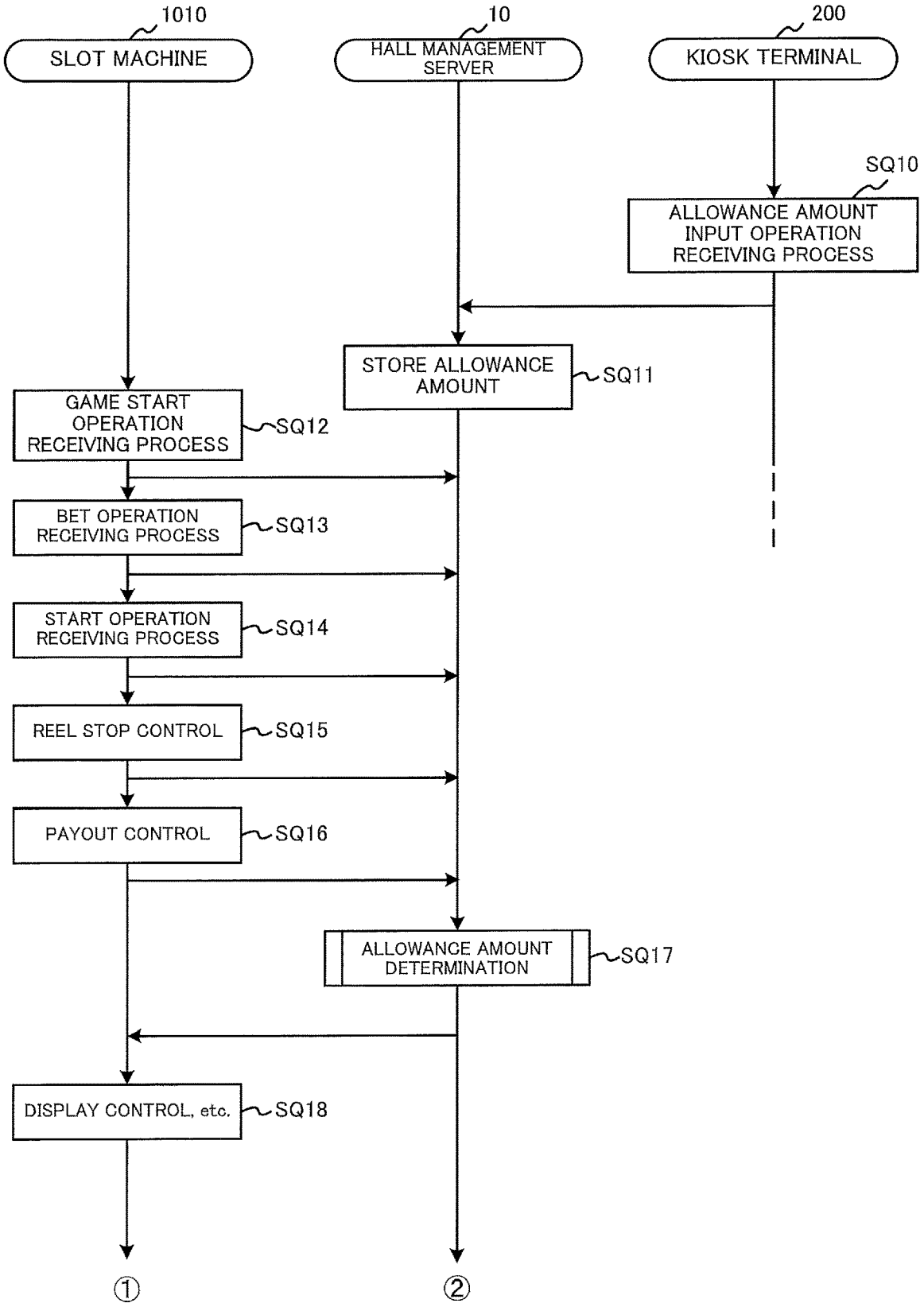
FIG. 28A exemplifies a flow sequence of an information providing service according to the embodiment of the present invention.

FIG. 28A exemplifies a flow sequence of an information providing service. With this sequence, a general flow of the information providing service is described.

In SQ10, the kiosk terminal 200 performs a process of receiving an input operation for inputting the allowance amount. For example, the kiosk terminal 200 displays on the LCD 201 a screen that prompts an input of the allowance amount (e.g., "Please input the amount consumable for playing.", "Please input your budget.", "Please input your reserve fund (the amount reserved for playing).", or "Please input the amount to be consumed.") (see FIG. 29A, etc.), and receives an input of the amount (allowance amount). In response to an input of the allowance amount based on a player's operation, the kiosk terminal 200 transmits information about the allowance amount (the allowance amount, a time and date of the input, and the like) to the hall management server 10.

Figure 33:
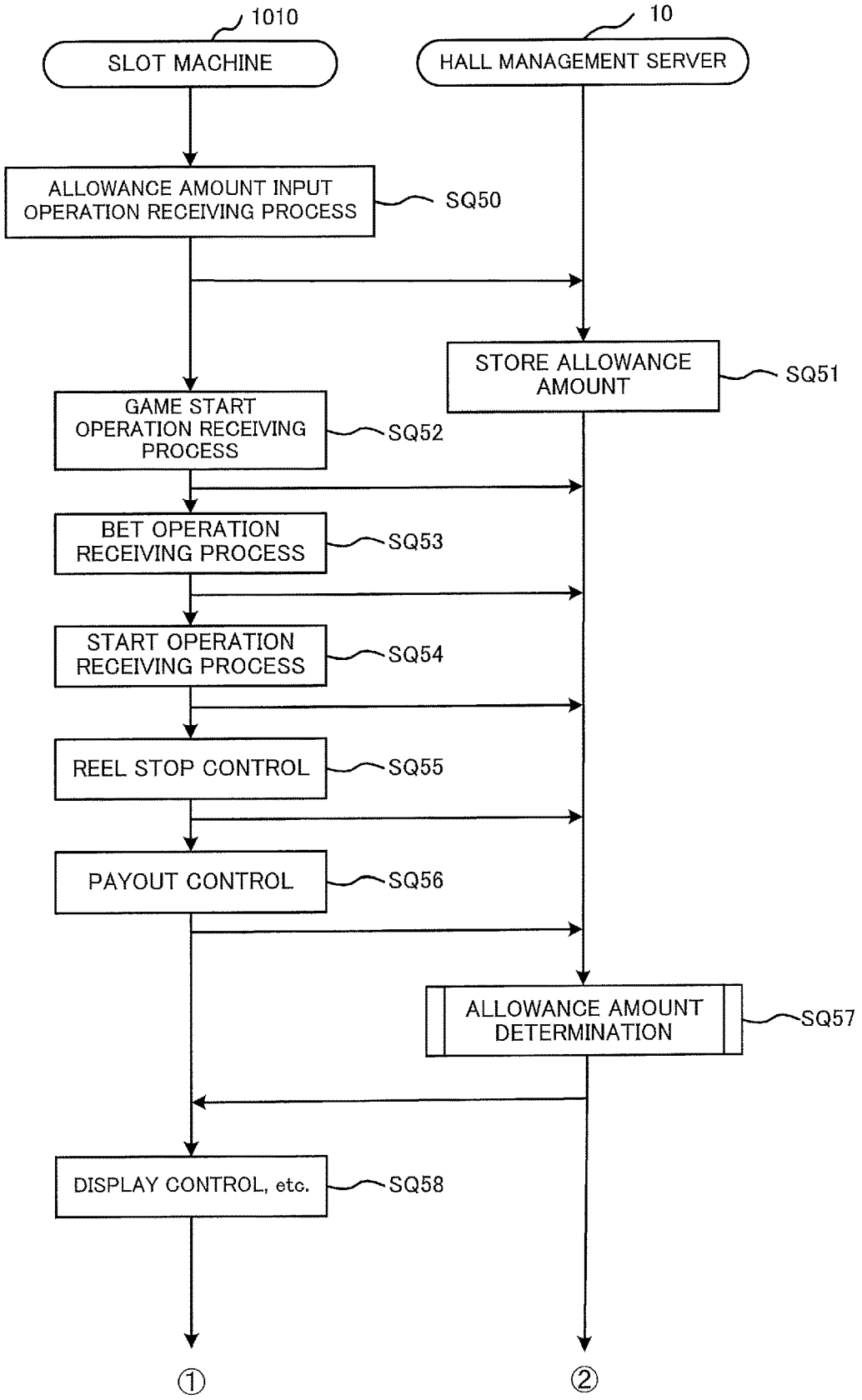
FIG. 33 exemplifies the flow sequence of the information providing service according to the embodiment of the present invention.

The input of the allowance amount may not necessarily be made on the kiosk terminal 200. For example, as shown in FIG. 33, etc., the allowance amount may be inputted on the slot machine 1010. Alternatively, the input may be made on another terminal including an input device, such as the signage 100.

In SQ11, upon receiving the allowance amount, the hall management server 10 stores an allowance amount input time/date as well as the allowance amount into a predetermined storage area of the external storage device 1404.

The allowance amount input time/date is a time and date when the input of the allowance amount is received, but not limited thereto. The allowance amount input time/date may be, for example, a time and date when the kiosk terminal 200 transmits the information about the allowance amount or a time and date when the hall management server 10 receives the information about the allowance amount.

In SQ12, the slot machine 1010 performs a game start operation receiving process. More specifically, upon receiving an operation for starting a session such as insertion of the IC card 1500 into the PTS terminal 1700, the slot machine 1010 transmits a session start notification (an example of the game information) to the hall management server 10. Upon receiving the session start notification, the hall management server 10 updates the session start time/date, etc., in the session history table shown in FIG. 27B.

The session start time/date is a time and date when an operation that indicates start of the session is received, but not limited thereto. The session start time/date may be, for example, a time and date when the slot machine 1010 transmits the session start notification or a time and date when the hall management server 10 receives the session start notification.

In SQ13, the slot machine 1010 performs a process of receiving a BET operation. For example, the slot machine 1010 transmits the BET information (an example of the game information) including the number of BETs, etc., to the hall management server 10 in accordance with the BET operation. Upon receiving the BET information, the hall management server 10 updates the number of BETs, the consumption amount, etc., in the play history table shown in FIG. 27A.

In SQ14, the slot machine 1010 performs a process of receiving a start operation. For example, the slot machine 1010 transmits the play start notification to the hall management server 10 in accordance with the start operation (an operation on the spin button). Upon receiving the play start notification, the hall management server 10 updates the play start time/date, the play interval, etc., in the play history table shown in FIG. 27A.

The play start time/date is a time and date when the start operation is received, but not limited thereto. The play start time/date may be, for example, a time and date when the slot machine 1010 transmits the play start notification or a time and date when the hall management server 10 receives the play start notification.

In SQ15, the slot machine 1010 performs a reel stop control. The slot machine 1010 transmits information (such as bonus information) about a combination of stopped symbols to the hall management server 10. The bonus information (an example of the game information) includes, for example, bonus identification information by which whether or not to start a bonus game can be identified, the number of plays of the bonus game, and the like. The bonus information enables the hall management server 10 to identify whether or not the bonus game is running, in other words, to identify start and end of the bonus game. The hall management server 10 counts the number of plays made after the end of the bonus game.

The bonus information may not necessarily be transmitted from the slot machine 1010 to the hall management server 10 in the reel stop control, but is transmitted at appropriate timing. For example, the number of plays of the bonus game may be determined by a lottery or the like, and transmitted to the hall management server 10 at a time of starting the bonus game (for example, at a time of a bonus game start operation).

In SQ16, the slot machine 1010 performs a payout control. For example, the slot machine 1010 transmits the number of payouts determined in the number-of-payouts determination process, together with a play end notification, to the hall management server 10. Upon receiving the number of payouts and the play end notification (an example of the game information), the hall management server 10 updates the payout amount, the benefit amount/loss amount, the play end time/date, etc., in the play history table shown in FIG. 27A.

The play end time/date is a time and date when symbols are stopped, but not limited thereto. The play end time/date may be, for example, a time and date when the number of payouts is determined, a time and date when the slot machine 1010 transmits the play end notification, or a time and date when the hall management server 10 receives the play end notification.

In SQ17, upon receiving the play end notification, the hall management server 10 performs an allowance amount determination. In the allowance amount determination, whether or not the consumption amount (cumulative amount) consumed after the allowance amount was set reaches the allowance amount is determined, though details is given later. Upon determination that the cumulative amount reaches the allowance amount, the hall management server 10 transmits announcement information to the slot machine 1010, the announcement information being for announcing the information contributing to anti-addiction.

The announcement information includes announcement start information indicating that an announcement is started. Contents of the announcement (e.g., screen information, light-up pattern information, and voice information) may be either transmitted from the hall management server 10 or preliminarily stored in the PTS terminal 1700.

In SQ18, upon receiving the announcement information, the slot machine 1010 performs a display control and the like. For example, the slot machine 1010 displays, on the LCD 1719 of the PTS terminal 1700, a screen indicating that the amount consumed by the player (cumulative amount) reaches the amount set by the player (allowance amount) (see FIG. 29B, etc.). For example, the full-color LEDs 1721*a* and 1721*b* emit light in a pattern indicating that the cumulative amount reaches the allowance amount (e.g., flashing blue light). For example, the speakers 1707 and 1709 output a sound indicating that the cumulative amount reaches the allowance amount (e.g., a voice saying "Set amount is reached.").

In this configuration, the information that encourages the player not to play the game is announced based on the setting made by the player himself/herself, and thereby the player can stop the game in accordance with the announcement which is the concern of the player, so that a situation in which the player becomes addicted to the game can be avoided.

Figure 28B:
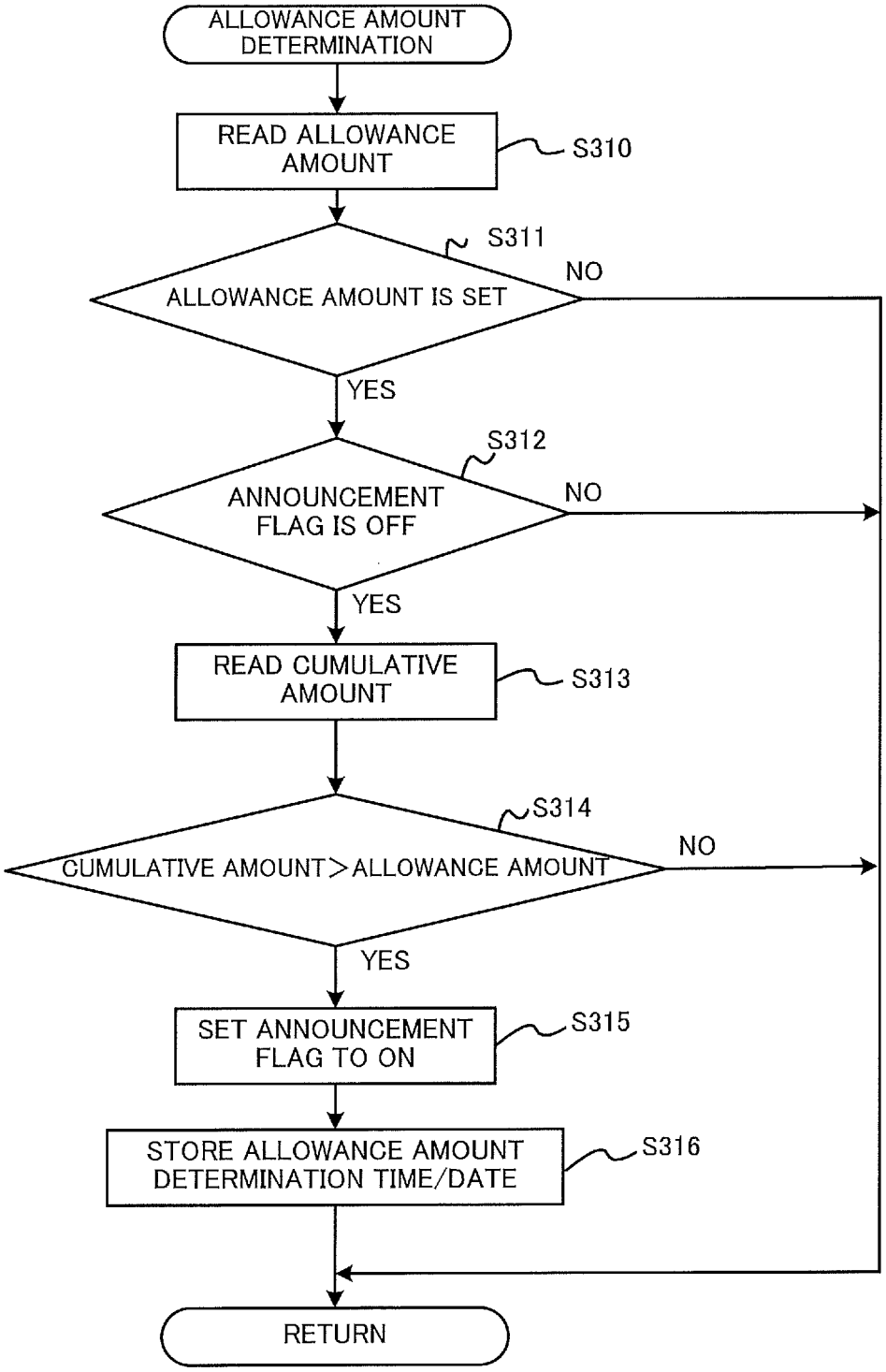
FIG. 28B exemplifies a flowchart of an allowance amount determination according to the embodiment of the present invention.

FIG. 28B exemplifies a flowchart of the allowance amount determination.

In S310, the CPU 1401 reads the allowance amount from the predetermined storage area of the external storage device 1404. After completing this processing, the CPU 1401 proceeds to S311.

In S311, the CPU 1401 determines whether or not the allowance amount is stored (set). Upon determination that the allowance amount is set, the CPU 1401 proceeds to S312, while upon determination that the allowance amount is not set, the CPU 1401 terminates the allowance amount determination.

In S312, the CPU 1401 determines whether or not an announcement flag is OFF. Upon determination that the announcement flag is OFF, the CPU 1401 proceeds to S313, while upon determination that the announcement flag is not OFF, the CPU 1401 terminates the allowance amount determination. The announcement flag is a flag for identifying whether or not to announce the information contributing to anti-addiction.

In S313, the CPU 1401 reads the cumulative amount from the predetermined storage area of the external storage device 1404. More specifically, the CPU 1401 refers to the tables of FIG. 27, to calculate the cumulative amount by summing up the benefit amounts and the loss amounts accumulated from when the allowance amount was set (after the allowance amount input time/date). After completing this processing, the CPU 1401 proceeds to S314.

In S314, the CPU 1401 determines whether or not the cumulative amount reaches the allowance amount. Upon determination that the cumulative amount reaches the allowance amount, the CPU 1401 proceeds to S315, while upon determination that the cumulative amount does not reach the allowance amount, the CPU 1401 terminates the allowance amount determination.

In S315, the CPU 1401 sets the announcement flag to ON. After completing this processing, the CPU 1401 proceeds to S316.

In S316, the CPU 1401 stores an allowance amount determination time/date into a predetermined storage area of the external storage device 1404, and terminates the allowance amount determination.

Figure 28C:
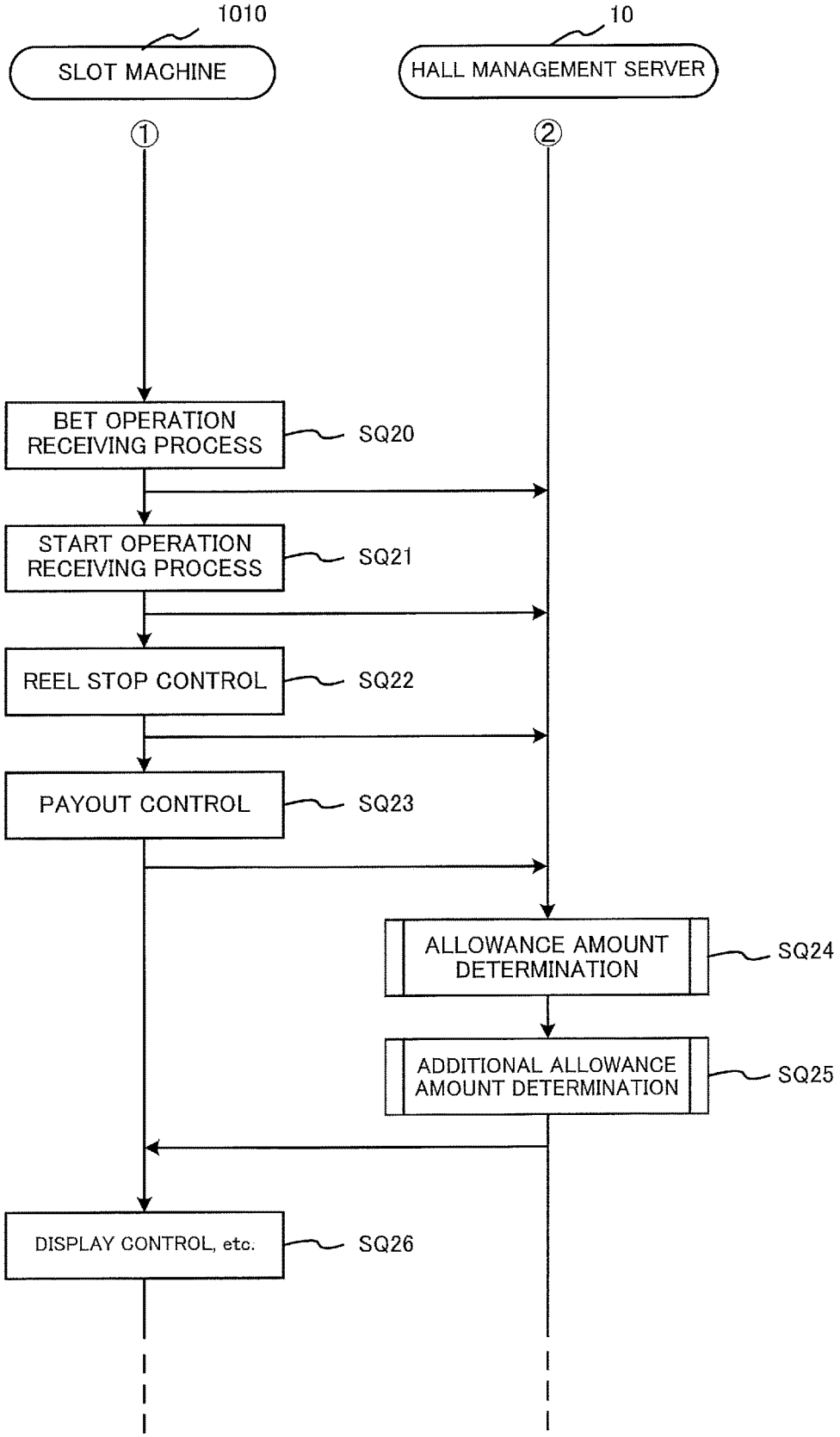
FIG. 28C exemplifies the flow sequence of the information providing service according to the embodiment of the present invention.

FIG. 28C exemplifies a flow sequence of the information providing service. With this sequence, a general flow of the information providing service subsequent to the setting of the allowance amount is described. Since SQ20 to SQ24 are similar to SQ13 to SQ17, descriptions thereof are omitted.

In SQ25, the hall management server 10 performs an additional allowance amount determination. In the additional allowance amount determination, whether or not the consumption amount consumed after the allowance amount was set (additional cumulative amount) reaches the value of "the allowance amount+the additional consumption amount" is determined, though details is given later. Upon determination that the additional cumulative amount reaches the value of "the allowance amount+the additional consumption amount", the hall management server 10 transmits additional announcement information to the slot machine 1010, the additional announcement information being for additionally announcing the information contributing to anti-addiction.

The additional announcement information includes additional announcement start information indicating that an additional announcement is started. Contents of the additional announcement (e.g., screen information, light-up pattern information, and voice information) may be either transmitted from the hall management server 10 or preliminarily stored in the PTS terminal 1700.

In SQ26, upon receiving the additional announcement information, the slot machine 1010 performs a display control and the like. For example, the slot machine 1010 displays, on the LCD 1719 of the PTS terminal 1700, a screen indicating that a predetermined amount (additional allowance amount) has been consumed in addition to the set amount (allowance amount). For example, the full-color LEDs 1721*a* and 1721*b* emit light in a pattern indicating that the additional allowance amount has been consumed in addition to the allowance amount (e.g., flashing red light). For example, the speakers 1707 and 1709 output a sound indicating that the additional allowance amount has been consumed in addition to the allowance amount (e.g., a voice saying "It's about time to take a break.").

In this configuration, the information that encourages the player not to play the game is announced in a case where the predetermined consumption amount is additionally consumed, and thereby the player can stop the game in consideration of the announcement, so that a situation in which the player becomes addicted to the game can be avoided.

Figure 28D:
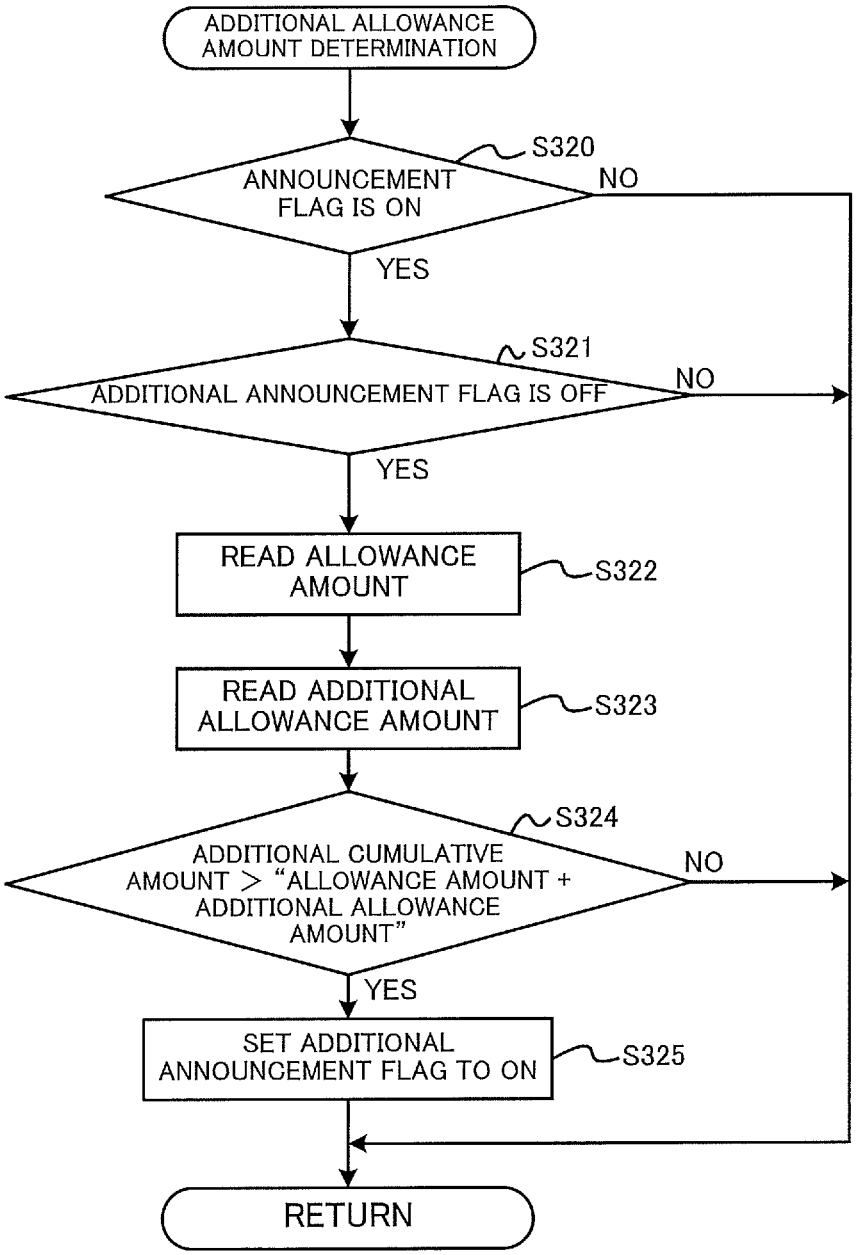
FIG. 28D exemplifies a flowchart of an additional allowance amount determination according to the embodiment of the present invention.

FIG. 28D exemplifies a flowchart of the additional allowance amount determination.

In S320, the CPU 1401 determines whether or not the announcement flag is ON. Upon determination that the announcement flag is ON, the CPU 1401 proceeds to S321, while upon determination that the announcement flag is not ON, the CPU 1401 terminates the additional allowance amount determination.

In S321, the CPU 1401 determines whether or not an additional announcement flag is OFF. Upon determination that the additional announcement flag is OFF, the CPU 1401 proceeds to S322, while upon determination that the additional announcement flag is not OFF, the CPU 1401 terminates the additional allowance amount determination.

In S322, the CPU 1401 reads the allowance amount from the predetermined storage area of the external storage device 1404. After completing this processing, the CPU 1401 proceeds to S323.

In S323, the CPU 1401 reads the additional allowance amount from the predetermined storage area of the external storage device 1404. After completing this processing, the CPU 1401 proceeds to S324. As the additional allowance amount, a predetermined value is preliminarily registered (stored) by the administrator or the like. For example, a predetermined percentage of the allowance amount is set.

In S324, the CPU 1401 determines whether or not the additional cumulative amount reaches the value of "the allowance amount+the additional allowance amount". Upon determination that the additional cumulative amount reaches the value of "the allowance amount+the additional allowance amount", the CPU 1401 proceeds to S325, while upon determination that the additional cumulative amount does not reach the value of "the allowance amount+the additional allowance amount", the CPU 1401 terminates the additional allowance amount determination.

In S325, the CPU 1401 sets the additional announcement flag to ON, and terminates the additional allowance amount determination.

Figure 29A:
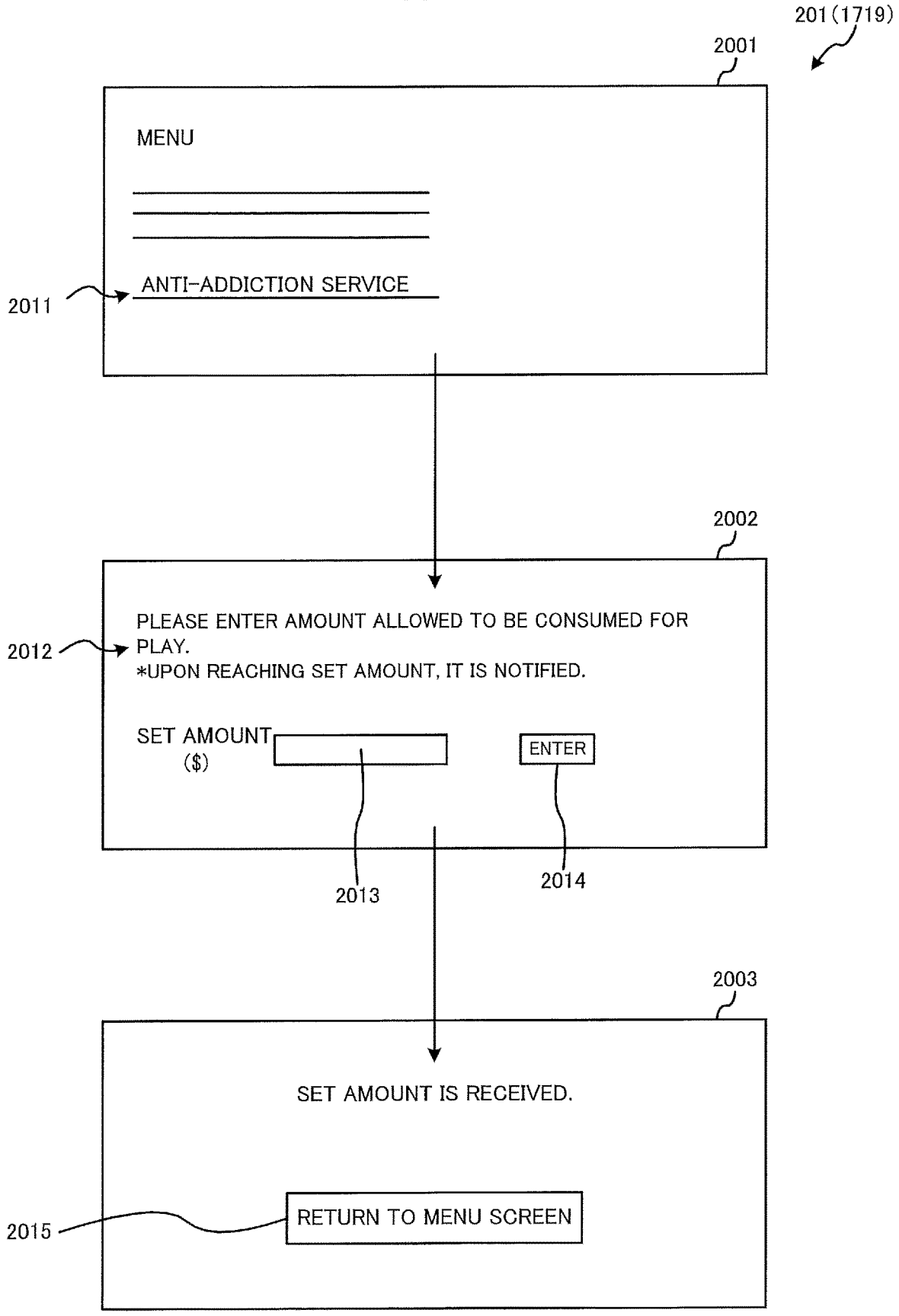
FIG. 29A exemplifies a display screen according to the embodiment of the present invention.

FIG. 29A exemplifies a display screen (screens 2001 to 2003) of the LCD 201 (LCD 1719).

A menu screen 2001 has a plurality of menus including an anti-addiction service menu 2011. In response to touching of the anti-addiction service menu 2011, an input screen 2002 that allows the set amount (allowance amount) to be inputted is displayed.

The input screen 2002 has an explanation 2012 showing the contents of the anti-addiction service, a set amount input field 2013, and an enter button 2014 for entering an input. In response to an input of a set amount in the input field 2013 and touching of the enter button 2014, a completion screen 2003 showing the reception of the input is displayed.

The completion screen 2003 has a return button 2015 for returning to the menu screen 2001. In response to touching of the return button 2015, the menu screen 2001 is displayed.

Figure 29B:
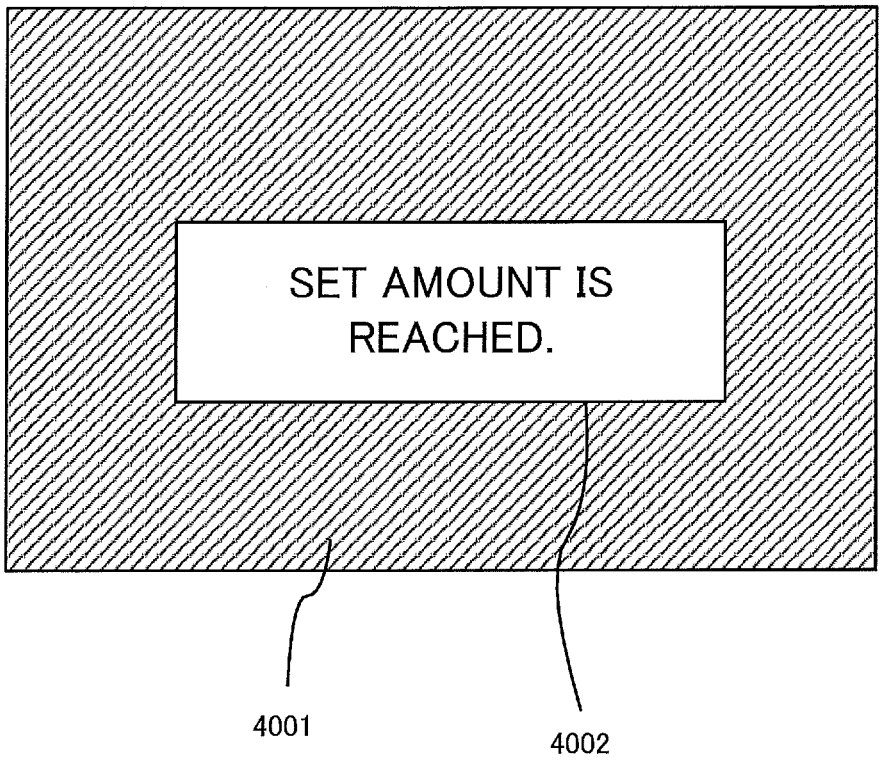
FIG. 29B exemplifies a display screen according to the embodiment of the present invention.

FIG. 29B exemplifies a display screen (a screen 4001) of the LCD 1719. The screen 4001 has a message display area 4002. The message display area 4002 displays the information contributing to anti-addiction (in this example, "Set amount is reached.").

<Variations of Game System>

This embodiment is not limited to the one illustrated above. For example, the configuration of the game system 1 may be a configuration shown in FIGS. 30A and 30B instead of the configuration shown in FIG. 3.

Figure 30A:
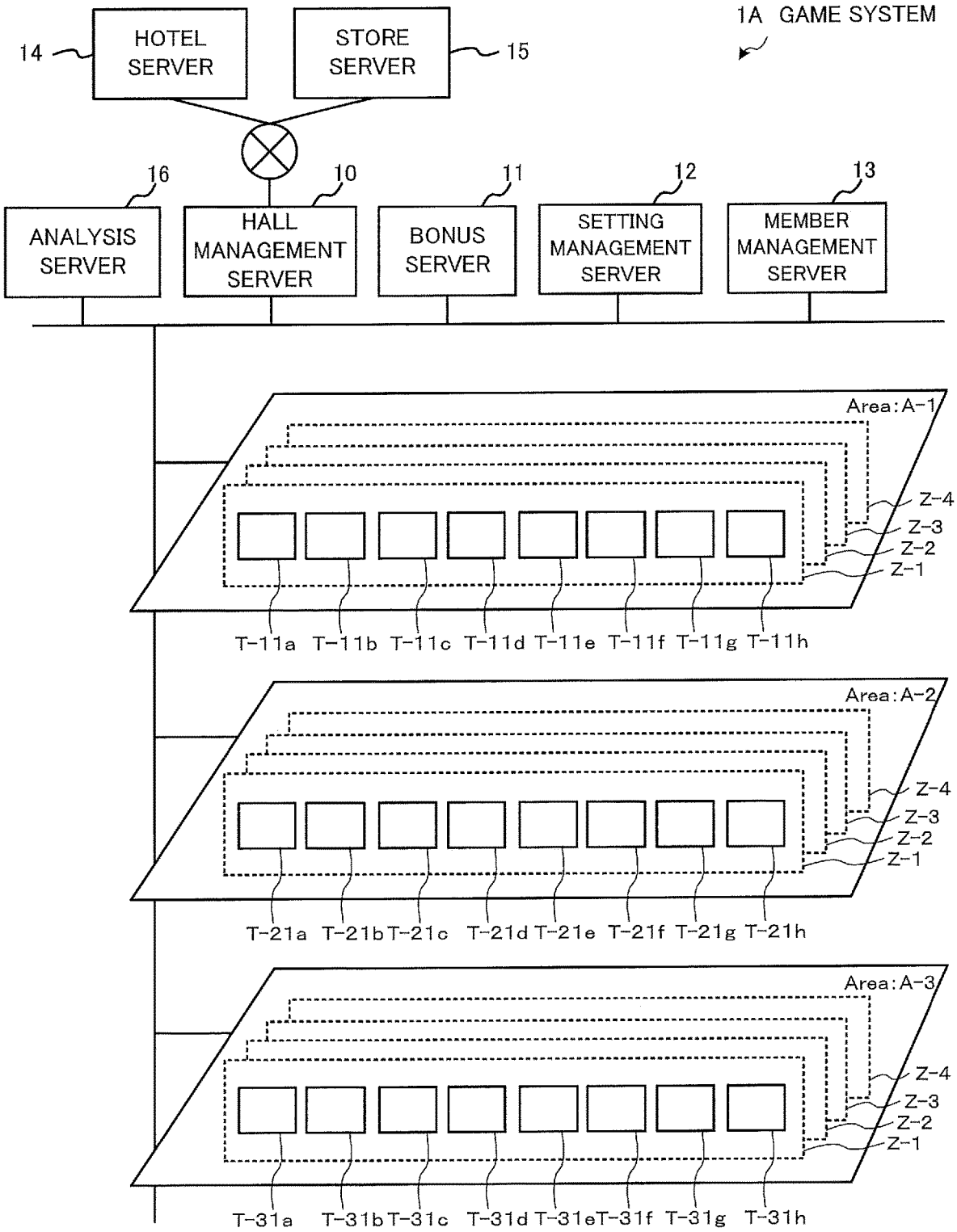
FIG. 30A schematically shows a game system according to the embodiment of the present invention.

A game system 1A shown in FIG. 30A is different from the game system 1 shown in FIG. 3, mainly in that it includes an analysis server 16.

Figure 21:
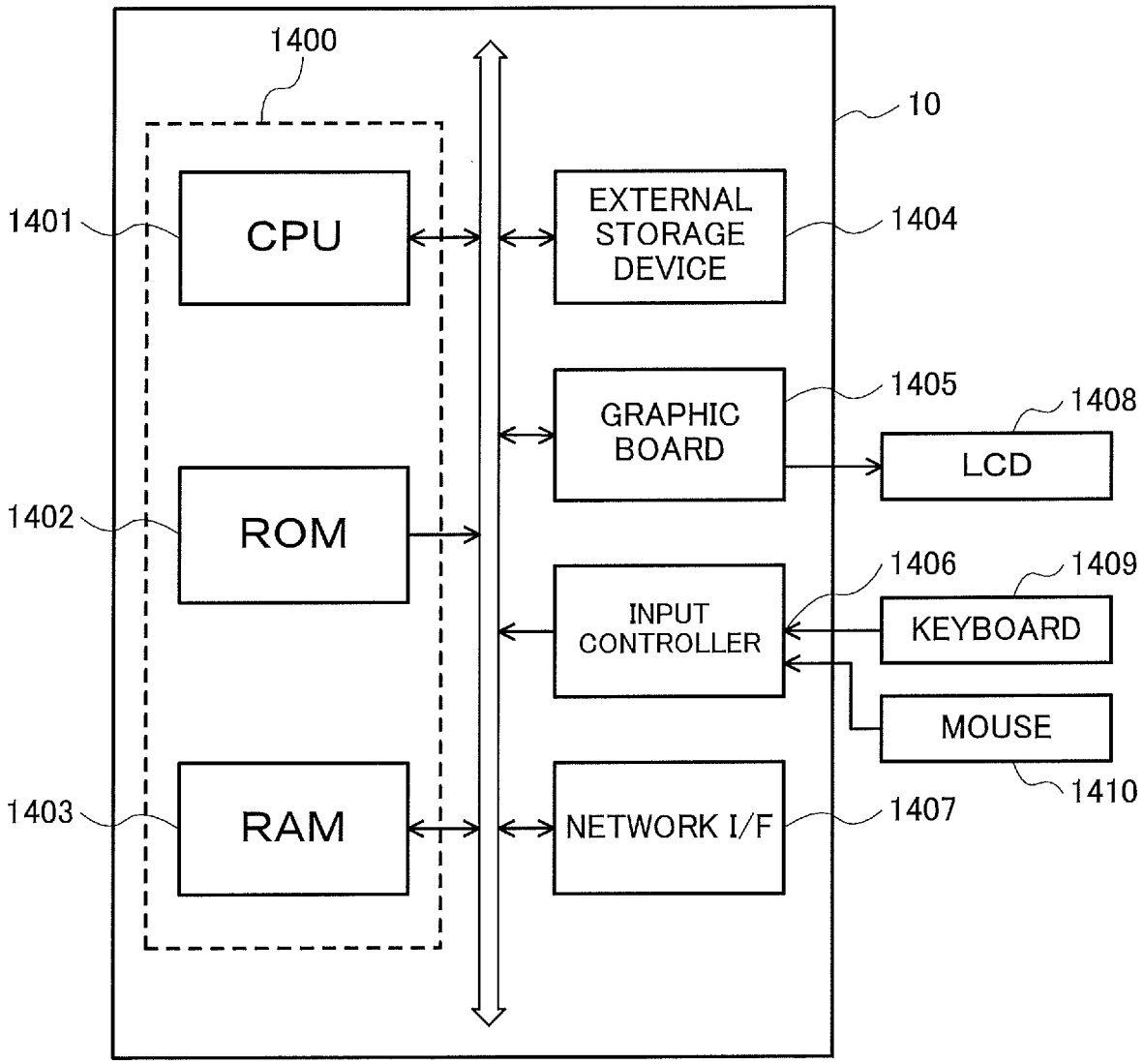
FIG. 21 shows a circuit configuration of a hall management server according to the embodiment of the present invention.

The analysis server 16, which has the circuit configuration shown in FIG. 21, covers a part of the process performed by the hall management server 10. For example, the hall management server 10 functions as a storage device for storing the game information and the like. The analysis server 16 obtains the game information from the hall management server 10, transmits the announcement information to the slot machine 1010 based on a result of the allowance amount determination, and transmits the additional announcement information to the slot machine 1010 based on a result of the additional allowance amount determination.

Figure 30B:
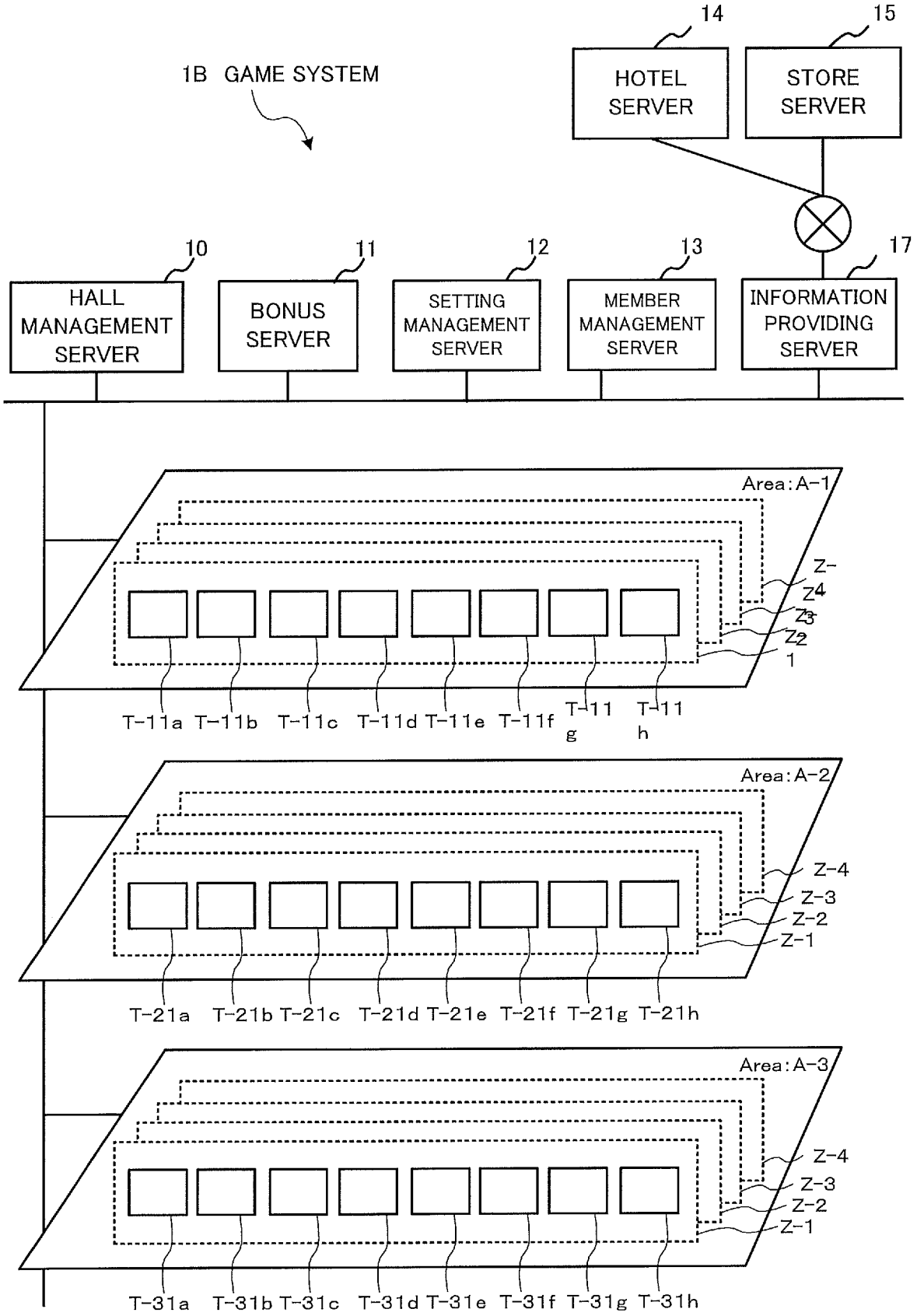
FIG. 30B schematically shows a game system according to the embodiment of the present invention.

A game system 1B shown in FIG. 30B is different from the game system 1 shown in FIG. 3, mainly in that it includes an information providing server 17 and the information providing server 17 communicates with the hotel server 14 and the store server 15.

The information providing server 17, which has the circuit configuration shown in FIG. 21, covers a part of the process performed by the hall management server 10. For example, the hall management server 10 functions as a storage device for storing the game information and the like. The information providing server 17 obtains the game information from the hall management server 10, obtains the vacant room information or the like from the hotel server 14 based on a result of the allowance amount determination, obtains the vacant seat information or the like from the store server 15 based on a result of the allowance amount determination, and transmits them as the announcement information to the slot machine 1010. The information providing server 17 obtains the game information from the hall management server 10, obtains the vacant room information or the like from the hotel server 14 based on a result of the additional allowance amount determination, obtains the vacant seat information or the like from the store server 15 based on a result of the additional allowance amount determination, and transmits them as the additional announcement information to the slot machine 1010.

<First-A: Variation of Information Providing Service>

Figure 31A:
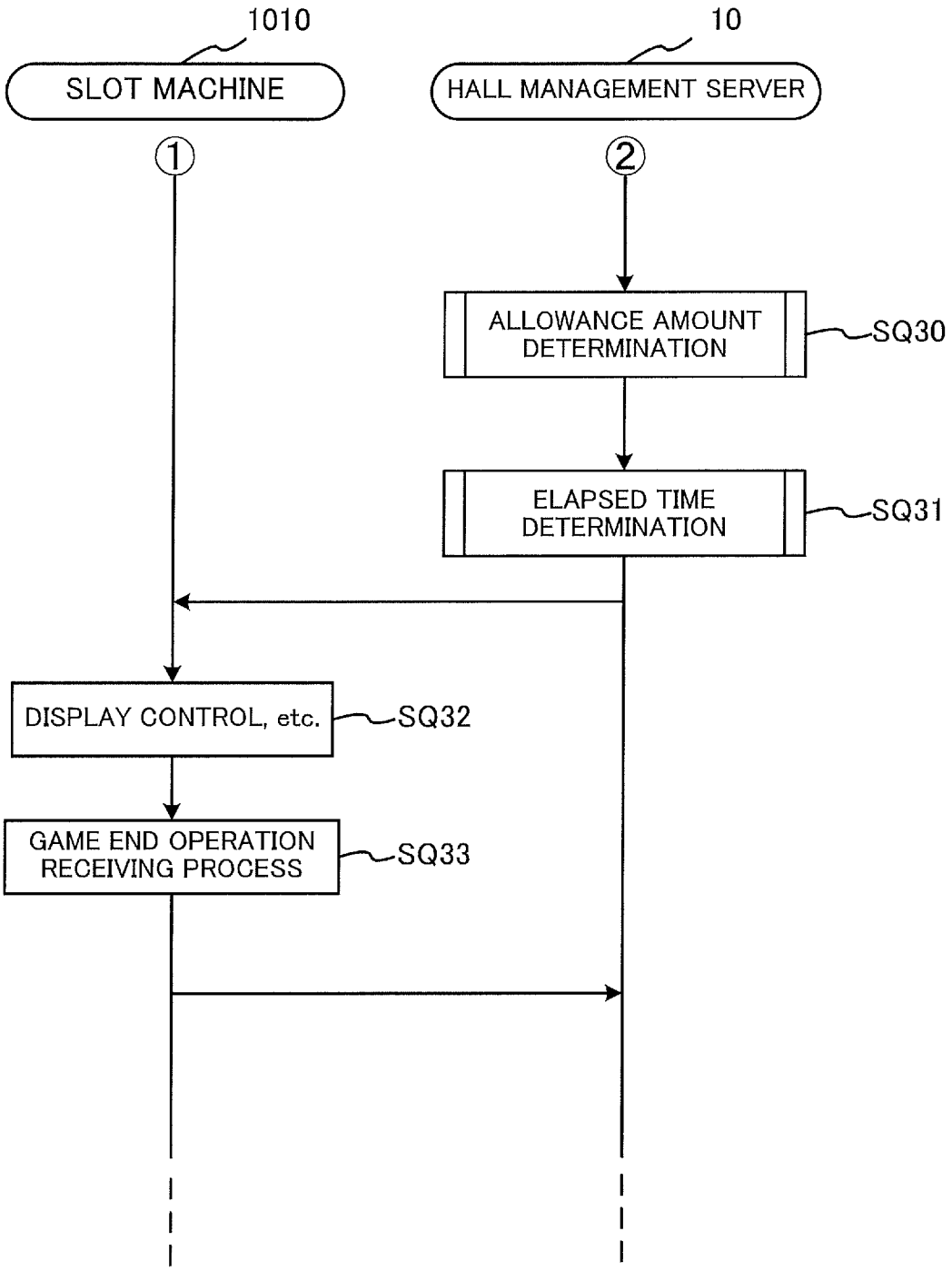
FIG. 31A exemplifies the flow sequence of the information providing service according to the embodiment of the present invention.

As the information providing service, a sequence shown in FIG. 31A may be adopted in addition to or instead of the sequence shown in FIG. 28C.

FIG. 31A exemplifies a flow sequence of the information providing service. With this sequence, a general flow of the information providing service subsequent to the setting of the allowance amount is described. Since SQ30 and SQ32 are similar to SQ24 and SQ26 shown in FIG. 28C, descriptions thereof are omitted.

In SQ31, the hall management server 10 performs an elapsed time determination. In the elapsed time determination, whether or not a predetermined time has elapsed since the allowance amount was reached is determined, though details will be given later. Upon determination that the predetermined time has elapsed, the hall management server 10 transmits the additional announcement information to the slot machine 1010, the additional announcement information being for additionally announcing the information contributing to anti-addiction.

In SQ33, the slot machine 1010 performs a game end operation receiving process. More specifically, the slot machine 1010 determines whether or not an operation for ending a session such as ejection of the IC card 1500 or a cash-out operation is received. Upon determination that the operation is received, the slot machine 1010 transmits a session end notification (an example of the game information) to the hall management server 10. Upon receiving the session end notification, the hall management server 10 updates the total consumption amount, the total payout amount, the total benefit amount/total loss amount, the session end time/date, the total number of plays, etc., in the session history table shown in FIG. 27B.

The session end time/date is a time and date when the operation for ending the session is received, but not limited thereto. The session end time/date may be, for example, a time and date when the PTS terminal 1700 determines that the player is not seated based on facial authentication, a time and date when the slot machine 1010 transmits the session end notification, or a time and date when the hall management server 10 receives the session end notification.

In this configuration, the information that encourages the player not to play the game is announced upon elapse of the predetermined time, and thereby the player can stop the game in consideration of the announcement, so that a situation in which the player becomes addicted to the game can be avoided.

Figure 31B:
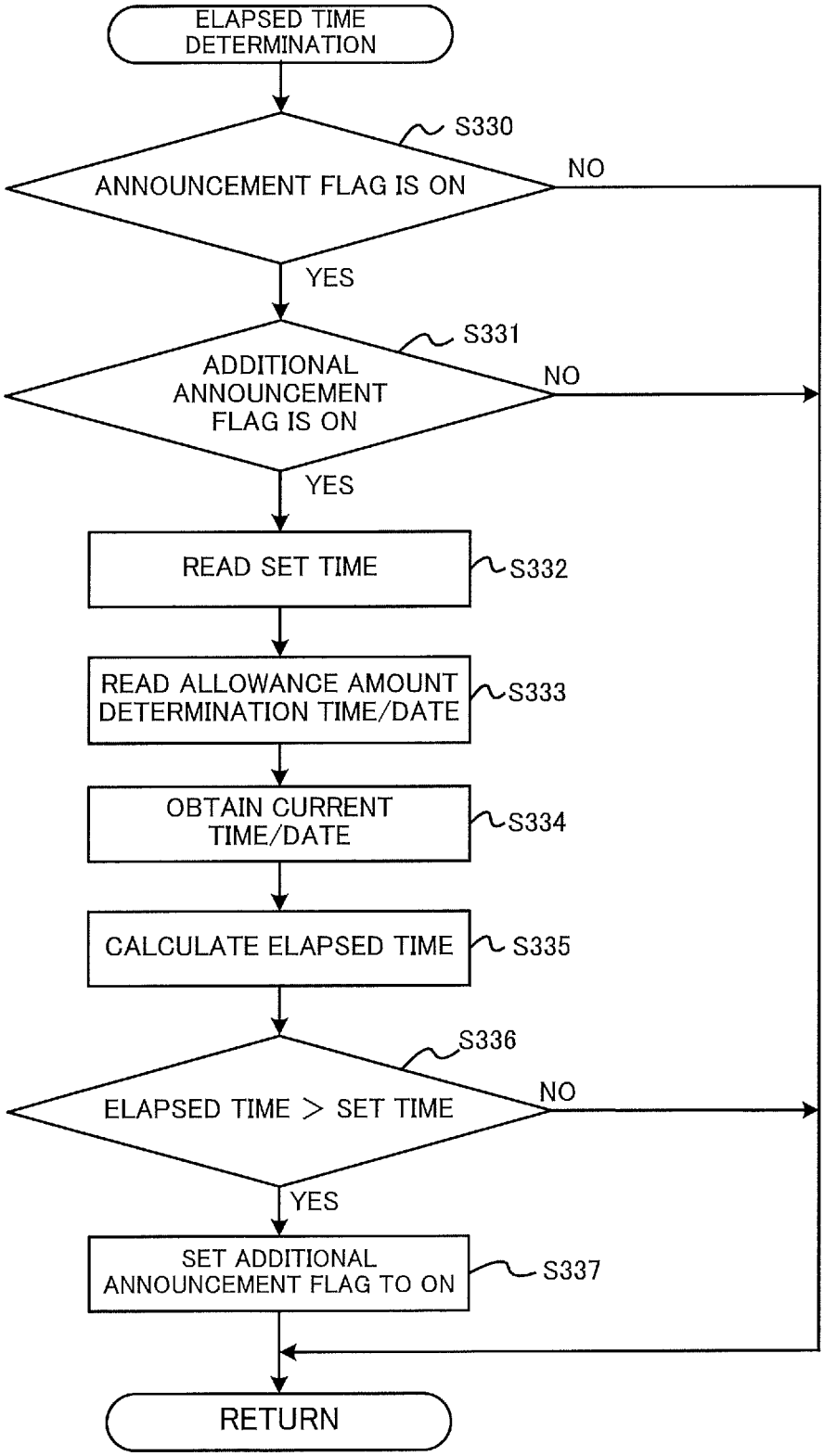
FIG. 31B exemplifies a flowchart of an elapsed time determination according to the embodiment of the present invention.

FIG. 31B exemplifies a flowchart of the elapsed time determination.

In S330, the CPU 1401 determines whether or not the announcement flag is ON. Upon determination that the announcement flag is ON, the CPU 1401 proceeds to S331, while upon determination that the announcement flag is not ON, the CPU 1401 terminates the elapsed time determination.

In S331, the CPU 1401 determines whether or not the additional announcement flag is OFF. Upon determination that the additional announcement flag is OFF, the CPU 1401 proceeds to S332, while upon determination that the additional announcement flag is not OFF, the CPU 1401 terminates the elapsed time determination.

In S332, the CPU 1401 reads a set time from a predetermined storage area of the external storage device 1404. After completing this processing, the CPU 1401 proceeds to S333. The set time is preliminarily registered (stored) by the administrator or the like.

In S333, the CPU 1401 reads the allowance amount determination time/date from the predetermined storage area of the external storage device 1404. After completing this processing, the CPU 1401 proceeds to S334.

In S334, the CPU 1401 obtains the current time and date. After completing this processing, the CPU 1401 proceeds to S335.

In S335, the CPU 1401 calculates an elapsed time. More specifically, the CPU 1401 calculates the elapsed time by subtracting the allowance amount determination time/date from the current time and date. After completing this processing, the CPU 1401 proceeds to S336.

In S336, the CPU 1401 determines whether or not the elapsed time reaches the set time. Upon determination that the elapsed time reaches the set time, the CPU 1401 proceeds to S337, while upon determination that the elapsed time does not reach the set time, the CPU 1401 terminates the elapsed time determination.

In S337, the CPU 1401 sets the additional announcement flag to ON, and terminates the elapsed time determination.

<First-B: Variation of Information Providing Service>

Figure 32A:
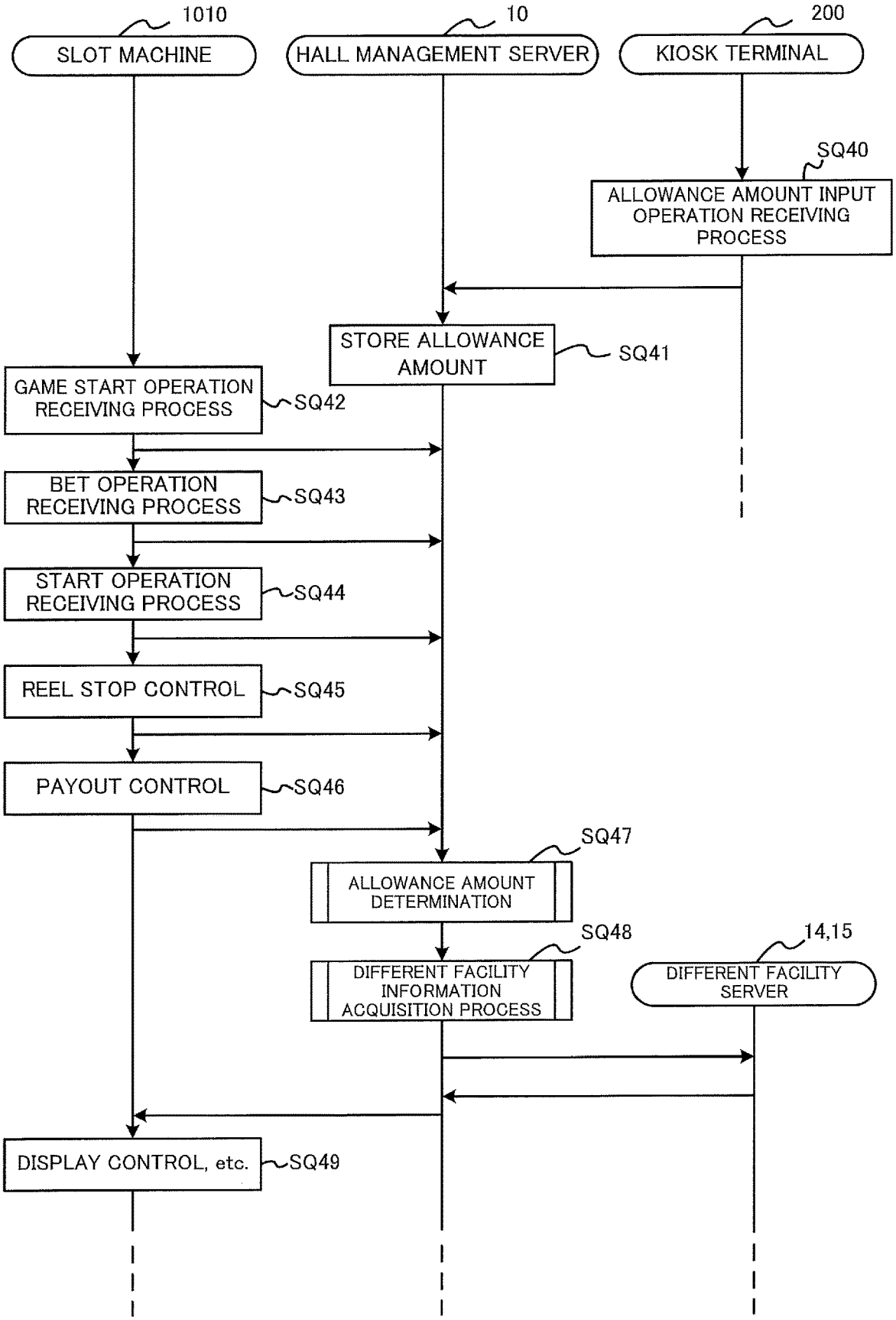
FIG. 32A exemplifies the flow sequence of the information providing service according to the embodiment of the present invention.

As the information providing service, a sequence shown in FIG. 32A may be adopted instead of the sequence shown in FIG. 28A.

FIG. 32A exemplifies a flow sequence of the information providing service. With this sequence, a general flow of the information providing service is described. Since SQ40 to SQ47 and SQ49 are similar to SQ10 to 18 shown in FIG. 28A, descriptions thereof are omitted.

In SQ48, the hall management server 10 performs a different facility information acquisition process. In the different facility information acquisition process, different facility information is obtained from each of at least one different facility server (the hotel server 14, the store server 15, etc.) that are predesignated, though details will be given later. As the different facility information, information that can provide an advantage (benefit) to the player, such as the vacant room information, the vacant seat information, the coupon information, the event information, and the sale information, can be adopted as appropriate.

A request for the different facility information may be given to one different facility server, or a request for the different facility information may be given to a plurality of different facility servers.

The different facility server transmits the different facility information to the hall management server 10 in accordance with a different facility information acquisition request. The hall management server 10 receives the different facility information, and then transmits it as the announcement information to the slot machine 1010.

A configuration for obtaining the different facility information from the different facility server is not limited to the one illustrated above.

For example, the hall management server 10 may be operable to periodically request the different facility information (for example, every 15 minutes) and store it into the external storage device 1404 irrespective of a result of the allowance amount determination.

For example, the different facility server transmits the different facility information to the hall management server 10 periodically or at timing when the different facility information is added or updated. The hall management server 10 may be operable to store the received different facility information into the external storage device 1404.

In these configurations, if the announcement flag is set in the allowance amount determination, the hall management server 10 reads the different facility information from the external storage device 1404 and transmits it as the announcement information to the slot machine 1010.

This configuration allows the player to go to another facility if the different facility information about different facilities (a hotel, a store, etc.), which is announced on the gaming machine 1010, is of high interest to the player. Since the player is guided to another facility by the announcement, a situation in which the player is addicted to the game can be avoided.

Figure 32B:
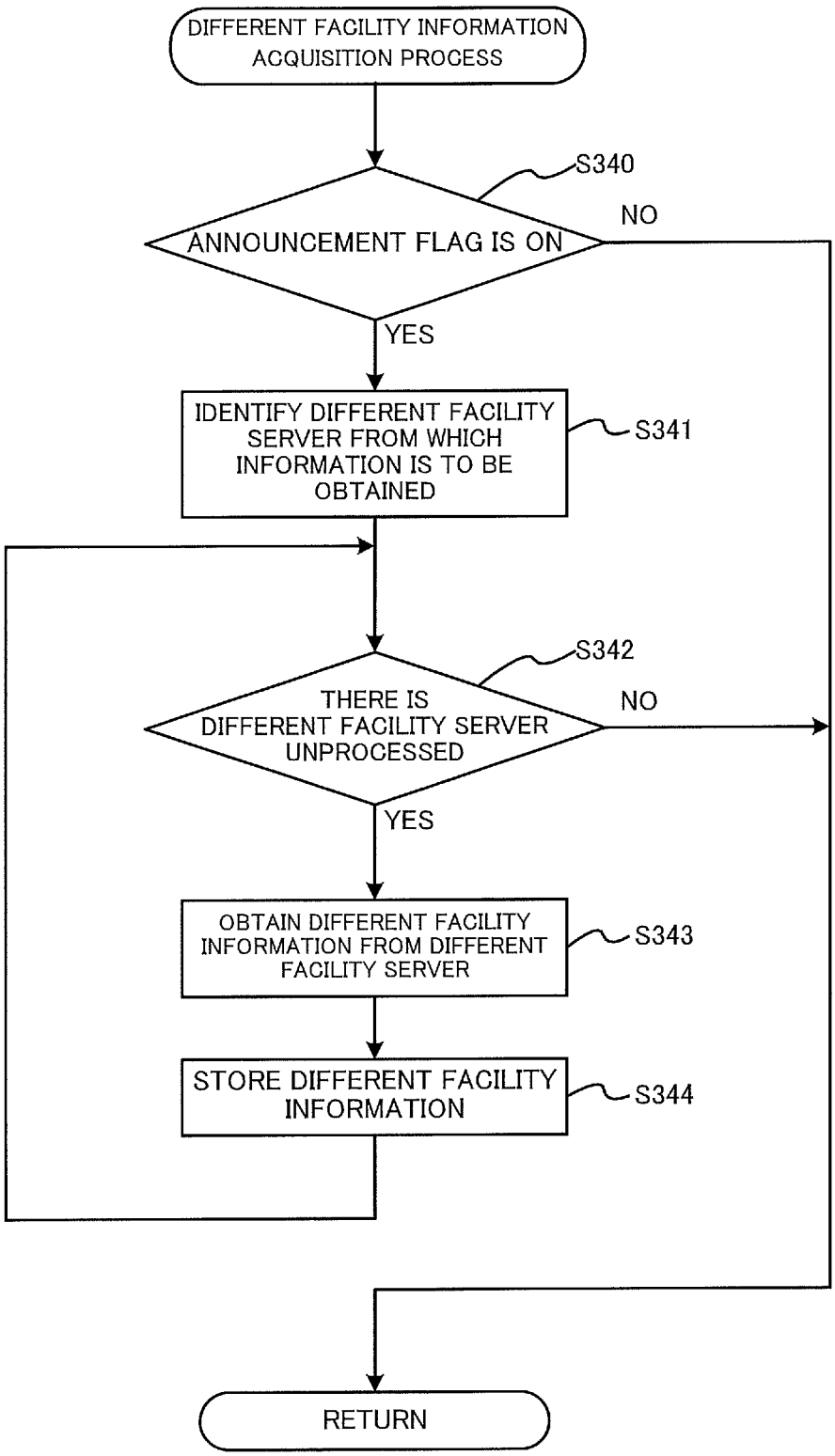
FIG. 32B exemplifies a flowchart of a different facility information acquisition process according to the embodiment of the present invention.

FIG. 32B exemplifies a flowchart of the different facility information acquisition process.

In S340, the CPU 1401 determines whether or not the announcement flag is ON. Upon determination that the announcement flag is ON, the CPU 1401 proceeds to S341, while upon determination that the announcement flag is not ON, the CPU 1401 terminates the different facility information acquisition process.

In S341, the CPU 1401 identifies the different facility server from which the information is to be obtained. More specifically, the CPU 1401 refers to a request list (the IP address, the service ID, etc.) for requesting the different facility information of each of at least one different facility server, to identify the different facility server from which the information is to be obtained. The request list is preliminarily stored in the external storage device 1404 by the administrator or the like. After completing this processing, the CPU 1401 proceeds to S342.

In S342, the CPU 1401 determines whether or not there is any different facility server unprocessed. Upon determination that there is any different facility server unprocessed, the CPU 1401 proceeds to S343, while upon determination that there is no different facility server unprocessed, the CPU 1401 terminates the different facility information acquisition process.

In S343, the CPU 1401 obtains the different facility information from the different facility server. More specifically, the CPU 1401 requests the different facility information of the unprocessed different facility server by designating the IP address, the service ID, or the like, and receives the different facility information from the unprocessed different facility server. After completing this processing, the CPU 1401 proceeds to S344.

Here, the CPU 1401 may be operable to obtain the different facility information by designating the URL of a prescribed file (different facility information).

In S344, the CPU 1401 stores the obtained different facility information into a predetermined storage area of the external storage device 1404, and proceeds to S432.

<First-C: Variation of Information Providing Service>

As the information providing service, a sequence shown in FIG. 33 may be adopted instead of the sequence shown in FIG. 28A.

FIG. 33 exemplifies a flow sequence of the information providing service. With this sequence, a general flow of the information providing service is described. Since SQ52 to SQ58 are similar to SQ12 to SQ18 shown in FIG. 28A, descriptions thereof are omitted.

In SQ50, the slot machine 1010 performs a process of receiving the input operation for inputting the allowance amount. For example, the slot machine 1010 displays, on the LCD 1719 of the PTS terminal 1700, a screen that prompts an input of the allowance amount (e.g., "Please input the amount consumable for playing.", "Please input your budget.", "Please input your reserve fund (the amount reserved for playing).", or "Please input the amount to be consumed.") (see FIG. 29A, etc.), and receives an input of the amount (allowance amount). In response to an input of the allowance amount based on a player's operation, the slot machine 1010 transmits the information about the allowance amount (the allowance amount, a time and date of the input, and the like) to the hall management server 10.

In SQ51, upon receiving the allowance amount, the hall management server 10 stores an allowance amount input time/date as well as the allowance amount into a predetermined storage area of the external storage device 1404.

The allowance amount input time/date is a time and date when the input of the allowance amount is received, but not limited thereto. The allowance amount input time/date may be, for example, a time and date when the slot machine 1010 transmits the information about the allowance amount or a time and date when the hall management server 10 receives the information about the allowance amount.

<First-D: Variation of Information Providing Service>

Figure 34:
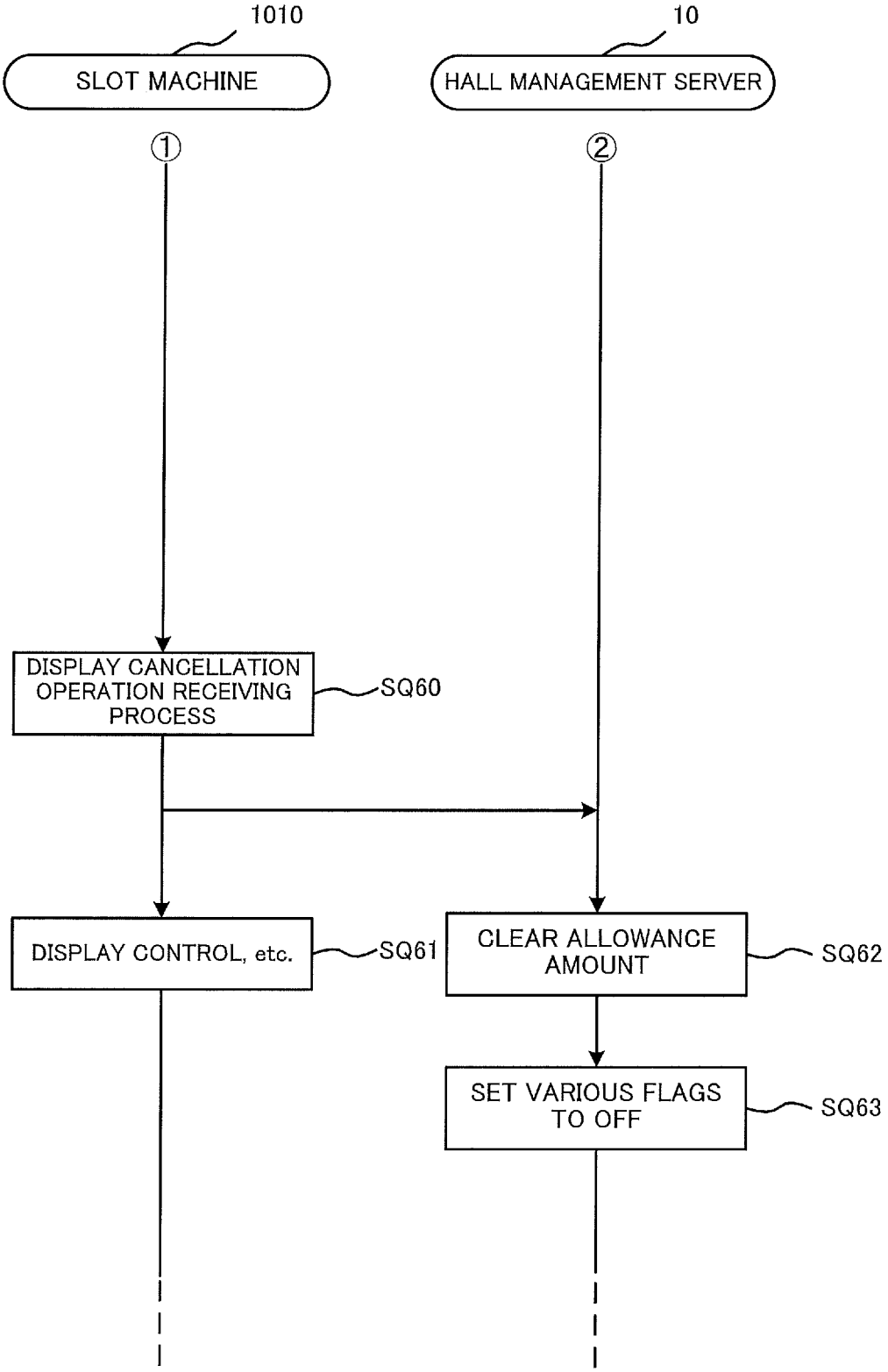
FIG. 34 exemplifies the flow sequence of the information providing service according to the embodiment of the present invention.

As the information providing service, a sequence shown in FIG. 34 may be adopted in addition to or instead of the sequence shown in FIG. 28C.

FIG. 34 exemplifies a flow sequence of the information providing service. With this sequence, a general flow of the information providing service subsequent to the setting of the allowance amount is described.

In SQ60, the slot machine 1010 performs a display cancellation operation receiving process. More specifically, the slot machine 1010 receives an operation (display cancellation operation) that cancels the display or the like (announcement) of the information contributing to anti-addiction on the PTS terminal 1700. Upon receiving the display cancellation operation, the slot machine 1010 cancels the announcement, and transmits a notification (display cancellation notification) indicating that the announcement is cancelled to the hall management server 10.

In SQ61, the slot machine 1010 performs a display control, an LED control, and a sound control, to cancel the announcement of the information contributing to anti-addiction. Here, it is not always necessary that the announcement through videos (images), lights, and sounds is cancelled simultaneously. For example, upon reception of the display cancellation operation, the announcement can be cancelled stepwise in the order of videos, lights, and sounds, or alternatively the announcement can be partially cancelled such as cancellation of only the announcement through sounds.

In SQ62, upon receiving the display cancellation notification, the hall management server 10 clears the allowance amount stored in the predetermined storage area of the external storage device 1404.

In SQ63, the hall management server 10 sets various flags (including the announcement flag and the like) to OFF. Here, if the additional announcement flag is ON, the additional announcement flag is set to OFF.

<First-E: Variation of Information Providing Service>

Figure 35:
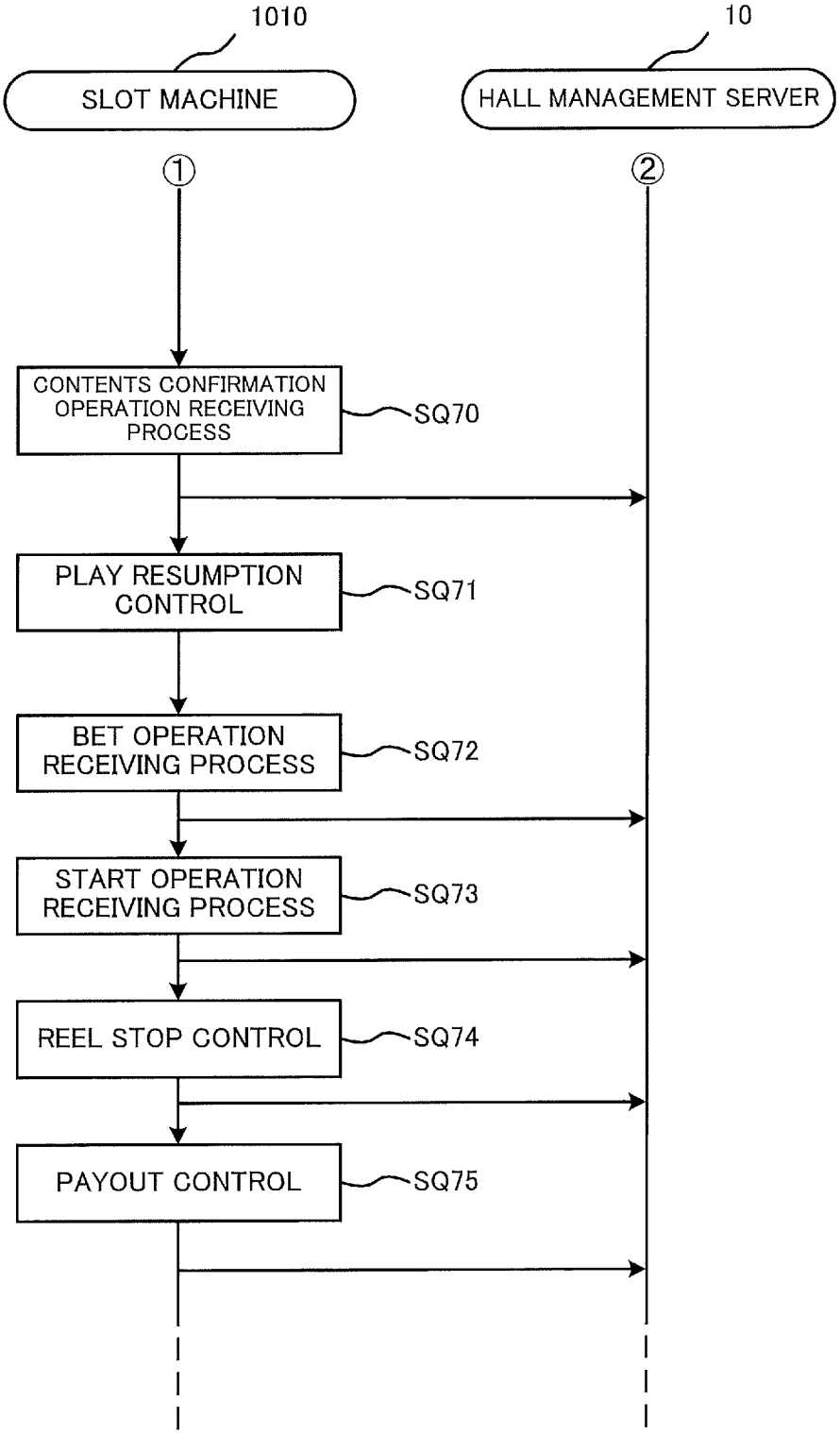
FIG. 35 exemplifies the flow sequence of the information providing service according to the embodiment of the present invention.

As the information providing service, a sequence shown in FIG. 35 may be adopted in addition to or instead of the sequence shown in FIG. 28C. Since SQ72 to SQ75 are similar to SQ13 to SQ16 shown in FIG. 28A, descriptions thereof are omitted.

FIG. 35 exemplifies a flow sequence of the information providing service. With this sequence, a general flow of the information providing service subsequent to the setting of the allowance amount is described.

In SQ70, the slot machine 1010 performs a contents confirmation operation receiving process. More specifically, the slot machine 1010 receives an operation (contents confirmation operation) indicating that the information contributing to anti-addiction announced by the PTS terminal 1700 is confirmed. For example, the slot machine 1010 displays a confirmation icon (e.g., "Confirmed.") as well as the information contributing to anti-addiction on the LCD 1719 of the PTS terminal 1700, and receives an operation made on the confirmation icon.

In SQ71, upon receiving the contents confirmation operation, the slot machine 1010 performs a play resumption control. More specifically, the slot machine 1010 resumes the play that has been interrupted (activates the BET operation and the start operation that have been disabled) since the information contributing to anti-addiction was announced.

<First-F: Variation of Information Providing Service>

Figure 36A:
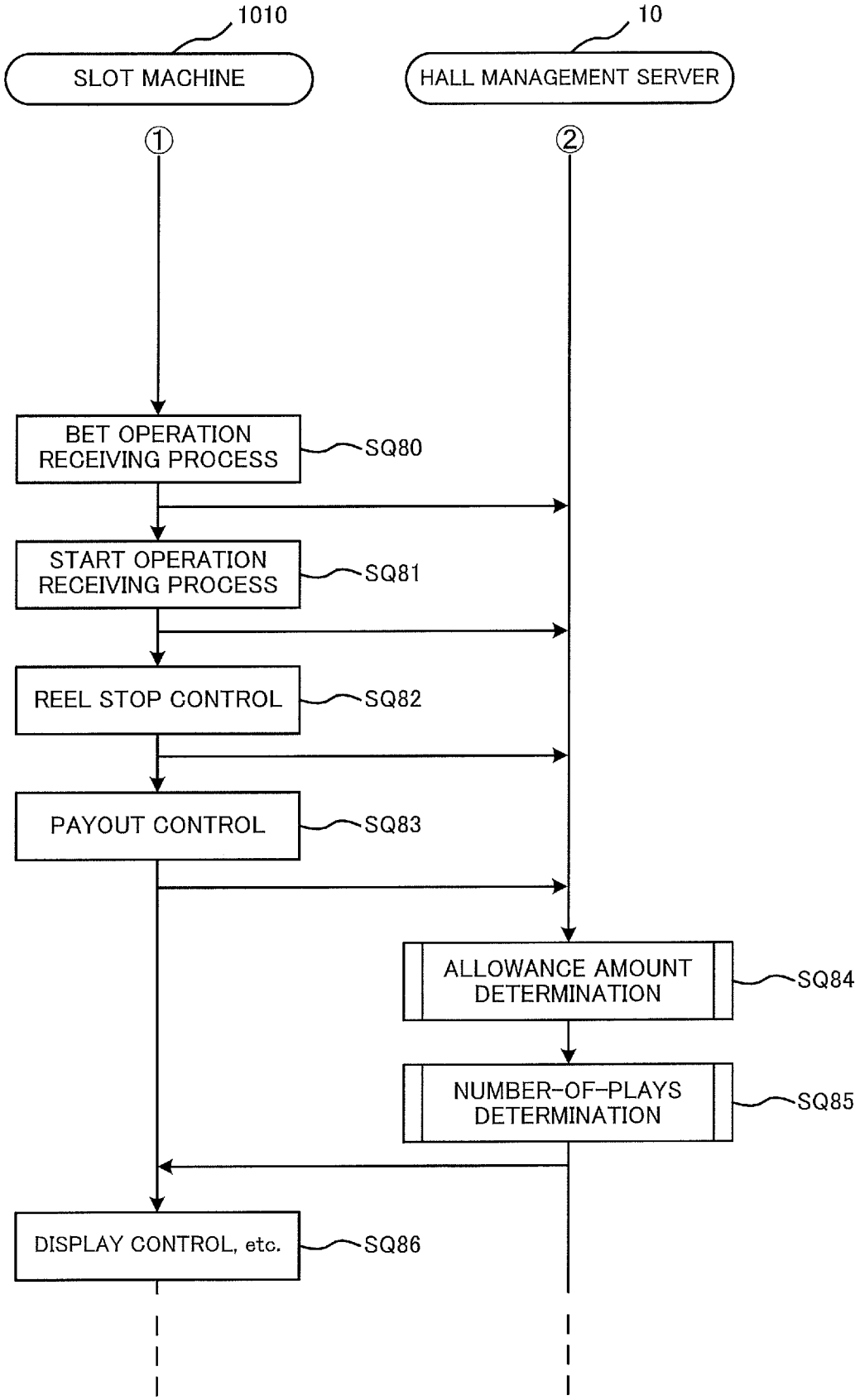
FIG. 36A exemplifies the flow sequence of the information providing service according to the embodiment of the present invention.

As the information providing service, a sequence shown in FIG. 36A may be adopted in addition to or instead of the sequence shown in FIG. 28C. Since SQ80 to SQ84 and SQ86 are similar to SQ13 to 18 shown in FIG. 28A, descriptions thereof are omitted.

FIG. 36A exemplifies a flow sequence of the information providing service. With this sequence, a general flow of the information providing service subsequent to the setting of the allowance amount is described.

In SQ85, the slot machine 1010 performs a number-of-plays determination. In the number-of-plays determination, whether or not the number of plays made after the information contributing to anti-addiction was announced reaches a predetermined number-of-plays value is determined, though details will be given later. Upon determination that the predetermined number-of-plays value is reached, the slot machine 1010 transmits the additional announcement information to the slot machine 1010.

In this configuration, the information that encourages the player not to play the game is announced in a case where a predetermined number of plays are additionally made, and thereby the player can stop the game in accordance with the announcement, so that a situation in which the player becomes addicted to the game can be avoided.

Figure 36B:
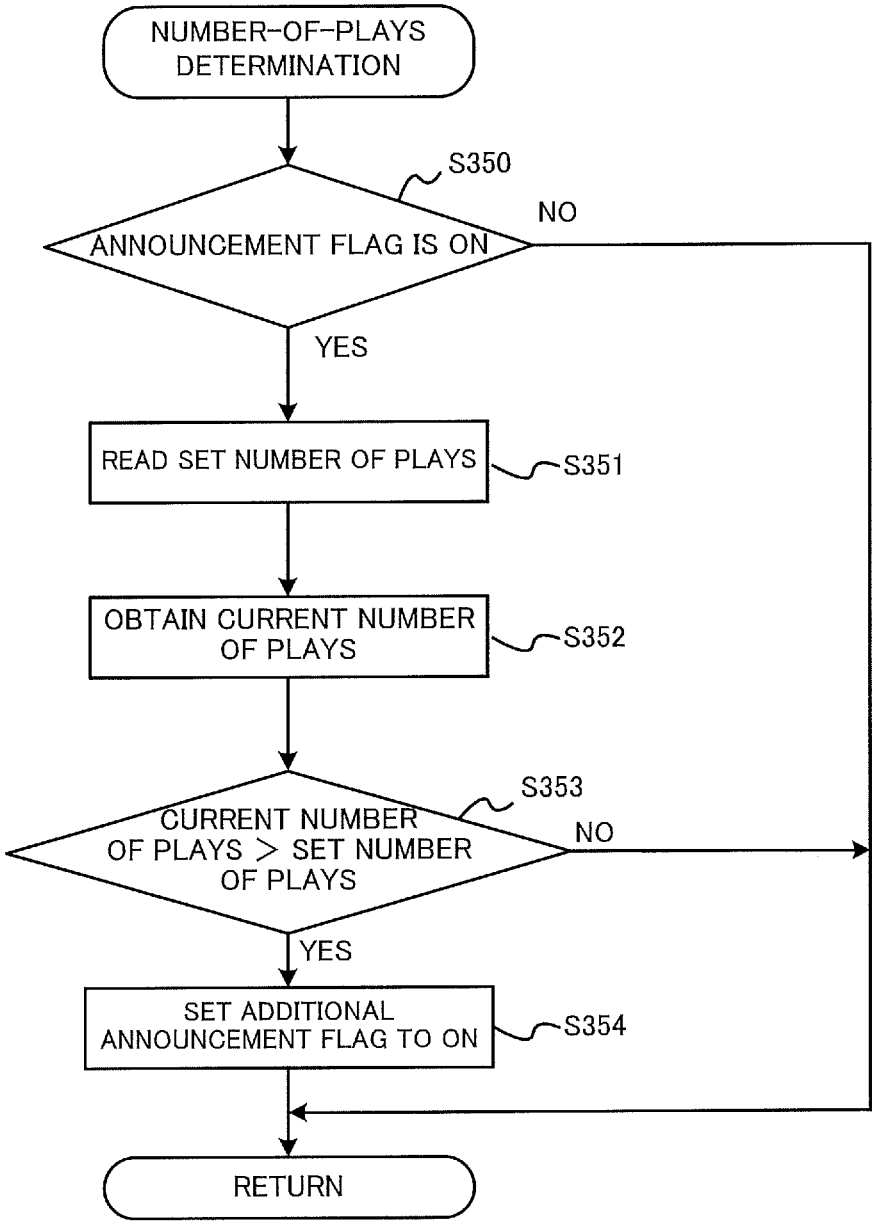
FIG. 36B exemplifies a flowchart of a number-of-plays determination according to the embodiment of the present invention.

FIG. 36B exemplifies a flowchart of the number-of-plays determination.

In S350, the CPU 1401 determines whether or not the announcement flag is ON. Upon determination that the announcement flag is ON, the CPU 1401 proceeds to S351, while upon determination that the announcement flag is not ON, the CPU 1401 terminates the number-of-plays determination.

In S351, the CPU 1401 reads the set number of plays from a predetermined storage area of the external storage device 1404. After completing this processing, the CPU 1401 proceeds to S352. The set number of plays is preliminarily stored in the predetermined storage area of the external storage device 1404 by the administrator or the like.

In S352, the CPU 1401 obtains the current number of plays. More specifically, the CPU 1401 refers to the allowance amount determination time/date and the play history table shown in FIG. 27A, to calculate the number of plays made after the information contributing to anti-addiction was announced.

In another possible configuration, the number of plays made after the information contributing to anti-addiction was announced may be counted in each play, stored in a predetermined storage area of the external storage device 1404, and read from the predetermined storage area of the external storage device 1404.

In S353, the CPU 1401 determines whether or not the current number of plays reaches the set number of plays. Upon determination that the current number of plays reaches the set number of plays, the CPU 1401 proceeds to S354, while upon determination that the current number of plays does not reach the set number of plays, the CPU 1401 terminates the number-of-plays determination.

In S354, the CPU 1401 sets the additional announcement flag to ON, and terminates the number-of-plays determination.

<First-G: Variation of Information Providing Service>

Figure 37:
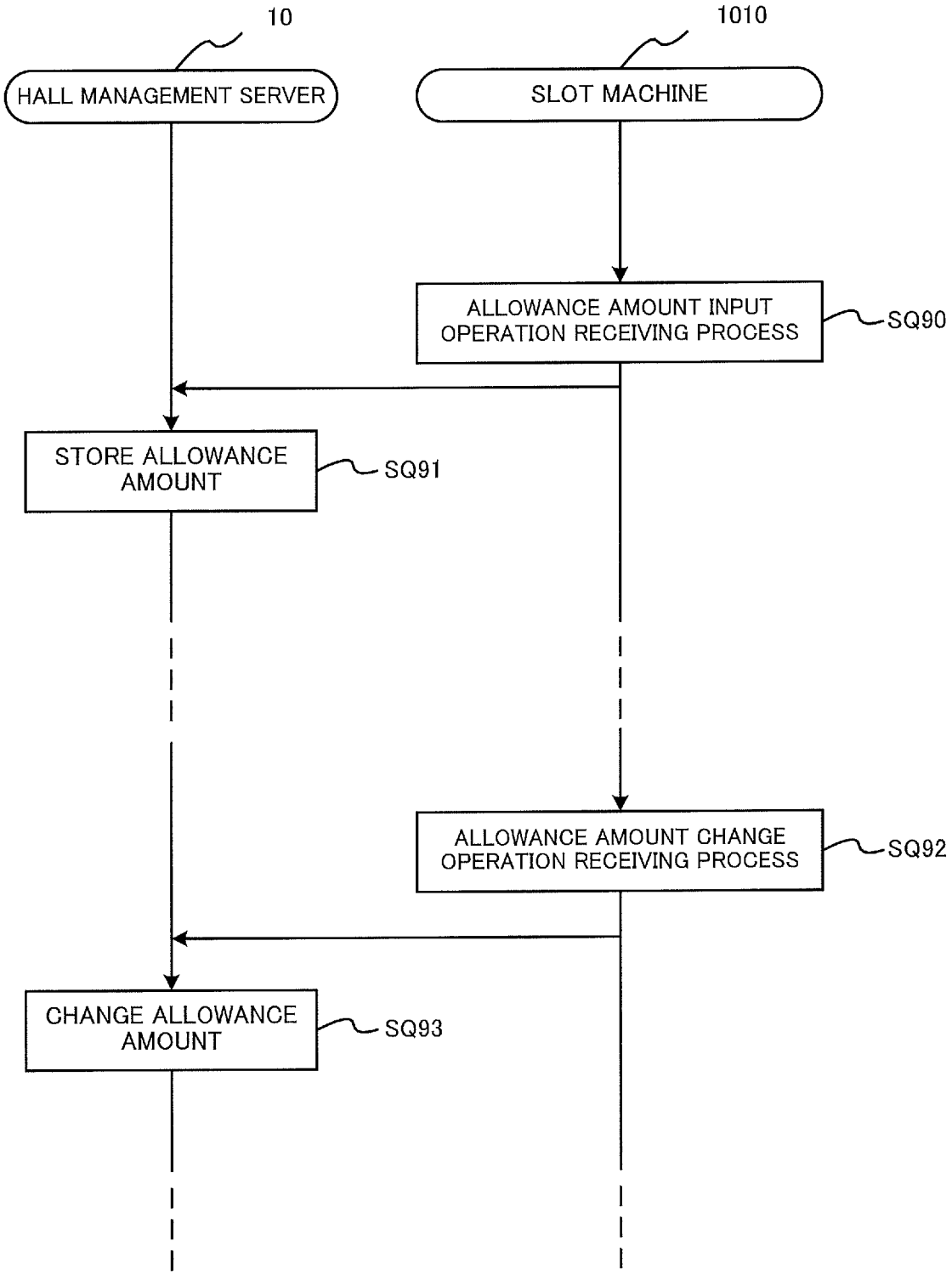
FIG. 37 exemplifies the flow sequence of the information providing service according to the embodiment of the present invention.

As the information providing service, a sequence shown in FIG. 37 may be adopted in addition to the sequence shown in FIG. 28A. Since SQ90 and SQ91 are similar to SQ10 and SQ11 shown in FIG. 28A, descriptions thereof are omitted.

FIG. 37 exemplifies a flow sequence of the information providing service. With this sequence, a general flow of the information providing service is described.

In SQ92, the slot machine 1010 performs an allowance amount change operation receiving process. More specifically, the slot machine 1010 receives an allowance amount change operation that is performed through the menu screen on the LCD 1719 of the PTS terminal 1700. Upon receiving the change operation, the slot machine 1010 transmits a change notification to the hall management server 10.

In SQ93, upon receiving the change notification, the hall management server 10 changes the allowance amount stored in the predetermined area of the external storage device 1404 (for example, updates or clears the value based on the change operation).

<First-H: Variation of Information Providing Service>

Figure 38:
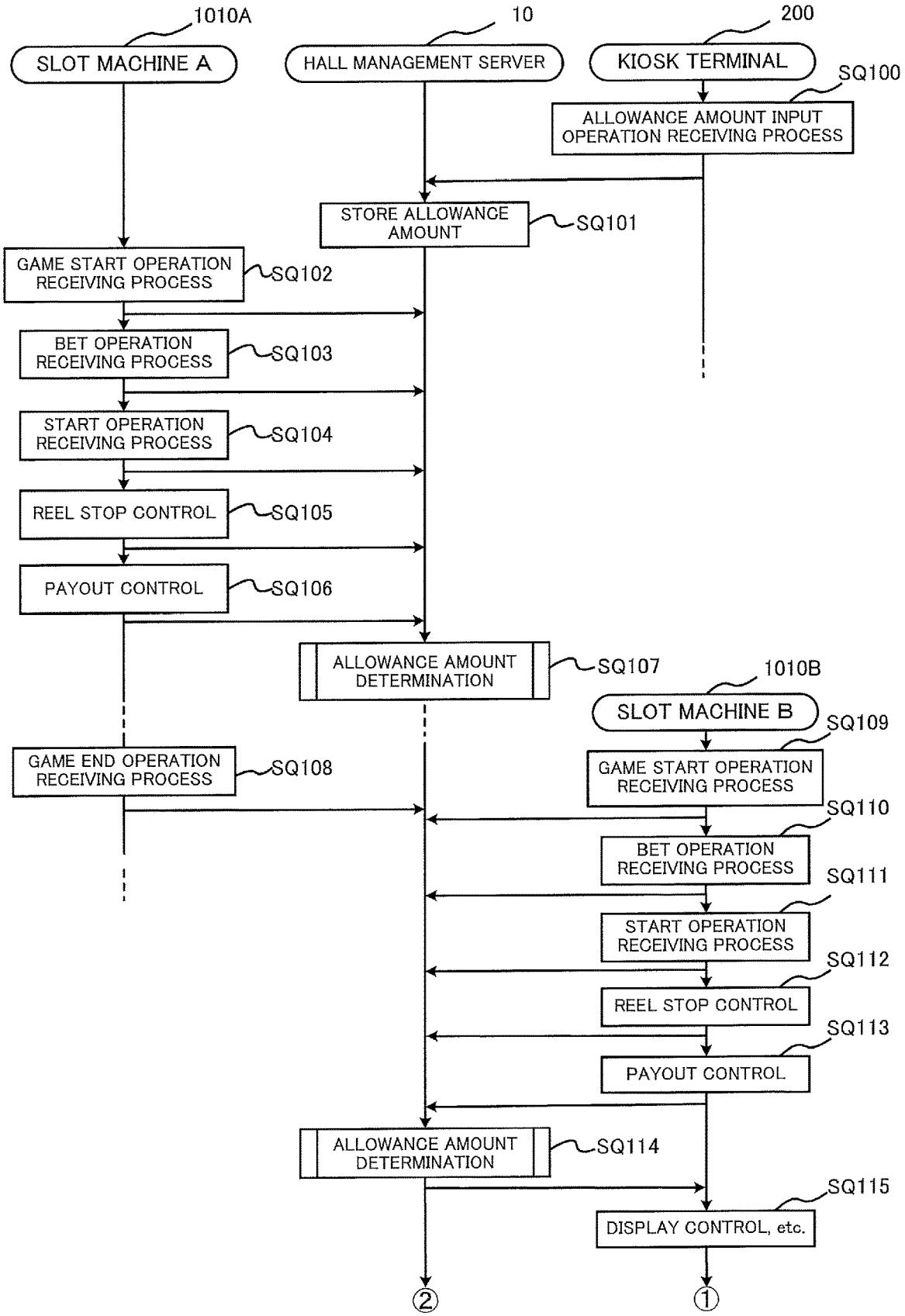
FIG. 38 exemplifies the flow sequence of the information providing service according to the embodiment of the present invention.

As the information providing service, a sequence shown in FIG. 38 may be adopted instead of the sequence shown in FIG. 28A. Since SQ100 to SQ107 are similar to SQ10 to SQ17 shown in FIG. 28A, descriptions thereof are omitted.

FIG. 38 exemplifies a flow sequence of the information providing service. With this sequence, a general flow of the information providing service is described.

In SQ108, the slot machine 1010A performs the game end operation receiving process. Upon determination that a game end operation is received, the slot machine 1010A transmits a session end notification (an example of the game information) to the hall management server 10.

In SQ109, the slot machine 1010B performs the game start operation receiving process. Upon receiving a game start operation, the slot machine 1010B transmits a session start notification to the hall management server 10.

In SQ110, the slot machine 1010B performs a BET operation receiving process. Upon receiving the BET operation, the slot machine 1010B transmits BET information to the hall management server 10.

In SQ111, the slot machine 1010B performs a start operation receiving process. Upon receiving a start operation, the slot machine 1010B transmits a play start notification to the hall management server 10.

In SQ112, the slot machine 1010B performs the reel stop control. The slot machine 1010B transmits information about a combination of stopped symbols to the hall management server 10.

In SQ113, the slot machine 1010B performs the payout control. For example, the slot machine 1010B transmits the number of payouts determined in the number-of-payouts determination process, together with a play end notification, to the hall management server 10.

In SQ114, upon receiving the play end notification, the hall management server 10 performs the allowance amount determination. Upon determination that the allowance amount is reached, the hall management server 10 transmits announcement information to the slot machine 1010B, the announcement information being for announcing the information contributing to anti-addiction.

In SQ115, upon receiving the announcement information, the slot machine 1010B performs the display control and the like.

In the above-described configuration, in a case where a player playing a game on one slot machine 1010 moves to another slot machine 1010 to play the game, information that encourages the player not to play the game is announced by said another slot machine 1010 upon determination that the cumulative amount consumed by the player reaches the allowance amount on said another slot machine 1010. Accordingly, the player can stop the game in accordance with the announcement even though the player changes the slot machine 1010 and plays the game, so that a situation in which the player becomes addicted to the game can be avoided. The movement of this player to said another slot machine 1010 can be identified based on the IC card 1500 inserted into the PTS terminal 1700.

Second Embodiment

In this embodiment, a method for preventing addiction by detecting an addicted player is mainly described. Configurations of this embodiment different from those of the first embodiment are mainly described. Configurations identical to those of the first embodiment are given reference signs identical thereto, and descriptions thereof are omitted as appropriate.

Figure 39:
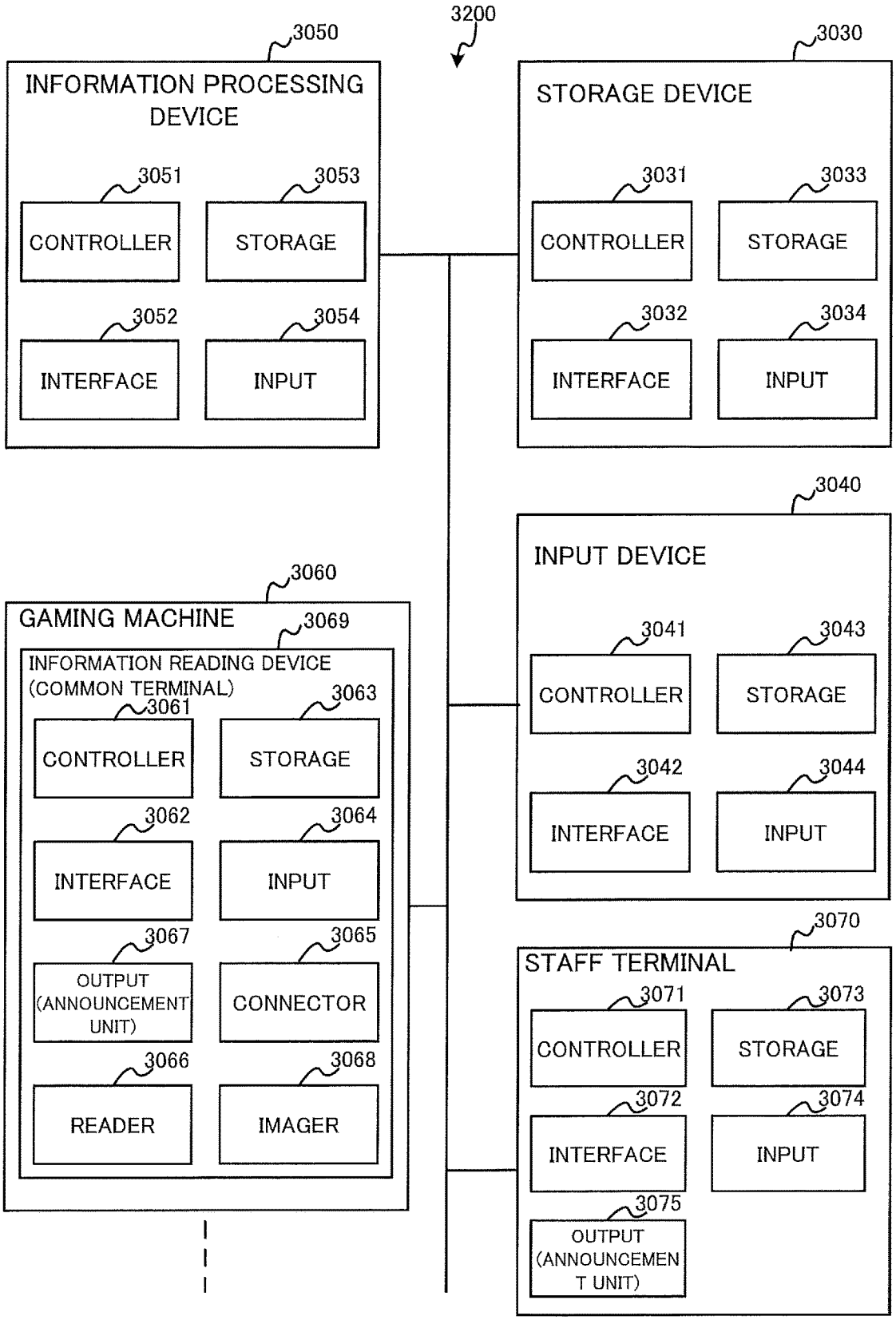
FIG. 39 shows a configuration of an information providing system according to another embodiment of the present invention.

FIG. 39 exemplifies a system (information providing system 3200) capable of providing the information contributing to anti-addiction. The information providing system 3200 includes a storage device 3030, an input device 3040, an information processing device 3050, a gaming machine 3060, and a staff terminal 3070.

(Staff Terminal 3070)

The staff terminal 3070 includes a controller 3071, an interface 3072, a storage 3073, an input 3074, and an output 3075.

The controller 3071 is operable to control the interface 3072, the storage 3073, the input 3074, and the output 3075. The controller 3071 is operable to perform a process of, for example, storing information received via the interface 3072 into the storage 3073. A CPU (Central Processing Unit), an MCU (Micro-Controller Unit), a motherboard, or the like, functions as the controller 3071.

The interface 3072 is communicable with an apparatus connected to a network. For example, a communication apparatus for wired communication or wireless communication (e.g., a communication module for a wired LAN, a wireless LAN, or mobile phone communication) functions as the interface 3072.

The storage 3073 is operable to store various information (e.g., programs and tables concerning a control of the information providing system 3200). A ROM (Read Only Memory), a RAM (Random Access Memory), a silicon disk, a hard disk, or the like, functions as the storage 3073.

For example, the CPU reads programs and table data stored in the ROM or the like and executes them on the RAM, to implement various functions of the staff terminal 3070.

The input 3074 is operable to input various information to the staff terminal 3070 based on a user operation. An input/output interface as exemplified by a USB terminal, a physical button, a physical keyboard, a mouse, a user interface provided on a liquid crystal touch panel, or the like, functions as the input 3074.

The output 3065 is operable to output various information received via the interface 3062. A display as exemplified by a liquid crystal display device, a light emitting member as exemplified by an LED (Light Emitting Diode), a speaker that outputs sound, voice, etc., a vibration generator as exemplified by a motor that generates vibrations, or the like, functions as the output 3065.

The staff terminal 3070 is an information processing device (a tablet terminal, an information display terminal, a portable terminal, a radio, a mobile phone, a smart phone, a wearable terminal, a personal computer, etc.) used by an arcade staff. The staff terminal 3070 receives various data from each of the storage device 3030, the input device 3040, the information processing device 3050, and the gaming machine 3060, displays the various data, and requests the various data of each of the devices.

[Description of Game System]

Figure 40:
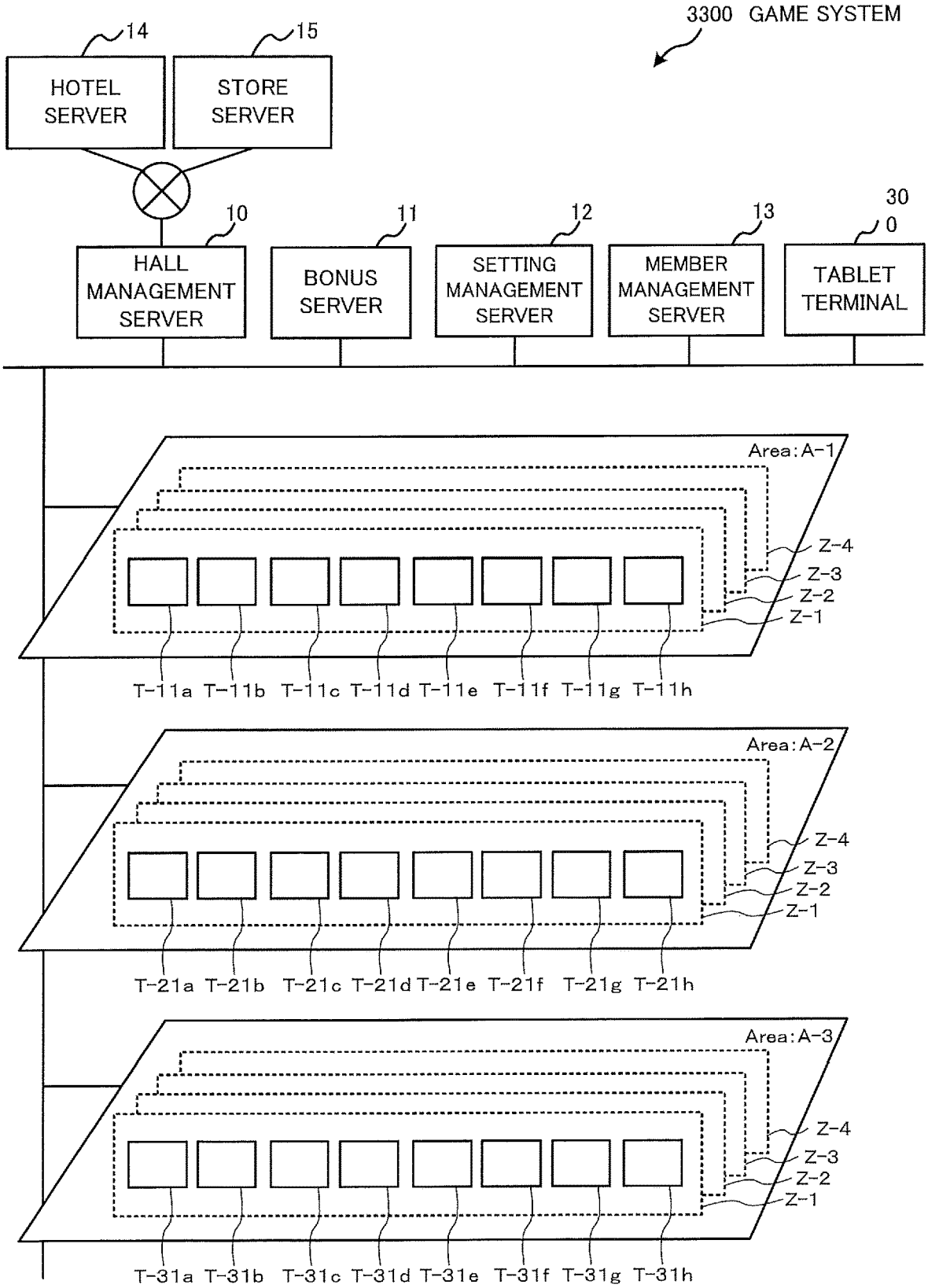
FIG. 40 schematically shows a game system according to another embodiment of the present invention.

Outline of a game system is described with reference to FIG. 40. FIG. 40 is an outline diagram schematically showing an overall configuration of a game system 3300 according to a second embodiment.

The game system 3300 includes the hall management server 10, the bonus server 11, the setting management server 12, the member management server 13, the hotel server 14, the store server 15, a tablet terminal 300, the gaming machines, the kiosk terminals, and the signages.

The tablet terminal 300 is a terminal that an arcade staff uses in order to perceive the situation (people, things, etc.) in the arcade. For example, the tablet terminal 300 receives and displays information about an addicted player which is transmitted from the hall management server 10. This enables the staff to perceive the addicted player, so that anti-addiction measures can be taken.

[Configuration of Tablet Terminal]

Figure 41:
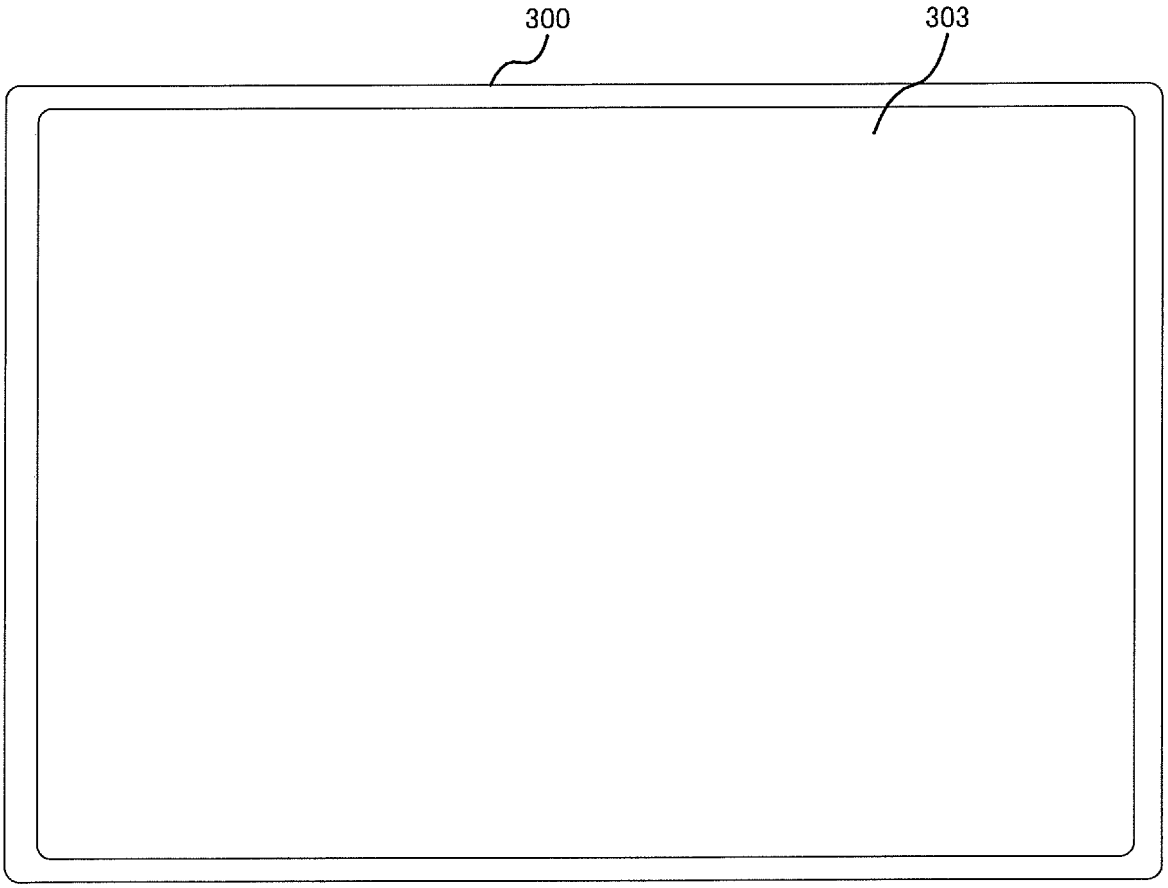
FIG. 41 shows an overall structure of a tablet terminal according to another embodiment of the present invention.

FIG. 41 exemplifies the tablet terminal 300. The tablet terminal 300 is connected to, for example, the hall management server 10 of the game system 3300 via a network.

The tablet terminal 300 includes an LCD 303 and the like. The LCD 303 is a liquid crystal display device of 10.1 inches, for example. The LCD 303 displays information about an addicted player, and the like. The LCD 303 has a touch panel function to receive an operation for switching the screen among a list screen, an individual screen, and a detail screen, for example (see FIGS. 44B and 44C)

[Circuit Configuration of Tablet Terminal]

Figure 42:
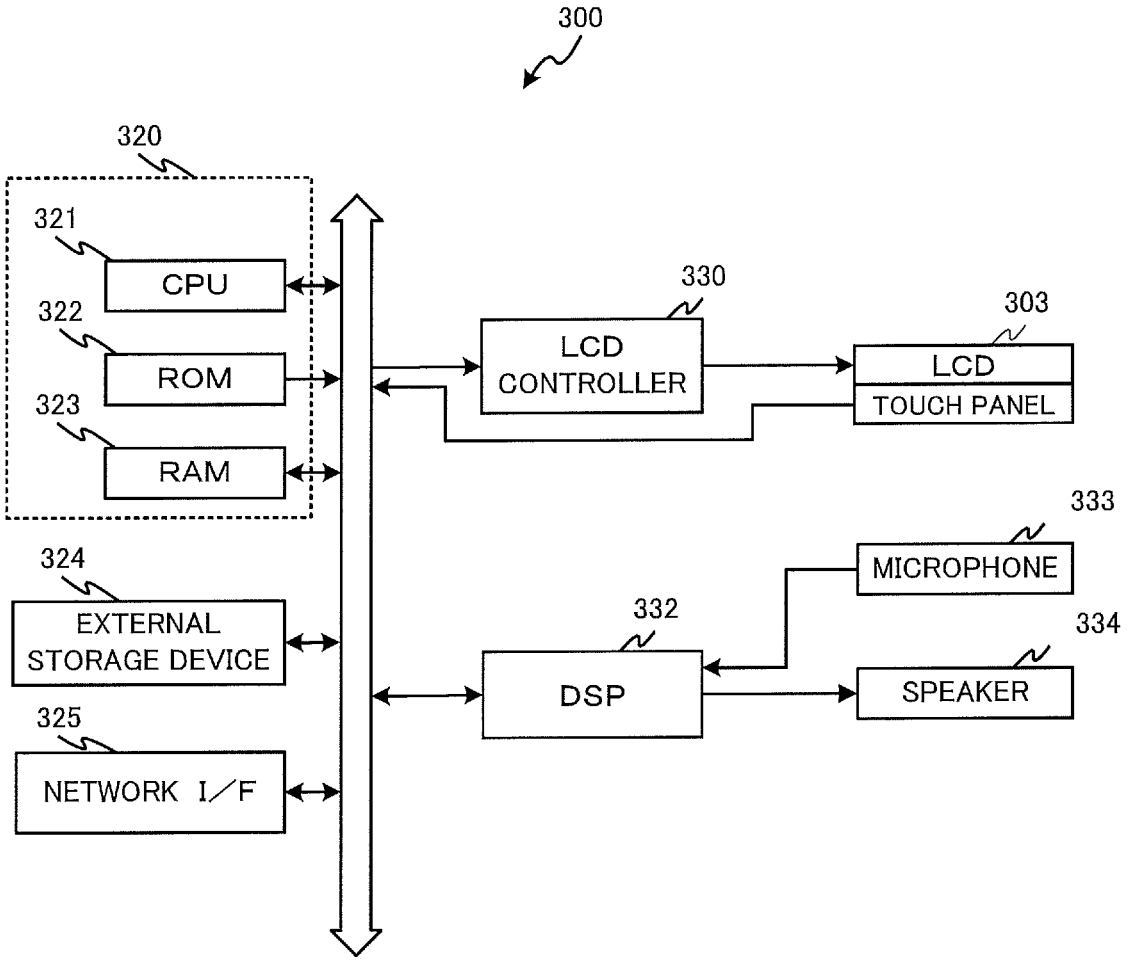
FIG. 42 shows a circuit configuration of the tablet terminal according to another embodiment of the present invention.

Next, a configuration of a circuit included in the tablet terminal 300 is described with reference to FIG. 42.

A tablet terminal controller 320 that controls the tablet terminal 300 includes a CPU 321, a ROM 322, and a RAM 323.

The CPU 321 controls operations of respective parts of the tablet terminal 300, executes various programs stored in the ROM 322, and performs calculation.

The ROM 322 includes a memory device such as a flash memory, and stores permanent data to be executed by the CPU 321.

The RAM 323 temporarily stores data necessary for executing the various programs stored in the ROM 322.

An external storage device 324, which is a storage device such as a hard disk device, stores programs to be executed by the CPU 321 and data used for the programs to be executed by the CPU 321.

A network I/F (interface) 325 implements data communication with the PTS terminal 1700 and servers including the hall management server 10, the bonus server 11, the member management server 13, and the like.

An LCD controller 330 controls the LCD 303 so as to display various information. The LCD 303 has a touch panel function to transmit a user operation to the CPU 321.

A DSP 332 receives voice data obtained from a microphone 333, performs predetermined processing thereon, and then transmits the resultant data to the CPU 321. The DSP 332 transmits the received voice data to a speaker 334, for outputting.

The tablet terminal 300 may be provided with various sensors including a motion sensor as exemplified by a camera, an enter button, a gyro, a digital compass, an illuminance sensor, and the like.

[Information Providing Service]

Figure 43A:
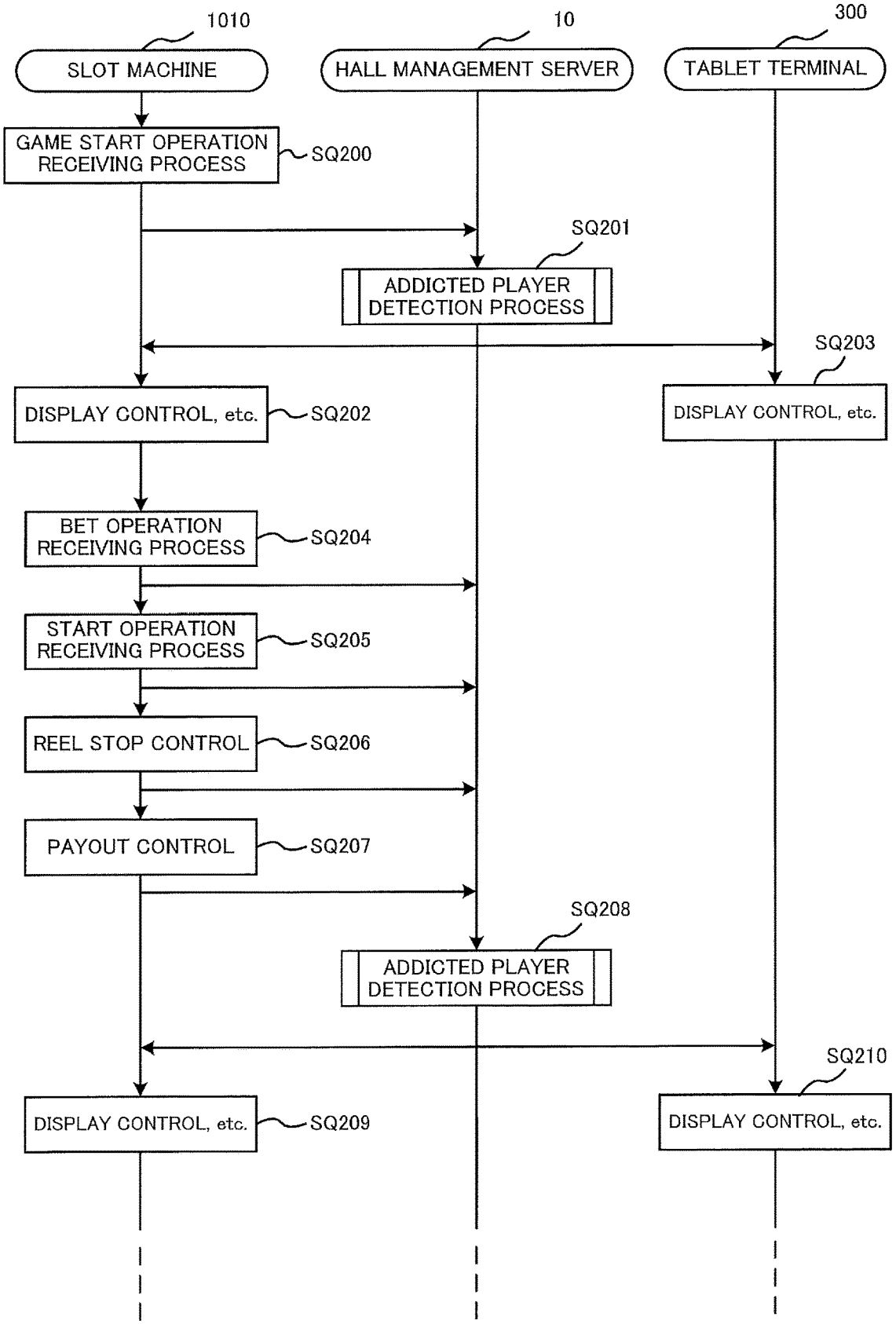
FIG. 43A exemplifies a flow sequence of an information providing service according to another embodiment of the present invention.

FIG. 43A exemplifies a flow sequence of the information providing service. With this sequence, a general flow of the information providing service is described. Since SQ204 to SQ207 are similar to SQ13 to SQ16 shown in FIG. 28A, descriptions thereof are omitted. Since SQ209 and SQ210 are similar to SQ202 and SQ203, descriptions thereof are omitted.

In SQ200, the slot machine 1010 performs a game start operation receiving process. More specifically, upon receiving an operation for starting a session such as insertion of the IC card 1500 into the PTS terminal 1700, the slot machine 1010 transmits a session start notification (an example of the game information) to the hall management server 10.

In SQ201, upon receiving the session start notification, the hall management server 10 updates the session start time/date, etc., in the session history table shown in FIG. 27B, and performs an addicted player detection process. In the addicted player detection process, whether or not the player is an addicted player is determined based on the game information, though details will be given later. Upon determination that the player is an addicted player, the hall management server 10 transmits announcement information to the slot machine 1010 and the tablet terminal 300, the announcement information being for announcing the information contributing to anti-addiction.

The announcement information includes announcement start information indicating that an announcement is started. Contents of the announcement (e.g., screen information, light-up pattern information, and voice information) may be either transmitted from the hall management server 10 or preliminarily stored in the PTS terminal 1700 and the tablet terminal 300.

In SQ202, upon receiving the announcement information, the slot machine 1010 performs a display control and the like. For example, the slot machine 1010 displays, on the LCD 1719 of the PTS terminal 1700, a screen for guiding the player not to play (see FIG. 44A, etc.). For example, the full-color LEDs 1721*a* and 1721*b* emit light in a pattern highlighting the announcement (e.g., flashing blue light). For example, the speakers 1707 and 1709 output a sound for guiding the player not to play (e.g., a voice saying "Why don't you take a rest today?").

In SQ203, upon receiving the announcement information, the tablet terminal 300 performs a display control and the like. For example, the tablet terminal 300 displays, on the LCD 303, a screen for guiding the player not to play (see FIGS. 44B, 44C, etc.). For example, the speaker 334 outputs a sound for guiding the player not to play (e.g., a voice saying "Please give guidance away from play.").

Here, a configuration is further adoptable in which the tablet terminal 300 is provided with a vibration generator so that the tablet terminal 300 vibrates in a pattern highlighting the announcement. A configuration is further adoptable in which the tablet terminal 300 is provided with a full-color LED that emits light in a pattern highlighting the announcement.

In this configuration, an addicted player is detected, and information for guiding the addicted player not to play the game is announced to the addicted player, a staff, and the like, so that a situation in which the addicted player becomes addicted to the game can be avoided.

In this configuration, moreover, information for guiding a player not to play a game is announced at a time when the game is started, that is, at a time when the player is calm before becoming addicted to the game on the slot machine 1010, so that a situation in which the player becomes addicted to the game can be avoided.

In SQ208, upon receiving the play end notification, the hall management server 10 performs the addicted player detection process as well as updating of the payout amount, the benefit amount/loss amount, the play end time/date, etc., in the play history table shown in FIG. 27A. Upon detecting an addicted player, the hall management server 10 transmits announcement information to the slot machine 1010 and the tablet terminal 300, the announcement information being for announcing the information contributing to anti-addiction.

In this configuration, game information is stored each time a player plays a game, and upon determination that the player is an addicted player, information for guiding the player not to play is announced.

This configuration is able to determine whether or not a player is likely to be addicted, even in a case where there is no history of game information of the player (for example, in a case of a non-member).

In this configuration, therefore, the information for guiding a player not to play a game is announced to a staff, a player who is determined to be likely to be addicted to the game, and the like, even though the player is a non-member; and thus a situation in which the player becomes addicted to the game can be avoided.

Figure 43B:
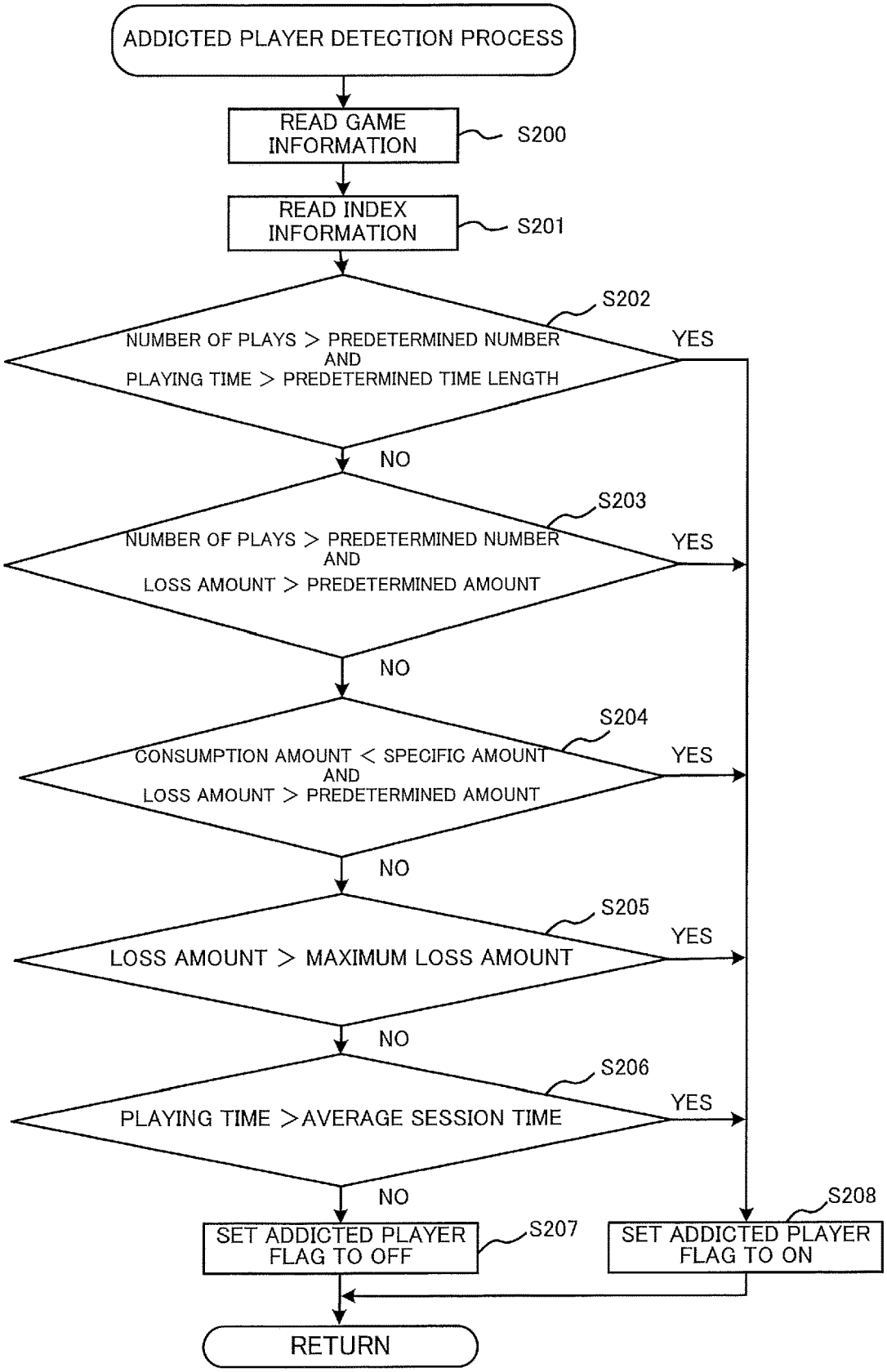
FIG. 43B exemplifies a flowchart of an addicted player detection process according to another embodiment of the present invention.

FIG. 43B exemplifies a flowchart of the addicted player detection process.

In S200, the CPU 1401 reads game information from a predetermined storage area of the external storage device 1404. After completing this processing, the CPU 1401 proceeds to S201.

In S201, the CPU 1401 reads index information (a predetermined number of times that is preliminarily specified, a predetermined time length that is preliminarily specified, a specific amount that is preliminarily specified, a predetermined amount that is preliminarily specified, a maximum loss amount, an average game time, etc.) from a predetermined storage area of the external storage device 1404. After completing this processing, the CPU 1401 proceeds to S202.

In S202, the CPU 1401 refers to the play history table shown in FIG. 27A and the like, to determine whether or not the number of plays in the current session reaches the predetermined number of times and additionally a playing time in the current session reaches the predetermined time length. Upon determination that both of the conditions are satisfied, the CPU 1401 proceeds to S208, while upon determination that at least either one of the conditions is not satisfied, the CPU 1401 proceeds to S203.

Processing in S202 is not limited to the one illustrated above.

For example, a configuration may be adoptable in which whether or not the number of today's plays reaches the predetermined number of times and additionally the today's playing time reaches the predetermined time length is determined.

For example, a configuration may be adoptable in which whether or not the number of plays within a predetermined time length (for example, within two hours) reaches the predetermined number of times and additionally a playing time within a predetermined time length (for example, within two hours) reaches the predetermined time length is determined.

For example, a configuration may be adoptable in which whether or not the cumulative number of plays reaches the predetermined number of times and additionally a cumulative playing time reaches the predetermined time length is determined.

In S203, the CPU 1401 refers to the play history table shown in FIG. 27A and the like, to determine whether or not the number of plays in the current session reaches the predetermined number of times and additionally the loss amount in the current session reaches the predetermined amount. Upon determination that both of the conditions are satisfied, the CPU 1401 proceeds to S208, while upon determination that at least either one of the conditions is not satisfied, the CPU 1401 proceeds to S204. The predetermined number of times employed in S202 and the predetermined number of times employed in S203 may have either the same value or different values.

The processing of S203 is not limited to the one illustrated above.

For example, a configuration may be adoptable in which whether or not the number of today's plays reaches the predetermined number of times and additionally the today's loss amount reaches the predetermined amount is determined.

For example, a configuration may be adoptable in which whether or not the number of plays within a predetermined time length (for example, within two hours) reaches the predetermined number of times and additionally the loss amount within a predetermined time length (for example, within two hours) reaches the predetermined amount is determined.

For example, a configuration may be adoptable in which whether or not the cumulative number of plays reaches the predetermined number of times and additionally the cumulative loss amount reaches the predetermined amount is determined.

In S204, the CPU 1401 refers to the play history table shown in FIG. 27A and the like, to determine whether or not the consumption amount in the current session is less than the specific amount and additionally the loss amount in the current session reaches the predetermined amount. Upon determination that both of the conditions are satisfied, the CPU 1401 proceeds to S208, while upon determination that at least either one of the conditions is not satisfied, the CPU 1401 proceeds to S205. The predetermined amount employed in S203 and the predetermined amount employed in S204 may have either the same value or different values.

The processing of S204 is not limited to the one illustrated above.

For example, a configuration may be adoptable in which whether or not the today's consumption amount is less than the specific amount and additionally the today's loss amount reaches the predetermined amount is determined.

For example, a configuration may be adoptable in which whether or not the consumption amount within a predetermined time length (for example, within two hours) is less than the specific amount and additionally the loss amount within a predetermined time length (for example, within two hours) reaches the predetermined amount is determined.

For example, a configuration may be adoptable in which whether or not the cumulative consumption amount is less than the specific amount and additionally the cumulative loss amount reaches the predetermined amount is determined.

In S205, the CPU 1401 refers to FIG. 27C, to determine whether or not the loss amount in the last play reaches the maximum loss amount. Upon determination that the loss amount in the last play reaches the maximum loss amount, the CPU 1401 proceeds to S208, while upon determination that the loss amount in the last play does not reach the maximum loss amount, the CPU 1401 proceeds to S206.

In S206, the CPU 1401 refers to the table of FIG. 27C, to determine whether or not a playing time in the current session reaches the average session time. Upon determination that the playing time in the current session reaches the average session time, the CPU 1401 proceeds to S208, while upon determination that the playing time in the current session does not reach the average session time, the CPU 1401 proceeds to S207.

In S207, the CPU 1401 sets an addicted player flag to OFF, and terminates the addicted player detection process.

In S208, the CPU 1401 sets the addicted player flag to ON, and terminates the addicted player detection process.

The addicted player detection process is not limited to the one illustrated above. The configuration in which the addicted player flag is set to ON upon satisfaction of any of the conditions of S202 to S206 is not limiting, and for example, a configuration in which the addicted player flag is set to ON upon satisfaction of two or more conditions (an arbitrary combination of conditions) may be adoptable. In other words, a configuration may be adoptable in which the addicted player flag is set to ON upon determination that specific game information exceeds a predetermined threshold value.

Figure 44A:
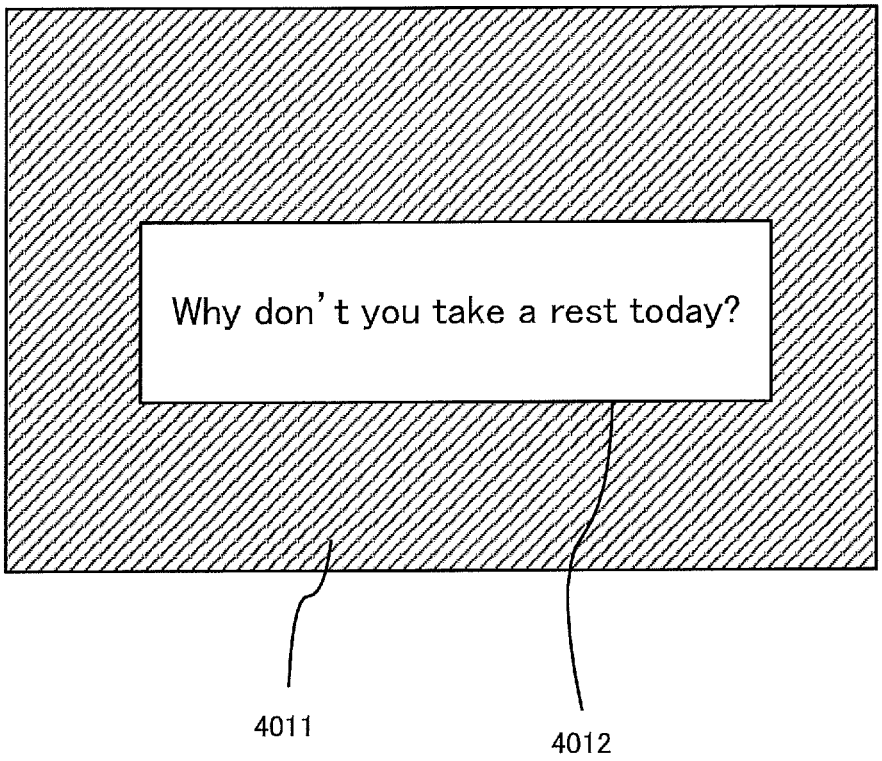
FIG. 44A exemplifies a display screen according to another embodiment of the present invention.

FIG. 44A exemplifies a display screen (a screen 4011) of the LCD 1719. The screen 4011 has a message display area 4012. The message display area 4012 displays the information contributing to anti-addiction (in this example, "Why don't you take a rest today?").

Figure 44B:
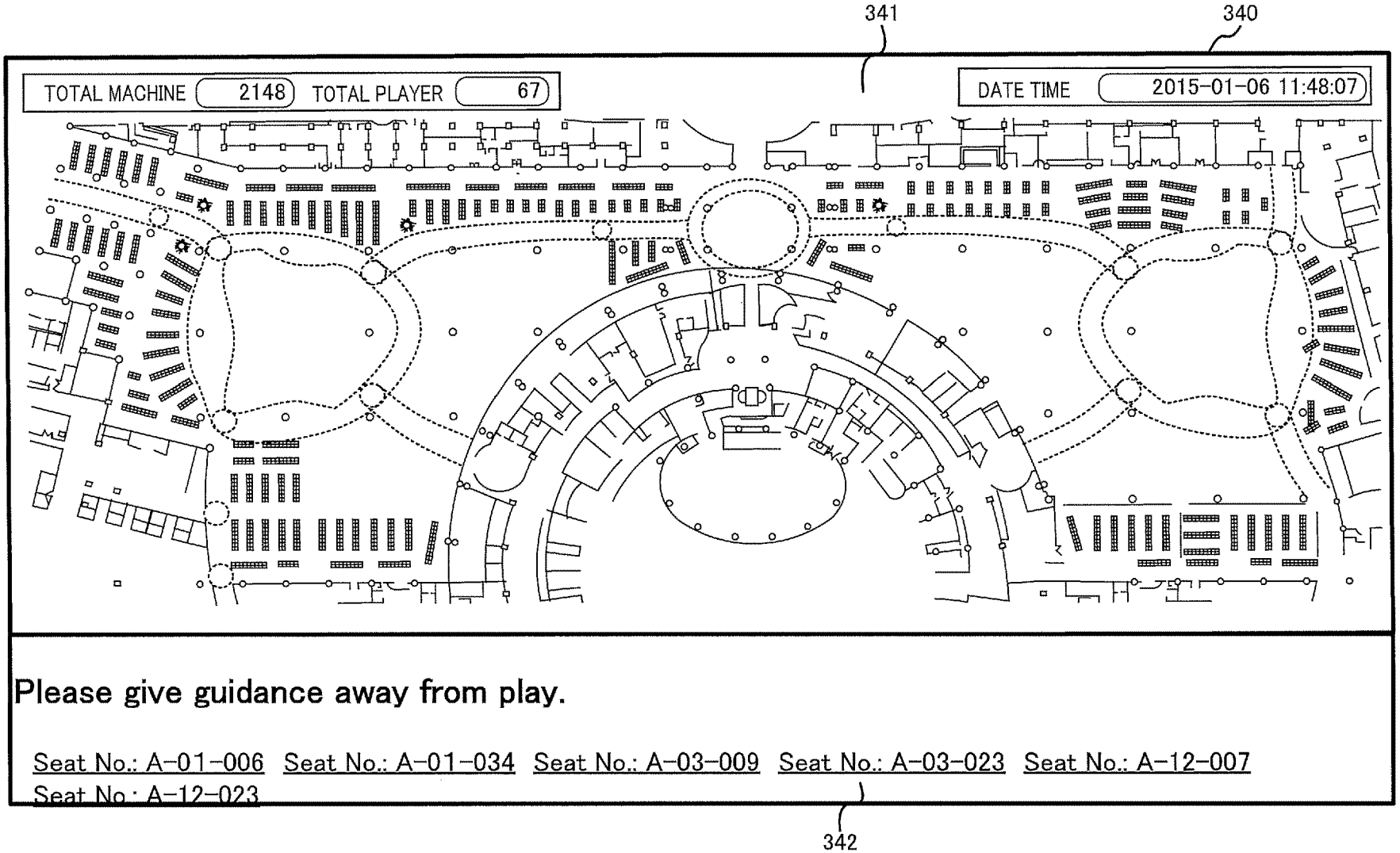
FIG. 44B exemplifies a display screen according to another embodiment of the present invention.

FIG. 44B exemplifies a display screen (a screen 340) of the LCD 303. The screen 340 has a floor map display area 341 and a message display area 342, in which the information contributing to anti-addiction is presented.

The floor map display area 341 displays a floor map of the floor where the staff is located. On the floor map, slot machines 1010 at which players to be guided not to play are seated are identifiably displayed (e.g., displayed in flashing).

The message display area 342 displays a list of the slot machines 1010 (guidance objects) at which the players to be guided against playing are seated (in this example, "Please give guidance away from play. Seat No.: A-01-006, . . . " is displayed). The guidance object is provided with a link, and in response to the staff pressing the link, details of the pressed (selected) guidance object are displayed (individual display) (FIG. 44C).

Figure 44C:
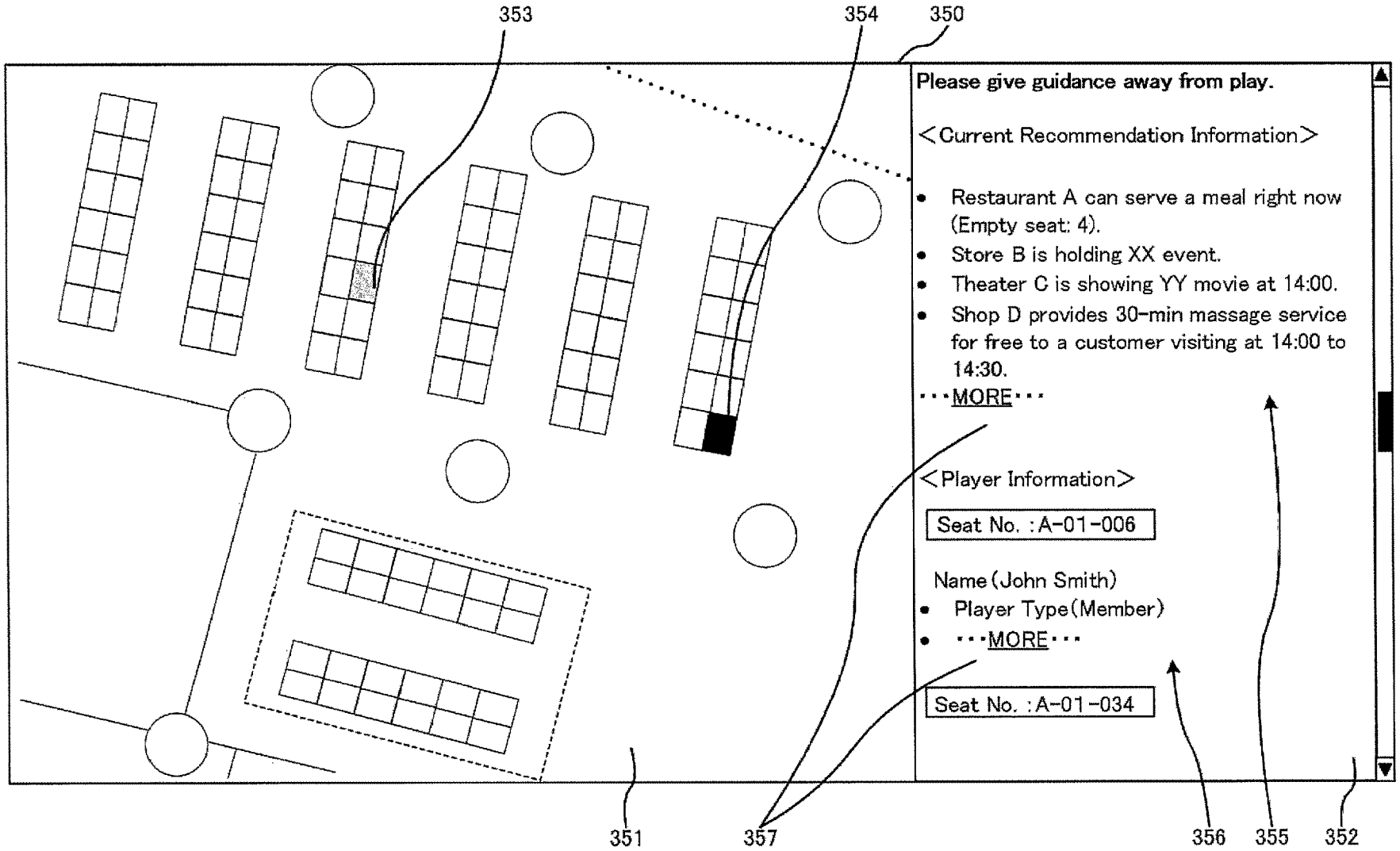
FIG. 44C exemplifies a display screen according to another embodiment of the present invention.

FIG. 44C exemplifies a display screen (a screen 350) of the LCD 303. The screen 350 has a floor map display area 351 and a message display area 352, in which the information contributing to anti-addiction is presented.

The floor map display area 351 zooms a part of the floor map in such a manner that the selected guidance object (e.g., the guidance object 353) is identifiable. When the zoomed part of the floor map includes another guidance object (e.g., the guidance object 354), said another guidance object is displayed in an identifiable manner, too.

The message display area 352 displays current recommendation information 355 and player information 356.

The current recommendation information 355 is the different facility information obtained from different facility servers such as the hotel server 14 and the store server 15.

The current recommendation information 355 is information that can be advantageous to the addicted player. Preferably, for example, the current recommendation information 355 has such contents that the advantage cannot be enjoyed unless an action is taken immediately (free of charge until XX o'clock, start at XX o'clock, etc.).

As the player information 356, the contents of the player management table shown in FIG. 24 are displayed. Information other than the name and the player type is displayed upon pressing of a link 357. In a case where the player is a non-member, the name field is blank and the player type field displays "non-member".

<Second-A: Variation of Information Providing Service>

This embodiment is not limited to the one illustrated above. As the information providing service, a sequence shown in FIG. 45A may be adopted instead of the sequence shown in FIG. 43A.

Figure 45A:
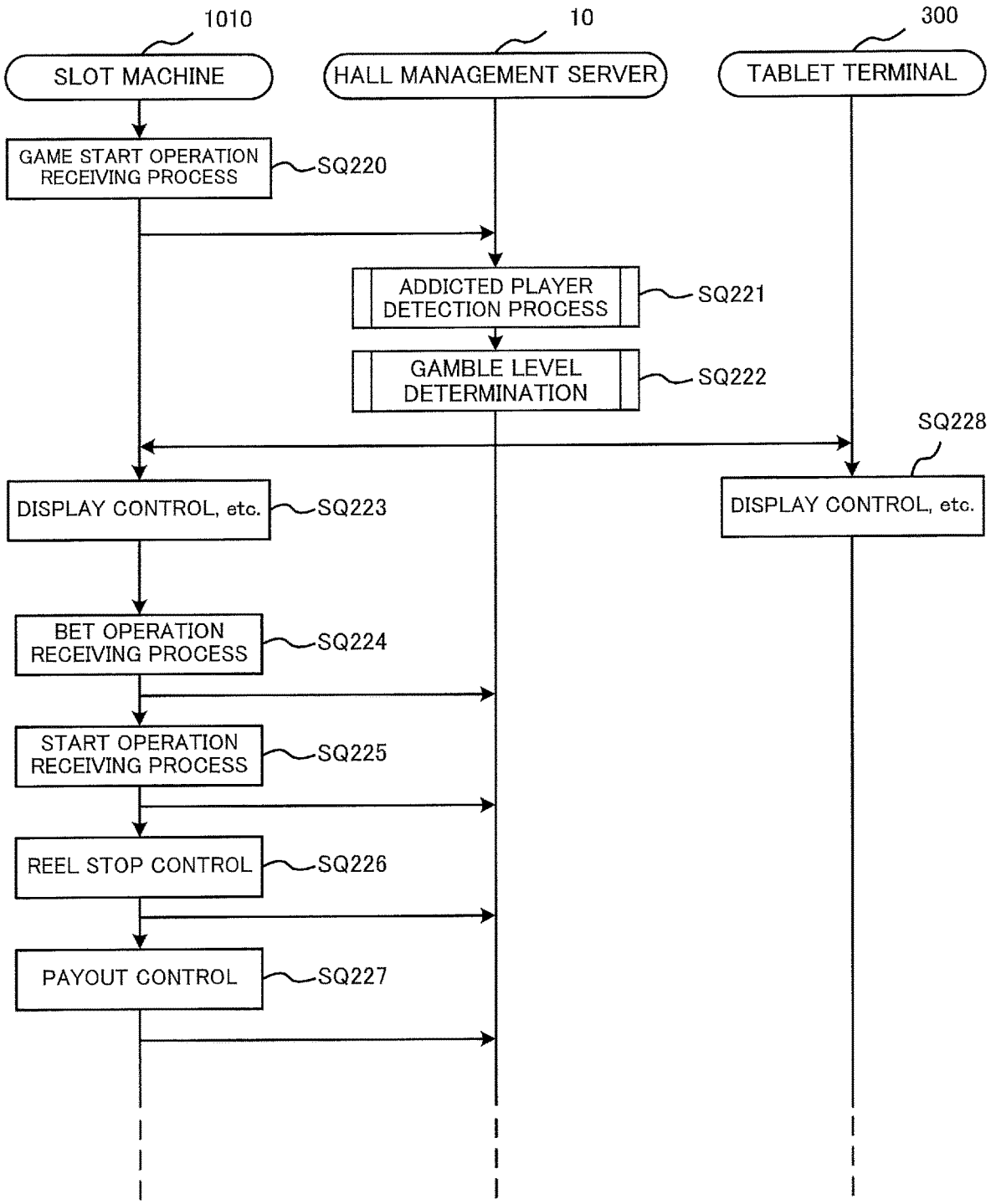
FIG. 45A exemplifies the flow sequence of the information providing service according to another embodiment of the present invention.

FIG. 45A exemplifies a flow sequence of the information providing service. With this sequence, a general flow of the information providing service is described. Since SQ220, SQ221, SQ223, and SQ228 are similar to SQ200 to SQ203 shown in FIG. 43A, descriptions thereof are omitted. Since SQ224 to SQ227 are similar to SQ13 to SQ16 shown in FIG. 28A, descriptions thereof are omitted.

In SQ222, upon detecting an addicted player, the hall management server 10 performs a gamble level determination. In the gamble level determination, whether or not the slot machine 1010 has a high gambling feature is determined, though details is given later. Upon determination that the gambling feature is high, the hall management server 10 transmits announcement information to the slot machine 1010 and the tablet terminal 300, the announcement information being for announcing the information contributing to anti-addiction.

In this configuration, when an addicted player is trying to play a game on a speculative slot machine 1010, information for guiding the addicted player not to play the game is announced on the slot machine 1010 and the tablet terminal 300, so that a situation in which the addicted player becomes addicted to the game can be avoided on the speculative slot machine.

Figure 45B:
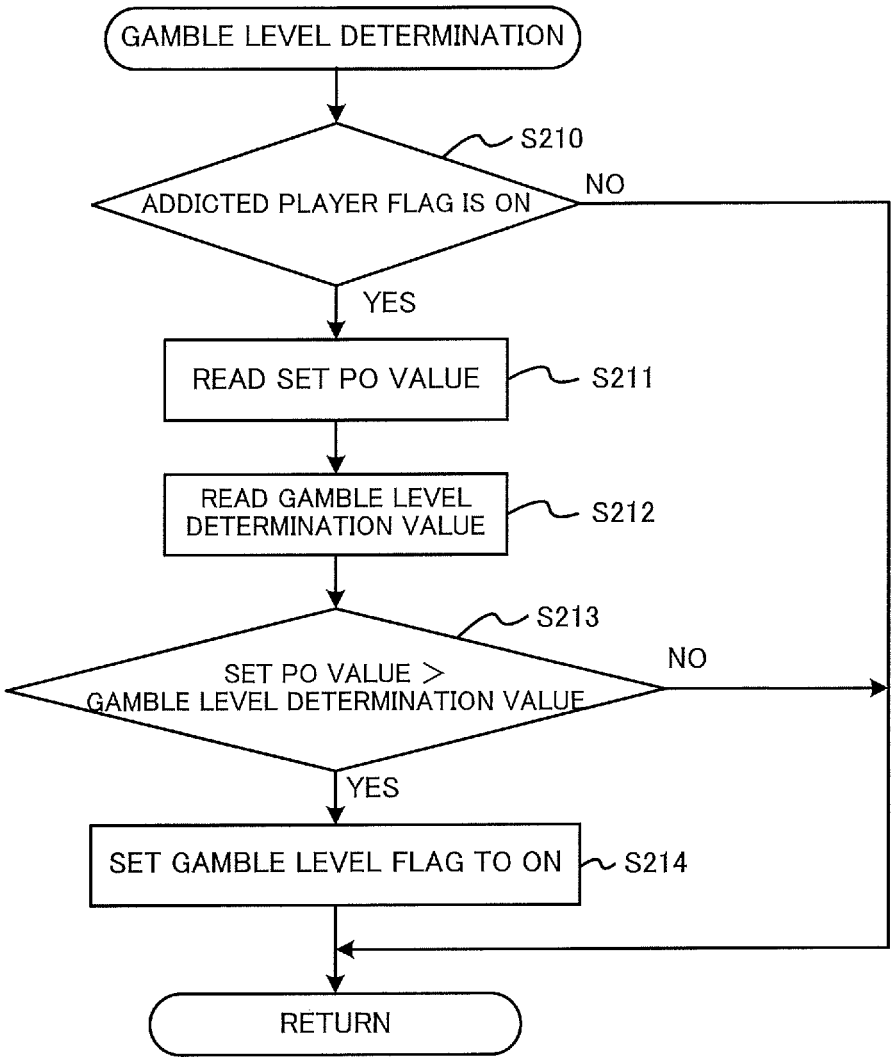
FIG. 45B exemplifies a flowchart of a gamble level determination according to another embodiment of the present invention.

FIG. 45B exemplifies a flowchart of the gamble level determination.

In S210, the CPU 1401 determines whether or not the addicted player flag is ON. Upon determination that the addicted player flag is ON, the CPU 1401 proceeds to S211, while upon determination that the addicted player flag is not ON, the CPU 1401 terminates the gamble level determination.

In S211, the CPU 1401 reads a set PO value (set payout rate) from a predetermined storage area of the external storage device 1404. After completing this processing, the CPU 1401 proceeds to S212.

In S212, the CPU 1401 reads a gamble level determination value from a predetermined storage area of the external storage device 1404. After completing this processing, the CPU 1401 proceeds to S213. The gamble level determination value is preliminarily stored in the predetermined storage area of the external storage device 1404 by the administrator or the like.

In S213, the CPU 1401 determines whether or not the set PO value is greater than the gamble level determination value. Upon determination that the set PO value is greater than the gamble level determination value, the CPU 1401 proceeds to S214, while upon determination that the set PO value is not greater than the gamble level determination value, the CPU 1401 terminates the gamble level determination.

In S214, the CPU 1401 sets a gamble level flag to ON, and terminates the gamble level determination.

<Second-B: Variation of Information Providing Service>

Figure 46A:
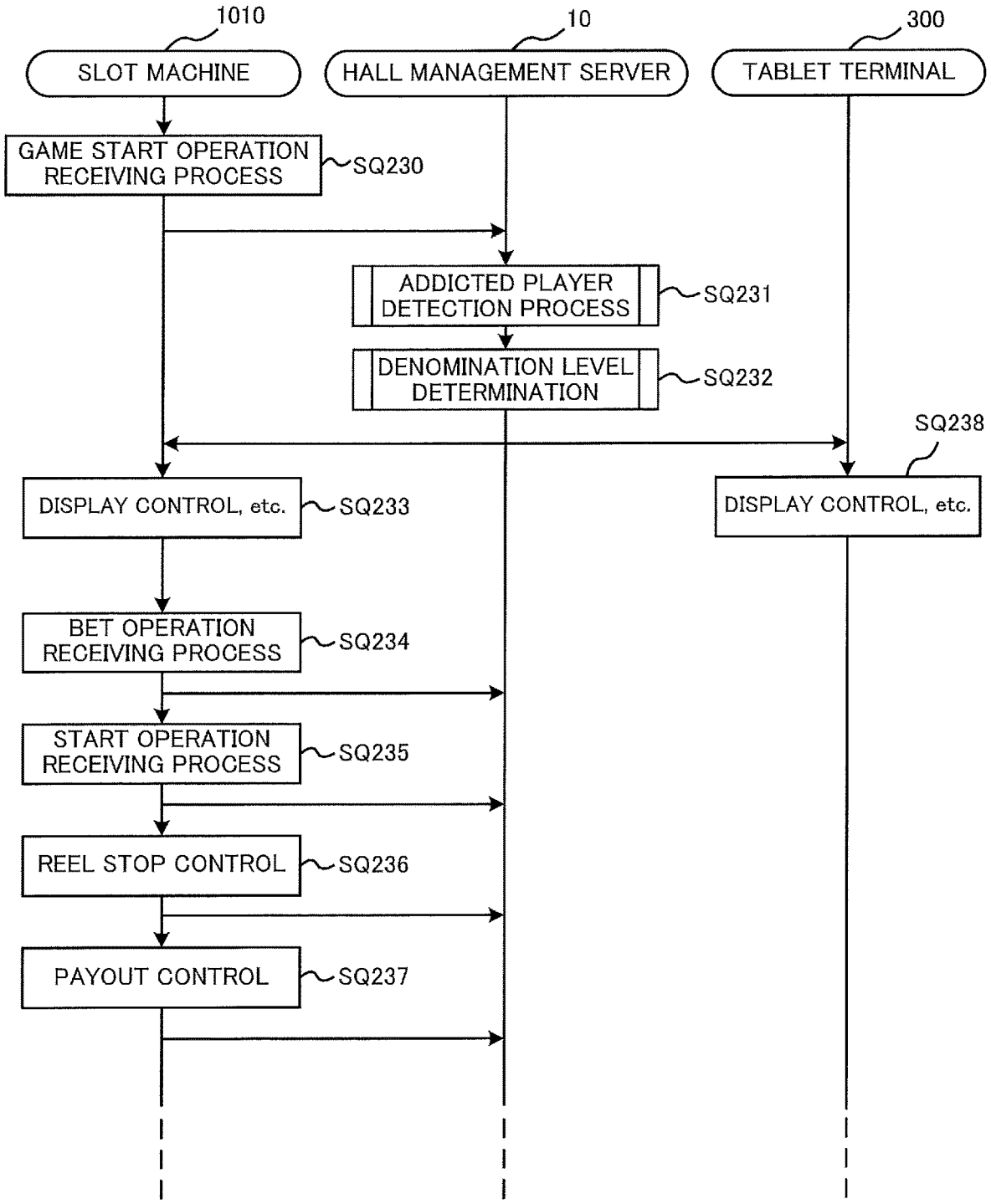
FIG. 46A exemplifies the flow sequence of the information providing service according to another embodiment of the present invention.

As the information providing service, a sequence shown in FIG. 46A may be adopted instead of the sequence shown in FIG. 43A.

FIG. 46A exemplifies a flow sequence of the information providing service. With this sequence, a general flow of the information providing service is described. Since SQ230, SQ231, SQ233, and SQ238 are similar to SQ200 to SQ203 shown in FIG. 43A, descriptions thereof are omitted. Since SQ234 to SQ237 are similar to SQ13 to SQ16 shown in FIG. 28A, descriptions thereof are omitted.

In SQ232, upon detecting an addicted player, the hall management server 10 performs a denomination level determination. In the denomination level determination, whether or not the slot machine 1010 has a high gambling feature is determined, though details will be given later. Upon determination that the gambling feature is high, the hall management server 10 transmits announcement information to the slot machine 1010 and the tablet terminal 300, the announcement information being for announcing the information contributing to anti-addiction.

In this configuration, when an addicted player is trying to play a game on a slot machine 1010 in which a high denomination value is set, information for guiding the addicted player not to play the game is announced on the slot machine 1010 and the tablet terminal 300, so that a situation in which the addicted player becomes addicted to the game can be avoided on the slot machine 1010 in which a high denomination value is set.

Figure 46B:
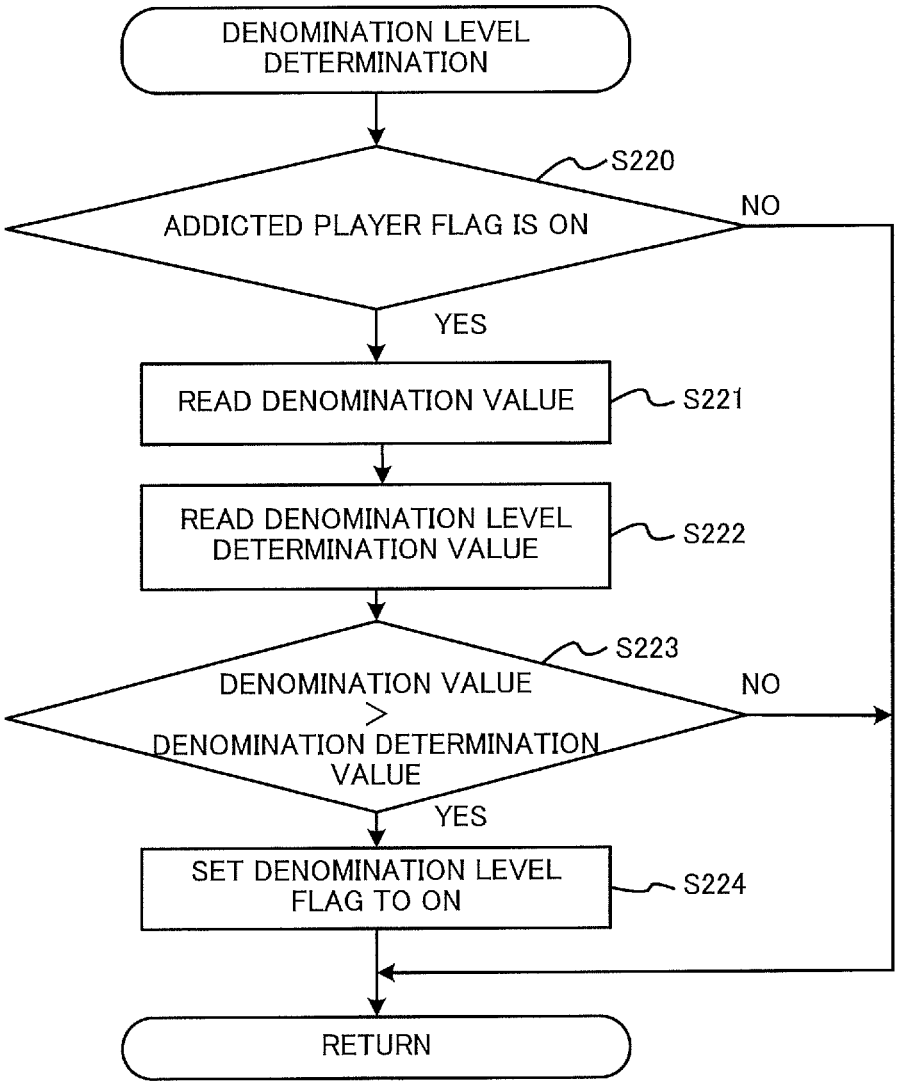
FIG. 46B exemplifies a flowchart of a denomination level determination according to another embodiment of the present invention.

FIG. 46B exemplifies a flowchart of the denomination level determination.

In S220, the CPU 1401 determines whether or not the addicted player flag is ON. Upon determination that the addicted player flag is ON, the CPU 1401 proceeds to S221, while upon determination that the addicted player is not ON, the CPU 1401 terminates the denomination level determination.

In S221, the CPU 1401 reads the denomination value from a predetermined storage area of the external storage device 1404. After completing this processing, the CPU 1401 proceeds to S222.

In S222, the CPU 1401 reads a denomination level determination value from a predetermined storage area of the external storage device 1404. After completing this processing, the CPU 1401 proceeds to S223. The denomination level determination value is preliminarily stored in the predetermined storage area of the external storage device 1404 by the administrator or the like.

In S223, the CPU 1401 determines whether or not the denomination value is greater than the denomination level determination value. Upon determination that the denomination value is greater than the denomination level determination value, the CPU 1401 proceeds to S224, while upon determination that the denomination value is not greater than the denomination level determination value, the CPU 1401 terminates the denomination level determination.

In S224, the CPU 1401 sets a denomination level flag to ON, and terminates the denomination level determination.

<Second-C: Variation of Information Providing Service>

Figure 47A:
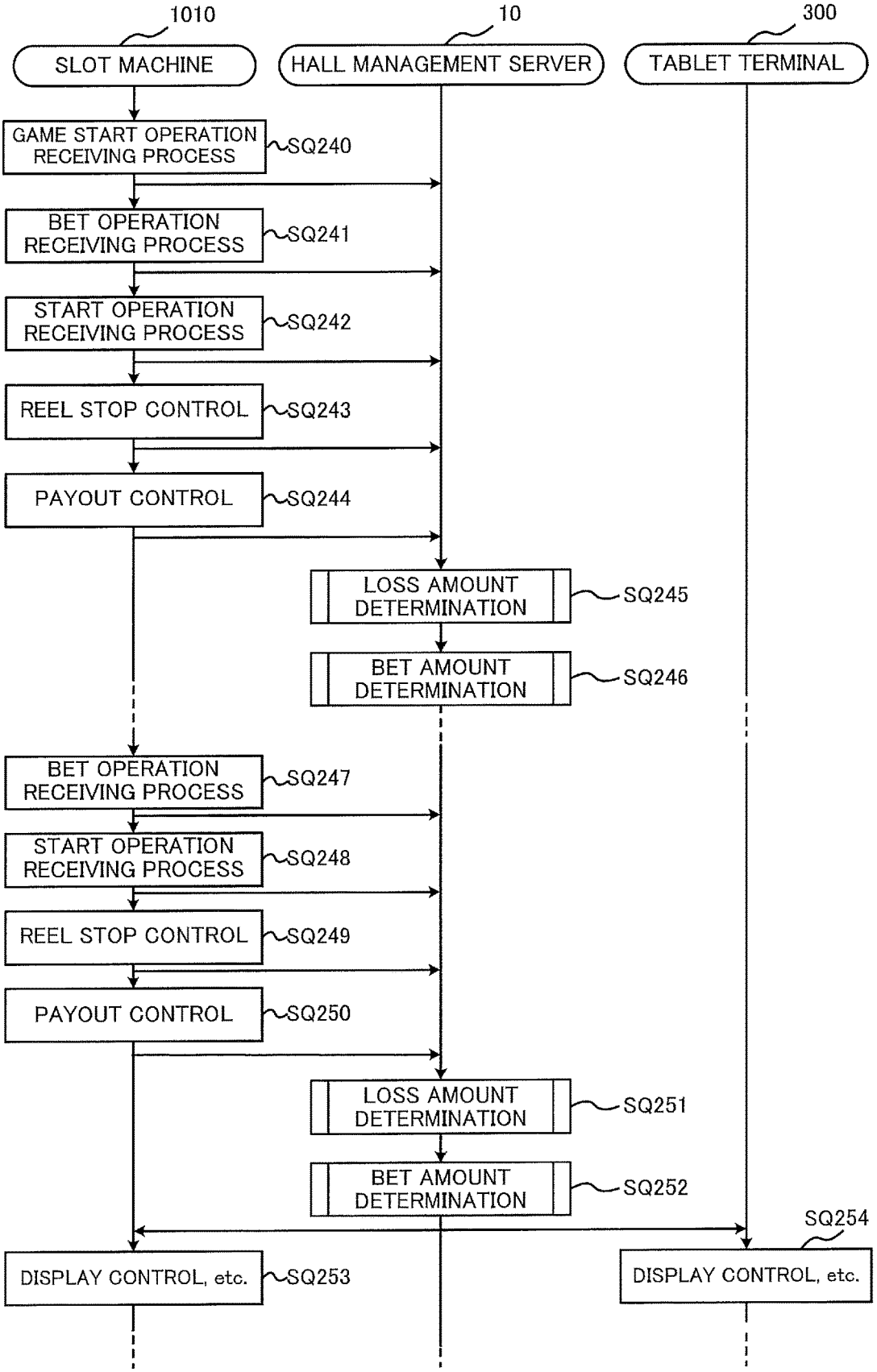
FIG. 47A exemplifies the flow sequence of the information providing service according to another embodiment of the present invention.

As the information providing service, a sequence shown in FIG. 47A may be adopted instead of the sequence shown in FIG. 43A.

FIG. 47A exemplifies a flow sequence of the information providing service. With this sequence, a general flow of the information providing service is described. Since SQ240 to SQ244 are similar to SQ12 to SQ16 shown in FIG. 28A, descriptions thereof are omitted. Since SQ247 to SQ250 are similar to SQ13 to SQ16 shown in FIG. 28A, descriptions thereof are omitted. Since SQ253 and SQ254 are similar to SQ202 and SQ203 shown in FIG. 43A, descriptions thereof are omitted.

In SQ245, upon receiving the play end notification, the hall management server 10 performs a loss amount determination as well as updating of the payout amount, the benefit amount/loss amount, the play end time/date, etc., in the play history table shown in FIG. 27A. In the loss amount determination, whether or not a loss greater than a predetermined amount is incurred is determined, though details will be given later.

In SQ246, the hall management server 10 performs a BET amount determination. In the BET amount determination, whether or not the BET amount is raised is determined, though details will be given later.

The loss amount determination and the BET amount determination are performed for each play. For example, in a situation where a plurality of plays are made, upon determining in SQ251 that a loss greater than the predetermined amount is incurred and determining in SQ252 that the BET amount is raised, the hall management server 10 transmits announcement information to the slot machine 1010 and the tablet terminal 300, the announcement information being for announcing the information contributing to anti-addiction.

Figure 47B:
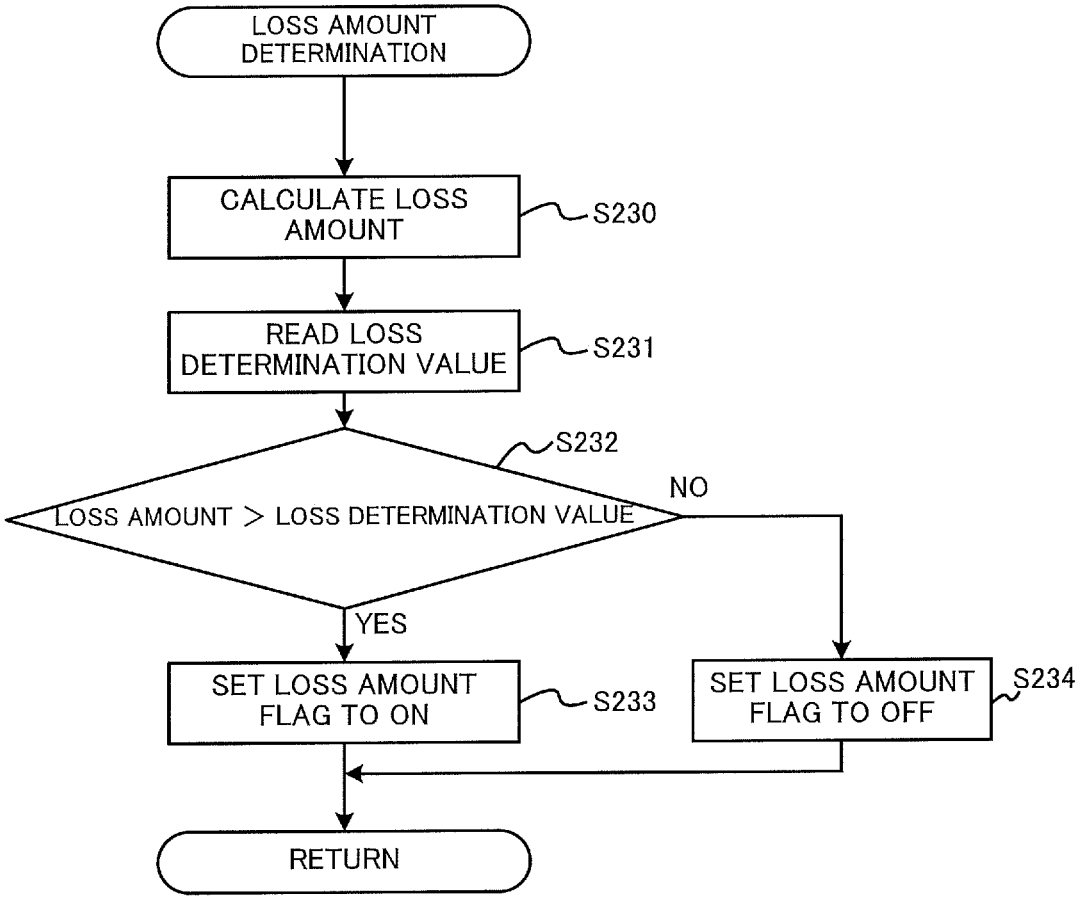
FIG. 47B exemplifies a flowchart of a loss amount determination according to another embodiment of the present invention.

FIG. 47B exemplifies a flowchart of the loss amount determination.

In S230, the CPU 1401 refers to the play history table shown in FIG. 27A and the like, to calculate the loss amount in the current session. After completing this processing, the CPU 1401 proceeds to S231.

In S231, the CPU 1401 reads a loss determination value from a predetermined storage area of the external storage device 1404. After completing this processing, the CPU 1401 proceeds to S232. The loss determination value is preliminarily stored in the predetermined storage area of the external storage device 1404 by the administrator or the like.

In S232, the CPU 1401 determines whether or not the loss amount in the current session reaches the loss determination value. Upon determination that the loss amount in the current session reaches the loss determination value, the CPU 1401 proceeds to S233, upon determination that the loss amount in the current session does not reach the loss determination value, the CPU 1401 proceeds to S234.

The processing of S230 to S232 is not limited to the one illustrated above.

For example, a configuration may be adoptable in which the today's loss amount is calculated and whether or not the today's loss amount reaches the loss determination value is determined.

For example, a configuration may be adoptable in which the loss amount within a predetermined time length (for example, within two hours) is calculated and whether or not this loss amount reaches the loss determination value is determined.

For example, a configuration may be adoptable in which the cumulative loss amount is read and whether or not the cumulative loss amount reaches the loss determination value is determined.

In S233, the CPU 1401 sets a loss amount flag to ON, and terminates the loss amount determination. The CPU 1401 stores a time and date when the loss amount flag is set to ON, into a predetermined storage area of the external storage device 1404.

In S234, the CPU 1401 sets the loss amount flag to OFF, and terminates the loss amount determination.

Figure 47C:
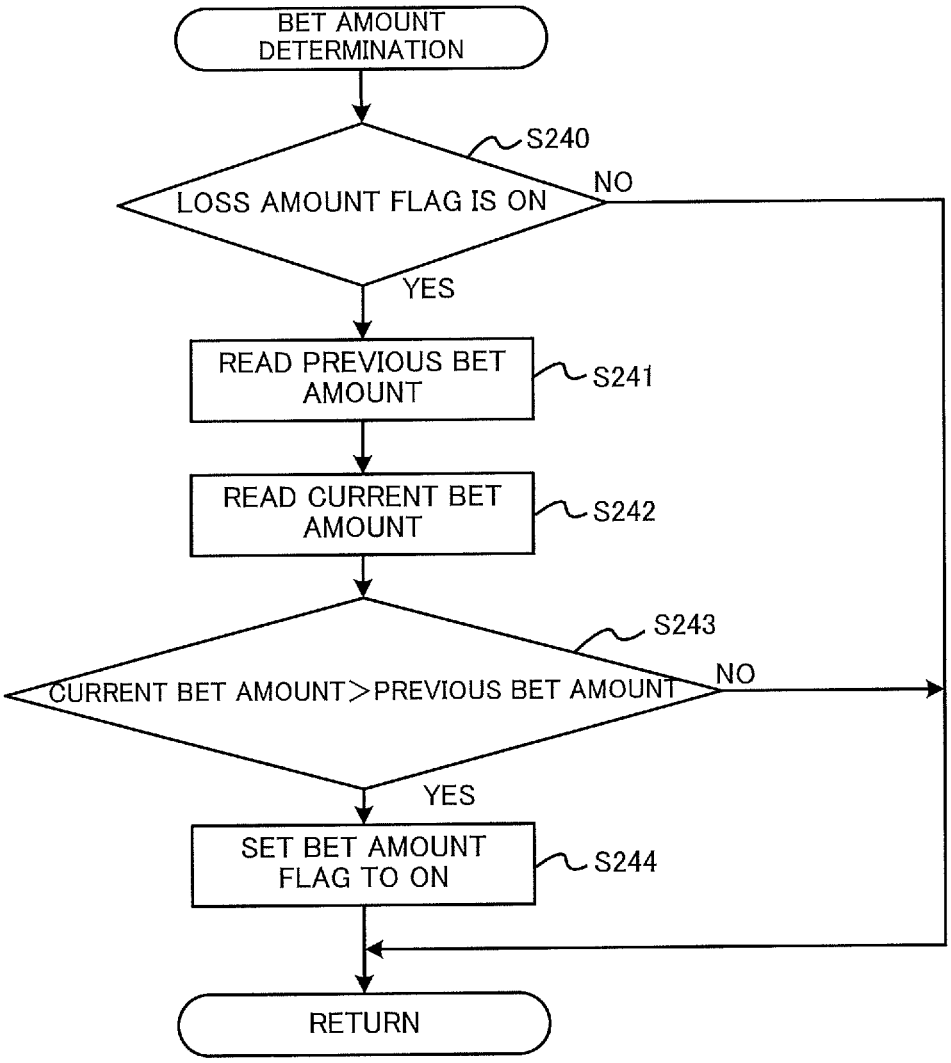
FIG. 47C exemplifies a flowchart of a BET amount determination according to another embodiment of the present invention.

FIG. 47C exemplifies a flowchart of the BET amount determination.

In S240, the CPU 1401 determines whether or not the loss amount flag is ON. Upon determination that the loss amount flag is ON, the CPU 1401 proceeds to S241, while upon determination that the loss amount flag is not ON, the CPU 1401 terminates the BET amount determination.

In S241, the CPU 1401 reads the previous BET amount from a predetermined storage area of the external storage device 1404. After completing this processing, the CPU 1401 proceeds to S242.

In S242, the CPU 1401 reads the current BET amount from a predetermined storage area of the external storage device 1404. After completing this processing, the CPU 1401 proceeds to S243.

In S223, the CPU 1401 determines whether or not the current BET amount is more than the previous BET amount. Upon determination that the current BET amount is more than the previous BET amount, the CPU 1401 proceeds to S244, while upon determination that the current BET amount is not more than the previous BET amount, the CPU 1401 terminates the BET amount determination.

In S244, the CPU 1401 sets a BET amount flag to ON, and terminates the BET amount determination.

<Second-D: Variation of Information Providing Service>

Figure 48:
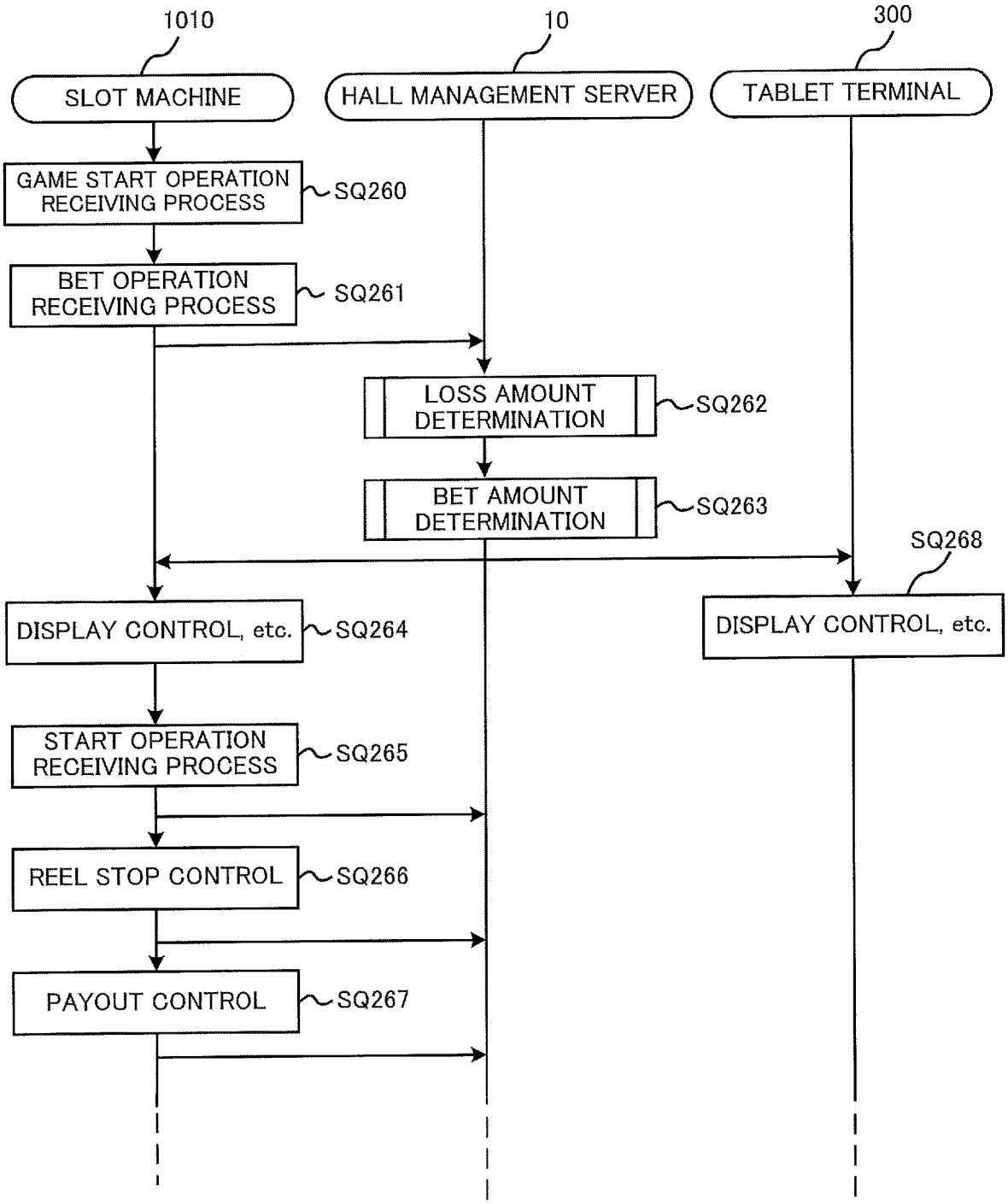
FIG. 48 exemplifies the flow sequence of the information providing service according to another embodiment of the present invention.

FIG. 48 exemplifies a flow sequence of the information providing service. This sequence is different from the sequence shown in FIG. 47A, in timing when the loss amount determination and the BET amount determination are performed.

More specifically, this sequence performs the loss amount determination and the BET amount determination each time a BET operation is made.

<Second-E: Variation of Information Providing Service>

Figure 49A:
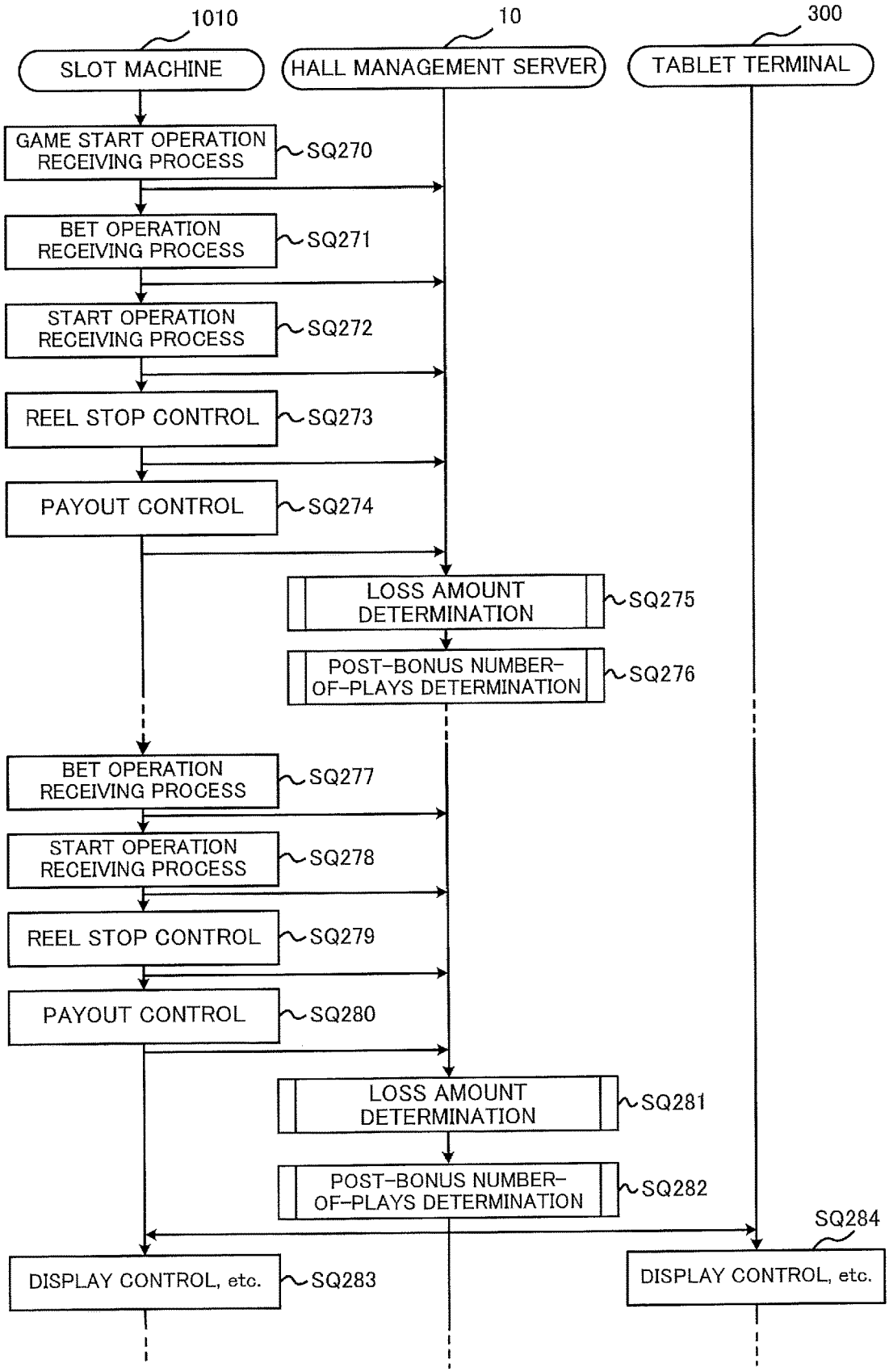
FIG. 49A exemplifies the flow sequence of the information providing service according to another embodiment of the present invention.

As the information providing service, a sequence shown in FIG. 49A may be adopted instead of the sequence shown in FIG. 43A.

FIG. 49A exemplifies a flow sequence of the information providing service. With this sequence, a general flow of the information providing service is described. Since SQ270 to SQ274 are similar to SQ12 to SQ16 shown in FIG. 28A, descriptions thereof are omitted. Since SQ277 to SQ280 are similar to SQ13 to SQ16 shown in FIG. 28A, descriptions thereof are omitted. Since SQ283 and SQ284 are similar to SQ202 and SQ203 shown in FIG. 43A, descriptions thereof are omitted. Since SQ275 and SQ281 are similar to SQ245 shown in FIG. 47A, descriptions thereof are omitted.

IN SQ276 and SQ282, the hall management server 10 performs a post-bonus number-of-plays determination. In the post-bonus number-of-plays determination, whether or not the number of plays made after the end of the bonus game reaches a predetermined number-of-plays value is determined, though details will be given later. Upon determination that the number of plays made after the end of the bonus game reaches the predetermined number-of-plays value, the hall management server 10 transmits announcement information to the slot machine 1010 and the tablet terminal 300, the announcement information being for announcing the information contributing to anti-addiction.

In this configuration, when an addicted player plays a game continuously after the end of the bonus game, information for guiding the addicted player not to play the game is announced to the addicted player, the staff, and the like, so that a situation in which the addicted player becomes addicted to the game can be avoided.

Figure 49B:
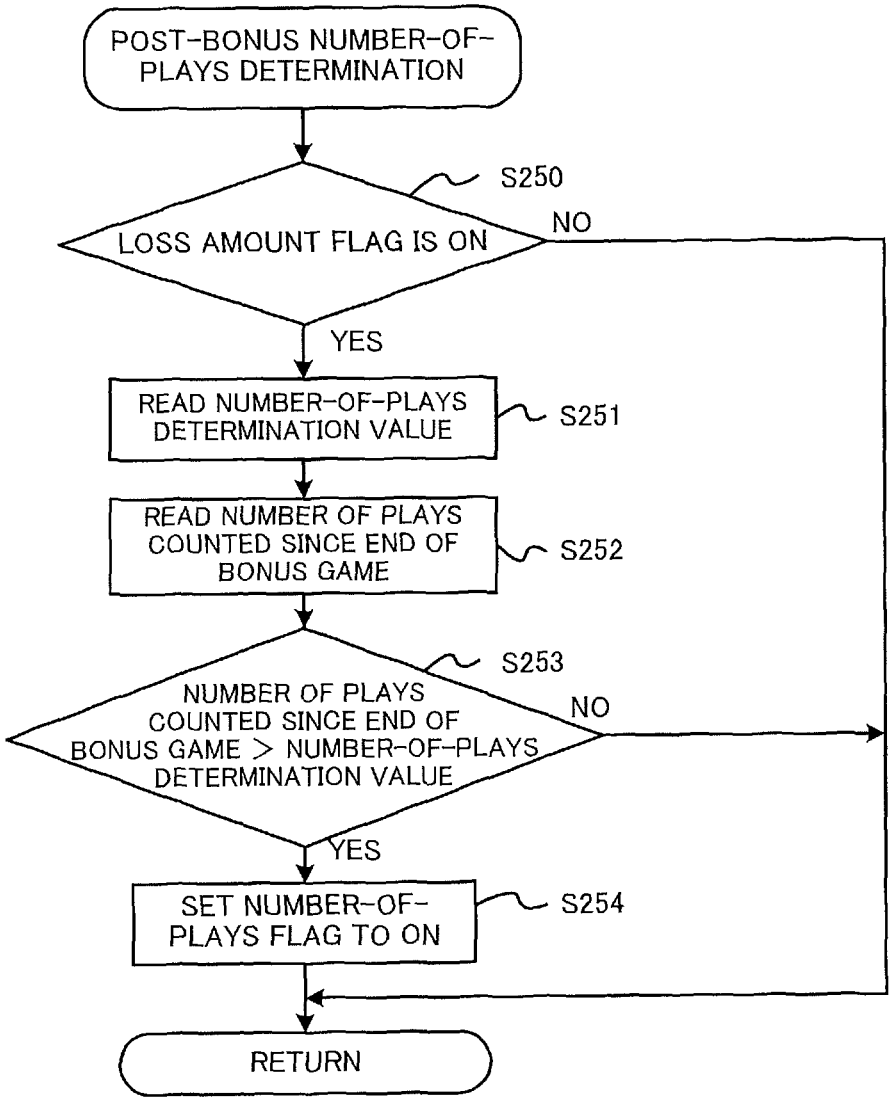
FIG. 49B exemplifies a flowchart of a post-bonus number-of-plays determination according to another embodiment of the present invention.

FIG. 49B exemplifies a flowchart of the post-bonus number-of-plays determination.

In S250, the CPU 1401 determines whether or not the loss amount flag is ON. Upon determination that the loss amount flag is ON, the CPU 1401 proceeds to S251, while upon determination that the loss amount flag is not ON, the CPU 1401 terminates the post-bonus number-of-plays determination.

In S251, the CPU 1401 reads a number-of-plays determination value from a predetermined storage area of the external storage device 1404. After completing this processing, the CPU 1401 proceeds to S252. The number-of-plays determination value is preliminarily stored in the predetermined storage area of the external storage device 1404 by the administrator or the like.

In S252, the CPU 1401 reads the number of plays counted since the end of the bonus game. After completing this processing, the CPU 1401 proceeds to S253.

In S253, the CPU 1401 determines whether or not the number of plays made after the end of the bonus game reaches the number-of-plays determination value. Upon determination that the number of plays made after the end of the bonus game reaches the number-of-plays determination value, the CPU 1401 proceeds to S254, while determining that the number of plays made after the end of the bonus game does not reach the number-of-plays determination value, the CPU 1401 terminates the post-bonus number-of-plays determination.

In S254, the CPU 1401 sets a post-bonus number-of-plays flag to ON, and terminates the post-bonus number-of-plays determination.

<Second-F: Variation of Information Providing Service>

Figure 50A:
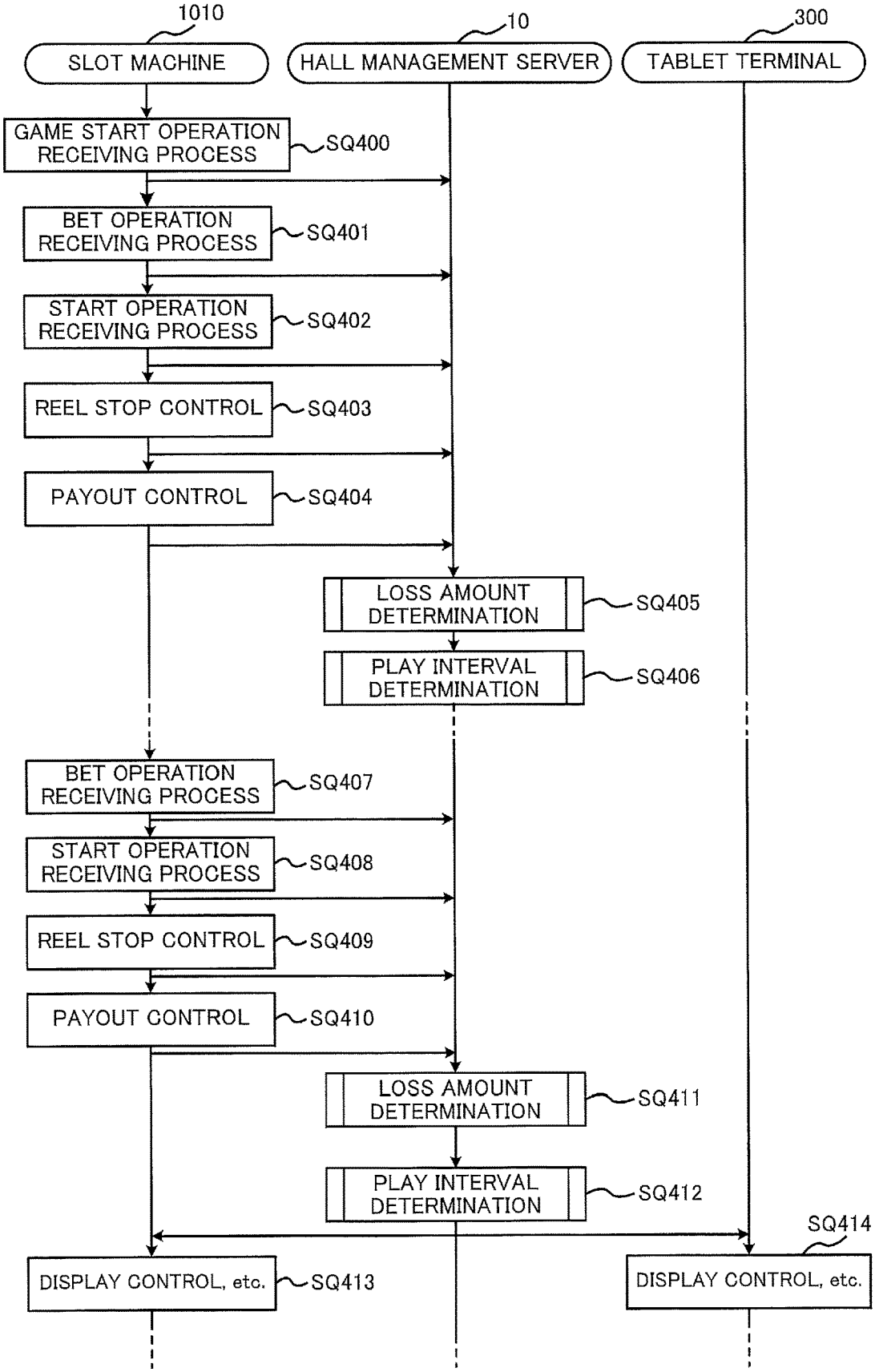
FIG. 50A exemplifies the flow sequence of the information providing service according to another embodiment of the present invention.

As the information providing service, a sequence shown in FIG. 50A may be adopted instead of the sequence shown in FIG. 43A.

FIG. 50A exemplifies a flow sequence of the information providing service. With this sequence, a general flow of the information providing service is described. Since SQ400 to SQ404 are similar to SQ12 to SQ16 shown in FIG. 28A, descriptions thereof are omitted. Since SQ407 to SQ410 are similar to SQ13 to SQ16 shown in FIG. 28A, descriptions thereof are omitted. Since SQ413 and SQ414 are similar to SQ202 and SQ203 shown in FIG. 43A, descriptions thereof are omitted. Since SQ405 and SQ411 are similar to SQ245 shown in FIG. 47A, descriptions thereof are omitted.

In SQ406 and SQ412, the hall management server 10 performs a play interval determination. In the play interval determination, whether or not the play interval is shorter than a predetermined play interval is determined, though details will be given later.

Upon determination that the play interval is shorter than the predetermined play interval, the hall management server 10 transmits announcement information to the slot machine 1010 and the tablet terminal 300, the announcement information being for announcing the information contributing to anti-addiction.

In this configuration, upon determination that the play interval is shorter than the predetermined play interval (upon determination that the addicted player has not taken a break), information for guiding the addicted player not to play the game is announced to the addicted player, the staff, and the like, so that a situation in which the addicted player becomes addicted to the game can be avoided.

Figure 50B:
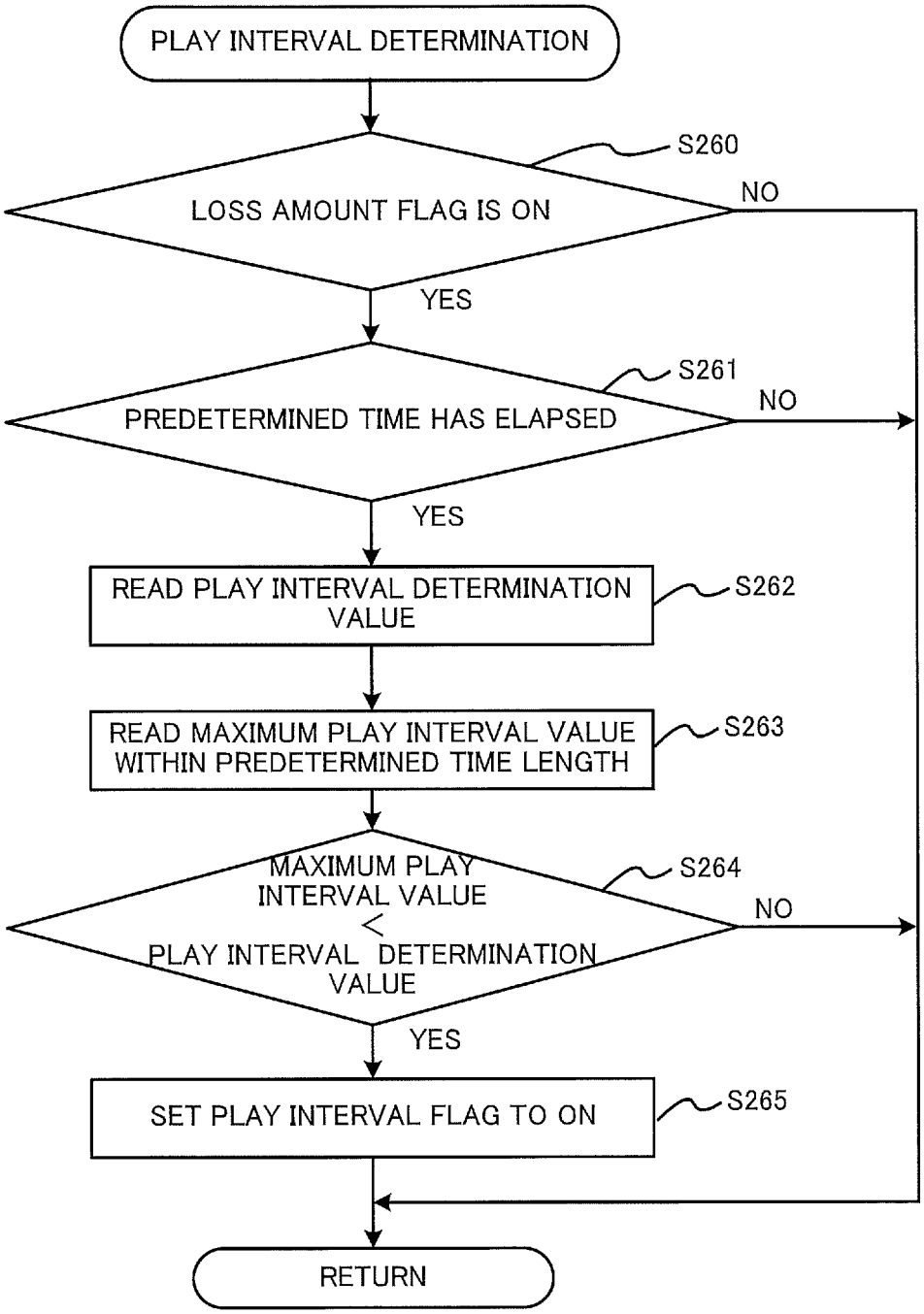
FIG. 50B exemplifies a flowchart of a play interval determination according to another embodiment of the present invention.

FIG. 50B exemplifies a flowchart of the play interval determination.

In S260, the CPU 1401 determines whether or not the loss amount flag is ON. Upon determination that the loss amount flag is ON, the CPU 1401 proceeds to S261, while upon determination that the loss amount flag is not ON, the CPU 1401 terminates the play interval determination.

In S261, the CPU 1401 determines whether or not a predetermined time has elapsed since the loss amount flag was set to ON. Upon determination that the predetermined time has elapsed, the CPU 1401 proceeds to S262, while upon determination that the predetermined time has not elapsed, the CPU 1401 terminates the play interval determination.

In S262, the CPU 1401 reads a play interval determination value from a predetermined storage area of the external storage device 1404. After completing this processing, the CPU 1401 proceeds to S263. The play interval determination value is preliminarily stored in the predetermined storage area of the external storage device 1404 by the administrator or the like.

In S263, the CPU 1401 refers to the table of FIG. 27A, to read the greatest play interval value (maximum play interval value) within a predetermined time length (for example, within two hours or within a period from the time when the loss amount flag was set to ON to the current time). After completing this processing, the CPU 1401 proceeds to S264.

In S264, the CPU 1401 determines whether or not the maximum play interval value is less than the play interval determination value. Upon determination that the maximum play interval value is less than the play interval determination value, the CPU 1401 proceeds to S265, while upon determination that the maximum play interval value is not less than the play interval determination value, the CPU 1401 terminates the play interval determination.

In S265, the CPU 1401 sets the play interval flag to ON, and terminates the play interval determination.

<Second-G: Variation of Information Providing Service>

Figure 51A:
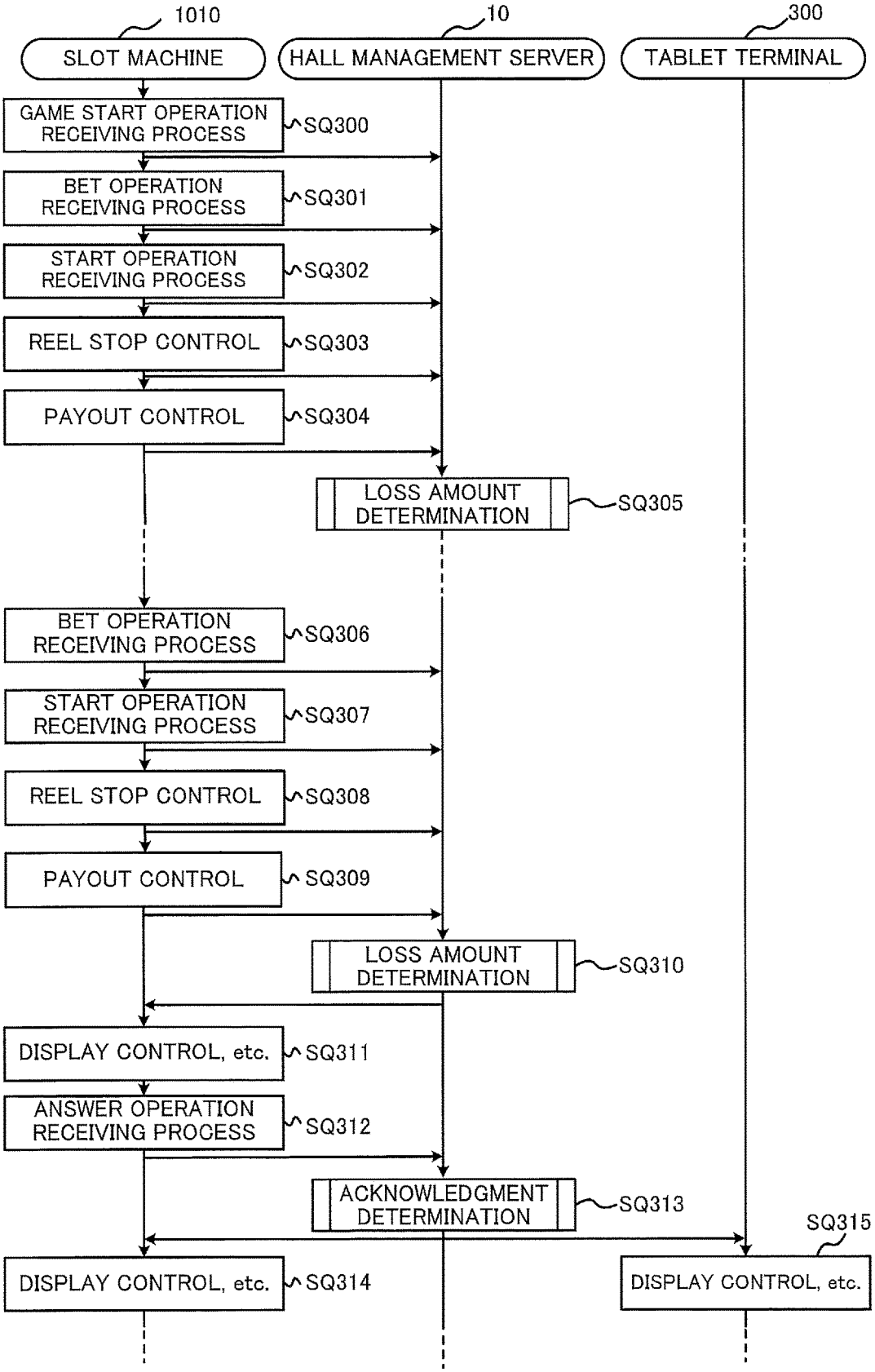
FIG. 51A exemplifies the flow sequence of the information providing service according to another embodiment of the present invention.

As the information providing service, a sequence shown in FIG. 51A may be adopted instead of the sequence shown in FIG. 43A.

FIG. 51A exemplifies a flow sequence of the information providing service. With this sequence, a general flow of the information providing service is described. Since SQ300 to SQ304 are similar to SQ12 to SQ16 shown in FIG. 28A, descriptions thereof are omitted. Since SQ306 to SQ309 are similar to SQ13 to SQ16 shown in FIG. 28A, descriptions thereof are omitted. Since SQ314 and SQ315 are similar to SQ202 and SQ203 shown in FIG. 43A, descriptions thereof are omitted. Since SQ305 and SQ310 are similar to SQ245 shown in FIG. 47A, descriptions thereof are omitted. In SQ310, the hall management server 10 performs a loss amount determination, and upon determination that a loss greater than a predetermined amount is incurred, transmits an acknowledgment request to the slot machine 1010.

In SQ311, upon receiving the acknowledgment request, the slot machine 1010 displays an answer message (e.g., "How about going for a meal?") and answer icons (e.g., icon A "NO", icon B "LATER", and icon C "YES") on the LCD 1719 of the PTS terminal 1700. The answer message and the answer icons may be included in the acknowledgment request, stored in the slot machine 1010, or stored in the PTS terminal 1700.

In SQ312, the slot machine 1010 performs an answer operation receiving process. Upon receiving an operation on any answer icon, the slot machine 1010 transmits operation answer information to the hall management server 10.

In SQ313, the hall management server 10 performs an acknowledgment determination. In the acknowledgment determination, whether or not an answer is received within a predetermined period is determined, though details will be given later. Upon determination that no answer is received within the predetermined period, the hall management server 10 transmits announcement information to the slot machine 1010 and the tablet terminal 300, the announcement information being for announcing the information contributing to anti-addiction.

In this configuration, upon determination that no answer is received within the predetermined period (upon determination that the addicted player does not answer the inquiry), information for guiding the addicted player not to play the game is announced to the addicted player, the staff, and the like, so that a situation in which the addicted player becomes addicted to the game can be avoided.

Figure 51B:
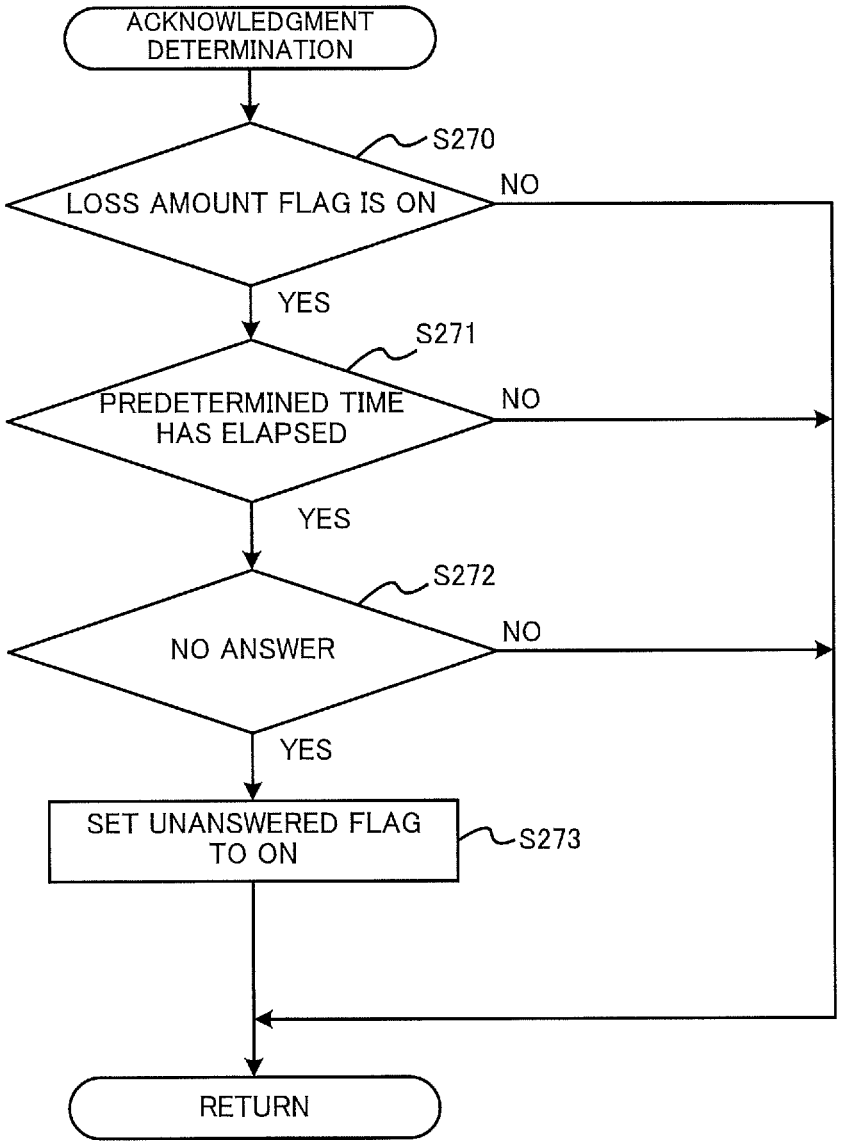
FIG. 51B exemplifies a flowchart of an acknowledgment determination according to another embodiment of the present invention.

FIG. 51B exemplifies a flowchart of the acknowledgment determination.

In S270, the CPU 1401 determines whether or not the loss amount flag is ON. Upon determination that the loss amount flag is ON, the CPU 1401 proceeds to S271, while upon determination that the loss amount flag is not ON, the CPU 1401 terminates the acknowledgment determination.

In S271, the CPU 1401 determines whether or not a predetermined time has elapsed since the loss amount flag was set to ON. Upon determination that the predetermined time has elapsed, the CPU 1401 proceeds to S272, while upon determination that the predetermined time has not elapsed, the CPU 1401 terminates the acknowledgment determination.

In S272, the CPU 1401 determines whether or not an answer is received from the slot machine 1010. Upon determination that no answer is received from the slot machine 1010, the CPU 1401 proceeds to S273, while upon determination that an answer is received from the slot machine 1010, the CPU 1401 terminates the acknowledgment determination.

In S273, the CPU 1401 sets an unanswered flag to ON, and terminates the acknowledgment determination.

<Second-H: Variation of Information Providing Service>

Figure 52A:
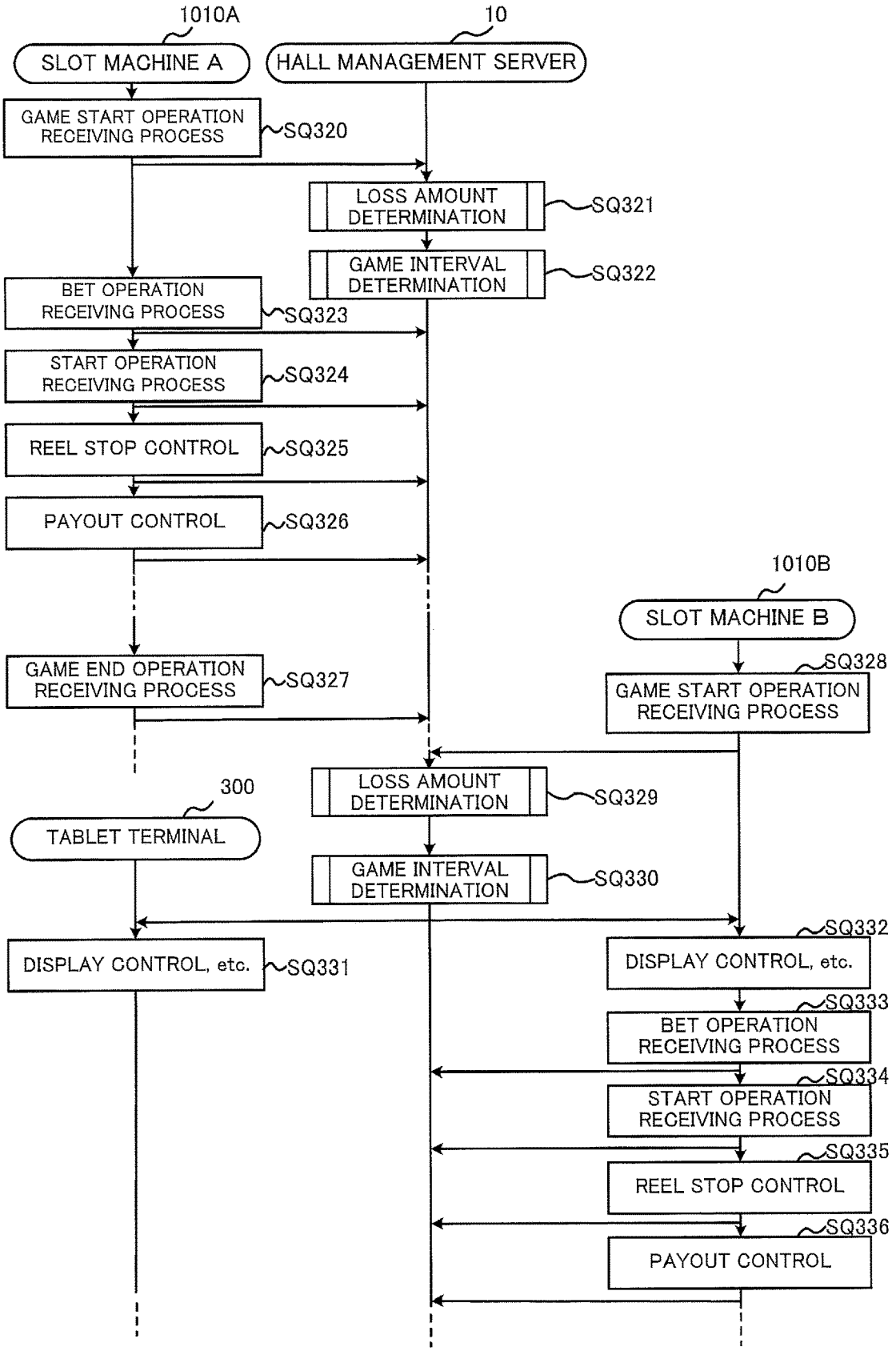
FIG. 52A exemplifies the flow sequence of the information providing service according to another embodiment of the present invention.

As the information providing service, a sequence shown in FIG. 52A may be adopted instead of the sequence shown in FIG. 43A.

FIG. 52A exemplifies a flow sequence of the information providing service. With this sequence, a general flow of the information providing service is described. Since SQ320, SQ323 to SQ326, SQ328, and SQ333 to SQ336 are similar to SQ12 to SQ16 shown in FIG. 28A, descriptions thereof are omitted. Since SQ321 and SQ329 are similar to SQ245 shown in FIG. 47A, descriptions thereof are omitted. Since SQ327 is similar to SQ33 shown in FIG. 31A, descriptions thereof are omitted. Since SQ331 and SQ332 are similar to SQ202 and SQ203 shown in FIG. 43A, descriptions thereof are omitted.

In SQ322 and SQ330, the hall management server 10 performs a game interval determination. In the game interval determination, whether or not a time length from the end of the previous game to the start of the current game is within a predetermined time length is determined, though details will be given later.

Upon determination that the time length from the end of the previous game to the start of the current game is within the predetermined time length, the hall management server 10 transmits announcement information to the slot machine 1010B and the tablet terminal 300, the announcement information being for announcing the information contributing to anti-addiction.

In this configuration, upon determination that the loss amount is greater than the loss determination value and that the time length from the end of the previous game to the start of the current game is within the predetermined time length (upon determination that the addicted player has switched to another slot machine 1010), information for guiding the addicted player not to play the game is announced to the addicted player, the staff, and the like, so that a situation in which the addicted player becomes addicted to the game can be avoided.

Figure 52B:
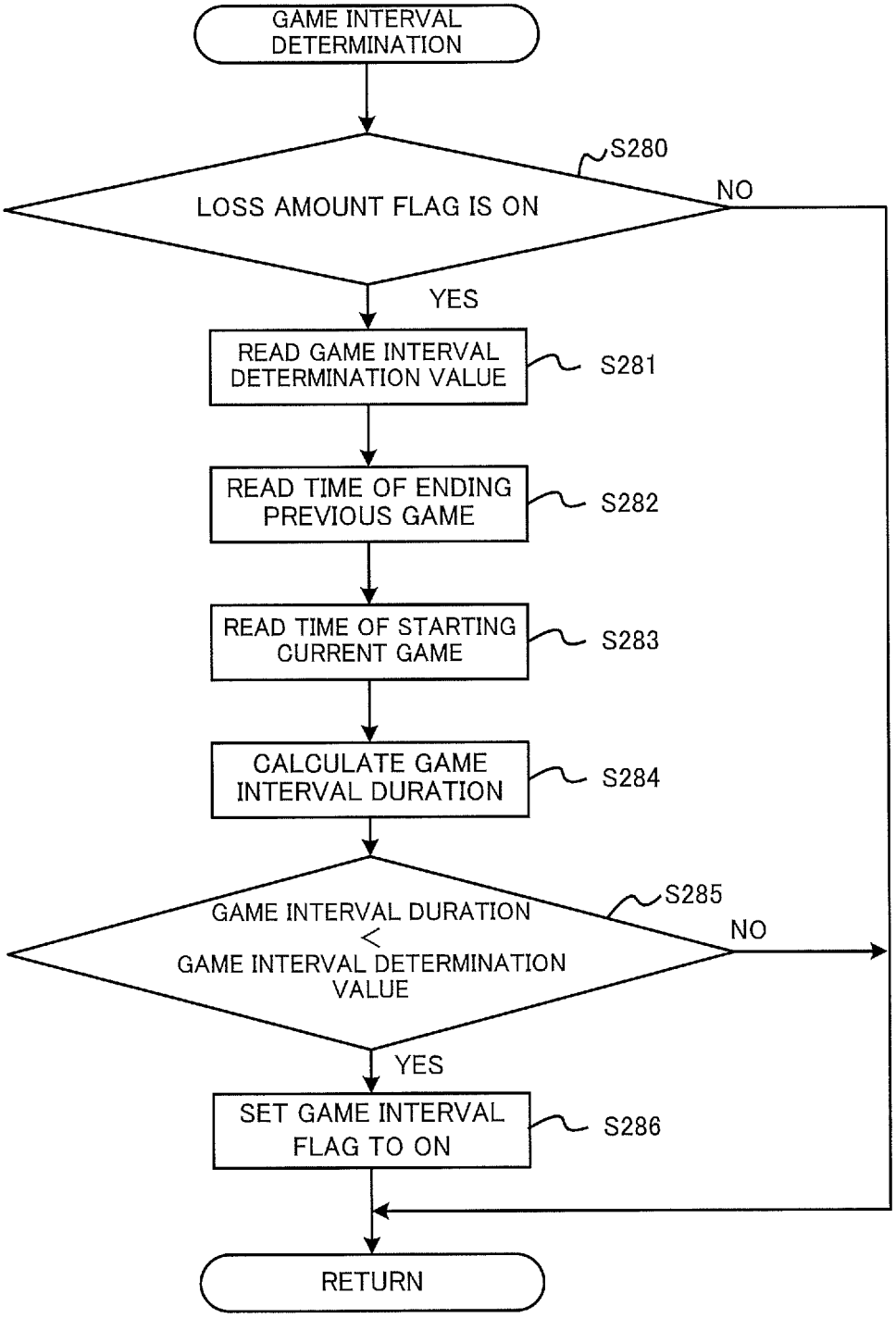
FIG. 52B exemplifies a flowchart of a game interval determination according to another embodiment of the present invention.

FIG. 52B exemplifies a flowchart of the game interval determination.

In S280, the CPU 1401 determines whether or not the loss amount flag is ON. Upon determination that the loss amount flag is ON, the CPU 1401 proceeds to S281 while upon determination that the loss amount flag is not ON, the CPU 1401 terminates the game interval determination.

In S281, the CPU 1401 reads a game interval determination value from a predetermined storage area of the external storage device 1404. After completing this processing, the CPU 1401 proceeds to S282. The game interval determination value is preliminarily stored in the predetermined storage area of the external storage device 1404 by the administrator or the like.

In S282, the CPU 1401 refers to the table of FIG. 27B, to read a time of ending the previous game (previous session end time/date). After completing this processing, the CPU 1401 proceeds to S283.

In S283, the CPU 1401 refers to FIG. 27B, to read a time of starting the current game (current session start time/date). After completing this processing, the CPU 1401 proceeds to S284.

In S284, the CPU 1401 calculates a game interval duration by subtracting the time of ending the previous game from the time of starting the current game. After completing this processing, the CPU 1401 proceeds to S285.

In S285, the CPU 1401 determines whether or not the game interval duration is less than the game interval determination value. Upon determination that the game interval duration is less than the game interval determination value, the CPU 1401 proceeds to S286, while upon determination that the game interval duration is not less than the game interval determination value, the CPU 1401 terminates the game interval determination.

In S286, the CPU 1401 sets a game interval flag to ON, and terminates the game interval determination.

<Second-I: Variation of Information Providing Service>

Figure 53:
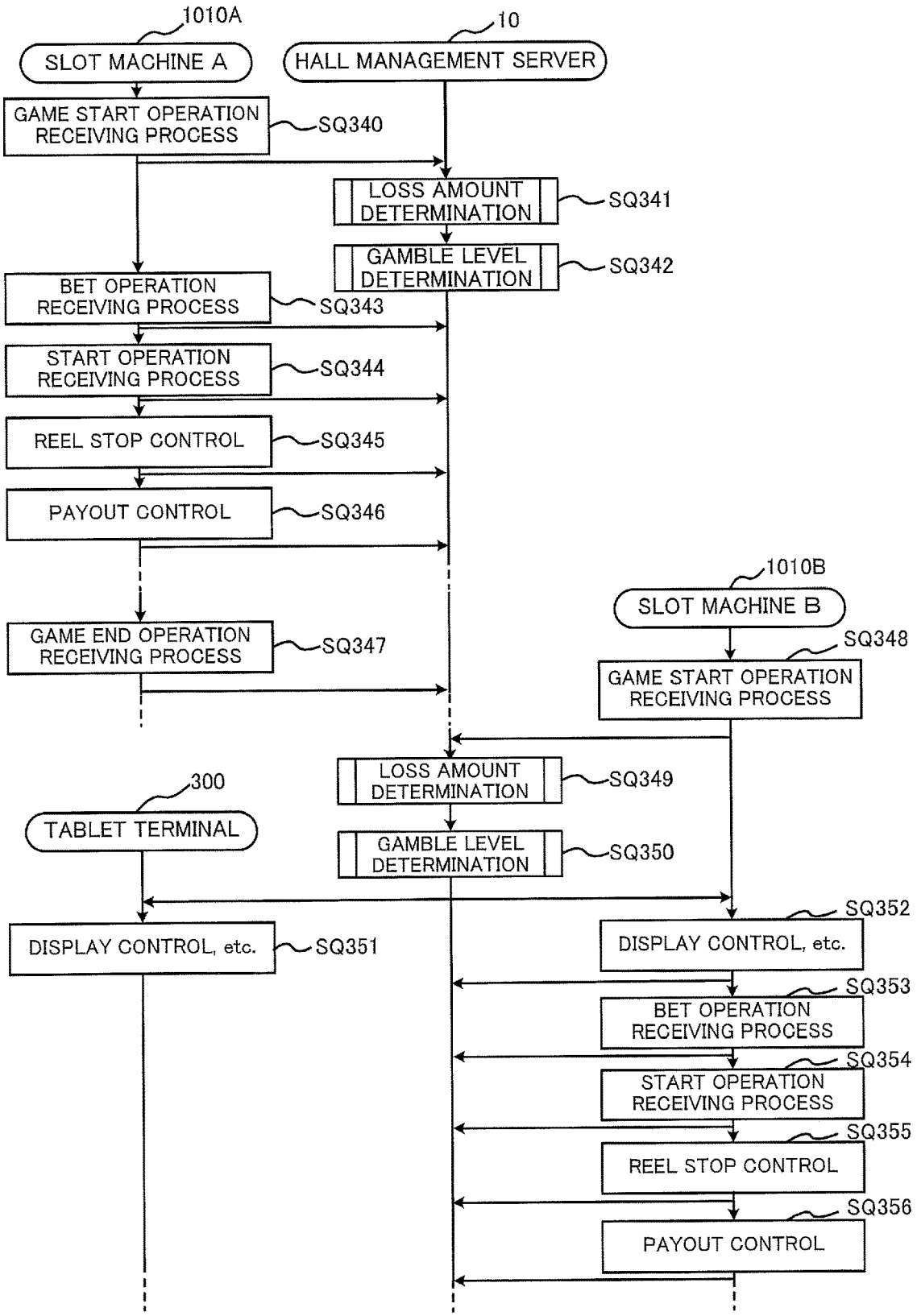
FIG. 53 exemplifies the flow sequence of the information providing service according to another embodiment of the present invention.

FIG. 53 exemplifies a flow sequence of the information providing service. This sequence is different from the sequence shown in FIG. 52A, in that a gamble level determination (SQ342, SQ350) is performed instead of the game interval determination (SQ322, SQ330) shown in FIG. 52A.

In this configuration, upon determination that the slot machine 1010 has a high gambling feature and that the addicted player is starting a game on the speculative slot machine 1010, information for guiding the addicted player not to play the game is announced to the addicted player, the staff, and the like, so that a situation in which the addicted player switches to the speculative slot machine 1010 and becomes addicted to the game can be avoided.

<Second-J: Variation of Information Providing Service>

Figure 54:
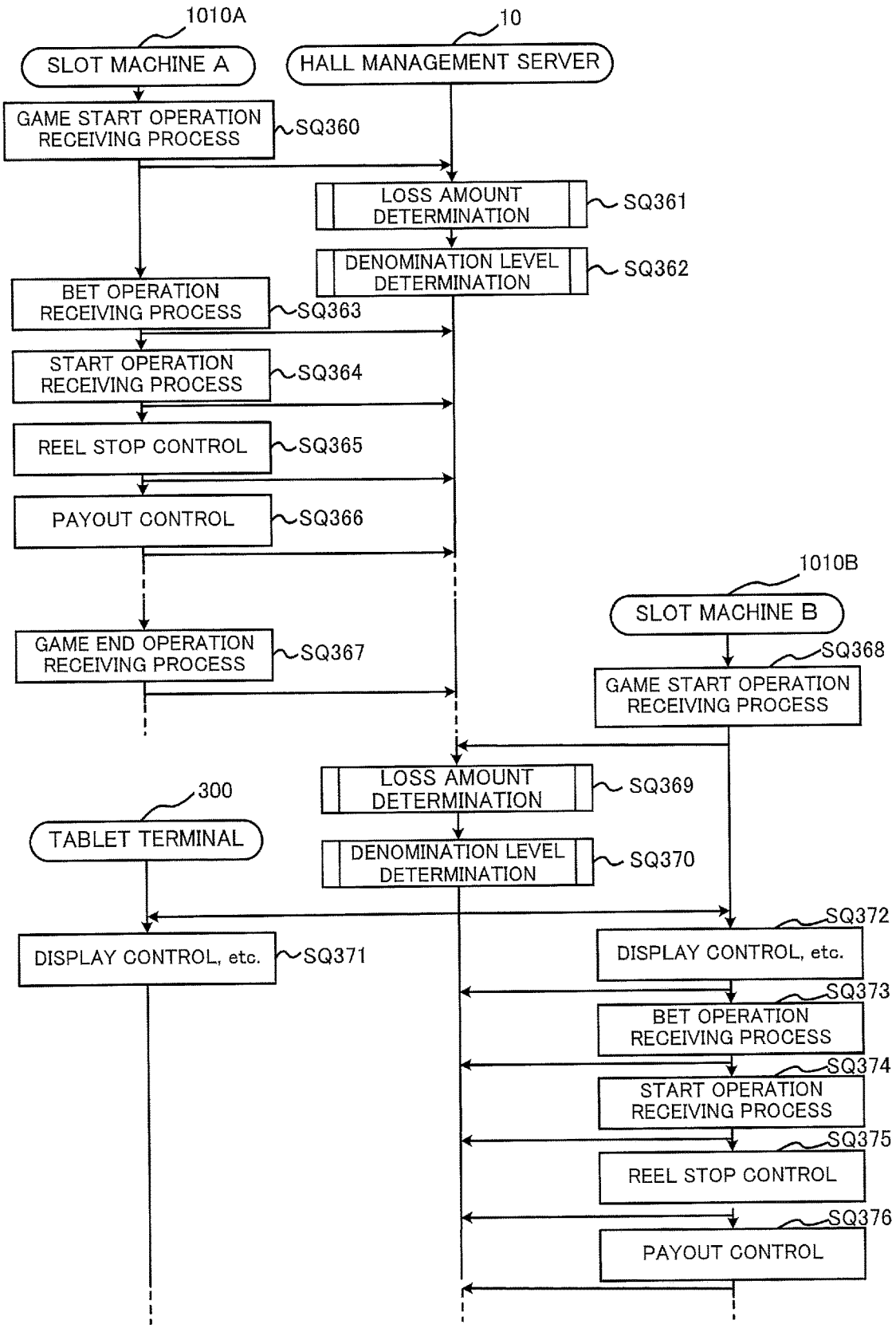
FIG. 54 exemplifies the flow sequence of the information providing service according to another embodiment of the present invention.

FIG. 54 exemplifies a flow sequence of the information providing service. This sequence is different from the sequence shown in FIG. 52A, in that a denomination level determination (SQ362, SQ370) is performed instead of the game interval determination (SQ322, SQ330) shown in FIG. 52A.

In this configuration, upon determination that the loss amount is greater than the loss determination value and that the addicted player is starting a game on the slot machine 1010 having a high gambling feature, information for guiding the addicted player not to play the game is announced to the addicted player, the staff, and the like, so that a situation in which the addicted player switches to the slot machine 1010 having a high gambling feature and becomes addicted to the game can be avoided.

The configurations illustrated in the first and second embodiments may be combined as appropriate.

The configurations illustrated in the first and second embodiments are applicable not only to a game arcade as exemplified by a casino but also to a facility with a game arcade, such as a hotel, an airport, a station, a shopping mall, a fueling station capable of supplying a fuel such as gasoline, a restaurant, or a movie theater as well as a complex facility where a plurality of facilities are collected.

In the following, the configurations of the above embodiments are described from different aspects.

A slot machine is conventionally known operable to stop and display a plurality of symbols after scrolling them, and award game media (e.g., coins) based on a combination of the symbols stopped.

A slot machine is also disclosed operable to allow a game player to realize an attractive payout rate by impressing the game player with a state becoming advantageous to the game player during progress of a game (specification of United States Patent Application Publication No. 2012/0115571).

The player, who is attracted by the above-mentioned slot machine and addicted to the game, may sometimes invest a more amount than initially expected in playing the game, or spend a longer game time than initially expected in playing the game. In the short run, this benefits the game arcade, but in the long run, this may make the player run out shortly and keep the player away from the game, which may result in disadvantages to both the game arcade and the player.

The following configurations were made in view of the problems above, and an object thereof is to provide assistance for avoiding a situation in which the player becomes addicted to the game.

(Supplemental Notes A)

In a first aspect of the above embodiments, an information providing system (the information providing system 3100, etc.) of the present invention includes:

an input device (the input device 3040, the signage 100, the kiosk terminal 200, the slot machine 1010, etc.) that receives an input of game value consumption plan information (the allowance amount, etc.) based on a setting operation (the user operation, the player operation, etc.) performed by a player;

a gaming machine (the gaming machine 3060, the slot machine 1010, etc.) enabling a game to be played; and an information processing device (the information processing device 3050, the hall management server 10, the analysis server 16, the information providing server 17, etc.) communicable with the gaming machine, the information processing device operable to receive game value consumption information (the consumption amount, etc.) about a game value consumed by the player from the gaming machine, and upon determination that the player's consumption information reaches the consumption plan information, transmit predetermined instruction information (the announcement information, etc.) to the gaming machine, the gaming machine operable to announce information (the information contributing to anti-addiction, etc.) that encourages the player not to play the game based on the predetermined instruction information.

In this configuration, if the game value consumption information reaches the game value consumption plan information inputted by the player, the information that encourages the player not to play the game is announced on the gaming machine.

Examples of the information that encourages the player not to play the game include an alert giving an implicit advice to stop the game (e.g., "Set amount is reached.", "It's about time to take a break.", or "It's about time to stop the game.").

For example, a player is able to make such setting that an alert is issued in response to reaching a certain amount of loss. Since the alert is issued upon actually reaching the set amount, the player can stop the game in accordance with the alert.

In this configuration, the information that encourages the player not to play the game is announced based on the setting made by the player himself/herself, and thereby the player can stop the game in accordance with the announcement which is the concern of the player, so that a situation in which the player becomes addicted to the game can be avoided.

In the information providing system, upon determination that predetermined consumption information (the additional allowance amount, etc.) is additionally consumed from the consumption plan information based on the consumption information received from the gaming machine, the information processing device transmits additional instruction information (the additional announcement information, etc.) to the gaming machine, and the gaming machine announces information that encourages the player not to play the game based on the additional instruction information.

In this configuration, if the predetermined consumption information is additionally consumed from the consumption plan information, the information that encourages the player not to play the game is announced.

In general, a player having a loss tends to keep playing the game in hope that he/she can catch up in some additional games, even if an alert is issued in response to reaching the set amount inputted by the player himself/herself.

Even in such a situation, the above-described configuration announces the information that encourages the player not to play the game if the predetermined consumption information is additionally consumed, and thereby the player can stop the game in consideration of the announcement, so that a situation in which the player becomes addicted to the game can be avoided.

In the information providing system, upon the player ending the game, the gaming machine transmits game end information (e.g., the session end notification, etc.) to the information processing device, upon determination that the game end information is not received though a predetermined time elapses after determining that the consumption information received from the gaming machine reaches the consumption plan information, the information processing device transmits additional instruction information (the additional announcement information, etc.) to the gaming machine, and the gaming machine announces information that encourages the player not to play the game based on the additional instruction information.

In this configuration, the information that encourages the player not to play the game is announced if the game is continued though the predetermined time has elapsed after the determination that the player's consumption information reached the consumption plan information.

In general, a player having experienced a benefit and currently incurring a loss keeps playing the game in the expectation that a more benefit can be obtained, even if an alert is issued in response to reaching the set amount inputted by the player himself/herself.

Even in such a situation, the above-described configuration announces the information that encourages the player not to play the game upon elapse of the predetermined time, and thereby the player can stop the game in consideration of the announcement, so that a situation in which the player becomes addicted to the game can be avoided.

In the information providing system, upon determination that the consumption information received from the gaming machine reaches the consumption plan information, the information processing device transmits service information (the different facility information, etc.) and the predetermined instruction information to the gaming machine, the service information relating to a facility different from a game arcade where the gaming machine is installed, the service information obtained from a storage device that stores the service information, and the gaming machine announces the service information as the information that encourages the player not to play the game, based on the predetermined instruction information.

In this configuration, if the game value consumption information reaches the game value consumption plan information inputted by the player, the service information about another facility is announced as the information that encourages the player not to play the game on the gaming machine.

In general, a player cannot help but keep playing the game against his/her will in hope that he/she can catch up on the loss amount, even if an alert is issued in response to reaching the set amount inputted by the player himself/herself.

Even in such a situation, the above-described configuration in which the service information about another facility is announced on the gaming machine allows the player to go to another facility if the service information is of high interest to the player. Since the player is guided to another facility by the announcement, a situation in which the player is addicted to the game can be avoided.

In a second aspect of the above embodiments, an information providing apparatus (the information processing device 3050, the hall management server 10, the analysis server 16, the information providing server 17, etc.) of the present invention includes:

a storage device (the storage 3053, the external storage device 1404, etc.) that stores game value consumption plan information (the allowance amount, etc.) set by a player; and an information processing device (the controller 3051, the controller 1400, the CPU 1401, etc.) communicable with a gaming machine (the gaming machine 3060, the slot machine 1010, etc.) enabling a game to be played, the information processing device operable to receive game value consumption information (the consumption amount, etc.) about a game value consumed by the player from the gaming machine, and upon determination that the player's consumption information reaches the consumption plan information, transmit predetermined instruction information (the announcement information, etc.) to the gaming machine such that the information that encourages the player not to play the game is announced.

In this configuration, if the game value consumption information reaches the game value consumption plan information set by the player, the information that encourages the player not to play the game is announced on the gaming machine.

Examples of the information that encourages the player not to play the game include an alert giving an implicit advice to stop the game (e.g., "Set amount is reached.", "It's about time to take a break.", or "It's about time to stop the game.").

For example, a player is able to make such setting that an alert is issued in response to reaching a certain amount of loss. Since the alert is issued upon actually reaching the set amount, the player can stop the game in accordance with the alert.

In this configuration, the information that encourages the player not to play the game is announced based on the setting made by the player himself/herself, and thereby the player can stop the game in accordance with the announcement which is the concern of the player, so that a situation in which the player becomes addicted to the game can be avoided.

In the information providing system, the gaming machine includes a common terminal (the information reading device 3069, the PTS terminal 1700, etc.) that is mountable on another gaming machine, too, and the gaming machine causes the common terminal to display information that encourages the player not to play the game.

This configuration, in which a function for avoiding addiction to the game can be implemented by mounting the common terminal, enables this function to be easily available in the existing gaming machine, too.

In the information providing system, the gaming machine includes the input device (the input 3064, the LCD 1719, etc.).

This configuration enables the player to set the consumption plan information without standing up, even after the player sits down on the gaming machine, for example.

In the information providing system, the gaming machine includes a receiving device (the input 3064, the LCD 1719, etc.) that receives a player's operation, and upon the receiving device receiving a cancellation operation (the display cancellation operation, etc.) for cancelling announcement of the information that encourages the player not to play the game, the gaming machine cancels the announcement.

In the information providing system, the gaming machine includes a receiving device (the input 3064, the LCD 1719, etc.) that receives a player's operation, and upon the receiving device receiving a confirmation operation (the contents confirmation operation, etc.) indicating confirmation of the information that encourages the player not to play the game, the gaming machine performs a control (the play resumption control, etc.) for enabling a next play to start.

In the information providing system, upon the player starting a play, the gaming machine transmits play start information (the play start notification, etc.) to the information processing device, and upon determining, based on the play start information received from the gaming machine, that a predetermined number (the set number of plays, etc.) of games are additionally played after determining that the consumption information received from the gaming machine reaches the consumption plan information, the information processing device transmits additional instruction information to the gaming machine.

In general, a player having a loss tends to keep playing the game in hope that he/she can catch up in some additional games, even though an alert is issued in response to reaching the set amount inputted by the player himself/herself.

Even in such a situation, the above-described configuration announces the information that encourages the player not to play the game if the predetermined number of games are additionally played, and thereby the player can stop the game in accordance with the announcement, so that a situation in which the player becomes addicted to the game can be avoided.

The information that encourages the player not to play the game may be transmitted from the information processing device (for example, included in the predetermined instruction information), preliminarily stored in the gaming machine, or preliminarily stored in the common terminal.

The predetermined instruction information and the additional instruction information may be either identical to or different from each other. In a case where they are identical, the information that encourages the player not to play the game have the same contents (e.g., "It's about time to take a break."), and in a case where they are different, the information that encourages the player not to play the game have different contents (for example, the predetermined instruction information is "Set amount is reached." and the additional instruction information is "Predetermined consumption information is additionally consumed in addition to set amount."

In the information providing system, the input device performs a process (the change operation receiving process, etc.) for receiving an input that cancels the consumption plan information.

In a third aspect of the above embodiments, an information providing system (information providing system 3100, etc.) includes:

an input device (the input device 3040, the signage 100, the kiosk terminal 200, the slot machine 1010, etc.) that receives an input of game value consumption plan information (the allowance amount, etc.) based on a setting operation (the user operation, the player operation, etc.) performed by a player;

a plurality of gaming machines (the gaming machine 3060, the slot machine 1010, etc.) enabling a game to be played;

an information processing device (the information processing device 3050, the hall management server 10, the analysis server 16, the information providing server 17, etc.) communicable with each of the plurality of gaming machines; and a storage device (the storage device 3030, the hall management server 10, the member management server 13, etc.) that stores identification information (the login/logout management table, etc.) by which a specific gaming machine on which the player is playing a game is identifiable among the plurality of gaming machines, the information processing device operable to receive game value consumption information (the consumption amount, etc.) about a game value consumed by the player from the specific gaming machine, and upon determination that the player's consumption information reaches the consumption plan information, transmit predetermined instruction information (the announcement information, etc.) to the specific gaming machine, the specific gaming machine operable to announce information that encourages the player not to play the game based on the predetermined instruction information.

In general, a player losing at one gaming machine may sometimes leave the gaming machine with hopes in another gaming machine. Also, a player losing at one gaming machine may sometimes play the game on another gaming machine that is more speculative (a gaming machine with high-risk/high-return setting) in hope that he/she can catch up on the loss amount.

In the above-described configuration, in a case where a player playing a game on one gaming machine moves to another gaming machine to play the game, the information that encourages the player not to play the game is announced by said another gaming machine upon determination that the player's consumption information on said another gaming machine reaches the consumption plan information. Accordingly, the player can stop the game in accordance with the announcement even though the player changes the gaming machine and plays the game, so that a situation in which the player becomes addicted to the game can be avoided.

(Supplemental Notes B)

In a fourth aspect of the above embodiments, an information providing system (the information providing system 3200, etc.) includes:

a storage device (the storage device 3030, the storage 3053 of the information processing device 3050, the hall management server 10, the member management server 13, the external storage device 1404, etc.) that stores game information (information of the play history table, the session history table, the accumulation table, etc.) with respect to each player;

an announcement device (the gaming machine 3060, the information reading device 3069, the output 3067, the staff terminal 3070, the output 3075, the slot machine 1010, the PTS terminal 1700, the tablet terminal 300, the LCD 1719, the LCD 303, etc.) operable to announce information; and an information processing device (the information processing device 3050, the hall management server 10, the analysis server 16, the information providing server 17, etc.) communicable with the announcement device, the information processing device operable to, upon determination that the game information associated with the player exceeds a predetermined threshold value (for example, upon determining YES in S202 to S206), transmit predetermined instruction information (the announcement information, etc.) to the announcement device, the announcement device operable to announce information (the information contributing to anti-addiction, etc.) for guiding the player not to play a game, based on the predetermined instruction information.

In this configuration, the information for guiding the player not to play the game is announced upon determination that the game information associated with the player, which is stored in the storage device, exceeds the predetermined threshold value.

Examples of the information for guiding the player not to play the game include an alert giving an implicit advice to stop the game (e.g., "Why don't you take a rest today?", "Why don't you watch a movie today?", or "How about going to a gym?" to the player; and "The customer using XX machine (machine ID) is under risk of addiction to game." or "Please give anti-addiction support to the customer seated at XX." to the hall staff).

For example, if it can be determined that the player is addicted to the game under the state where the predetermined threshold value is exceeded or it can be determined that the player tends to be addicted to the game under the state where the predetermined threshold value is exceeded, an alert is issued to the hall staff, the player who is likely to be addicted to the game, and the like.

In the above-described configuration, a player who is addicted to the game, a player who is likely to be addicted to the game, or the like (a player-at-risk), is detected, and the information for guiding the player-at-risk not to play the game is announced to the player-at-risk, the hall staff, and the like, so that a situation in which the player-at-risk becomes addicted to the game can be avoided.

In the information providing system, the storage device stores game information of a player each time the player plays a game, and in response to the game information being stored in the storage device and upon determination that the game information associated with the player exceeds a predetermined threshold value (for example, upon determining YES in S202 to S206), the information processing device transmits the predetermined instruction information to the announcement device.

In this configuration, the game information is stored each time a player plays a game, and upon determination that the game information associated with the player exceeds the predetermined threshold value, the information for guiding the player not to play the game is announced.

In this configuration, whether or not a player is likely to be addicted can be determined even in a case where there is no history of game information of the player (for example, in a case of a non-member).

In this configuration, therefore, the information for guiding the player-at-risk not to play the game is announced to the hall staff, the player (the player-at-risk) who is determined to be likely to be addicted to the game, and the like, even in a case where the player-at-risk is a non-member, so that a situation in which the player-at-risk becomes addicted to the game can be avoided.

The information providing system further includes a gaming machine enabling a game to be played, wherein the gaming machine transmits game start information (the session start notification, etc.) to the information processing device at a time when the player starts a game, and in response to receiving the game start information from the gaming machine and upon determination that the game information associated with the player, which is stored in the storage device, exceeds the predetermined threshold value, the information processing device transmits the predetermined instruction information to the announcement device.

In this configuration, in response to reception of the game start information and upon determination that the game information associated with the player exceeds the predetermined threshold value, the information for guiding the player not to play the game is announced.

In this configuration, the information for guiding the player not to play the game is announced at a time when the game is started, that is, at a time when the player is calm before becoming addicted to the game on the gaming machine, so that a situation in which the player becomes addicted to the game can be avoided.

The information providing system further includes a gaming machine (the gaming machine 3060, the slot machine 1010, etc.) enabling a game to be played, wherein the storage device stores information (the set PO value, the gamble level determination value, etc.) by which whether or not the gaming machine is a speculative machine is identifiable, and upon determination that the game information associated with the player exceeds the predetermined threshold value and that the gaming machine is a speculative machine, the information processing device transmits the predetermined instruction information to the announcement device.

In this configuration, the information for guiding the player not to play the game is announced upon determination that the game information associated with the player exceeds the predetermined threshold value and that the gaming machine is a speculative machine.

In general, a player who is likely to be addicted to a game (a player-at-risk), having a greater waste amount (loss amount), tends to play a game on a speculative gaming machine in an attempt to quickly catch up on the waste amount, which makes the player addicted to the game.

In the above-described configuration, if the player-at-risk tries to play a game on a speculative gaming machine, the information for guiding the player-at-risk not to play the game is announced, so that a situation in which the player-at-risk becomes addicted to the game on the speculative gaming machine can be avoided.

The information providing system further includes a gaming machine enabling a game to be played, wherein the storage device stores denomination setting information (the denomination value, etc.) of the gaming machine, and upon determination that the game information associated with the player exceeds the predetermined threshold value and that the setting information exceeds a prescribed threshold value (the denomination level determination value, etc.), the information processing device transmits the predetermined instruction information to the announcement device.

In this configuration, the information for guiding the player not to play the game is announced upon determination that the game information associated with the player exceeds the predetermined threshold value and that the denomination setting information exceeds the prescribed threshold value.

In general, a player who is likely to be addicted to a game (a player-at-risk), having a greater waste amount, tends to play a game on a gaming machine with a higher denomination setting in an attempt to quickly catch up on the waste amount, which makes the player addicted to the game.

In the above-described configuration, if a player-at-risk tries to play a game on a gaming machine with a higher denomination setting, the information for guiding the player-at-risk not to play the game is announced, so that a situation in which the player-at-risk becomes addicted to the game on the gaming machine with a higher denomination setting can be avoided.

In a fifth aspect of the above embodiments, an information providing apparatus (the information processing device 3050, the hall management server 10, the analysis server 16, the information providing server 17, etc.) includes:

a storage device (the storage 3053, the external storage device 1404, etc.) that stores game information (information of the play history table, the session history table, the accumulation table, etc.) with respect to each player; and an information processing device (the controller 3051, the controller 1400, the CPU 1401, etc.) communicable with an announcement device (the gaming machine 3060, the information reading device 3069, the output 3067, the staff terminal 3070, the output 3075, the slot machine 1010, the PTS terminal 1700, the tablet terminal 300, the LCD 1719, the LCD 303, etc.) operable to announce information, the information processing device operable to, upon determination that the game information associated with the player, which is stored in the storage device, exceeds a predetermined threshold value (for example, upon determining YES in S202 to S206), transmit predetermined instruction information (the announcement information, etc.) to the announcement device such that the information for guiding the player not to play the game (the information contributing to anti-addiction, etc.) is announced.

In this configuration, the information for guiding the player not to play the game is announced upon determination that the game information associated with the player, which is stored in the storage device, exceeds the predetermined threshold value.

Examples of the information for guiding the player not to play the game include an alert giving an implicit advice to stop the game (e.g., "Why don't you take a rest today?", "Why don't you watch a movie today?", or "How about going to a gym?" to the player; and "The customer using XX machine (machine ID) is under risk of addiction to game." or "Please give anti-addiction support to the customer seated at XX." to the hall staff).

For example, if it can be determined that the player is addicted to the game under the state where the predetermined threshold value is exceeded or it can be determined that the player tends to be addicted to the game under the state where the predetermined threshold value is exceeded, an alert is issued to the hall staff, the player who is likely to be addicted to the game, and the like.

In the above-described configuration, a player who is addicted to the game, a player who is likely to be addicted to the game, or the like (a player-at-risk), is detected, and the information for guiding the player-at-risk not to play the game is announced to the player-at-risk, the hall staff, and the like, so that a situation in which the player-at-risk becomes addicted to the game can be avoided.

In the information providing system, the announcement device (the output 3067, the output 3075, the PTS terminal 1700, the LCD 1719, the LCD 303, etc.) may be provided in the gaming machine, in a staff terminal (the staff terminal 3070, the tablet terminal 300, etc.) carried by a hall staff, or in both the gaming machine and the staff terminal.

In the information providing system, the game information associated with the player comprises number-of-games information (the number of plays, etc.) and game time information (the playing time, etc.), and when the number-of-games information exceeds number-of-times information (the predetermined number of times, etc.) that is preliminarily specified and the game time information exceeds time information (the predetermined time length, etc.) that is preliminarily specified, the information processing device determines that the predetermined threshold value is exceeded.

In the information providing system, the game information associated with the player comprises number-of-games information (the number of plays, etc.) and waste amount information (the loss amount, etc.), and when the number-of-games information exceeds number-of-times information (the predetermined number of times, etc.) that is preliminarily specified and the waste amount information exceeds amount information (the predetermined amount, etc.) that is preliminarily specified, the information processing device determines that the predetermined threshold value is exceeded.

In the information providing system, the game information associated with the player comprises consumption amount information (the consumption amount, etc.) and waste amount information (the loss amount, etc.), and when the consumption amount information is less than amount information (the specific amount, etc.) that is preliminarily specified and the waste amount information exceeds amount information (the predetermined amount, etc.) that is preliminarily specified, the information processing device determines that the predetermined threshold value is exceeded.

In the information providing system, the game information associated with the player comprises waste amount information (the loss amount, etc.), and when the waste amount information exceeds amount information (the maximum loss amount, etc.) that is preliminarily specified, the information processing device determines that the predetermined threshold value is exceeded.

In the information providing system, the game information associated with the player comprises game time information (the playing time, etc.), and when the game time information exceeds time information (the average session time, etc.) that is preliminarily specified, the information processing device determines that the predetermined threshold value is exceeded.

The information providing system includes:

a gaming machine enabling a game to be played;

an information processing device communicable with the gaming machine;

a storage device that stores waste information with respect to each player; and an announcement device operable to announce information, the gaming machine operable to transmit bet information to the information processing device for each play (play start operation), the information processing device operable to, upon determination that the waste information associated with the player exceeds a predetermined value and that the bet information is set higher than the bet information of the previous game, transmit predetermined instruction information to the announcement device, the announcement device operable to announce the information for guiding the player not to play the game, based on the predetermined instruction information.

In general, a player who is likely to be addicted to a game (a player-at-risk), having a greater waste amount, tends to play a game with higher setting of the bet information in an attempt to quickly catch up on the waste amount, which makes the player addicted to the game.

In the above-described configuration, if a player-at-risk tries to play a game with increased bet information, the information for guiding the player-at-risk not to play the game is announced to the player-at-risk, the hall staff, and the like, so that a situation in which the player-at-risk becomes addicted to the game can be avoided.

In a sixth aspect of the above embodiments, an information providing system (the information providing system 3200, etc.) includes:

a gaming machine (the gaming machine 3060, the slot machine 1010, etc.) enabling a game to be played;

an information processing device (the information processing device 3050, the hall management server 10, the analysis server 16, the information providing server 17, etc.) communicable with the gaming machine;

a storage device (the storage device 3030, the storage 3053 of the information processing device 3050, the hall management server 10, the member management server 13, the external storage device 1404, etc.) that stores waste information (the loss amount, etc.) and the number of games (the number of plays, etc.) with respect to each player; and an announcement device (the gaming machine 3060, the information reading device 3069, the output 3067, the staff terminal 3070, the output 3075, the slot machine 1010, the PTS terminal 1700, the tablet terminal 300, the LCD 1719, the LCD 303, etc.) operable to announce information, the gaming machine operable to award a bonus game, the information processing device operable to, upon determination that the waste information associated with the player, which is stored in the storage device, exceeds a predetermined value (the loss determination value, etc.) and that the number of games played after awarding of the bonus game (the number of plays made after the end of the bonus game, etc.) reaches a number of times (the number-of-plays determination value, etc.) that is preliminarily specified, transmit predetermined instruction information (the announcement information, etc.) to the announcement device, the announcement device operable to announce the information for guiding the player not to play the game (the information contributing to anti-addiction, etc.), based on the predetermined instruction information.

In general, a player who is likely to be addicted to a game (a player-at-risk), having spent a waste amount, tends to play a game even after finishing the bonus game in the expectation that a bonus game is awarded soon, which makes the player addicted to the game.

In the above-described configuration, if a player-at-risk is continuously playing a game after the bonus game, the information for guiding the player-at-risk not to play the game is announced to the player-at-risk, the hall staff, and the like, so that a situation in which the player-at-risk becomes addicted to the game can be avoided.

In a seventh aspect of the above embodiments, an information providing system (the information providing system 3200, etc.) includes:

a gaming machine (the gaming machine 3060, the slot machine 1010, etc.) enabling a game to be played;

an information processing device (the information processing device 3050, the hall management server 10, the analysis server 16, the information providing server 17, etc.) communicable with the gaming machine;

a storage device (the storage device 3030, the storage 3053 of the information processing device 3050, the hall management server 10, the member management server 13, the external storage device 1404, etc.) that stores waste information (the loss amount, etc.) with respect to each player; and an announcement device (the gaming machine 3060, the information reading device 3069, the output 3067, the staff terminal 3070, the output 3075, the slot machine 1010, the PTS terminal 1700, the tablet terminal 300, the LCD 1719, the LCD 303, etc.) operable to announce information, the gaming machine operable to, upon the player starting a play, transmit play start information (the play start notification, etc.) to the information processing device, the information processing device operable to transmit predetermined instruction information (the announcement information, etc.) to the announcement device, upon determination that the waste information associated with the player, which is stored in the storage device, exceeds a predetermined value (the loss determination value, etc.) and determining after elapse of a predetermined period that each interval of the play start information within the predetermined period is shorter than a predetermined interval (one hour or more and two hours or less) (for example, upon determination that the maximum play interval value within the predetermined time length is less than the play interval determination value), the announcement device operable to announce the information for guiding the player not to play the game (the information contributing to anti-addiction such as "How about going for a meal?" or "Please recommend the customer seated at XX to take a meal."), based on the predetermined instruction information.

In general, a player who is likely to be addicted to a game (a player-at-risk), having a greater waste amount, hardly takes a break, which makes the player addicted to the game.

In the above-described configuration, upon determination that each interval of the play start information within the predetermined period is shorter than the predetermined interval (upon determination that the player-at-risk takes no break), the information for guiding the player-at-risk not to play the game is announced to the player-at-risk, the hall staff, and the like, so that a situation in which the player-at-risk becomes addicted to the game can be avoided.

In an eighth aspect of the above embodiments, an information providing system (the information providing system 3200, etc.) includes:

a gaming machine (the gaming machine 3060, the slot machine 1010, etc.) enabling a game to be played;

an information processing device (the information processing device 3050, the hall management server 10, the analysis server 16, the information providing server 17, etc.) communicable with the gaming machine;

a storage device (the storage device 3030, the storage 3053 of the information processing device 3050, the hall management server 10, the member management server 13, the external storage device 1404, etc.) that stores waste information (the loss amount, etc.) with respect to each player; and an announcement device (the gaming machine 3060, the information reading device 3069, the output 3067, the staff terminal 3070, the output 3075, the slot machine 1010, the PTS terminal 1700, the tablet terminal 300, the LCD 1719, the LCD 303, etc.) operable to announce information, the information processing device operable to, upon determination that the waste information associated with the player, which is stored in the storage device, exceeds a predetermined value (the loss determination value, etc.), transmit inquiry information (the acknowledgment request, the answer message, the answer icon, etc.) to the gaming machine, the gaming machine operable to display the inquiry information on a display device, receive an answer operation (the operation on the answer icon, etc.) for answering the inquiry information, and upon receiving the answer operation, transmit answer information (the operation answer information, etc.) to the information processing device, the information processing device operable to, upon determination that the answer information is not received after elapse of a predetermined time length since the transmission of the inquiry information, transmit predetermined instruction information (the announcement information, etc.) to the announcement device, the announcement device operable to announce the information for guiding the player not to play the game (the information contributing to anti-addiction, etc.), based on the predetermined instruction information.

In general, a player who is likely to be addicted to a game (a player-at-risk), having a greater waste amount, is addicted to the game without paying any attention to other things.

In the above-described configuration, upon determination that the answer information is not received after elapse of the predetermined time length since the transmission of the inquiry information (upon determination that the player-at-risk does not answer the inquiry), the information for guiding the player-at-risk not to play the game is announced to the player-at-risk, the hall staff, and the like, so that a situation in which the player-at-risk becomes addicted to the game can be avoided.

In a ninth aspect of the above embodiments, an information providing system (the information providing system 3200, etc.) includes:

a plurality of gaming machines (the gaming machine 3060, the slot machine 1010, etc.) enabling a game to be played;

an information processing device (the information processing device 3050, the hall management server 10, the analysis server 16, the information providing server 17, etc.) communicable with each of the plurality of gaming machines; and a storage device (the storage device 3030, the storage 3053 of the information processing device 3050, the hall management server 10, the member management server 13, the external storage device 1404, etc.) that stores waste information (the loss amount, etc.), a game start time (the session start time, etc.), and a game end time (the session end time, etc.) with respect to each player, and stores identification information (the login/logout management table, the session history table, etc.) by which a specific gaming machine on which the player is playing a game and a gaming machine on which the player played a game prior to the specific gaming machine are identifiable among the plurality of gaming machines, the information processing device operable to, upon determination that the waste information (the loss amount, etc.) associated with the player exceeds a predetermined value (the loss determination value, etc.) and that the interval between a game end time at the previous gaming machine (the time of ending the previous game, etc.) and a game start time at the specific gaming machine (the time of starting the current game, etc.) is equal to or shorter than a predetermined time length (the game interval determination value, etc.), transmit predetermined instruction information (the announcement information, etc.) to the specific gaming machine, the specific gaming machine operable to announce the information for guiding the player not to play the game (the information contributing to anti-addiction, etc.), based on the predetermined instruction information.

In general, a player who is likely to be addicted to a game (a player-at-risk), having his/her waste amount increasing, tends to switch to another gaming machine and becomes addicted to the game.

In the above-described configuration, upon determination that the waste information exceeds the predetermined value and that the interval between the game end time at the previous gaming machine and the game start time at the current gaming machine is equal to or shorter than the predetermined time length (upon determination that switching of the gaming machine is made), the information for guiding the player-at-risk not to play the game is announced to the player-at-risk, so that a situation in which the player-at-risk becomes addicted to the game can be avoided.

The information providing system further includes a staff terminal (the staff terminal 3070, the tablet terminal 300, etc.) usable by a staff, wherein upon determination that the waste information associated with the player exceeds a predetermined value (the loss determination value, etc.) and that the interval between a game end time at the previous gaming machine and a game start time at the specific gaming machine is equal to or shorter than a predetermined time length, the information processing device transmits predetermined instruction information (the announcement information, etc.) to the staff terminal, and the staff terminal announces the information for guiding the player not to play the game (the information contributing to anti-addiction, etc.), based on the predetermined instruction information.

In this configuration, upon determination that the waste information exceeds the predetermined value and that the interval between the game end time at the previous gaming machine and the game start time at the current gaming machine is equal to or shorter than the predetermined time length (upon determination that switching of the gaming machine is made), the information for guiding the player-at-risk not to play the game is announced to the staff.

This configuration thereby allows the staff to guide the player-at-risk not to play the game based on the announcement, so that a situation in which the player-at-risk becomes addicted to the game can be avoided.

In a tenth aspect of the above embodiments, an information providing system (the information providing system 3200, etc.) includes:

a plurality of gaming machines (the gaming machine 3060, the slot machine 1010, etc.) enabling a game to be played;

an information processing device (the information processing device 3050, the hall management server 10, the analysis server 16, the information providing server 17, etc.) communicable with each of the plurality of gaming machines; and a storage device (the storage device 3030, the storage 3053 of the information processing device 3050, the hall management server 10, the member management server 13, the external storage device 1404, etc.) that stores waste information (the loss amount, etc.) with respect to each player, stores identification information (the login/logout management table, the session history table, etc.) by which a specific gaming machine on which the player is playing a game and a gaming machine on which the player played a game prior to the specific gaming machine are identifiable among the plurality of gaming machines, and stores information (the gaming machine definition table, the play history table, the set PO value, the gamble level determination value, etc.) by which whether or not each of the plurality of gaming machines is a speculative machine is identifiable, each of the plurality of gaming machines operable to transmit game start information (the session start notification, etc.) to the information processing device at a time when the player starts a game, the information processing device operable to transmit predetermined instruction information (the announcement information, etc.) to the specific gaming machine, in response to receiving the game start information from the specific gaming machine and upon determination that the waste information associated with the player, which is stored in the storage device, exceeds a predetermined value (the loss determination value, etc.) and that the specific gaming machine is more speculative than the gaming machine on which the player played a game prior to the specific gaming machine (for example, upon determination that the set PO value reaches the gamble level determination value), the specific gaming machine operable to announce the information for guiding the player not to play the game (the information contributing to anti-addiction, etc.), based on the predetermined instruction information.

In general, a player who is likely to be addicted to a game (a player-at-risk), having his/her waste amount increasing, tends to switch to a speculative gaming machine and plays the game in an attempt to quickly catch up on the waste amount, which makes the player addicted to the game.

In the above-described configuration, upon determination that the waste information exceeds the predetermined value and that the game starts on a speculative gaming machine, the information for guiding the player-at-risk not to play the game is announced to the player-at-risk, so that a situation in which the player-at-risk switches to a speculative gaming machine and becomes addicted to the game can be avoided.

The information providing system further includes a staff terminal (the staff terminal 3070, the tablet terminal 300, etc.) usable by a staff, wherein the information processing device transmits predetermined instruction information (the announcement information, etc.) to the staff terminal, in response to receiving the game start information (the session start notification, etc.) from the specific gaming machine and upon determination that the waste information associated with the player, which is stored in the storage device, exceeds a predetermined value (the loss determination value, etc.) and that the specific gaming machine is more speculative than the gaming machine on which the player played a game prior to the specific gaming machine (for example, upon determination that the set PO value reaches the gamble level determination value), and the staff terminal announces the information for guiding the player not to play the game, based on the predetermined instruction information.

In this configuration, upon determination that the waste information exceeds the predetermined value and that the game starts on a speculative gaming machine, the information for guiding the player-at-risk not to play the game is announced to the staff.

This configuration thereby allows the staff to guide the player-at-risk not to play the game based on the announcement, so that a situation in which the player-at-risk switches to a speculative gaming machine and becomes addicted to the game can be avoided.

In an eleventh aspect of the above embodiments, an information providing system (the information providing system 3200, etc.) includes:

a plurality of gaming machines (the gaming machine 3060, the slot machine 1010, etc.) enabling a game to be played;

an information processing device (the information processing device 3050, the hall management server 10, the analysis server 16, the information providing server 17, etc.) communicable with each of the plurality of gaming machines; and a storage device (the storage device 3030, the storage 3053 of the information processing device 3050, the hall management server 10, the member management server 13, the external storage device 1404, etc.) that stores waste information (the loss amount, etc.) with respect to each player, stores identification information (the login/logout management table, the session history table, etc.) by which a specific gaming machine on which the player is playing a game and a gaming machine on which the player played a game prior to the specific gaming machine are identifiable among the plurality of gaming machines, and stores denomination setting information (the gaming machine definition table, the denomination value, etc.) of each of the plurality of gaming machines, each of the plurality of gaming machines operable to transmit game start information (the session start notification, etc.) to the information processing device at a time when the player starts a game, the information processing device operable to transmit predetermined instruction information (the announcement information, etc.) to the specific gaming machine, in response to receiving the game start information from the specific gaming machine and upon determination that the waste information associated with the player, which is stored in the storage device, exceeds a predetermined value (the loss determination value, etc.) and that setting information of the specific gaming machine is set higher than setting information of the gaming machine on which the player played a game prior to the specific gaming machine, the specific gaming machine operable to announce the information for guiding the player not to play the game (the information contributing to anti-addiction, etc.), based on the predetermined instruction information.

In general, a player who is likely to be addicted to a game (a player-at-risk), having a greater waste amount, tends to switch to a gaming machine with a higher denomination setting and plays the game in an attempt to quickly catch up on the waste amount, which makes the player addicted to the game.

In the above-described configuration, upon determination that the waste information exceeds the predetermined value and that the player-at-risk starts a game on a gaming machine with a higher denomination setting, the information for guiding the player-at-risk not to play the game is announced to the player-at-risk, so that a situation in which the player-at-risk switches to a gaming machine with a higher denomination setting and becomes addicted to the game can be avoided.

This information providing system further includes a staff terminal (the staff terminal 3070, the tablet terminal 300, etc.) usable by a staff, wherein the information processing device transmits predetermined instruction information (the announcement information, etc.) to the staff terminal, in response to receiving the game start information (the session start notification, etc.) from the specific gaming machine and upon determination that the waste information associated with the player, which is stored in the storage device, exceeds a predetermined value (the loss determination value, etc.) and that setting information (the denomination value, etc.) of the specific gaming machine is set higher than setting information (the denomination value, etc.) of the gaming machine on which the player played a game prior to the specific gaming machine, and the staff terminal announces the information for guiding the player not to play the game (the information contributing to anti-addiction, etc.), based on the predetermined instruction information.

In this configuration, upon determination that the waste information exceeds the predetermined value and that the player-at-risk starts a game on a gaming machine with a higher denomination setting, the information for guiding the player-at-risk not to play the game is announced to the staff.

This configuration thereby allows the staff to guide the player-at-risk not to play the game based on the announcement, so that a situation in which the player-at-risk switches to a gaming machine with a higher denomination setting and becomes addicted to the game can be avoided.

The present invention discloses problems to be solved by the embodiments illustrated above, solutions to the problems, and the like, as follows.

<Second Aspect>

FIELD OF THE INVENTION

The present invention relates to an information providing system and an information providing apparatus.

BACKGROUND OF THE INVENTION

A slot machine is conventionally known operable to stop and display a plurality of symbols after scrolling them, and award game media (e.g., coins) based on a combination of the symbols stopped.

A slot machine is also disclosed operable to allow a game player to realize an attractive payout rate by impressing the game player with a state becoming advantageous to the game player during progress of a game (see specification of United States Patent Application Publication No. 2012/0115571).

A player, who is addicted to a game, may sometimes invest a more amount than initially expected in playing the game, or spend a longer game time than initially expected in playing the game. In the short run, this benefits the game arcade, but in the long run, this may make the player run out shortly. This may possibly keep the game player away from the game, which may result in disadvantages to both the game arcade and the player.

The present invention was accomplished in view of the problems described above, and an object of the present invention is to provide avoidance of a situation in which a player becomes addicted to a game.

For example, the present invention is applicable not only to a game arcade as exemplified by a casino but also to a facility with a game arcade, such as a hotel, an airport, a station, a shopping mall, a fueling station capable of supplying a fuel such as gasoline, a restaurant, or a movie theater as well as a complex facility where a plurality of facilities are collected.

Objects of the present invention, problems to be solved by the present invention, and effects (benefits) of the present invention should be understood from the claims, and should not be wrongly interpreted from the following description.

BRIEF SUMMARY OF THE INVENTION

In a first aspect of the present invention, an information providing system includes:

a storage device that stores game information with respect to each player;

an announcement device operable to announce information; and an information processing device communicable with the announcement device, the information processing device operable to, upon determination that the game information associated with the player exceeds a predetermined threshold value, transmit predetermined instruction information to the announcement device, the announcement device operable to announce information for guiding the player not to play a game, based on the predetermined instruction information.

In this configuration, the information for guiding the player not to play the game is announced upon determination that the game information associated with the player, which is stored in the storage device, exceeds the predetermined threshold value.

Examples of the information for guiding the player not to play the game include an alert giving an implicit advice to stop the game (e.g., "Why don't you take a rest today?", "Why don't you watch a movie today?", or "How about going to a gym?" to the player; and "The customer using XX machine (machine ID) is under risk of addiction to game." or "Please give anti-addiction support to the customer seated at XX." to the hall staff).

For example, if it can be determined that the player is addicted to the game under the state where the predetermined threshold value is exceeded or it can be determined that the player tends to be addicted to the game under the state where the predetermined threshold value is exceeded, an alert is issued to the hall staff, the player who is likely to be addicted to the game, and the like.

In the above-described configuration, a player who is likely to be addicted to a game (a player-at-risk) is detected, and the information for guiding the player-at-risk not to play the game is announced to the player-at-risk, the hall staff, and the like, so that a situation in which the player-at-risk becomes addicted to the game can be avoided.

In the information providing system, the storage device stores game information of a player each time the player plays a game, and in response to the game information being stored in the storage device and upon determination that the game information associated with the player exceeds a predetermined threshold value, the information processing device transmits the predetermined instruction information to the announcement device.

In this configuration, the game information is stored each time a player plays a game, and upon determination that the game information associated with the player exceeds the predetermined threshold value, the information for guiding the player not to play the game is announced.

In this configuration, whether or not a player is likely to be addicted can be determined even in a case where there is no history of game information of the player (for example, in a case of a non-member).

In this configuration, therefore, the information for guiding the player-at-risk not to play the game is announced to the hall staff, the player (the player-at-risk) who is determined to be likely to be addicted to the game, and the like, even in a case where the player-at-risk is a non-member, so that a situation in which the player-at-risk becomes addicted to the game can be avoided.

The information providing system further includes a gaming machine enabling a game to be played, wherein the gaming machine transmits game start information to the information processing device at a time when the player starts a game, and in response to receiving the game start information from the gaming machine and upon determination that the game information associated with the player, which is stored in the storage device, exceeds the predetermined threshold value, the information processing device transmits the predetermined instruction information to the announcement device.

In this configuration, in response to reception of the game start information and upon determination that the game information associated with the player exceeds the predetermined threshold value, the information for guiding the player not to play the game is announced.

In this configuration, the information for guiding the player not to play the game is announced at a time when the game is started, that is, at a time when the player is calm before becoming addicted to the game on the gaming machine, so that a situation in which the player becomes addicted to the game can be avoided.

The information providing system further includes a gaming machine enabling a game to be played, wherein the storage device stores information by which whether or not the gaming machine is a speculative machine is identifiable, and upon determination that the game information associated with the player exceeds the predetermined threshold value and that the gaming machine is a speculative machine, the information processing device transmits the predetermined instruction information to the announcement device.

In this configuration, the information for guiding the player not to play the game is announced upon determination that the game information associated with the player exceeds the predetermined threshold value and that the gaming machine is a speculative machine.

In general, a player who is likely to be addicted to a game (a player-at-risk), having a greater waste amount, tends to play a game on a speculative gaming machine in an attempt to quickly catch up on the waste amount, which makes the player addicted to the game.

In the above-described configuration, if the player-at-risk tries to play a game on a speculative gaming machine, the information for guiding the player-at-risk not to play the game is announced, so that a situation in which the player-at-risk becomes addicted to the game on the speculative gaming machine can be avoided.

The information providing system further includes a gaming machine enabling a game to be played, wherein the storage device stores denomination setting information of the gaming machine, and upon determination that the game information associated with the player exceeds the predetermined threshold value and that the setting information exceeds a prescribed threshold value, the information processing device transmits the predetermined instruction information to the announcement device.

In this configuration, the information for guiding the player not to play the game is announced upon determination that the game information associated with the player exceeds the predetermined threshold value and that the denomination setting information exceeds the prescribed threshold value.

In general, a player who is likely to be addicted to a game (a player-at-risk), having a greater waste amount, tends to play a game on a gaming machine with a higher denomination setting in an attempt to quickly catch up on the waste amount, which makes the player addicted to the game.

In the above-described configuration, if a player-at-risk tries to play a game on a gaming machine with a higher denomination setting, the information for guiding the player-at-risk not to play the game is announced, so that a situation in which the player-at-risk becomes addicted to the game on the gaming machine with a higher denomination setting can be avoided.

In a second aspect of the present invention, an information providing apparatus includes:

a storage device that stores game information with respect to each player; and an information processing device communicable with an announcement device operable to announce information, the information processing device operable to, upon determination that the game information associated with the player, which is stored in the storage device, exceeds a predetermined threshold value, transmit predetermined instruction information to the announcement device such that information for guiding the player not to play a game is announced.

In this configuration, the information for guiding the player not to play the game is announced upon determination that the game information associated with the player, which is stored in the storage device, exceeds the predetermined threshold value.

Examples of the information for guiding the player not to play the game include an alert giving an implicit advice to stop the game (e.g., "Why don't you take a rest today?", "Why don't you watch a movie today?", or "How about going to a gym?" to the player; and "The customer using XX machine (machine ID) is under risk of addiction to game." or "please give anti-addiction support to the customer seated at XX." To the hall staff).

For example, if it can be determined that the player is addicted to the game under the state where the predetermined threshold value is exceeded or it can be determined that the player tends to be addicted to the game under the state where the predetermined threshold value is exceeded, an alert is issued to the hall staff, the player who is likely to be addicted to the game, and the like.

In the above-described configuration, a player who is likely to be addicted to a game (a player-at-risk) is detected, and the information for guiding the player-at-risk not to play the game is announced to the player-at-risk, the hall staff, and the like, so that a situation in which the player-at-risk becomes addicted to the game can be avoided.

The present invention provides avoidance of a situation in which a player becomes addicted to a game.

<Supplemental Notes>

The present invention also discloses an invention according to the following embodiment.

An information providing system comprising:

an input device that receives an input of game plan information of a player based on a setting operation performed by the player;

a gaming machine enabling a game to be played;

a storage device that stores game plan information and game information with respect to each player;

an announcement device operable to announce information; and an information processing device communicable with the announcement device, the information processing device operable to compare the game information associated with the player against a predetermined threshold value that is determined based on the game plan information, and upon determination that the game information exceeds the threshold value, transmit predetermined instruction information to the announcement device, the announcement device operable to, based on the predetermined instruction information, display information that is unrelated to the game information and that can be advantageous to the player, the information being displayed as the information for guiding the player not to play the game.

The present invention also discloses an invention according to the following embodiment.

An information providing system comprising:

an input device that receives an input of game plan information of a player based on a setting operation performed by the player;

a gaming machine enabling a game to be played;

a storage device that stores game plan information and game information with respect to each player;

an announcement device operable to announce information;

an information processing device communicable with the announcement device; and an administrative terminal, the information processing device operable to compare the game information associated with the player against a predetermined threshold value that is determined based on the game plan information, and upon determination that the game information exceeds the threshold value, transmit predetermined instruction information to each of the announcement device and the administrative terminal, the announcement device operable to, based on the predetermined instruction information, display information that is unrelated to the game information and that can be advantageous to the player, the information being displayed as the information for guiding the player not to play the game, the administrative terminal operable to display position information of the player, individual information of the player, and an instruction for an administrator to guide the player not to play, the position information of the player and the individual information of the player included in the instruction information.

The embodiments described above merely illustrate specific examples of the present invention, and should not be construed to put any particular limitations on the present invention. Specific structures of the units, etc. may be suitably designed or modified. Furthermore, the effects of the present invention described in the above embodiments are not more than examples of most preferable effects achievable by the present invention. The effects of the present invention are not limited to those described in the above embodiments.

The detailed descriptions above are mainly focused on characteristic parts, for easier understanding of the present invention. The present invention is not limited to the embodiments illustrated in the detailed description above, and is applicable to other embodiments. A diversity of applications can be made. In addition, the terms and phraseology used in the present specification are adopted solely to provide an appropriate illustration of the present invention, and in no case should be construed to limit the interpretation of the present invention. Moreover, other configurations, systems, methods, etc. covered by the concept of the present invention could be easily envisioned by those skilled in the art based on the concept of the invention described in this specification. The description of claims therefore shall encompass configurations equivalent to the present invention without departing from the technical idea of the present invention. Furthermore, the abstract is provided for the purpose of allowing, for example, the Patent Office, public institutions, engineers in the art who are not fully familiarized with patents, legal terminology, or technical terminology to quickly determine the technical features of the present application and essences thereof through a simple investigation. The abstract is therefore not intended to limit the scope of the invention which shall be construed on the basis of the description of the claims. To fully understand the object of the present invention and effects unique to the present invention, it is encouraged to sufficiently refer to disclosures of documents already made available.

The detailed description of the present invention provided hereinabove includes a process executed on a computer. The above descriptions and expressions are provided to allow the one skilled in the art to most efficiently understand the present invention. In the present specification, respective steps performed to yield one result shall be understood as a process with no self-contradiction. In addition, electrical or magnetic signals are transmitted/received or recorded in respective steps. It should be noted that, in processing of each step, such a signal is expressed in the form of bits, values, symbols, characters, terms, numbers, etc., which are adopted merely for the purpose of convenience of description. Although processing of each step may be sometimes expressed as if it is a human behavior, processing described in this specification is in principle executed by devices. Furthermore, other configurations required for executing each step are obvious from the descriptions given above.

What is claimed is:

1. An information-providing gaming system comprising:

a processor;

one or more gaming machines, each including 1) a value-addition mechanism by means of which value required to play a game on a given gaming machine can be added to the given gaming machine, and 2) a reader that is configured to read identification information by means of which a player can be identified;

an electronic display device that is programmed to present to the player a graphical user interface including an anti-addiction screen, which anti-addiction screen prompts the player to input a player-input, amount-consumed threshold value;

a storage device that stores game information with respect to each player who uses the gaming system;

an announcement device associated with each gaming machine and operable to announce information; and an information processing device communicable with each announcement device, wherein the gaming system further includes program instructions that cause the information processing device 1) to determine whether the game information associated with a given player exceeds the player-input, amount-consumed threshold value; and, if so, 2) to transmit predetermined suggestive information not to play a game to the announcement device and to cause the announcement device to announce the suggestive information for guiding the player not to play a game without disabling a gaming machine at which the player has been adding value to the gaming machine, thereby keeping the gaming machine in a playable state and leaving it within the player's discretion as to whether to discontinue playing games.

2. The information-providing gaming system according to claim 1, wherein the programming instructions are configured to cause the storage device to store game information of a player each time the player plays a game.

3. The information-providing gaming system according to claim 1, wherein each gaming machine transmits game start information to the information processing device at a time when a player starts a game at a given gaming machine, and wherein the program instructions are configured to cause the information processing device to transmit the predetermined suggestive information to the announcement device associated with the given gaming machine in response to receiving the game start information from the given gaming machine and upon determination that the game information associated with the player at the given gaming machine exceeds the player-input, amount-consumed threshold value.

4. The information-providing gaming system according to claim 1, wherein the program instructions are configured to cause the storage device to store information by which the information processing device is able to determine whether or not a given gaming machine is a speculative machine, and wherein the program instructions are configured such that, upon determining that the game information associated with a player exceeds the player-input, amount-consumed threshold value and that the gaming machine at which the player is adding value is a speculative machine, the information processing device transmits the predetermined suggestive information to the announcement device.

5. The information-providing gaming system according to claim 1, wherein the program instructions are configured to cause the storage device to store denomination setting information of a given gaming machine, and wherein the program instructions are configured such that, upon determining that the game information associated with a player exceeds the player-input, amount-consumed threshold value and that the denomination setting information exceeds a prescribed threshold value, the information processing device transmits the predetermined suggestive information to the announcement device.

6. The information-providing gaming system according to claim 1, wherein the game information comprises number-of-games information and game time information, and wherein the program instructions are configured such that when the number-of-games information for a given player exceeds number-of-times information that is preliminarily specified for the given player and the game time information exceeds time information that is preliminarily specified for the given player, the information processing device determines that the player-input, amount-consumed threshold value is exceeded.

7. The information-providing gaming system according to claim 1, wherein the game information comprises number-of-games information and waste amount information, and wherein the program instructions are configured such that when the number-of-games information for a given player exceeds number-of-times information that is preliminarily specified for the given player and the waste amount information for the given player exceeds amount information that is preliminarily specified for the given player, the information processing device determines that the player-input, amount-consumed threshold value is exceeded.

8. The information-providing gaming system according to claim 1, wherein the game information comprises consumption amount information and waste amount information, and wherein the program instructions are configured such that when the consumption amount information is less than amount information that is preliminarily specified for a given player and the waste amount information exceeds amount information that is preliminarily specified for the given player, the information processing device determines that the player-input, amount-consumed threshold value is exceeded.

9. The information-providing gaming system according to claim 1, wherein the game information comprises waste amount information, and wherein the program instructions are configured such that when the waste amount information exceeds amount information that is preliminarily specified for a given player, the information processing device determines that the player-input, amount-consumed threshold value is exceeded.

10. The information-providing gaming system according to claim 1, wherein the game information comprises game time information, and wherein the program instructions are configured such that when the game time information exceeds time information that is preliminarily specified for a given player, the information processing device determines that the player-input, amount-consumed threshold value is exceeded.

* * * * *